US008865989B1

(12) United States Patent
Voit, II

(10) Patent No.: US 8,865,989 B1
(45) Date of Patent: Oct. 21, 2014

(54) KINETIC MEASUREMENT OF PIANO KEY MECHANISMS FOR INERTIAL PROPERTIES AND KEYSTROKE CHARACTERISTICS

(71) Applicant: Hugh Richard Voit, II, Louisville, KY (US)

(72) Inventor: Hugh Richard Voit, II, Louisville, KY (US)

( * ) Notice: Subject to any disclaimer, the term of this patent is extended or adjusted under 35 U.S.C. 154(b) by 77 days.

(21) Appl. No.: 13/795,428

(22) Filed: Mar. 12, 2013

(51) Int. Cl.
*G10C 3/12* (2006.01)
*G10C 9/00* (2006.01)

(52) U.S. Cl.
CPC ..... *G10C 9/00* (2013.01)
USPC ..... 84/433

(58) Field of Classification Search
USPC ..... 84/423 R, 432–438, 442, 447
See application file for complete search history.

(56) References Cited

U.S. PATENT DOCUMENTS

| | | | |
|---|---|---|---|
| 5,585,582 | A | 12/1996 | Stanwood |
| 5,796,024 | A | 8/1998 | Stanwood |
| 7,893,335 | B2 | 2/2011 | Szczap |
| 8,049,090 | B1 | 11/2011 | Voit |
| 8,558,095 | B2 * | 10/2013 | Muramatsu et al. ..... 84/236 |

OTHER PUBLICATIONS

Instruction Manual for the Jaras Multifunctional Key Leveler Apparatus, approx. 1982.

Hickman Article with results from his apparatus, 1930; pp. 5-7.

Interview with Hickman, excerpt from 1987 book by Richard Howe.

Dynamic Model of a Piano Mechanism, Thesis by Hirschkorn, 2004, pp. 29-40.

Excerpt, "Acoustics of Pianos" by Suzuki, in Applied Acoustics vol. 30, 1990, pp. 155-157.

Paper, "Dynamical Modeling of the Grand Piano Action", 1992, by Brent Gillespie.

Flyer, The Leveler Company, 2009.

Web page, The Leveler Company, 2009.

* cited by examiner

*Primary Examiner* — Kimberly Lockett

(57) ABSTRACT

Important new descriptors (Down Force Slope and Up Force Slope), which more fully and meaningfully characterize the continuous Down Force and Up Force are revealed. Similar descriptors are also created to more fully characterize the Balance Force and Frictional Force curves. The invention also discloses various methods and means for accurately testing, measuring and determining other parameters (including the position of the at-rest key, key sluggishness, and others characterizing the "let-off" event) in an accurate and efficient manner. Methods of quantifying and measuring the actual inertia of a key action—in a non-invasive manner—are also disclosed, with several inertial parameters being defined. Methods for quantifying and measuring the actual inertia of the major individual components of a key action are also detailed, along with parameters and methods for expressing their contribution "at the key". All of the various measurement methods of the current invention are performed in a "controlled, kinetic and continuous" manner.

29 Claims, 53 Drawing Sheets

| | A | B |
|---|---|---|
| 1 | Crown, B | 1.2 |
| 2 | dist_1to88 | 1194 |
| 3 | Key Dip | 9.9 |
| 4 | $y_{des}(p)$ | =$H$1-$H$2 + ($B$1)/2 |

| | D | E |
|---|---|---|
| 1 | BackBal | 220 |
| 2 | BackFrt | 390 |
| 3 | AR Ratio | =($E$1)/($E$2) |

| | G | H |
|---|---|---|
| 1 | spc'd. KeyHt. | 64 |
| 2 | Ht. of Zero Pt. above Keybed | 63.5 |
| 3 | p | =($B$2)/2 |
| 4 | Key Pitch | =($B$2)/51 |

| | A | B | C | D | E | F | G |
|---|---|---|---|---|---|---|---|
| 8 | Key # | White Key # | MRKCD | -MRKCD | BOD | -BOD | x-value |
| 15 | 11 | 7 | 1.3 | =(-1)*C15 | 10.9 | =(-1)*E15 | =(B15-1)* $H$4 |

| | H | I | J | K | L | M |
|---|---|---|---|---|---|---|
| 8 | MRKCD_des | DY_AR | BOD_des | DY_Dep | Delta_ Shim_Bal | Des_Key Ht_RZ |
| 15 | =IF(G15<=$H$3,($B$1/$H$3)*G15+$B$4-$B$1,(-1)*($B$1/$H$3)*G15+$B$4+$B$1) | =C15+ H15 | =H15- $B$3 | =E15+J15 | =I15*E$3 | =$H$1- $H$2 |

Fig. 22

| | A | B |
|---|---|---|
| 1 | Crown, B | 1.2 |
| 2 | dist_1to88 | 1194 |
| 3 | Key Dip | 9.9 |
| 4 | $y_{des}(p)$ | 1.1 |

| | D | E |
|---|---|---|
| 1 | BackBal | 190 |
| 2 | BackFrt | 400 |
| 3 | Ratio | 0.564 |

| | G | H |
|---|---|---|
| 1 | spc'd. KeyHt. | 64 |
| 2 | Ht. of Zero Pt. above Keybed | 63.5 |
| 3 | p | 597 |
| 4 | Key Pitch[mm] | 23.41 |

| | A | B | C | D | E | F | G |
|---|---|---|---|---|---|---|---|
| | Key # | WhiteKey # | MRKCD | -MRKCD | BOD | -BOD | x-value |
| 15 | 11 | 7 | 1.3 | -1.3 | 10.9 | -10.9 | 140.5 |
| 23 | 25 | 15 | 0.9 | -0.9 | 10.5 | -10.5 | 327.8 |
| 30 | 37 | 22 | 1.9 | -1.9 | 11.5 | -11.5 | 491.7 |
| 40 | 54 | 32 | 2.0 | -2.0 | 11.5 | -11.5 | 725.8 |
| 48 | 68 | 40 | 1.3 | -1.3 | 10.7 | -10.7 | 913.1 |
| 56 | 81 | 48 | 1.5 | -1.5 | 11.0 | -11.0 | 1100.4 |

| | H | I | J | K | L | M |
|---|---|---|---|---|---|---|
| | MRKCD_des | DY_AR | BOD_des | DY_Dep | Delta_ Shim_Bal | Des_Key Ht_RZ |
| 15 | 0.18 | 1.48 | -9.72 | 1.18 | 0.70 | 0.5 |
| 23 | 0.56 | 1.46 | -9.34 | 1.16 | 0.69 | 0.5 |
| 30 | 0.89 | 2.79 | -9.01 | 2.49 | 1.32 | 0.5 |
| 40 | 0.84 | 2.84 | -9.06 | 2.44 | 1.35 | 0.5 |
| 48 | 0.46 | 1.76 | -9.44 | 1.26 | 0.84 | 0.5 |
| 56 | 0.09 | 1.59 | -9.81 | 1.19 | 0.75 | 0.5 |

Fig. 23

| Case/Configuration | $m_1$ [g] | $m_4$ [g] | $R_4$ [mm] | DF [g] (mea) | $Fr_{c.s.}$ [g] (mea) | $a_1$ [mm/ms$^2$] | $AF_{tot}$ [g] (@ $a_1$) | IK [g mm$^2$] (@ $a_1$) | $a_2$ [mm/ms$^2$] | $AF_{tot}$ [g] (@ $a_2$) | IK [g mm$^2$] (@ $a_2$) | $a_3$ [mm/ms$^2$] | $AF_{tot}$ [g] (@ $a_3$) | IK [g mm$^2$] (@ $a_3$) | $a_4$ [mm/ms$^2$] | $AF_{tot}$ [g] (@ $a_4$) | IK [g mm$^2$] (@ $a_4$) | IK (avg) |
|---|---|---|---|---|---|---|---|---|---|---|---|---|---|---|---|---|---|---|
| 1 | 80 | 18.4 | 698 | 56.2 | 3.2 | 9.88 x $10^{-4}$ | 122.6 | 1.72 x $10^7$ | 1.28 x $10^{-3}$ | 143.9 | 1.75 x $10^7$ | 1.67 x $10^{-3}$ | 171.2 | 1.76 x $10^7$ | 2.17 x $10^{-3}$ | 201.1 | 1.71 x $10^7$ | 1.73 x $10^7$ |
| 2 | 100 | 26.8 | 618 | 54.6 | 3.0 | 7.6 x $10^{-4}$ | 116.3 | 2.08 x $10^7$ | 9.88 x $10^{-4}$ | 131.7 | 2.00 x $10^7$ | 1.28 x $10^{-3}$ | 156.6 | 2.03 x $10^7$ | 1.67 x $10^{-3}$ | 186.9 | 2.03 x $10^7$ | 2.04 x $10^7$ |
| 3 | 100 | 35.2 | 458 | 51.4 | 2.9 | 7.6 x $10^{-4}$ | 103.6 | 1.76 x $10^7$ | 9.88 x $10^{-4}$ | 119.6 | 1.77 x $10^7$ | 1.28 x $10^{-3}$ | 139.8 | 1.76 x $10^7$ | 2.17 x $10^{-3}$ | 199.3 | 1.74 x $10^7$ | 1.76 x $10^7$ |

Figure 44

| Config | DF [g] (meas) | $Fr_{c.s.}$ [g] (meas) | $a_1$ [mm/ms$^2$] | $AF_{tot}$ [g] (@ $a_1$) | IK [g mm$^2$] (@ $a_1$) | $a_2$ [mm/ms$^2$] | $AF_{tot}$ [g] (@ $a_2$) | IK[g mm$^2$] (@ $a_2$) |
|---|---|---|---|---|---|---|---|---|
| G1 | 46.6 | 8.5 | 0.00065 | 82.1 | $1.94X10^7$ | 0.00081 | 89.4 | $1.90X10^7$ |
| G2 | 57.1 | 13 | 0.00052 | 97.3 | $2.80X10^7$ | 0.00065 | 105.7 | $2.67X10^7$ |
Fig. 51
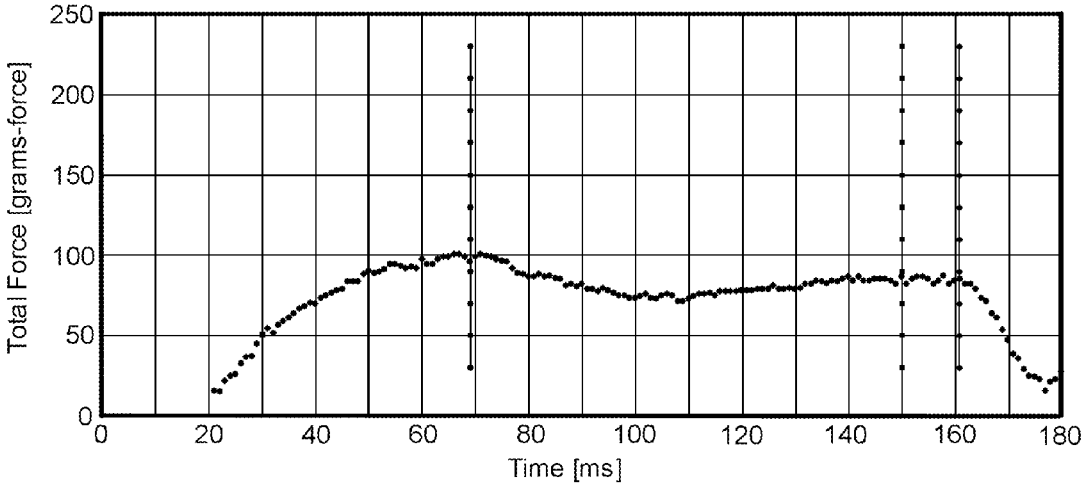
Fig. 52(a)
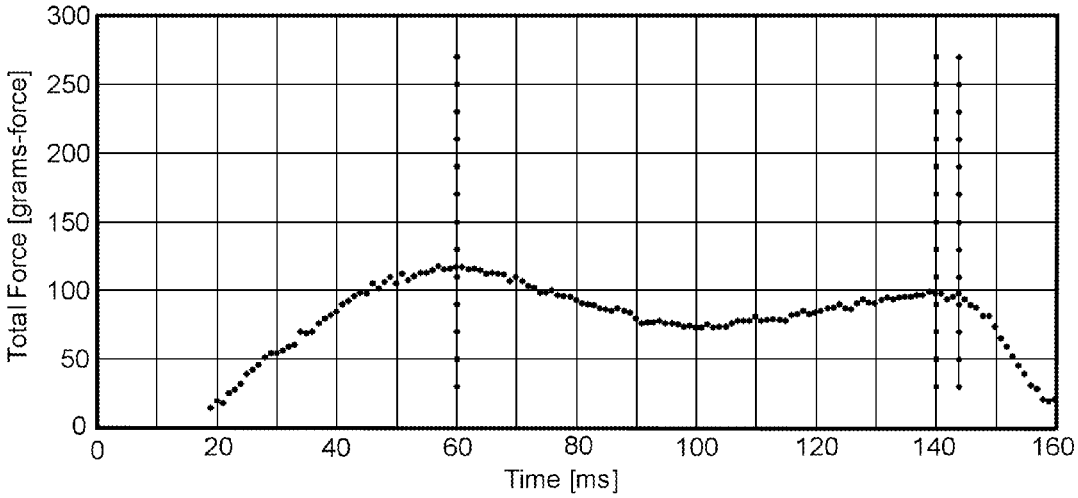
Fig. 52(b)

KINETIC MEASUREMENT OF PIANO KEY MECHANISMS FOR INERTIAL PROPERTIES AND KEYSTROKE CHARACTERISTICS

CROSS-REFERENCES TO RELATED APPLICATIONS

Not Applicable

INCORPORATION-BY-REFERENCE OF MATERIAL SUBMITTED ON A COMPACT DISC

Not Applicable.

STATEMENT REGARDING FEDERALLY SPONSORED RESEARCH OR DEVELOPMENT

Not Applicable.

BACKGROUND OF THE INVENTION

1. Field of Invention

This invention relates to piano key mechanisms, and more specifically to improvements in measuring the performance characteristics of key mechanisms of a piano or keyboard.

2. Description of the Prior Art

A. Measuring "Static" Key Forces

There is a longstanding practice of measuring "static" values of Down Weight, Up Weight, and (indirectly) Balance Weight and Friction, by applying "gram weights" to the keys of the piano action. New methods and apparatus were disclosed in U.S. Pat. No. 8,049,090, by the present author, which eliminated the need for the old "gram weight" techniques, producing more scientific and repeatable results. These new methods involved reaction forces at the key being measured continuously during constant-speed downstrokes and upstrokes, resulting in continuous force data for the stroke. In addition, averages of these forces were described, being declared as "replacements" for the old parameters of Down Weight, Up Weight, Balance Weight and Friction Weight.

A clever mechanism was built and used on a piano action in the 1920's. It was able to depress a piano key gradually, due to a manual "sliding" adjustment of a horizontal lever (containing a "pen" that drug across nearby graph paper). The other end of the lever—opposite a pivot—rested on the piano key. When the sliding changed the moment arm of the lever sufficiently to further displace the key, the entire lever (with pen) would rotate, dragging the pen across the paper. The force was therefore not actually measured, but rather known by the moment induced by the sliding member. The force could therefore change only very gradually with key displacement, allowing for only very primitive information with regards to "dynamic" events such as the escapement. The displacement was not controlled in any way, with the rotation of the member being dependent upon the current resistance offered at its contacting point with the key.

B. Key Leveling

Included in the process of regulating a piano is the act of "leveling" the keys, in both their "at rest" and "depressed" states. This leveling process generally involves measuring (or checking) the key locations (vertically) first, followed by adding or removing various punchings or spacers to/from the Balance Rail and/or the Front Rail.

"Reference bar" methods of "at rest" Key Leveling have been used for many decades in the industry. They consist of laying a "reference edge" of a "reference bar" against two or more "point" datums, the datums being approximately in the designated Vertical AP Plane for the given-colored keys being measured. This method seems to be more often used for white keys, and less often for black keys. Whether the "reference edge" is linear or not, it establishes the "zero line", against which the key tops are compared. With these "reference bar" methods, the "reference edge" is usually considered to be the desired location for the various key tops. The vertical distance from the "at rest" AP of each same-colored key to the "reference edge" of the bar is noted and/or measured. For each key, this distance tells the technician how much "shimming" needs to be added or removed at the Balance Rail of that key.

In the past 30 years, at least two "passive displacement" gauges have been offered on the market, designed to measure both the "at rest" and "depressed" key locations, relative to a "global" reference plane. Various types of small blocks and gauges have also been used throughout the years to determine the "depressed position" of the key. In addition, the present author disclosed methods and means—in U.S. Pat. No. 8,049,090—for "active" determination of the Key Dip, using a kinetic, well-controlled, force-sensing manipulator. This allowed the key's exact location and resisting force (due assuredly to compression of the front punching) to be quickly and simultaneously created and measured, respectively—with no reliance upon the technician/operator.

C. Measuring Key Action Inertia and "Sluggishness"

A significant problem in the area of piano manufacture and piano action repair is that of the true "feel" of the piano keys not being measurable or quantifiable. There is no way in the prior art of kinetically determining the inertial properties of a key mechanism, or even an individual key action component. And certainly there is no non-invasive way of measuring key action inertia. The limited methods that have been utilized in obtaining numbers related to inertia normally involve significant disassembly of the key mechanism and simple stationary weighing of components. There is no way in the prior art of measuring inertial forces on any one of a multitude of different key actions, resulting from some known acceleration or series of accelerations. Nor has a way been established of turning such "inertial force" data into intrinsic inertial properties of the key mechanism. There is also no way in the prior art of directly measuring and quantifying the "sluggishness" of a key action. The only existing indicator that has sometimes been used to describe how readily a key will rise from a depressed position is the Up Weight. It is, however, a very indirect indicator of this ability, having very limited value in this regard.

What is therefore needed is a means of accurately quantifying and measuring the true resistance to accelerated motion (i.e., the total inertia)—as felt at the key during an accelerated downstroke—of any key action. This "resistance to accelerated motion" must be due solely to mass and its distribution in the mechanism, and not to any "down force" effects (such as friction, springs, gravity or magnets). The ability to measure inertia would allow the key actions of a piano to be judged objectively and accurately as to their true "dynamic resistance" during the act of playing a piano. Also needed is a way of directly and quantitatively measuring the ability of a key to return to its rest position, from some depressed position.

The inertia determination might also be done on the "component" level. That is, by focusing on individual components of the key action and accelerating/measuring them in some fashion to obtain their "local inertia" about a convenient axis. Once a "local inertia" value is obtained, knowing certain geometric or moment ratios in the action might then allow one to calculate that component's equivalent inertia at the key.

SUMMARY OF THE INVENTION

Important new descriptors (Down Force Slope and Up Force Slope), which more fully and meaningfully characterize the continuous Down Force and Up Force are revealed. Similar descriptors are also created to more fully characterize the Balance Force and Frictional Force curves. The invention also discloses various methods for accurately testing, measuring and determining other parameters (including the position of the at-rest key, key sluggishness, and others characterizing the "let-off" event) in an accurate and efficient manner. Methods of quantifying and measuring the actual inertia of a key action—in a non-invasive manner—are also disclosed, with several inertial parameters being defined. Methods for quantifying and measuring the actual inertia of the major individual components of a key action are also detailed, along with parameters and methods for expressing their contribution "at the key". All of the various measurement methods of the current invention are performed in a "controlled, kinetic and continuous" manner.

These and other objectives and advantages of the invention will become more apparent from the following detailed description when taken in conjunction with the accompanying drawings.

BRIEF DESCRIPTION OF THE DRAWINGS

FIG. 12(*b*) shows the resulting reaction force vs. time curve generated when the piano action was driven by the profile of FIG. 12(*a*), and beginning in a Key Adjacent State.

FIG. 17 (*b*) is the Motion Profile for an actual run for determining BOD. FIG. 17 (*c*) shows the Contact forces resulting from the current embodiments following the flowchart of FIG. 16, with the Contact following the Motion Profile of FIG. 17 (*b*).

FIG. 21 (*b*) shows a "downstroke" Motion Profile, with the resulting forces shown in FIG. 21 (*c*), used for determining the MRKC Point and TMBC, followed by the MRKCD.

FIG. 22 shows the equations and approximate format of a spreadsheet for plotting "at rest" and "depressed" key leveling measurements, and calculating and plotting "desired" profiles in various locations, all relative to a zero position plane.

FIG. 23 shows the same spreadsheet described by FIG. 22, but with actual "key leveling" data for six different keys of a piano "read in" to columns C and E. All input parameters are filled in with their proper values, and all "calculating" cells show their resulting values, rather than the actual equations.

FIG. 28 (*b*) shows the force data resulting from the Contact following the Motion Profile of FIG. 28 (*a*), but where Scanning Acquisition was employed.

FIG. 32 (*b*) shows the resulting forces versus time, when the hammer was measured using this Motion Profile, using methods of the current embodiments.

FIG. 39 (*c*) is a schematic of the same mechanism, but with non-inertial forces now present (gravity, springs, etc.).

FIG. 43(*b*) is a free body diagram for "acceleration" runs on the see-saw.

FIG. 44 is a table displaying the three configuration variations of the leveraged see-saw, along with the resulting global inertial values for each configuration.

FIG. 51 is a table showing global inertial values determined from "inertia runs" on two configurations (G1 and G2) of a piano key action, with mass being added to both the hammer head and the key front of the second configuration (G2).

FIGS. 52 (*a*) and 52 (*b*) show the resulting total force curves for two different accelerations, with configuration G1.

Figure 1:
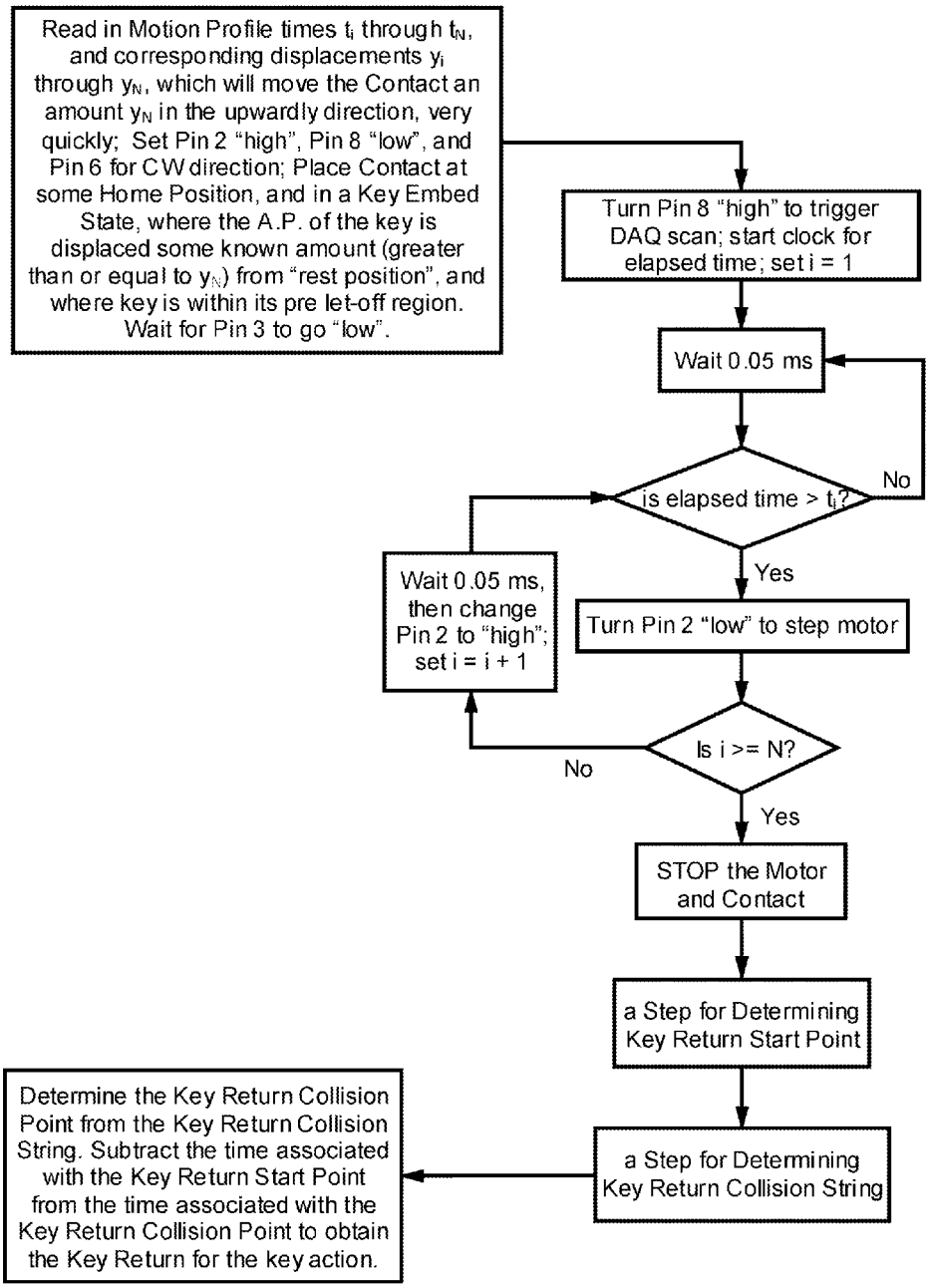
FIG. 1 is a flowchart detailing means of obtaining the Key Return parameter on a piano key mechanism.

While the invention is susceptible of various modifications and alternative constructions, certain illustrated embodiments have been shown in the drawings and will be described below in detail. It should be understood, however, that there is no intention to limit the invention to the specific forms disclosed, but rather, the intention is to cover all modifications, alternative constructions, and equivalents falling within the spirit and scope of the invention.

DETAILED DESCRIPTION OF THE INVENTION

A. Apparatus and other Important Concepts

Figure 5:
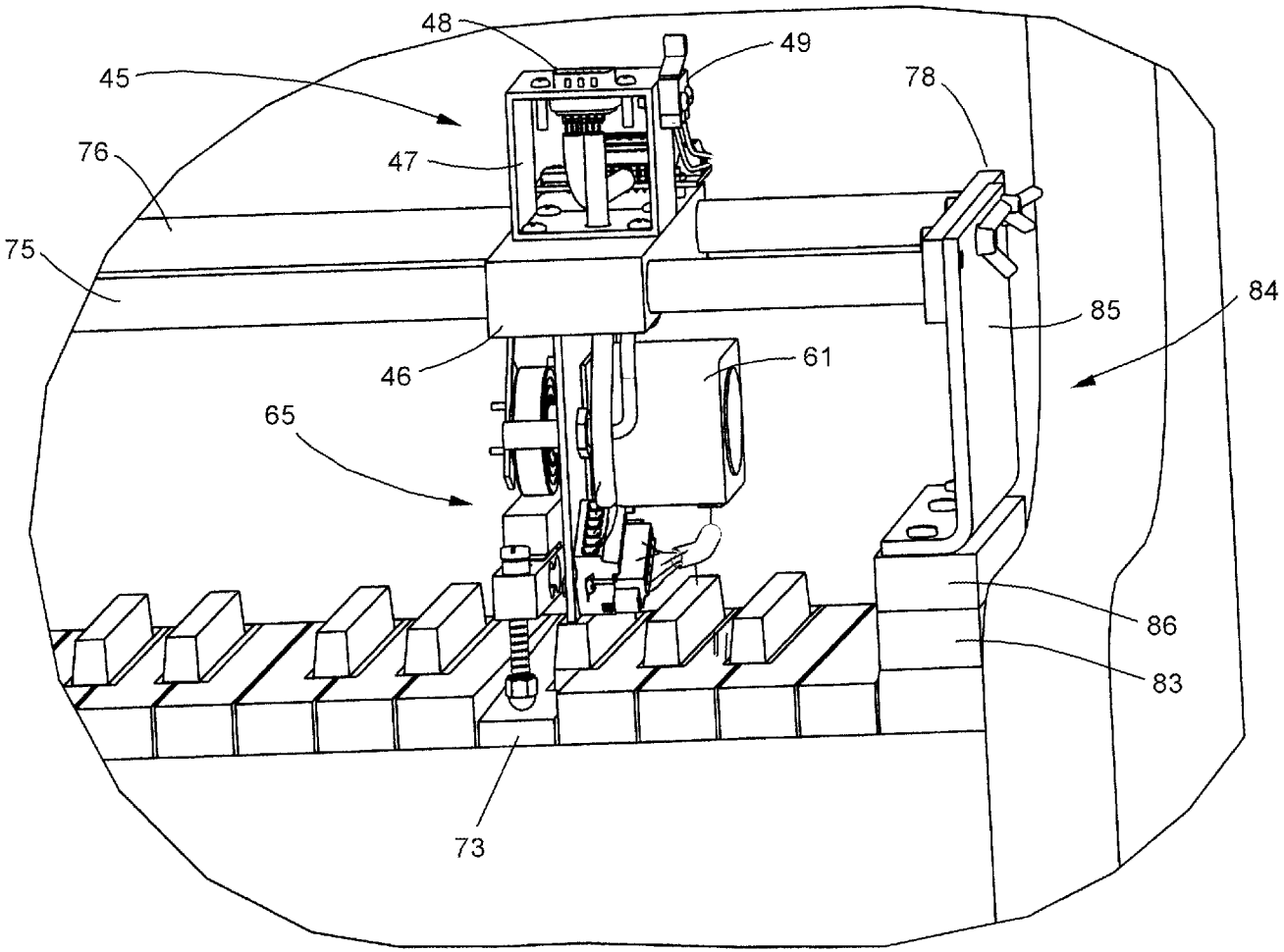
FIG. 5 is a fragmentary perspective view of one embodiment of a device configured for use with and in accordance with certain aspects of the invention, the device being shown as on a keyboard for practicing certain methods of the invention.

A device with similar capabilities as what was described by Voit in U.S. Pat. No. 8,049,090 is required for the methods described herein. The machine shown in FIGS. 5 through 11 herein is similar to embodiments described in U.S. Pat. No. 8,049,090, and is used to implement the embodiments herein. The configuration of the cam, follower, arm, load cell, and motor are the same herein as those described in U.S. Pat. No. 8,049,090. As shown in FIG. 5, a carriage 45 is supported above a piano key to be measured. A carriage block 46 is the main structure of the carriage, and a motor plate 52 protrudes downwardly from the block 46. Coupled to the motor plate 52 is an arm 65, consisting of a follower 66, a force transducer 67 (see also, FIG. 7), and a contact 68. The arm 65 pivots about an arm axis 69. Forming the pivot is a shoulder screw 59, affixed firmly in a position normal to a bracket 58, which is securely fastened to the motor plate 52. A clearance hole in the follower 66 fits over the shoulder screw 59, allowing the arm 65 to rotate freely about arm axis 69. Secured to, and extending downward from, the force transducer 67 is the Contact 68, which engages and excites a piano key 73 or piano action component. The motor plate 52 has a motor 61 affixed to one side and a cam 62 situated on the other. The cam 62 is secured to the output shaft of motor 61, said output shaft passing through a clearance hole in the motor plate 52. An upward force is generated on the follower 66 with an extension spring 70, keeping the follower in constant contact with the cam 62. Mounted on the face of the cam 62, for rotation therewith, is a positioning blade 71 (see also FIG. 7), which causes a voltage output from a position sensor 72, indicative of the angular position of the blade, when the two are in close proximity. Since the blade 71 rotates with the cam 62, and the cam is coupled to rotate with the motor output shaft, the output signal of the position sensor 72 is indicative of the angular position of the motor output shaft. When the blade 71 is near the position sensor 72, the output signal from the position sensor in turn causes transistor switch TR1 (see FIG. 54) to close, sending a "low" voltage signal to an I/O interface of a controlling computer.

Figure 54:
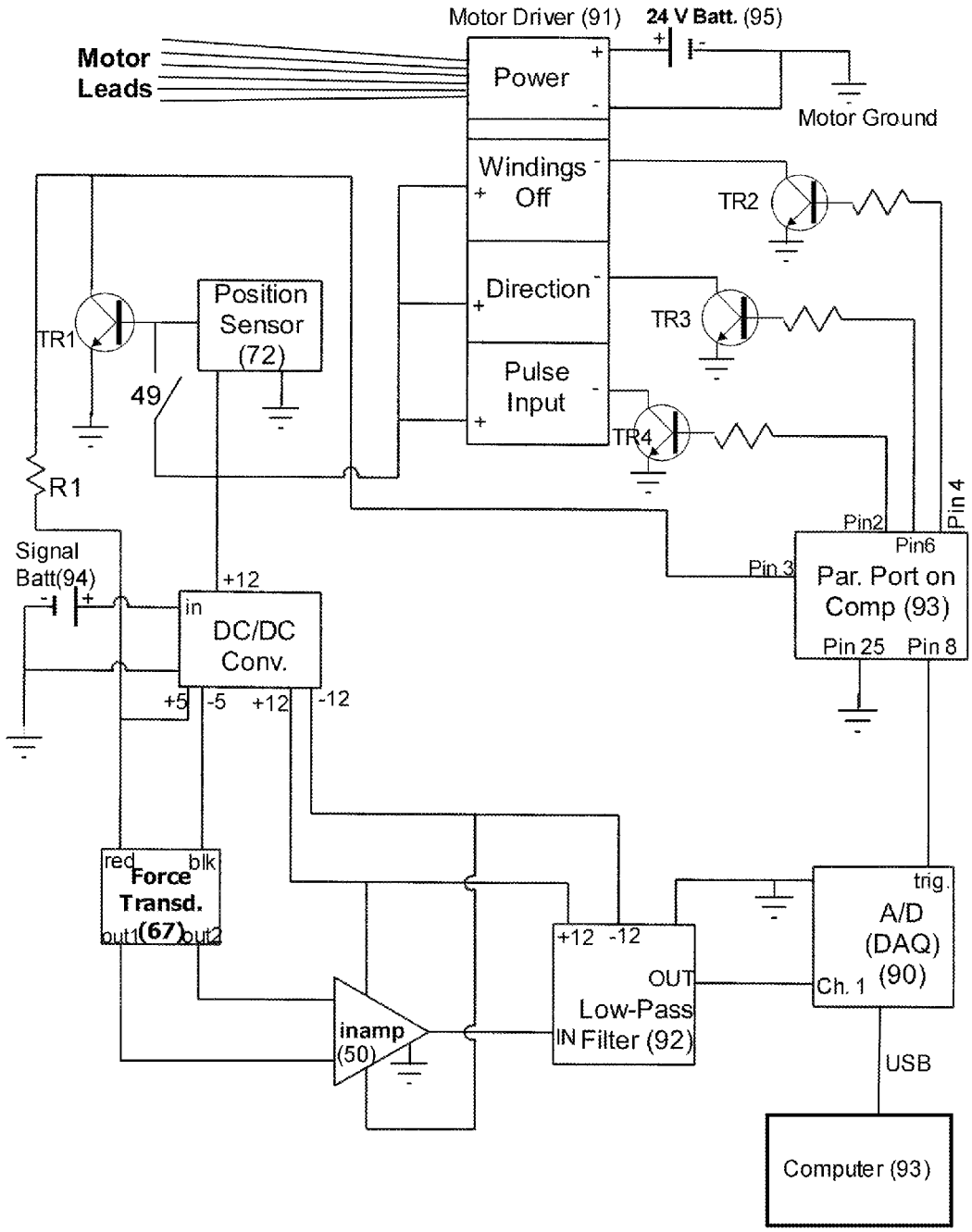
FIG. 54 is a diagram showing the electrical and electronic operation of the machine.

Mounted to the top of the carriage block 46 is a connector support 47, which supports a multi-pin connector 48, providing electrical power for motor 61, and signals to and from an amplification circuit and the force transducer 67. The amplification circuit sits atop the rear portion of the carriage block 46, and contains the instrumentation amp (inamp) 50, a gain resistor, and various connection means for wiring between a switch 49, the multi-pin connector 48, the force transducer 67, and the position sensor 72. The switch 49 has the main purpose of manually activating a Run, or series of Runs, after the Contact has been positioned above the key or action component. As shown in FIG. 54, the switch does this by electrically bypassing (shorting) the position sensor 72 and causing Pin 3 on the parallel port of computer 93 to go "low". The controlling program takes this signal to mean "begin the run".

Figure 55:
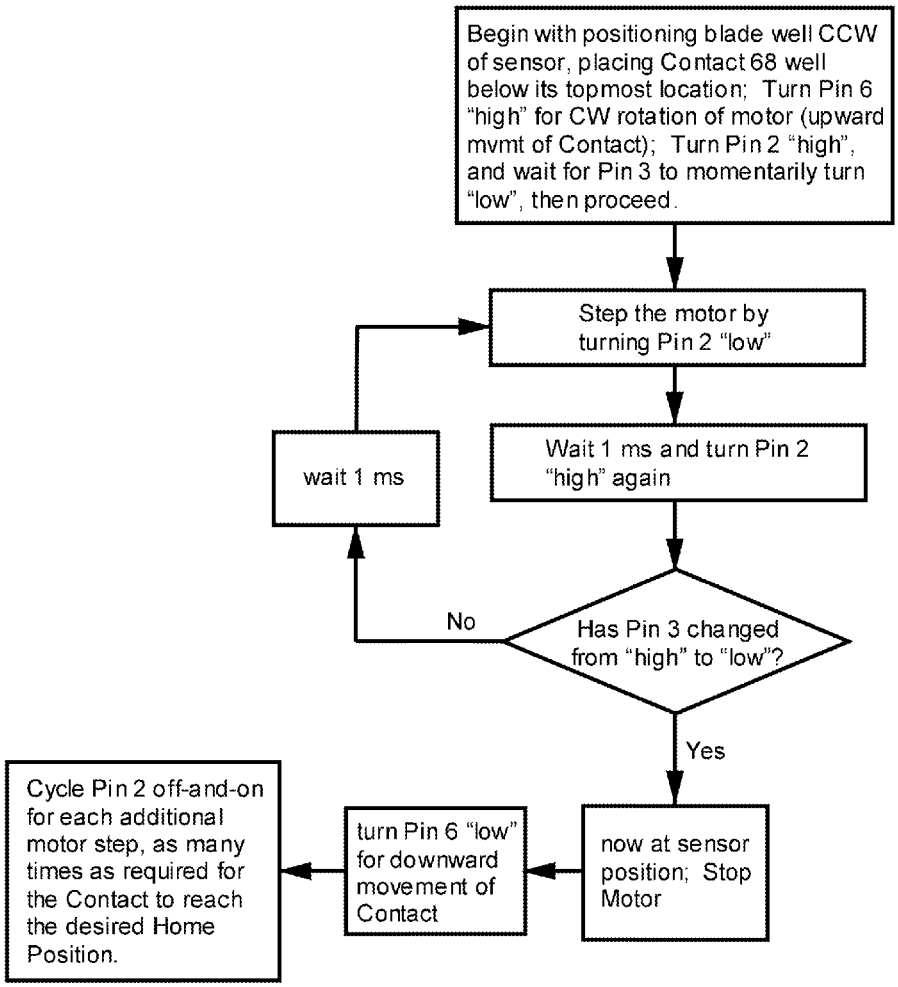
FIG. 55 is a flowchart describing a Home Address procedure of the machine.

FIG. 54 is a diagram that shows the operation and interaction of the important electrical and electronic components of the machine. The figure and associated description below is for the case of the motor 61 being a stepper motor, controlled by a stepper motor driver 91. A "signal" battery 94 is connected to a "signal" ground, and provides power to a DC/DC converter, which provides the necessary "signal" voltages. All ground connections in FIG. 54 are "signal" ground, except for the "motor" ground, to which the 24 Volt battery 95 is connected. The 24V battery 95 is what powers the motor driver 91. This is the power that eventually makes its way to the windings of the motor 61. It is seen in FIG. 54 that both the (+12) voltage and the (−12) voltage are needed for the inamp 50 and the Low-Pass Filter 92. The (+12) voltage is further required for the position sensor 72 and the three control inputs (Windings Off, Direction, and Pulse Input) on the motor driver 91. The "signal" ground is connected to: the "signal" battery 94, the inamp 50, the position sensor 72, the Low-Pass Filter 92, the A/D (analog-to-digital) converter 90, a pin on the parallel port of computer 93, and all four transistor switches or relays. The (+5) and (−5) voltages are connected to the force transducer 67. The (+5) voltage is further used for connecting, through a resistor R1, to the collector pin (top of transistors in FIG. 54) of the NPN transistor relay TR1 near the position sensor 72. The (+5) voltage is also connected, through the same resistor R1, to Pin 3 of the parallel port of computer 93. This ensures that Pin 3 sees a "high" voltage except when "sensor position" has occurred. Sensor position is the position of the positioning blade, motor and Contact at the point where the position sensor "sees" the positioning blade 71. During "sensor position", the position sensor 72 outputs a voltage to the base pin of the transistor relay TR1, effectively closing the transistor "switch" between the collector and the signal ground. When this happens, the voltage at the collector of transistor relay is reduced significantly due to the (+5) voltage dropping across resistor R1, and on to ground through the transistor. This low voltage at the collector is immediately sensed by Pin 3 of the parallel port of computer 93, causing the computer code to temporarily stop the motor movement. The motor thus knows exactly where it is in its rotation. Normally, subsequent motor movements are then made to place the Contact into the desired "home position" for the coming Run. This "home address" process is shown in the flowchart of FIG. 55. The process of bringing the Contact to a Home Position is referred to as Home Address.

As indicated in FIG. 54 and the various flowcharts herein, precisely timed "voltage pulsing" of pin 2 on the parallel port produces the desired motion of the motor and Contact. The motor driver 91 is constructed so that the motor takes one step each time pin 2 goes from "high" to "low". Pin 6 simply controls the direction of motor rotation, with a "high" value resulting in Clockwise Rotation, and a "low" value causing CCW rotation. Based on the construction of the cam-follower arrangement, a "high" signal at Pin 6 causes upward movement of the Contact 68, with a "low" signal at Pin 6 causing downward movement of the Contact 68. Just as with the other pins, Pin 6 is controlled by a controlling program in the computer 93. A "time file" is read into the program, or created by it, with all sequential points in time specified in milliseconds. As is indicated in the various flowcharts herein, each of these points in time instruct Pin 2 when it is to switch from "high" to "low" voltage (thus producing a motor step). From previous careful calibration, it is also known how much vertical travel the Contact undergoes at each successive step. Home Position is defined to be any one point in the motor's movement that corresponds to some convenient or desired vertical position of the Contact, from which a Run will begin. Home Position is easily arrived at, with the help of a sensor, as explained previously. Note that Home Position can be referring to either the position/orientation of the motor or the position of the Contact, when in this configuration. Knowing the current Home Position, along with the "time file", the program thus has a "motion profile" for the upcoming Run. A theoretical Displacement vs. Time curve that a Contact is forced to follow during a Run is referred to herein as a Motion Profile. Its displacements are relative to the Home Position of the Contact.

As seen in FIG. 54, the two output voltages (opposite corners of the Wheatstone bridge) of the force transducer 67 are received by the inamp 50. The inamp 50 outputs a voltage, relative to signal ground, that is proportional to the difference in these two input voltages. By installing an appropriate gain resistor onto the inamp, the output voltage is amplified greatly and accurately. The output signal from the inamp 50 goes into a Low-Pass Filter 92, which filters out unwanted higher frequencies. The filtered signal then goes into the A/D converter (DAQ) 90, which samples the continuous analog signal very frequently, converting each reading into digital data. This data, for every Run, is subsequently transferred to the computer 93 via a USB connection, and stored. For "scanning" runs, the A/D converter 90 is instructed by the controlling program, via Pin 8 on parallel port of computer 93, as to when to begin each sampling "run". Pin 8 is connected to a Trigger pin on the A/D, so the sampling begins as soon as the appropriate signal is received at the Trigger.

Regarding the three transistor relays TR2, TR3 and TR4 near the top-right of FIG. 54, their base connections (to their right in the figure) are each connected to a corresponding pin on the parallel port of computer 93. The three control circuits in the motor driver 91 (Windings Off, Direction, and Pulse Input) are connected on one end to (+12) volts. But no current flows through them until the base of the corresponding transistor relay is made "high" by the corresponding pin of the parallel port. The Windings Off circuit, within the driver 91, is set up so that the motor windings are turned off whenever current is flowing through that circuit. That is, in the embodiments, when the corresponding transistor relay TR2 is "closed" (due to Pin 4 being "high"), then current is allowed to flow through the Windings Off circuit of driver, and the motor windings are all turned off. When the TR2 is not "closed", then the windings do whatever they are supposed to do, based on the Pulse Input circuit (discussed below).

Regarding the "Direction" circuit of the driver 91, when current flows through that circuit of the driver, the motor steps in one direction (CW). When current flow stops, the motor steps in the opposite direction (CCW). And similar to the Windings Off circuit, current is made to flow or not by turning on or off the corresponding transistor relay TR3 with Pin 6 of the parallel port. So, Pin 6 would be constantly "high" while the motor is stepping in one direction, and then switched to constantly "low" for stepping in the opposite direction. The "Pulse Input" circuit of the driver is set up so that whenever a transition is made from "current flowing" to "current not flowing", the motor takes one step. Looking at the corresponding transistor relay TR4 in FIG. 54, one sees that the motor therefore steps whenever Pin 2 of the parallel port goes from High to Low.

Figure 6:
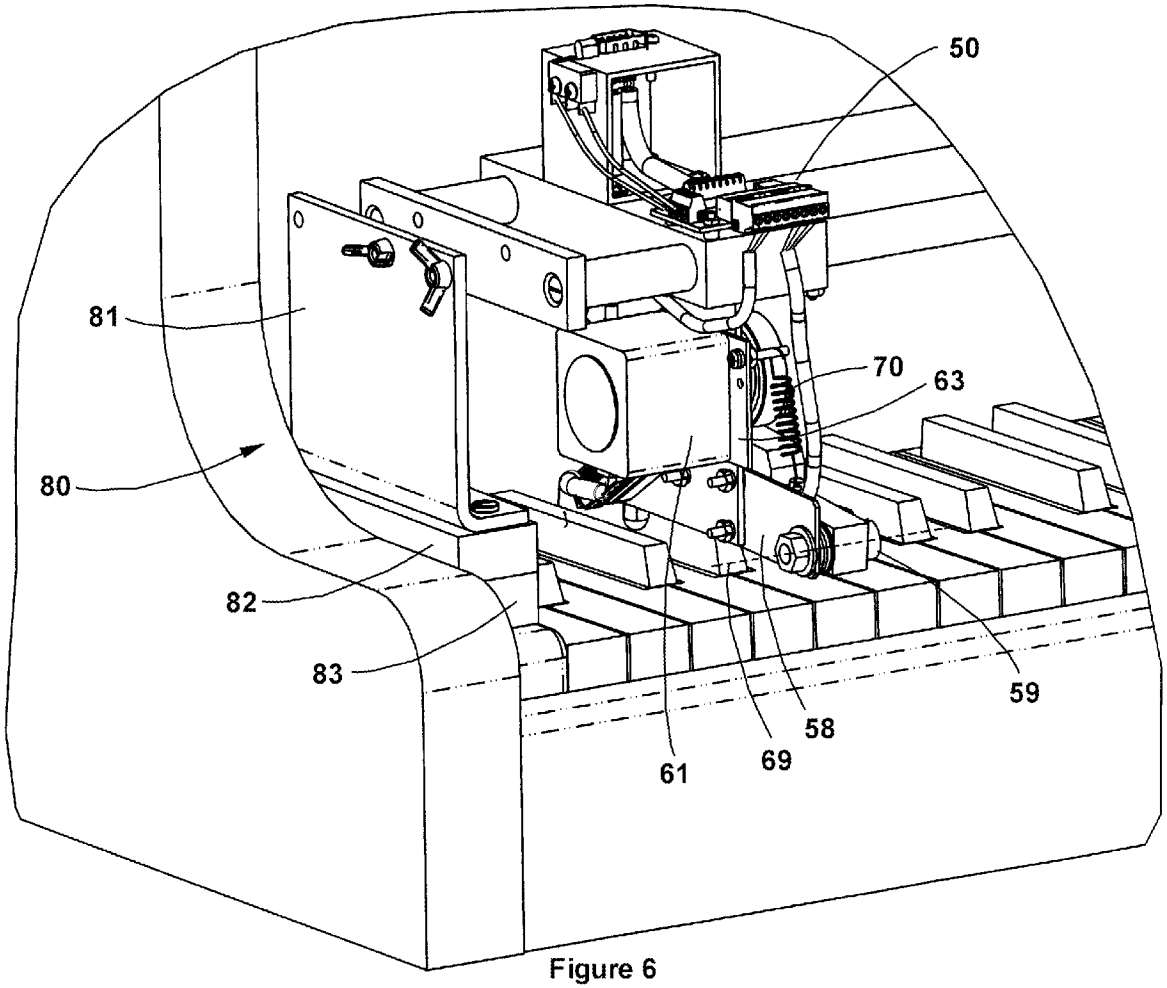
FIG. 6 is an alternate fragmentary perspective view of the device shown in FIG. 5, and with the device configured for measuring black keys.
Figure 7:
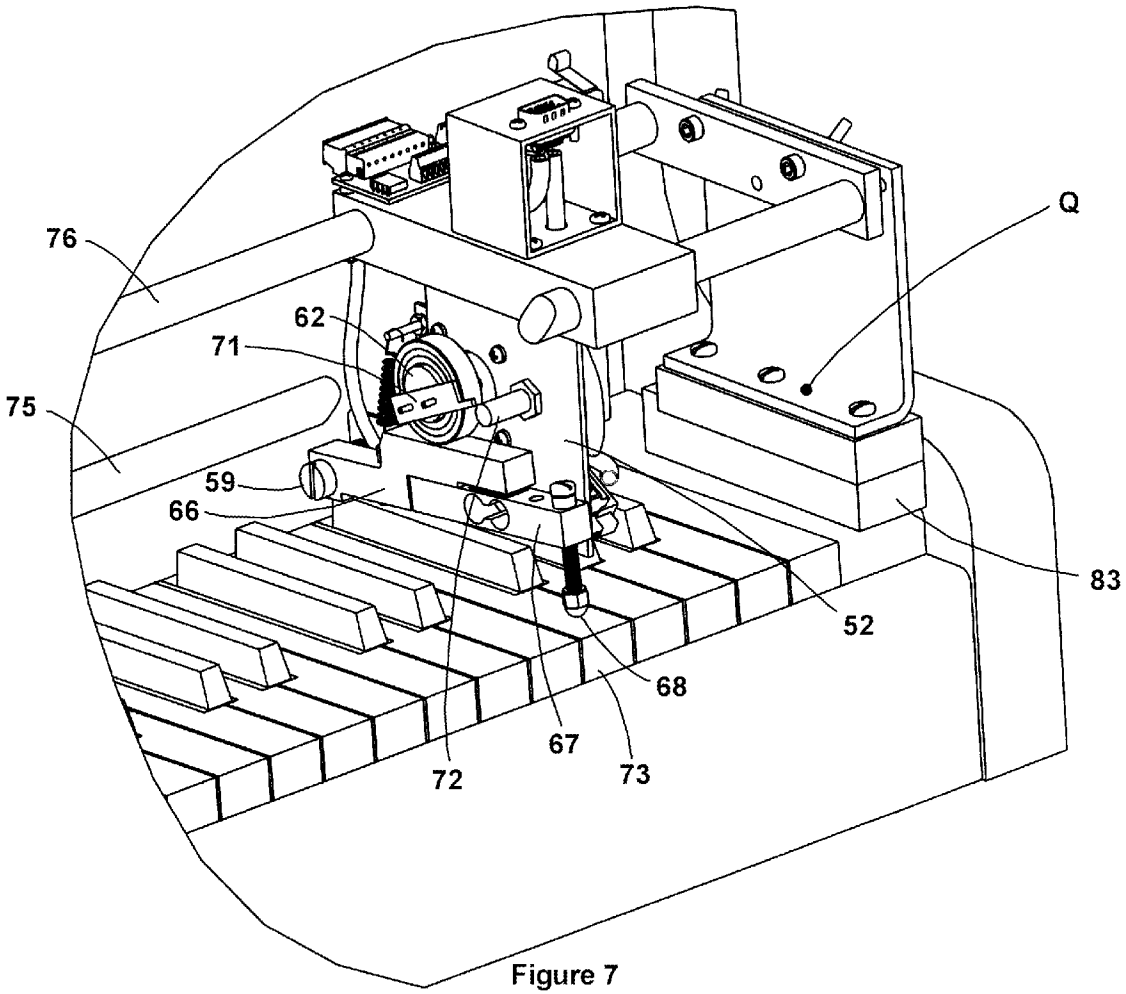
FIG. 7 is an alternate perspective view of the device shown in FIG. 5, showing the device as it appears while in a Key Clear State, prior to a run on a white key.
Figure 8:
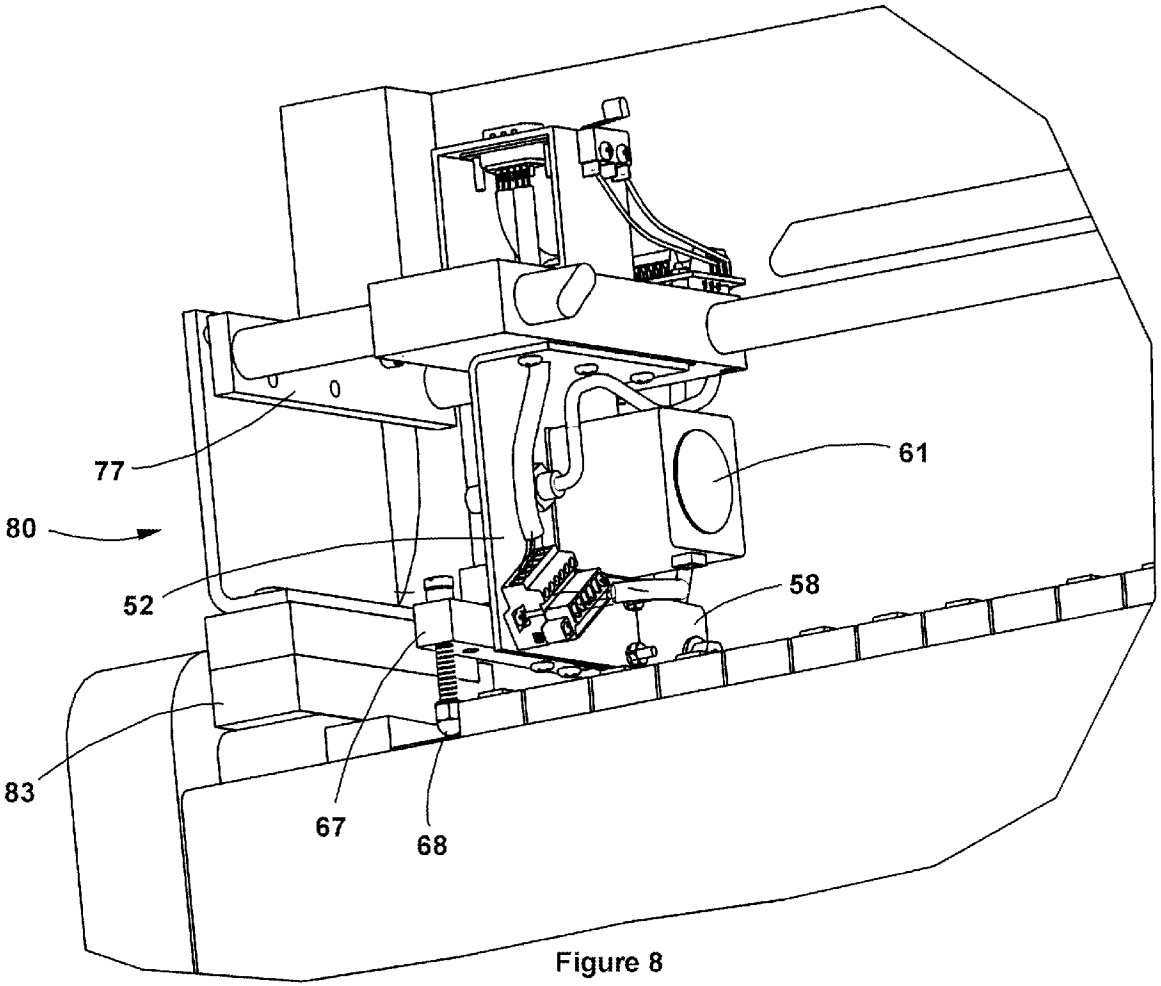
FIG. 8 is an alternate perspective view of the device shown in FIG. 5, the Contact located at an approximate "bottom out" position on a white key.
Figure 9:
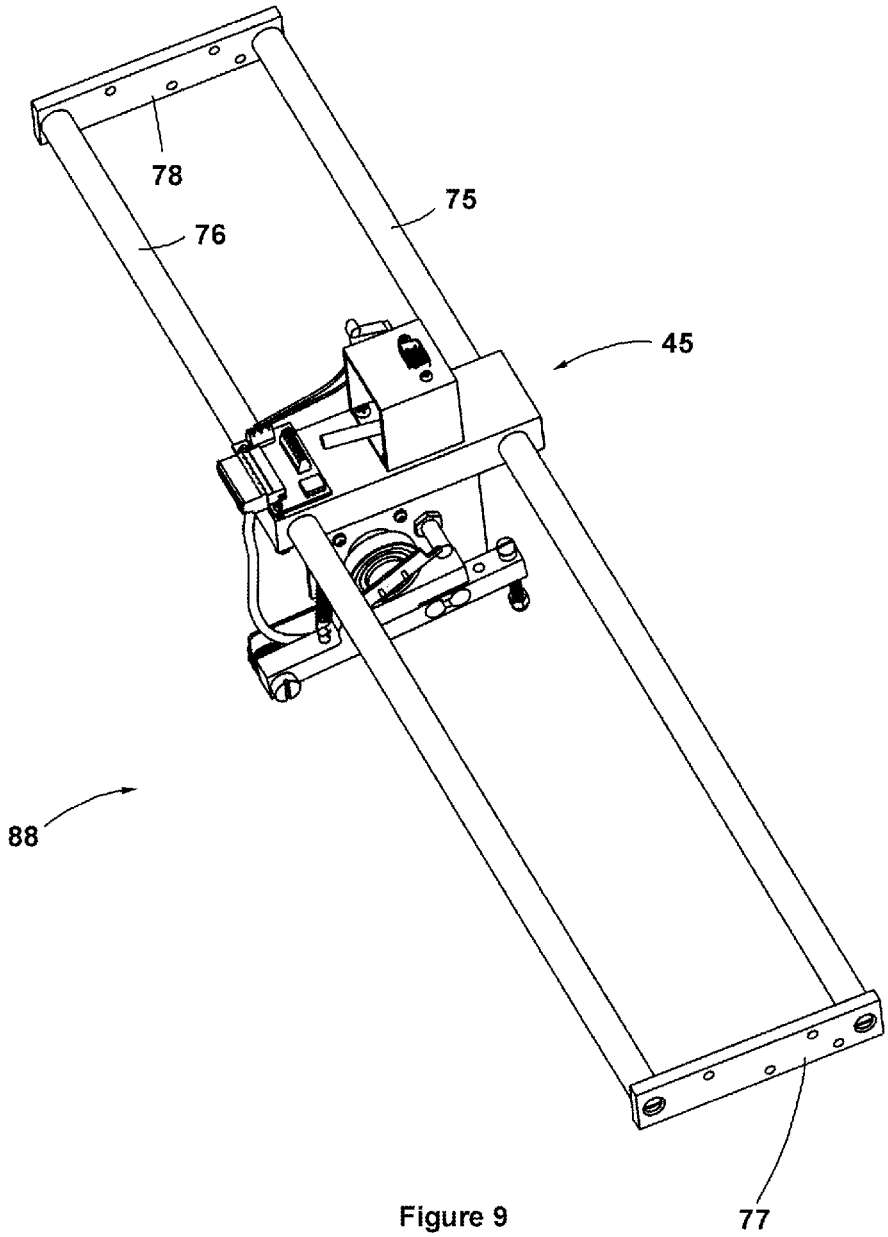
FIG. 9 shows the Carriage Frame portion of the device, the frame to be oriented in one of two different ways, depending on whether white or black keys are being measured.
Figure 10:
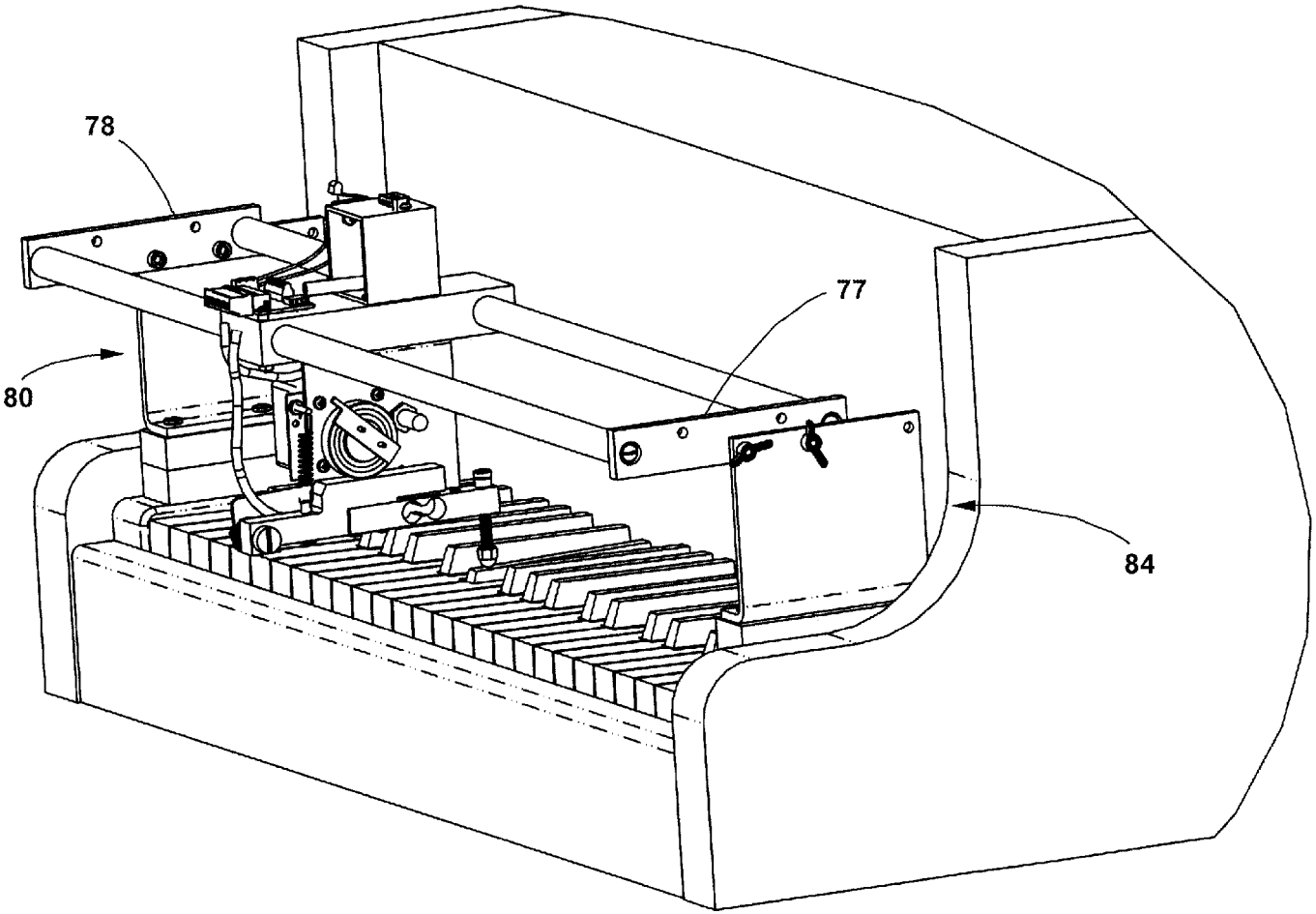
FIG. 10 shows the entire "on piano" portion of the device, as configured for measuring properties of black keys.
Figure 11:
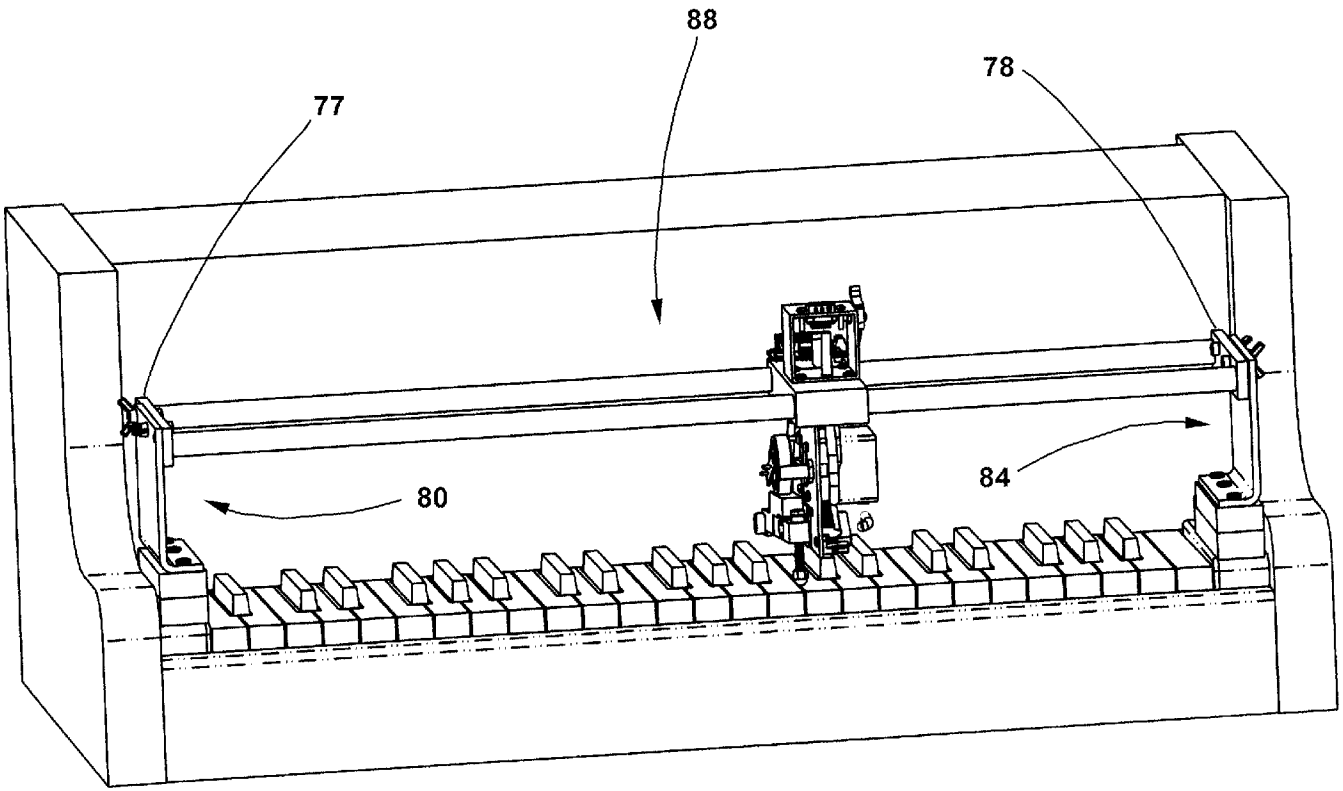
FIG. 11 shows the entire "on piano" portion of the device, as configured for measuring properties of white keys.

The device herein spans the entire keyboard, being securely mounted onto each keyblock when used "on the piano", as shown in FIG. 11. The carriage 45 slides along two Horizontal Support Rods (75 and 76), being positioned generally over a key 73 to be measured. The two horizontal support rods (75 and 76), which support the carriage 45 and allow it to translate from key to key, fasten securely on one end to a RH Rod Support Block 78, and on the other end to a LH Rod Support Block 77. Counterbores on the outer face of each Rod Support Block allow a fastener to screw into a tapped hole on each end of the support rods, while ensuring that the fastener head is not proud of the outer face of the Rod Support Block. The LH and RH Rod Support Blocks are mirror images of each other. In addition to the counterbored holes for fastening to the rods, each Rod Support Block contains four additional holes, divided into two rows. Block 78 and Block 77 are on the Right Hand and Left Hand ends respectively when white keys are being measured; they are reversed when black keys are being measured. The assembled Carriage 45, Carriage Support Rods 75 and 76 and Rod Support Blocks 77 and 78 together make up the Carriage Frame 88, which is shown in FIG. 9. When white keys are being measured, the LH Rod Support Block 77 (and the entire Carriage Frame 88) is secured to a LH Key Block Angle Assembly 80, using the upper row of mounting holes on the block. Similarly, the RH rod support block 78 is secured to a RH Key Block Angle Assembly 84, also using the upper row of mounting holes on the block. When black keys are to be measured, the Carriage Frame is rotated 180 degrees about the vertical, so that the lower row of holes in the Rod Support Blocks is rearward (i.e., away from the technician/pianist) of the upper row of holes, as shown in FIGS. 6 and 10. In addition, the LH Rod Support Block 77 is secured to the RH Key Block Angle Assembly 84; and the RH Rod Support Block 78 is secured to the LH Key Block Angle Assembly 80. For these black key measurements, the holes in the lower row (of the Rod Support Blocks) are aligned with the two forward-most holes in the angles, as shown clearly in FIG. 10. For either white or black key measurements, two hex socket screws—facing outwardly—pass through the aligned holes of each Rod Support Block and angle, receiving corresponding "wingnut" fasteners on the outer face of each angle.

The LH Key Block Angle Assembly 80 consists of a LH Key Block Angle 81, which is screwed to a LH Key Block Angle Support 82 as shown in FIG. 6. The RH Key Block Angle Assembly 84 consists of a RH Key Block Angle 85, which is screwed to a RH Key Block Angle Support 86 as shown in FIG. 5. Both the Key Block Angles (81 and 85) and the Key Block Angle Supports (82 and 86) are mirror images of each other. In order to precisely locate each Key Block Angle Assembly—and thus the entire Carriage—vertically, a series of Key Block Spacers 83 are employed. One or more of these can be used on each key block, with some degree of interlocking occurring between the Key Block Spacers themselves and between the spacer(s) and the Key Block Angle Support. There would be preferably several pairs of key block spacers, each pair having a unique thickness. The desired longitudinal location of the Contact along the key would be achieved by moving the combination of Key Block Spacer and mating Key Block Angle Assembly (on each end of keyboard) fore or aft. Once the proper longitudinal location (Vertical AP Plane) is achieved, each Key Block Angle Assembly would be clamped down against its underlying key block, with the proper Key Block Spacer sandwiched in between. A standard C-clamp could be used, with its lower clamping face against the bottom of the key bed, and its upper clamping face pressing down on the Key Block Angle, at some point "Q" between the first and second screws, as shown for the right-hand side in FIG. 7. When the machine is measuring an action outside of its piano case, appropriate spacers and/or supports would be employed to support each Key Block Angle, the rudiments of which would be obvious to those skilled in the art. The end result of such a "benchtop" setup procedure would have the machine in the same basic orientation relative to the keyboard as it would be if measurements were done "on the piano".

The vertical distance between the two rows of holes in the rod support blocks is approximately one half inch, or the average height difference between the top front edge of the black keys and the top front edge of the white keys. Using the lower row for securing the frame prior to black key measurements ensures that the entire frame, carriage, and Contact are raised vertically by this distance. The Contact is automatically shifted further rearward as well, for the black key measurements. This is accomplished by: (1) the fact that the carriage frame is rotated 180 degrees, which tends to place the Contact too far rearward (near the fallboard), (2) using the lower row of holes on the rod support blocks, which partly compensates for (1) by tending to move the frame forward, and (3) using the first and second holes in the key block angles, which further compensates for (1) by moving the frame forward still more. Fine adjustments can then be made by loosening the clamps and moving the Key Block Angle Assemblies (and key block spacers) fore and aft on the corresponding key blocks, just as was described above for measuring white keys. Once the desired longitudinal position (i.e., Vertical AP Plane) is achieved, the clamps are retightened.

It probably makes the most sense to measure the white keys first. One would measure the approximate vertical location of the highest white key top relative to the key blocks (or important action datum if the action is removed). A simple straight edge could be laid across the key blocks, with a "slider" that protrudes downward below this edge by different "preset" amounts. For each setting, the slider would be swept along the straight edge, while watching the keys all the while, looking for potential deflections. With some practice, it would become quite easy with such a primitive device to quickly get this sort of reading for a piano. The value determined would then correlate, with the help of a table or matrix, to some "total Key Block Spacer thickness" to use. Using this value would ensure that the Contact, in its preferred Home Position, is well clear of the highest key. The "key locating" measurements would generally be done first on each key, with the resulting distance to the "at rest" key determining the exact Home Position to use for subsequent runs (such as those determining Down Force, Up Force, let-off points, and Inertial Force) that might best begin from a Key Adjacent State. When the entire measurement sequence is completed for a given key, the Carriage 45 is slid by hand along the rods 75 and 76, until the Contact 68 is positioned correctly, in a lateral sense, over the key to be measured next.

The Contact, and essentially the entire Arm, is the well-controlled "finger" of the machine (coupled to the well-controlled motor) that actually touches and moves the piano key, and moves near the key, and also transmits any reaction force to the force transducer. The vertical location of the Contact is always known exactly, relative to the machine. For "key leveling" runs (and sometimes other types of runs), the Contact's vertical location is also known with respect to the key bed, or some other important horizontal action datum. The controlled movement and positioning of the Contact above, near or against the static or moving key (or action component, for tests related to Local Inertia), not including preparatory movements such as Home Address, while simultaneously measuring and/or recording any forces acting upwardly on the Contact, is referred to as a Run. There can be several Runs on one key, each with potentially different movements (constant speed, constant acceleration, downward, downward-and-upward, etc.), and each designed to extract different information ("at rest" or "depressed" key positions, Down Force, Up Force, "let-off" forces, etc.).

As mentioned, the Motion Profile displacements associated with a Run are relative to some Home Position of the Contact. Thus, the current Home Position is considered the "starting point" for the current Run. The Home Address would, in certain embodiments of the invention herein, place the Contact in a position where it is well clear of the "at rest" key below. This configuration of the Contact will be referred to herein as a Key Clear State. The Home Address would, in another embodiment, place the Contact in a position where it is barely touching (or very nearly touching) the "at rest" key. This configuration of the Contact will be referred to herein as a Key Adjacent State. In another embodiment, the Home Address might place the Contact in a position where it is displacing the key below its normal "at rest" position. This configuration of the Contact will be referred to herein as a Key Embed State. Regardless, Home Address puts the Contact in a known location relative to the machine (which is typically located vertically relative to the keybed, keyboard frame, or action datum). When the machine is properly oriented relative to the keyboard for "key leveling" (and possibly other) runs, the carriage (and Contact at Home Position) moves from key to same-colored key in a manner that keeps it essentially equidistant from the keybed/keyboard frame (or action datum).

The output voltage from the force transducer will not necessarily be zero when the Contact is unloaded (i.e., in a Key Clear State). Several force readings are generally taken while the Contact is in a Key Clear State, either during, before or after the current Run. These readings are averaged to obtain an "unloaded" force, which is subtracted from all force readings acquired for that Run. This results in the actual force experienced by the Contact.

B. Improved Methods for Evaluating "Static" Key Forces and Friction

Methods are disclosed herein to more fully characterize the "static" forces that occur during constant-speed movements of a Contact against the key. As with the methods of prior art U.S. Pat. No. 8,049,090, they require a machine containing a force-sensing Contact that moves vertically up and down against the key, in a well-controlled manner. Any force that the key may exert on the Contact during these movements is measured by the force transducer of the machine in a regular and/or continuous fashion. The methods of U.S. Pat. No. 8,049,090 more specifically include measuring the reaction forces continuously as the key is forced to descend at essentially constant speed by the downwardly-moving Contact. And also, measuring the contact forces continuously as the key is allowed to ascend against the upwardly-moving Contact, at essentially constant speed, back towards some initial or "at rest" position. The damper lever would generally be fully disengaged for all these measurements. Embodiments of U.S. Pat. No. 8,049,090 use the acquired force data to calculate an average contact force for a portion of the constant-speed downstroke when the Contact is touching the key, and an average contact force for a portion of the upstroke when the Contact is touching the key. Downstroke, as normally used herein, refers to any controlled downward movement of the Contact, while near or actually touching the key. Upstroke, as normally used herein, refers to any controlled upward movement of the Contact, while near or actually touching the key.

It should be noted that "friction" as used herein will refer to "constant speed" friction, unless stated or understood otherwise. It will be shown elsewhere herein that additional frictional force can be created when a component or mechanism is accelerated.

Characterizing Further the Continuous Forces, and Some "Let-Off" Terminology When a piano key is depressed far enough through its stroke, the toe of the jack begins to hit the let-off button. This is true for either a grand piano action or an upright piano action. In a grand piano, at around this same instant, the top of the repetition lever (balancier) begins to hit the drop screw. This escapement (let-off) event for a grand piano action is described well in the Background section of U.S. Pat. No. 5,911,167, with reference to FIGS. 1, 2 and 3 of said patent. As the key descends further, the jack is urged strongly to rotate clockwise (i.e., top of jack towards the keys), but some amount of bending stress and deflection also occurs, with storage of elastic potential energy. If the key continues sufficiently downward, the jack will eventually rotate clockwise far enough so that the top of the jack "trips" out from beneath the knuckle. At that point, the friction between the top of the jack and the knuckle (or hammer butt in an upright piano) can no longer contain this potential energy. Aside from the potential energy, the position of the jack relative to the knuckle becomes less and less conducive to continued contact between the two. The combination of built-up stress and nonconducive geometry causes the "tripping" of the jack. It will be shown herein how these events can be "seen at the finger" during a downstroke, where the "finger" is the well-controlled, force-sensing Contact of the machine. As will be seen herein, a tremendous amount of extremely repeatable force and displacement data is obtained from such a well-controlled Run.

The point in space and/or time where either (a) the jack first contacts the let-off button during a downstroke, or (b) the repetition lever first contacts the drop screw during a downstroke, will be referred to herein as the Let-Off Start Point of a piano key mechanism. It may also refer herein to the point in the resulting force data that corresponds to either of these actual events. The region of a piano key mechanism's stroke between the key's "at rest" position and the Let-Off Start Point will be known herein as the "pre let-off region" of a piano key's stroke. The Jack Trip Point is defined herein as the point in space and/or time, during the downward keystroke of a key action, where the jack ends direct contact with the hammer knuckle (in the case of a grand piano), or with the hammer butt (in the case of a vertical piano). It generally occurs at a point fairly close to where the key begins to "bottom out" on the Front Punching. The Jack Trip Point may also be referring herein to the point in the resulting force data that corresponds to this "tripping out" event. The region of a piano key action's stroke between the Let-Off Start Point and the Jack Trip Point will be referred to herein as the "let-off region" of the piano action's stroke.

For the region of interest (before let-off), and for the A.P. chosen for the Run, the Average Down Force (ADF) defined by U.S. Pat. No. 8,049,090 accurately represents the average force required to depress the key from one position to another, at a constant speed. Similarly, the Average Up Force (AUF) described in U.S. Pat. No. 8,049,090 accurately expresses the average force acting upwards at the Application Point (AP)—against a Contact—while the key is allowed to ascend, with the AP moving against the Contact at constant speed, from one position to another (both positions being in the "pre let-off" region).

Certain embodiments of the invention herein describe other calculations and manipulations that can be done with "continuous" key force data resulting from constant-speed downstrokes and upstrokes, where those forces correspond to points in the "pre let-off region" of the key's stroke. If points "a" and "b" represent two separate points (in time and/or space) of an essentially constant-speed downstroke, then a "best fit" line through the force data points measured between "a" and "b" can be determined using "linear regression" methods known to those skilled in the art. Similarly, if points "c" and "d" represent two separate points (in time and/or space) of an essentially constant-speed upstroke, then a "best fit" line through the force data points measured between "c" and "d" can also be determined. These "best fit" lines can be done either on the force vs. time graph, or on the force vs. displacement graph. If the former, then each entire line can be "transposed" to the displacement domain in the same way as individual data points can be. This will be explained in more detail shortly. Now assume that points "a" and "b"—and all points between—are within the "pre let-off" region of the keystroke. Assume also that points "c" and "d"—and all points between—are also within the "pre let-off" region of the keystroke. Once the "best fit" lines exist in the displacement domain, they conveniently and quantitatively represent the continuous Down Force, and the continuous Up Force, as a function of key or contact displacement. The general form of the equation for the Down Force function in the displacement domain is:

$$F=m_{DF}\cdot x+b_{DF} \quad \text{(Equ. 1)}$$

The general form of the Up Force equation is:

$$F=m_{UF}\cdot x+b_{UF} \quad \text{(Equ. 2)}$$

where in both cases "x" represents displacement, the coefficient of the "x" term represents the slope, while the constant term is the "y-intercept". The slope of the Down Force function will be called herein the Down Force Slope ($m_{DF}$), while the slope of the Up Force function will be called the Up Force Slope ($m_{UF}$). The "y-intercept" of the Down Force and Up Force functions will be called herein the Down Force Intercept ($b_{DF}$) and Up Force Intercept ($b_{UF}$), respectively.

While the methods disclosed in U.S. Pat. No. 8,049,090 resulted in continuous Down Force and Up Force data, as a function of key displacement or time, that data could say little about how the force changes during the stroke. Based on the teaching of U.S. Pat. No. 8,049,090, the only way of discerning these sort of changes would entail either: (a) visual examination of the data, resulting in very subjective and nonquantitative determination of how the forces vary along the stroke, or (b) performing the force-averaging to obtain ADF or AUF over several small subintervals of the stroke, and comparing the various values. Neither of these options are very good or accurate, and don't share the characteristics of both convenience and usefulness, when it comes to quantifying how the Down Force and Up Force (and therefore the Balance Force and Frictional Force) vary along the stroke.

With these two "best fit" equations (for the Down Force and Up Force) created in (or transposed to) the displacement domain, one can also obtain a continuous and linear Balance Force function. The resulting linear equation expresses the continuous Balance Force as a function of key or Contact displacement. The equation is found by adding the equations for the DF and UF (equations 1 and 2), and dividing by two. This results in:

$$\text{Balance Force} = \frac{(m_{DF}+m_{UF})(x)+(b_{DF}+b_{UF})}{2} \quad \text{Equ. 3}$$

where "x" represents the displacement. With this equation/line, one can see how the key force due to all non-frictional components would vary across some portion of a non-accelerating keystroke if no friction were present in the system. These "non-frictional" components, as mentioned before, include those due to gravity/leverage, springs, and magnets, if the latter two exist. Friction has been totally removed from the picture. It should be noted that this Balance Force line bisects the region between the Down Force line and Up Force line. At any given displacement, it's ordinate is exactly halfway between the two. A convenient and useful new parameter is the slope of the Balance Force function, which alone indicates how much the Balance Force changes as the keystroke progresses. It will be referred to as the Balance Force Slope, and from the Balance Force equation it is seen to be:

$$\text{Balance Force Slope} = \frac{(m_{DF}+m_{UF})}{2} \quad \text{Equ. 4}$$

Another way of obtaining the Balance Force line is to first obtain the "raw" Balance Force plot, directly from the "raw" (but synchronized and transposed) Down Force and Up Force curves (not from their best fit lines). For each displacement, one would add the measured Down Force to the measured Up Force, and divide by two. That is, for each displacement, one averages the DF and UF at that displacement. Doing this for many displacements, and plotting or tabulating the results, one obtains a continuous plot of Balance Force versus displacement. One can then obtain the Balance Force Line by calculating a "best fit" line through the Balance Force data.

With the Down Force and Up Force linear functions determined, they can also be used to define yet another linear continuous function: the "frictional force" function. At any given displacement on the graph (i.e., the "horizontal axis") in the "pre let-off" region, the friction is exactly half the distance between the Down Force and the Up Force at that displacement. So in general, once the linear equations of both the Down Force and Up Force functions have been determined, a "Frictional Force" equation (also linear) is easily found from the two. The linear equation for this continuous "frictional force" is:

$$F_{fric} = \frac{(m_{DF} - m_{UF})(x) + (b_{DF} - b_{UF})}{2} \quad \text{Equ. 5}$$

and is found by subtracting the Up Force equation from the Down Force equation, and dividing by two. The slope of this linear "Frictional Force" equation will be referred to herein as the Frictional Slope, and is an important new parameter as well. Its equation is simply:

$$\text{Frictional Slope} = \frac{(m_{DF} - m_{UF})}{2} \quad \text{Equ. 6}$$

It represents exactly how much the key action's frictional force (as seen at the AP of the key) changes for every additional unit of key displacement at the AP, in the region prior to let-off Another way of obtaining the Frictional Force line is to first obtain the "raw" Frictional Force plot, directly from the "raw" (but synchronized and transposed) Down Force and Up Force curves (not from their best fit lines). For each displacement, one would subtract the measured Up Force from the measured Down Force, and divide by two. Doing this for many displacements, and plotting or tabulating the results, one obtains a continuous plot of Frictional Force versus displacement. One can then obtain the Frictional Force Line by calculating a "best fit" line through the Frictional Force data. Both Balance Force and Frictional Force are referred to herein as "indirect" forces, as they are not measured directly, but rather are calculated from the measured Down Forces and Up Forces.

Note that when determining a "best fit" curve to represent the continuous Down Force and continuous Up Force functions, one could also use a nonlinear curve. The data appears, however, to generally fit a line better, and the various parameters emanating from this operation are much easier to calculate and work with when the equations are linear. Parameters such as Balance Force Slope and Frictional Slope would have much more complicated "equivalents" if the "best fit" DF and UF equations were, say, quadratic, cubic or logarithmic.

In defining the concepts of Down Force and Up Force (both continuous and average), care was taken in U.S. Pat. No. 8,049,090 to make them correspond as much as possible to the assumed intent and definition of the traditional Down Weight and Up Weight parameters. In keeping with this, it should be noted that Up Force should be measured on an upstroke that was not preceded by entry into the let-off region during the preceding downstroke. If the jack is even partially tripped during part of the upstroke, the force values will be very different for much of the subsequent upstroke. This is due to the "resetting" of the jack back under the knuckle. These stipulations work out very well, since the traditional Up Weight measurement always begins from a position where the jack is in its "normal" position, under the knuckle.

Figure 12A:
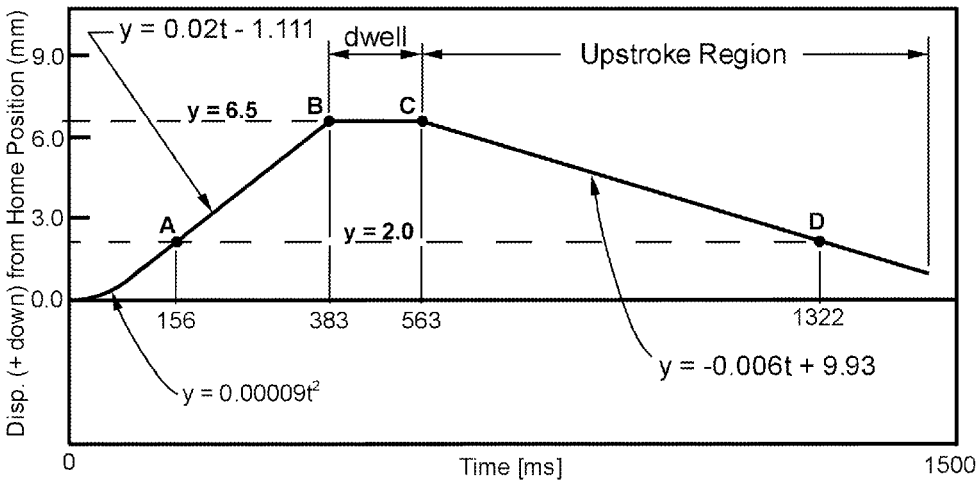
FIG. 12(*a*) shows the displacement vs. time profile (Motion Profile) used during a run for measuring Down Forces and Up Forces on an actual piano action.
Figure 12B:
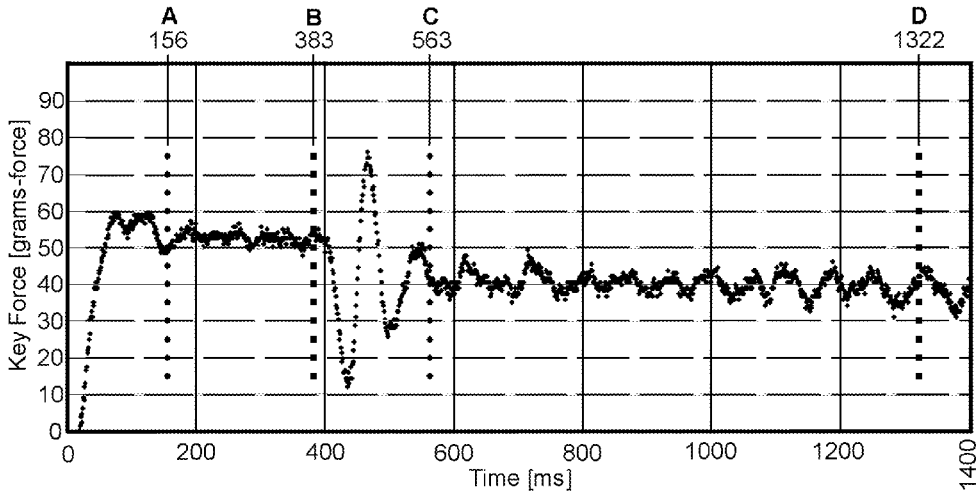

Demonstration of Force Equations being Determined, and Parameters being Calculated, from Measurements on an Actual Piano An example of these embodiments being implemented on an actual piano key action now follows. The Contact was made to follow a Motion Profile. The zero reference for the Motion Profile displacement corresponds (in this example) to the top of the key, in its "at rest" (i.e. top) position. In other words, the Run began from a Key Adjacent State, causing the Contact displacement to correspond exactly with the key displacement during the Run. The Motion Profile used for this example is shown in FIG. 12(*a*), where "positive y" is in the downward direction on the piano key action, and y=0 corresponds to the top surface of the "at rest" (i.e. non-depressed) key. Note that this profile is designed to move the key down and then back up. Between the "down" and the "up" movements is a short "dwell" period, designed to make sure nothing (in particular the hammer) is still moving or vibrating when the upstroke begins. The entire range of movement is within the "pre let-off region" of the stroke (i.e., short of the Let-Off Start Point). The Contact follows the linear equation y=0.02t−1.111 during the downstroke (after a very short parabolic section as shown). The upstroke follows the "slower" linear curve y=−0.006t+9.93. The damper lever was disengaged fully. The resulting contact forces between the Contact and the top of the key were measured at many points during these movements, and are shown versus time in FIG. 12 (*b*). These forces were measured, via a DAQ (data acquisition device) and force transducer connected to the Contact, every 1 millisecond.

The pertinent average forces are now calculated, based on the teaching of U.S. Pat. No. 8,049,090. In FIG. 12 (*a*), Point A, where the "force averaging" process for DF begins, is when y=2 mm and t=156 ms. The constant speed is maintained until point B, where the motion stops temporarily. Point B is also where the "force averaging" for the downstroke ends in this example. As seen in FIG. 12 (*a*), point B corresponds to t=383 ms and y=6.5 mm. The upstroke begins at time 563 ms (point C on graph), and continues until y is approximately 1 mm. The point in this upstroke where y=2 mm is shown as point D. The time here is 1322 ms, as shown, and represents the end of the "force averaging" for the upstroke. Point C is the beginning of the "force averaging" for the upstroke, in this example. The resulting ADF—the average Down Force between y=2 and y=6.5 mm—was found to be 52.3 grams. Numerical integration was used to calculate the AUF, with a=563 ms, and b=1322 ms. This resulted in an Average Up Force (AUF) between "y=6.5" and "y=2" of 40.0 grams. The average friction, AF, is thus found to be (52.3−40.0)/2, which is 6.1 grams. This is a fairly typical value for a piano key action. And of course, the Average Balance Force (i.e., ABF) (between 2 mm and 6.5 mm displacement) is found to be (52.3+40.0)/2, which is 46.2 grams.

Figure 13:
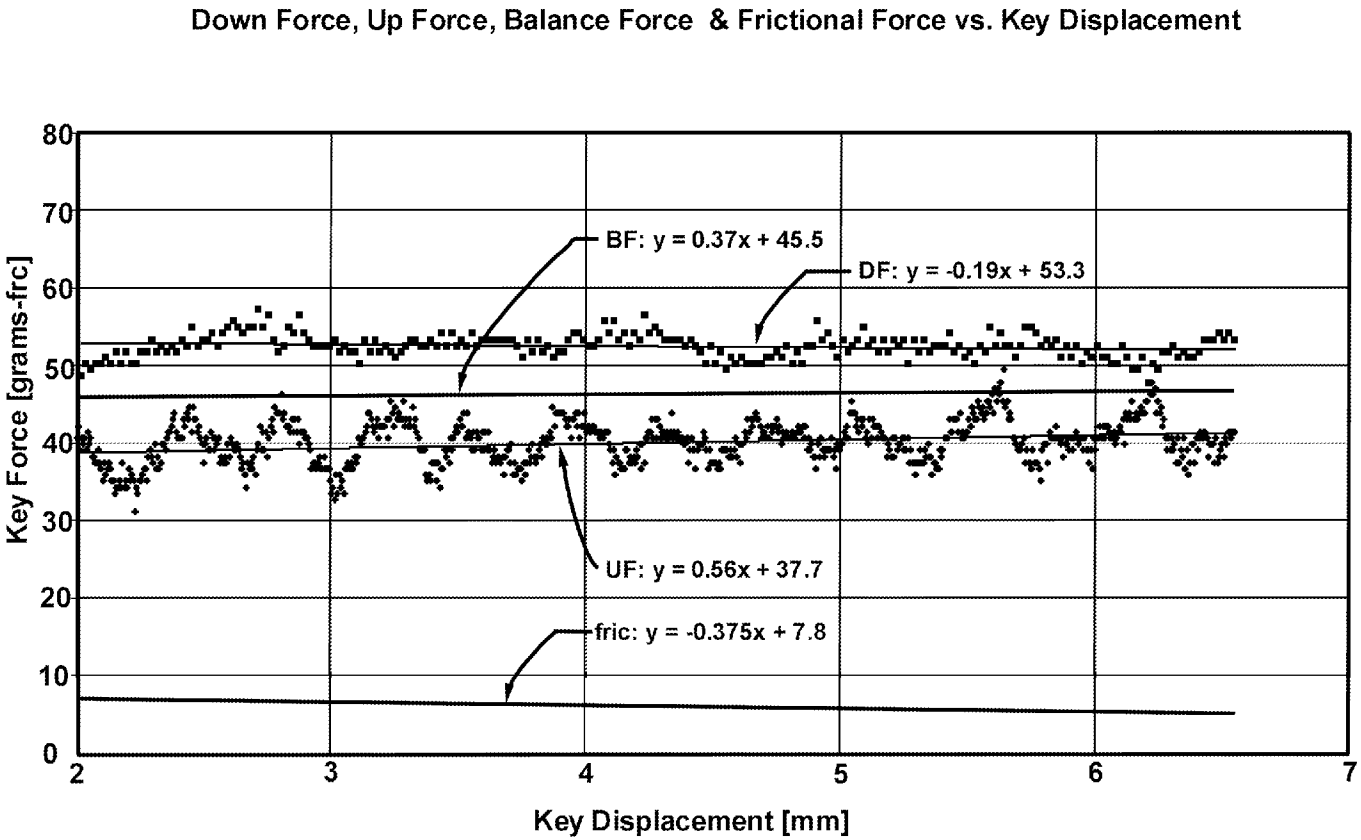
FIG. 13 is a graph of Down Force, Up Force, Balance Force and Frictional Force, all superposed together versus displacement, for the run of FIG. 12(*b*).

The force graph of FIG. 12 (*b*) is an example of a "synchronized force vs. time" graph (explained in the next two sections). This simply means that the "time zero" of the Motion Profile is clearly indicated in FIG. 12 (*b*). In fact, this "time zero" is actually at the origin of the graph in FIG. 12 (*b*). Thus, all forces are known as a function of time from the actual "time zero" of the Motion Profile. As long as the forces are synchronized, one can then graph both the downstroke forces and the upstroke forces as a function of Contact (or key) displacement. The example of FIG. 12 will be used to demonstrate this process, which will be referred to as Force Transposition. From the Motion Profile of FIG. 12 (*a*), one knows which portions of time correspond to the downstroke and which correspond to the upstroke. Furthermore, one would have already decided upon the "integration limits". For this example, the integration limits were chosen to be y=2 and y=6.5, for both the upstroke and the downstroke. Points "A" and "D" were already said to represent "y=2 mm" on the downstroke and upstroke, respectively. Similarly, points "B" and "C" were said to represent "y=6.5 mm" on the downstroke and upstroke respectively. So in FIG. 12(*b*), for the downstroke region, one simply pairs the force value of every data point between t=156 ms and t=383 ms (i.e., points A and B) with the corresponding displacement, using the "y=0.02t−1.111" equation of the downstroke. And for the upstroke, one simply pairs the force value of every data point between t=563 and t=1322 (i.e., points C and D) with the corresponding displacement, using the "y=−0.006t+9.93" equation of the upstroke. Obviously this is very easy to do with standard spreadsheet functionality. If Column A lists the forces, and Column B lists the synchronized times, then Column C can calculate the corresponding displacements, using the time values in Column B with the appropriate motion equation. A graph of Column A vs. Column B gives the type of graph shown in FIG. 12(*b*), while a graph of Column A vs. Column C gives a Force vs. Displacement graph like FIG. 13. FIG. 13 is the result of transposing the forces of the example of FIG. 12.

The act of "converting" one or more force data points from its "synchronized" time domain to its proper displacement domain, as was just described above, is herein called Force Transposition. As each force data point in the downstroke region of FIG. 12(*b*) was "transposed" in this way, it created a corresponding point in the displacement domain, as shown in FIG. 13. The combination of all these transposed points for the downstroke region results in an upper tier of points in FIG. 13. Similarly, the combination of all transposed points for the upstroke region results in a lower tier of points in FIG. 13. In the example of FIG. 12/13, traditional "least squares/best fit" methods yielded an equation for the Down Force function of: F=−0.19x+53.3, where "x" represents the displacement. The equation for the Up Force function was similarly found to be F=0.56x+37.7. Both of these lines are plotted in FIG. 13. Based on the general equations for Down Force and Up Force described earlier (equations 1 and 2), the Down Force Slope ($m_{DF}$) is thus equal to −0.19 [g/mm], and the Down Force Intercept ($b_{DF}$) is 53.3 grams, for this example. Similarly, the Up Force Slope ($m_{UF}$) is 0.56 [g/mm], while the Up Force Intercept ($b_{UF}$) must be 37.7 grams.

Using Equation 3, the continuous Balance Force function is:

$$\text{Balance Force} = \frac{(-.19 + .56)(x) + (53.3 + 37.7)}{2} = 0.37x + 45.5$$

The Balance Force line is also shown on FIG. 13. One can see visually that the BF increases very slightly with increasing key displacement. Of course, the parameter that specifies this characteristic exactly is the Balance Force Slope from Equ. 4. It is the coefficient of the above equation: 0.37 [grams/mm]. The continuous Frictional Force equation is then given by Equ. 5:

$$F_{fric} = \frac{(-.19 - .56)(x) + (53.3 - 37.7)}{2} = -0.375x + 7.8$$

One can now plug in various values of key displacement into this equation, obtaining the "local" or "instantaneous" friction at that point in the stroke. For "x" (displacement) equal to 2 mm, $F_{fric}$ equals 7 grams; for "x" equal to 6.5 mm, $F_{fric}$=5.4 grams. So for this piano key, there is not a lot of frictional change across the "pre-let-off" stroke. Some piano keys show significantly more change. It is also quite helpful to plot this equation on the same graph with the others, as shown in FIG. 13, giving an immediate visual indication of what the friction is doing at any point in the stroke. As Equ. 6 indicates, the coefficient of the equation for $F_{fric}$ is the Frictional Slope. Thus, for this key, the Frictional Slope is −0.375 [grams/mm]. This parameter reveals immediately and quantitatively how the frictional force changes across the "pre let-off" keystroke.

Determination of the "best fit" Down Force or Up Force line provides yet another way of performing Force Averaging. For a downstroke between two points A and B, if one obtains the Down Force line in the displacement domain, the Average Down Force (ADF) between points A and B is equal to the force at the centroid of this line. That is, if $y_A$ and $y_B$ are the displacements at A and B, then plugging $(y_A+y_B)/2$ into the linear DF equation results in the ADF for that region. Similarly, for an upstroke between two points C and D, if one obtains the Up Force line in the displacement domain, the Average Up Force (AUF) between points C and D is equal to the force at the centroid of this line. That is, if $y_c$ and $y_D$ are the displacements at C and D, then plugging $(y_C+y_D)/2$ into the linear UF equation results in the AUF for that region.

Note that in this example, the Force Transposition was done first, with the "best fit" calculation done in the displacement domain. It is equally valid to calculate "best fit" equations for both the downstroke region and the upstroke region, while still in the time domain. Then, each resulting line would have its points transposed to the displacement domain, in essentially the same manner already described for individual force data points. If that were done in this example, then FIG. 12 (*b*) would preferably show two linear curves with their corresponding equations (in terms of time) nearby. After these two lines were "force transposed" (still using the downstroke and upstroke equations of the Motion Profile), the end result of FIG. 13 would be the same.

Figure 14:
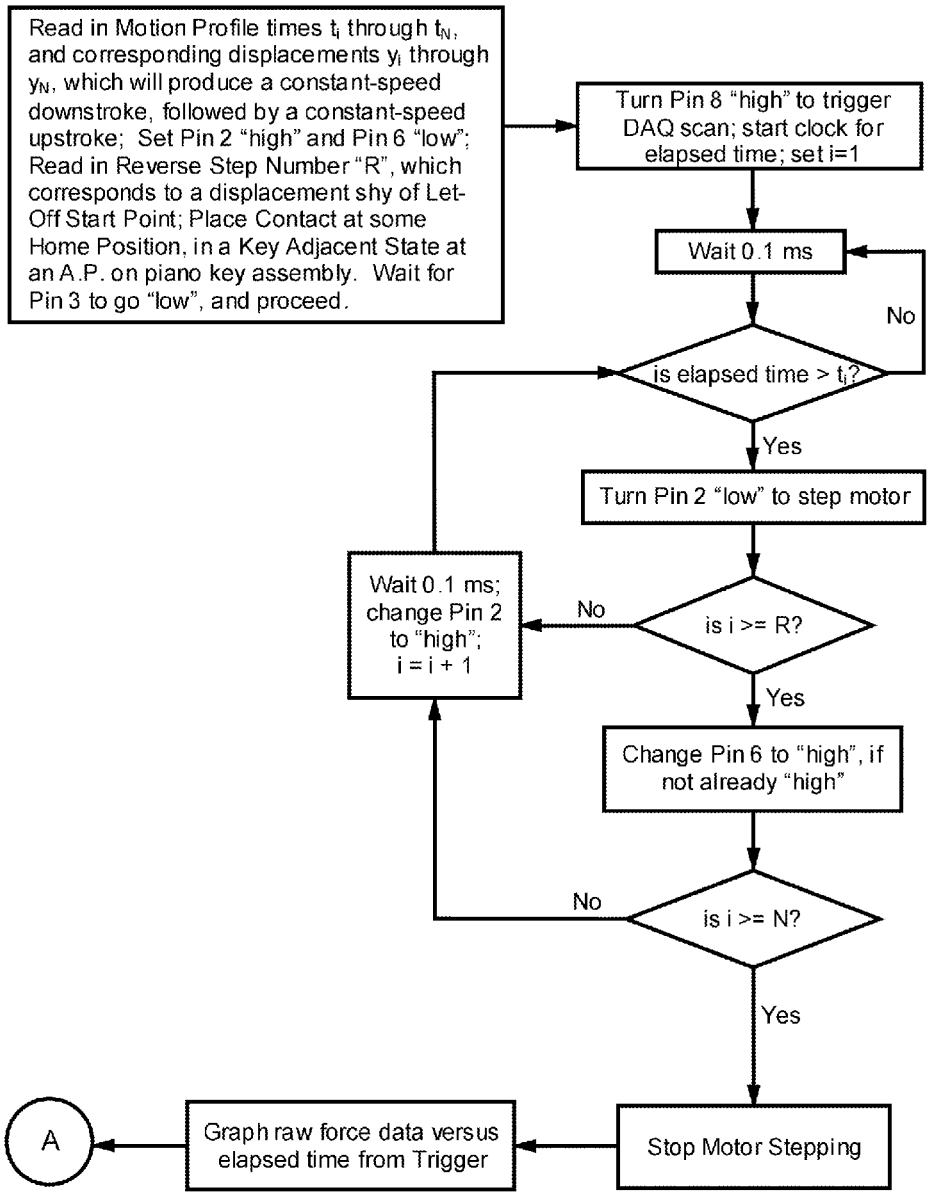
FIG. 14 and FIG. 15 show a flowchart for performing a constant-speed "down and up" Run, and subsequent calculations of various average forces, graphing of continuous forces, and determination of best-fit parameters for Down Force, Up Force, Balance Force and Friction.
Figure 15:
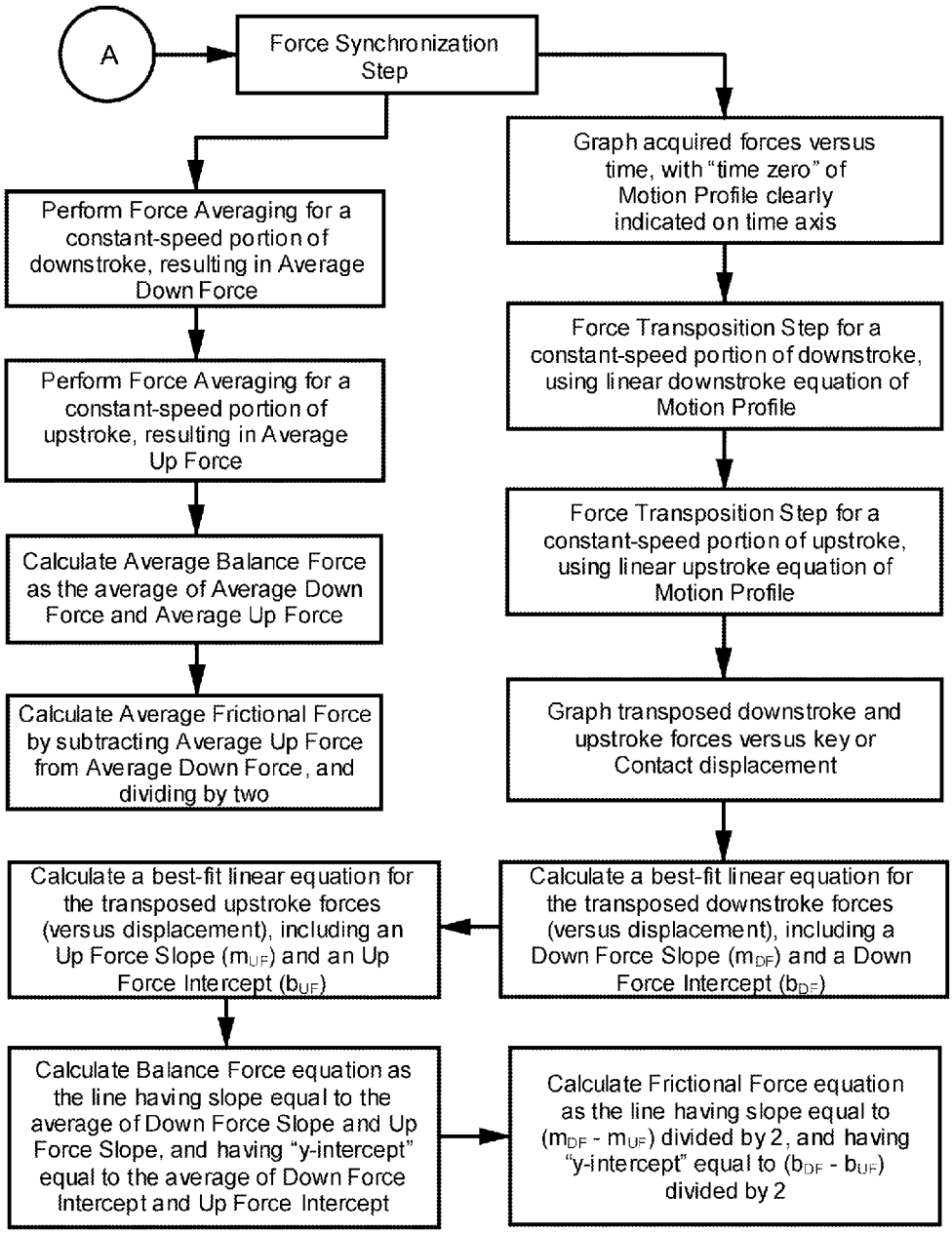
Figure 25:
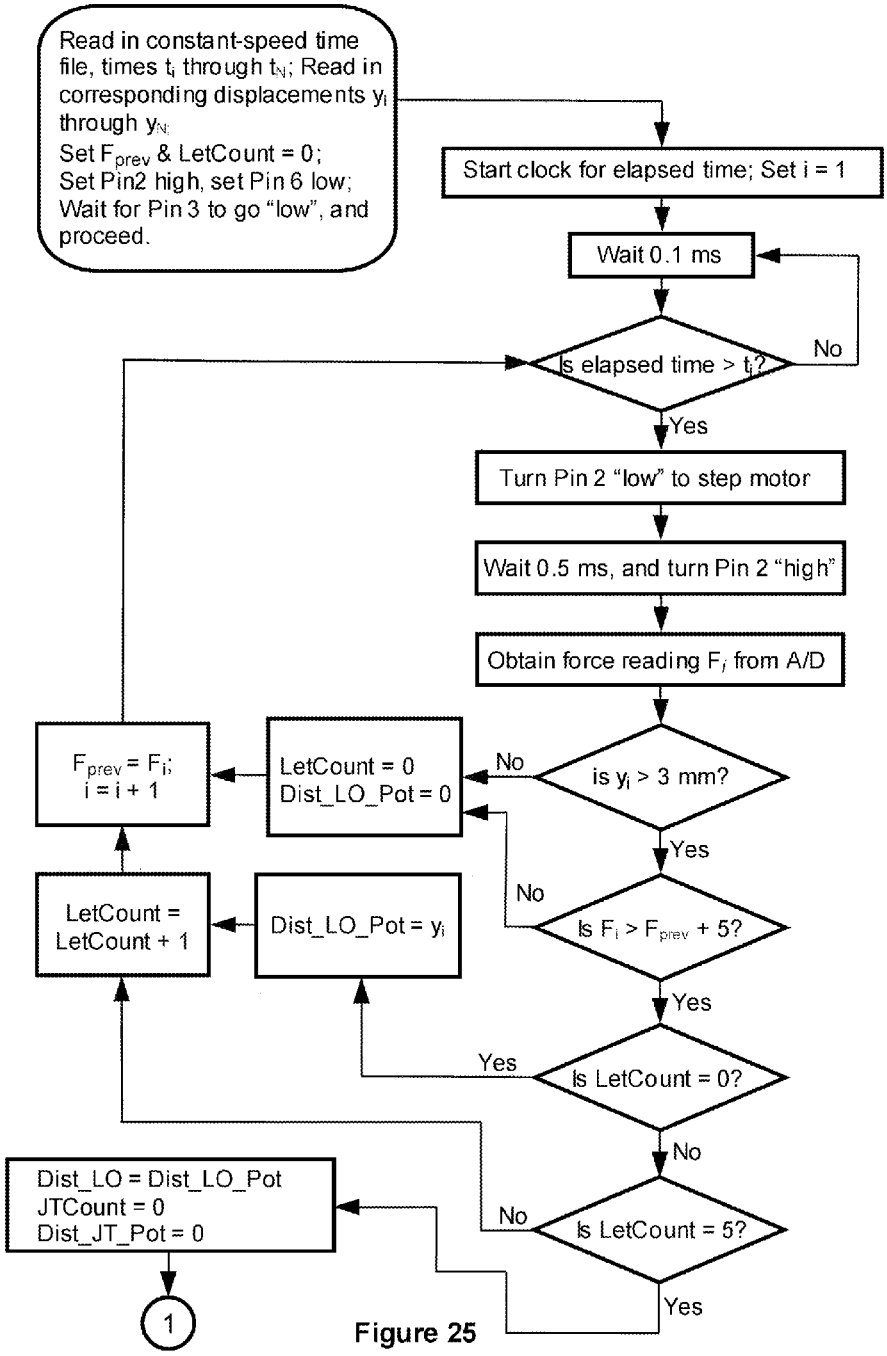
FIG. 25 and FIG. 26 show a flowchart for performing a downward Run, followed by various calculations for obtaining let-off start and jack trip points, and corresponding displacements.

The flowchart of FIGS. 14 and 15 details a constant-speed "down and up" run similar to that of the example above, and similar to FIG. 25 of U.S. Pat. No. 8,049,090. However, additional "post processing" steps are shown in the flowchart, including those required to determine some of the new "static" force parameters disclosed in embodiments herein. Normally such a Run begins in a Key Adjacent State, and the "reverse point" corresponds to a displacement safely short of the Let-Off Start Point.

C. Acquiring Forces: Scanning Vs. Displacement-Based Acquisition

In the embodiments described in U.S. Pat. No. 8,049,090, the DAQ can acquire the force data in two different ways. One way is what will be referred to herein as "Scanning Acquisition". This is where the force at the Contact is sampled in a manner independent of the motion or position of the Motor and Contact. This might involve the DAQ sampling either at some predetermined rate or pattern (say, 1000 samples/second). The motor would be simultaneously going about its own business of moving in a manner that causes the Contact to follow the Motion Profile. The points in time where force data is taken are essentially independent of the motion of the motor and Contact. The other way of acquiring force data (acting on the Contact) is what will be referred to herein as Displacement-Based Acquisition. This is the type of data acquisition wherein the DAQ takes a force reading only at certain predetermined points in the displacement of the Contact. These force readings can thus be acted upon (if desired) by the controlling program, during the Run itself. If a stepper motor is being used, a convenient embodiment for this type of data acquisition would have the DAQ take a force reading every time the motor takes a step (or possibly, a little before or a little after each step). In fact, the readings could be taken every few steps, every step, or some combination thereof. The distinguishing characteristic of Displacement-Based Acquisition is that the force readings are taken at points in time where the Contact displacement (relative to the Contact's Home Position for that Run) is already known. Non-stepping types of motors could also be employed, as long as there is sufficient feedback to know the position of the motor (and thus the Contact) at all times.

D. More about Scanning Acquisition, and the Concept of Force Synchronization

For a Run made using Displacement-Based Acquisition, one knows ahead of time what displacement corresponds to each force data point. By the very nature of the process, everything is already "synchronized". The acquired forces are each known as a function of both elapsed time along the Motion Profile, and the displacement of the Contact relative to its Home Position. With Runs made using Scanning Acquisition, however, unless certain things are known or assumed correctly, one does not immediately know which force data point corresponds to which time (and thus displacement) of the Motion Profile. For these types of Runs, a process herein called Force Synchronization maps the "time zero" point of the Motion Profile to the proper corresponding point (herein called TZ) on the raw Force vs. Time graph. Point TZ is the actual "time zero" point for the Motion Profile, but shown in its proper place on the raw Force vs. Time graph. The data points to the left of point TZ can then be removed if desired. If the points are removed, then "time zero" on the Synchronized Force-Time graph corresponds exactly to the Motion Profile "time zero". That is, point TZ is actually located at the time value of zero on the Synchronized Force-Time graph. Alternatively, point TZ can simply be left at its mapped and proper location on the raw Force vs. Time graph. But in that case, it is known and understood that "time zero" of the Motion Profile corresponds to this point (TZ), and not to the actual origin of the time axis. In either case, the result is said to be a Synchronized Force-Time graph. That is, a Synchronized Force-Time Graph has its forces "synchronized" with the Motion Profile times. In essence, this synchronization allows each force data point to be known as a function of the Contact displacement. The process of "transposing" force data points from the time domain to the displacement domain has already been referred to herein as Force Transposition. Force Transposition can only be done with a Synchronized Force-Time Graph. As will be shown, either additional assumptions must be made (along with simple arithmetic operations)—or additional processing of the force data must be done—to arrive at a Synchronized Force-Time Graph from a Scanning Acquisition Run. Any method—which has as its result the synchronizing of a Scanning Acquisition Run's sampled forces to their corresponding locations on the Motion Profile used for that Run—is herein called a Force Synchronization Step.

A Force vs. Time graph, resulting from a Run in these embodiments, that is not synchronized will be referred to as a raw Force Graph, or a raw Force vs. Time graph (or raw Force data). Unless or until such a graph is further processed, its first data point will simply correspond to the exact start point of the DAQ scanning And there is no "marker" (i.e., no point TZ) that reveals which subsequent point/time corresponds to the actual "time zero" of the Motion Profile.

i) Force Synchronization when PTD is Known

In general, when employing Scanning Acquisition, one would want to have the DAQ begin taking force readings (i.e., sampling or scanning) for a Run well before the Motor/Contact begins to move. When employing Scanning Acquisition, the delay between the Trigger and the "time zero" of the theoretical Motion Profile will herein be called the Post Trigger Delay (PTD). In general, this delay is programmed right into the controlling program. It will be assumed that there is a negligible delay between the time the DAQ receives the trigger (generally, a signal sent by the Controlling Program to start data acquisition) and the time it begins sampling forces. As long as one knows what the PTD is, for a given Scanning Acquisition Run, then one knows that the "time zero" of the theoretical Motion Profile begins exactly PTD [ms] after the first raw force data point. That is, point "TZ" mentioned above would be located at time "PTD" on the raw force graph. Having this known "marker" turns that raw force data into a Synchronized Force-Time Graph. If, for example, the Controlling Program was written so that the Post-Trigger Delay (PTD) was 200 ms, then the first point in the raw force data would represent a point in time exactly 200 ms before "time zero" of the Motion Profile. And so, if the data was sampled every 1 ms, then one would know that the 201' data point is point TZ, and thus represents the point in time corresponding exactly to the "time zero" of the Motion Profile. Thus, as long as one knows the PTD for a given Run, and also knows that the Controlling Program and associated computer hardware does not allow that value to fluctuate appreciably, then the method just described is a fairly straightforward example of a Force Synchronization Step.

ii) Force Synchronization when PTD is Unknown or Unpredictable

If the PTD is found to vary unpredictably from Run to Run, then it cannot be used for Force Synchronization. The Force Synchronization Step is then a bit more complicated. In this situation, the raw force data is examined (preferably by computer program or spreadsheet) for some telltale signature of force data behavior that corresponds to some known corresponding point of the Motion Profile. In short, one must:

1) determine from the raw force data the "telltale" point that is known to correspond to some particular point of the Motion Profile, then
2) knowing the offset from "time zero" of the Motion Profile to this telltale point, move backward (or forward if applicable) through the force data by the exact number of data points corresponding to this "time offset"; then
3) designate the resulting data point (which is the appropriate number of points over) as "time zero" (i.e. point "TZ") of the force data.

Regarding step (1), the "telltale point" could correspond to all or part of a "force signature" created by any event or phenomenon that occurs at a repeatable and predictable point in the stroke of the motor or Contact. This "force signature" may be the result of an electromagnetic field or burst emitted by the motor or motor driver at some consistently-repeating point in its movement. Or it could be the result of another sensor, as discussed just below. This signal/spike would then be read by the DAQ as part of the force data. If the "telltale point" (for simplicity, could be the beginning of the force signature, but could also be any particular point of the force signature) of such a signal/spike can be determined ahead of time to always correspond to a certain point in the stroke of the motor, then it will always correspond to some known distance "D1" of the Contact from a given Home Position. And the particular Motion Profile being used then gives the exact time "T1" (relative to "time zero") associated with distance "D1". Assuming the spike/signal occurs after the "time zero", then after locating the "telltale point" of the signal/spike on the raw force graph, one moves to the left on the "time axis" by an amount "T1". The resulting point then represents the actual "time zero" point (of the Motion Profile), on the raw force graph. This is the point "TZ" discussed above, and the force graph has now become a Synchronized Force-Time Graph.

The "signal/spike" might emanate from the motor or motor driver in their purchased state, as "through the air" electromagnetic noise. Or it could also be an electrical signal from a sensor, which might be a sensor similar to the Position Sensor 72, which would send a short signal at some specific and consistent point in the stroke, relative to Home Position. If a blade rotating with the motor shaft, for example, passed by this sensor (similar to how the Position Sensor 72 and corresponding blade 71 interact), then one would have a short electrical signal at the same exact location—relative to any given Home Position—in every Run using that Home Position. This short signal could be "piped" into the force data being acquired (possibly through a diode), thus showing up on the raw force data so that "time zero" can be determined as described above.

E. Introducing Bottom-Out Force, the Bottom-Out Point, and Bottom-Out Displacement (BOD)

The Bottom-Out Displacement (BOD) represents the essentially vertical displacement between the Contact when at some Home Position and the Contact when it has depressed the key to the "bottom" of its keystroke. That is, the BOD represents how far that Contact can descend vertically before some given amount of "bottom-out force" (due to compression of the Front Punching) is encountered. The present author in U.S. Pat. No. 8,049,090 demonstrated a similar process, but where the net displacement from the "at rest" position of the key was determined. This led to the key dip of the keystroke. In the current embodiments, the displacement is more general, being relative to the Home Position of the downstroke. This Home Position may correspond to a Key Clear State, a Key Adjacent State, or even a Key Embed State.

Once the downward displacement of the key has reached the point where compression of the Front Punching is occurring, each additional downward movement of the key generally causes the compressive force to further increase. One could plot the reaction force acting between a downwardly-moving Contact and the key—as this compression is occurring—versus the Contact displacement (relative to some Home Position) at the AP (where displacement is in the essentially vertical direction, and positive downward). Unless the Front Punching is badly damaged or worn, this graph should always show higher forces with increasing displacements. Assume that force is graphed on the y-axis, and displacement or time is graphed on the x-axis. Such a graph would increase to the right—in some manner—as long as the downstroke is moving the key against the Front Punching. In determining Bottom-Out Displacement, these forces would first be transposed (if they are not already transposed forces) so that they are known as a function of Contact displacement.

As a downstroke progresses, there may be increases in force that are due to other, temporary events, such as let-off/escapement. A concept used in U.S. Pat. No. 8,049,090 to filter out such forces will be herein called a Compression Threshold Force (CTF). As a downstroke progresses, when a point is reached where this Compression Threshold Force is exceeded, it is called the "CTF point". One must determine if the forces corresponding to the CTF point—and all subsequent points in the downstroke—are in fact due to the key "bottoming out" against the Front Punching. The CTF would generally be chosen larger than the known or expected Down Force for the key. It should preferably be chosen so that only a rare strong let-off event may produce forces exceeding the CTF. As the downstroke continues beyond the CTF point, forces continue to be acquired. If these ongoing forces exhibit behavior indicating that they are generally and significantly increasing for a sufficient distance, then the forces corresponding to the CTF point—and all points beyond—are said to be due to compression of the Front Punching. The Bottom-Out Point is then defined as the point in this region that corresponds to some predetermined "bottom-out force". The displacement associated with this point is then said to be the Bottom-Out Displacement (BOD). The Bottom-Out Point may also refer to the actual point (in space or time) in the keystroke where the force first exceeds the Bottom-Out Force during a downstroke (and is also due to the Front Punching). The two definitions thus refer to the same event, but with one focused on the force data, the other on the actual keystroke. At any point in the "post CTF" region, one may also calculate stiffness values between any two of the points. This is done by dividing the difference in measured (and transposed) force by the difference in displacement/travel between the two points. This stiffness is very closely associated with the stiffness of the Front Punching itself. Many stiffness values may be calculated, as the force and displacement increases and the Front Punching is further compressed.

Various algorithms may be used to find the "bottom-out point", some of which were described in U.S. Pat. No. 8,049,090. Examples include:

- examining each acquired force of a downstroke (or every second, or every third, etc.) following the CTF Point until one exceeds some predetermined "closing force" value, with all intervening acquired forces having also exceeded their immediate (or near-immediate) predecessors by some minimum amount. If these conditions are met, then the "bottom-out" point is found from the given Bottom-Out Force. The distance from Home Position to this point is the BOD.
- examining each point following the CTF Point to determine if some minimum number of consecutive acquired points have forces that consistently exceed the force of their immediately preceding acquired point. If this condition is met, then the entire region of increasing forces is said to be due to Front Punching compression. The bottom-out point and BOD are then determined as was done above. This is an example of an algorithm employing a "force increase counter", instead of a "closing force".
- looking for "y" number of consecutive (or "every other" or "every third", etc.) force increases following the CTF Point, where each successive force increase exceeds some minimum value. If this condition is met, then the entire region of increasing forces is said to be due to Front Punching compression. The bottom-out point and BOD are then determined as was done above.

In practice, any of these examples of algorithms can be used—as could various combinations or permutations of them—to find the region where the Front Punching is being compressed by the key, during a controlled downstroke. Other mathematical algorithms may also be used, as long as they confirm a strong, increasing, and prolonged nature of "ever increasing" forces. The "closing force" mentioned in some of the examples above will be referred to herein as the Front Punching Termination Force (FPTF). Its chosen value has a big impact on how well the "mathematical confirmation" algorithm filters out regions not due to Front Punching compression.

As long as the Contact at Home Position is furthermore precisely located vertically (at any given key) with respect to the key bed, key frame, or important horizontal datum of the action, then the current embodiments allow for an active, kinetic means of performing key leveling of the depressed keys.

F. More about Determining the BOD, and Introducing TMBBO

The time required for the Contact to travel from Home Position to the Bottom-Out Point is herein referred to as the Time Moving Before Bottom-Out (TMBBO). It is relative to the true "time zero" of the Motion Profile. The Bottom-Out Point is located for a downstroke, based on the chosen Bottom-Out Force. For Runs employing Scanning Acquisition, either before or after the Bottom-Out Point is located, the forces are synchronized so that all resulting data points have their times known with respect to "time zero" of the Motion Profile. The time associated with the Bottom-Out Point (relative to "time zero") is TMBBO, by definition. And then from the Motion Profile that was used, one picks off the displacement associated with TMBBO, which is the BOD. This step is another example of Force Transposition. For Runs employing Displacement-Based Acquisition, the TMBBO is not necessary, since the displacement at every force data point is already inherently known.

i) Determining BOD while Employing Displacement-Based Acquisition

Displacement-based acquisition has the significant advantage of allowing for all the Front Punching compression necessary for determining these compression parameters, while also being able to stop the downward movement once the Bottom-Out Point has been found. For Runs employing Displacement-Based Acquisition, all of the acquired forces are already associated with displacements (as discussed elsewhere). So once a region corresponding to Front Punching compression is found, and the Bottom-Out Point located from the given Bottom-Out Force, the BOD is known.

Figure 16:
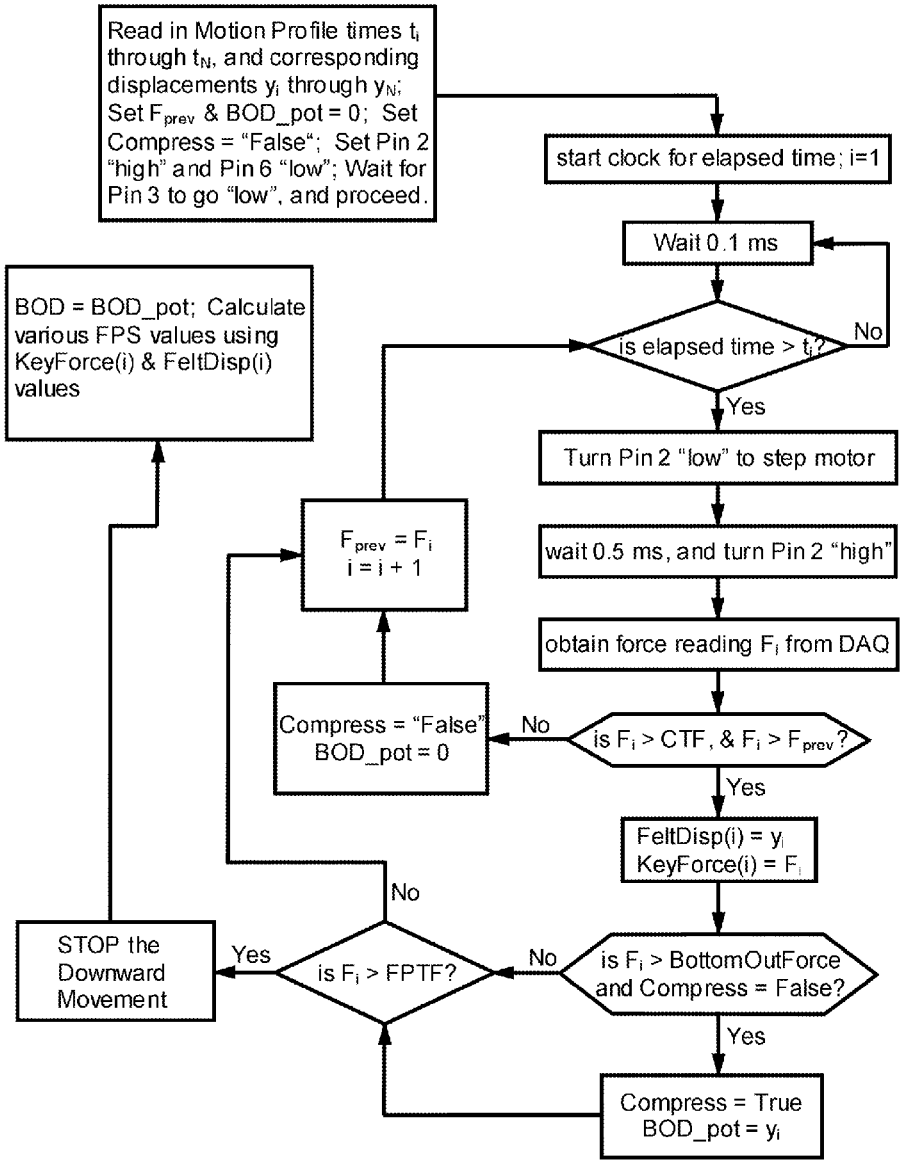
FIG. 16 is a flowchart detailing a downward Run for determining the Bottom-Out Point (and BOD) for a given Bottom-Out Force. Front Punching Stiffness values are also calculated per methods described herein. The Run utilizes Displacement-Based Acquisition.

The flowchart of FIG. 16 shows steps for a downward Run to: (1) find the Bottom-Out Point and the BOD for a given Bottom-Out Force, and (2) calculate various Front Punching Stiffness values from the resulting force data. Displacement-Based Acquisition is employed. In this example, the Compression Threshold Force is chosen to be less than the Bottom-Out Force. The Contact is initially at a Home Position corresponding to a Key Clear State, a Key Adjacent State, or a Key Embed State. Any upward force acting on the Contact is read shortly after each motor step, with the help of the load cell. The Contact is moved downwardly in the essentially-vertical direction, where it will eventually contact and begin moving the key. Movement continues, and as soon as the force exceeds CTF, all subsequent forces are checked to see if they are due to Front Punching compression. If they are, then they will increase continuously with all subsequent steps/displacements, until finally exceeding the FPTF. Before the FPTF is exceeded, the Bottom-Out Force will be exceeded. When the Bottom-Out Force is exceeded, the corresponding displacement is recorded as BOD_pot (potential BOD). When FPTF is finally exceeded—with all intervening forces having shown increases—the movement of the motor (and Contact) ceases, and the BOD is assigned to the displacement "BOD_pot". The "mathematical algorithm" employed here for confirming Front Punching compression is to simply ensure that all acquired forces beyond the CTF point increase relative to their predecessor, until finally reaching a value corresponding to the Front Punching Termination Force (FPTF).

Figure 17:
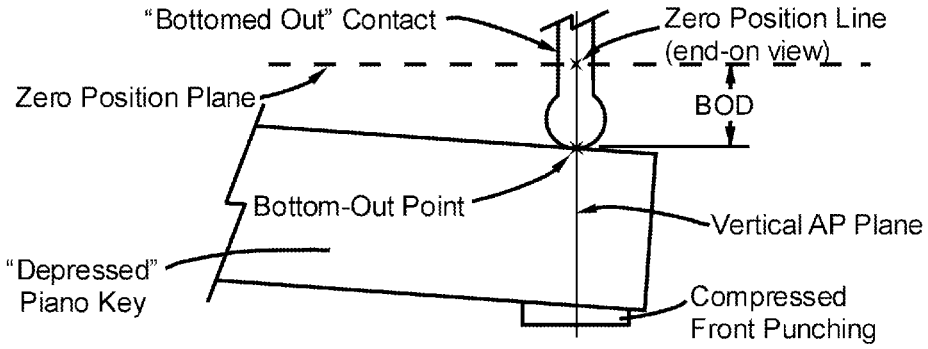
FIG. 17 (*a*) shows geometry at the Bottom-Out Point of a run for determining BOD.
Figure 17:
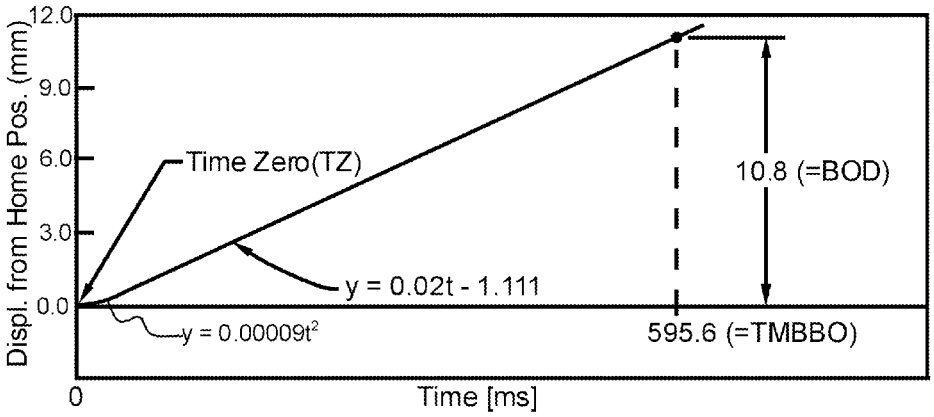
Figure 17:
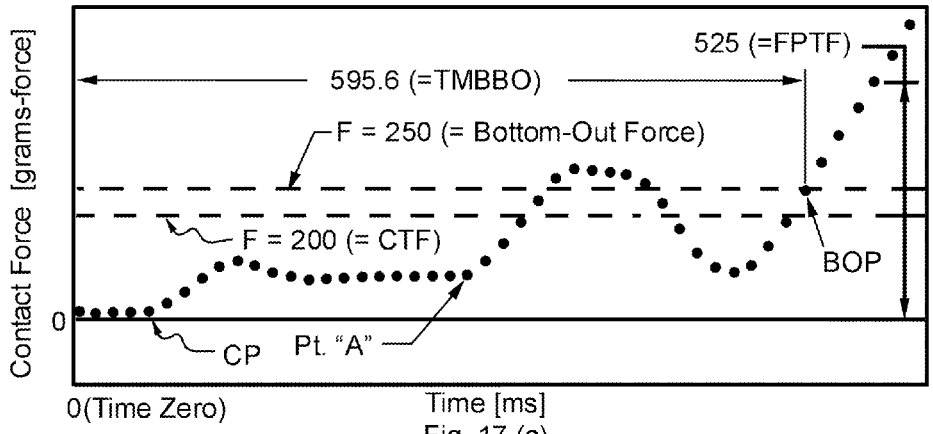

This process was performed on an actual piano key mechanism. The Contact began the Run in a Key Clear State. The Motion Profile employed is shown in FIG. 17 (*b*). The resulting forces measured during this Run are shown in FIG. 17 (*c*), all with respect to "time zero" of the Motion Profile (since Displacement-Based Acquisition runs are inherently synchronized). FIG. 17 (*a*) is a view looking from the left end of the keyboard, and shows the Contact at the exact moment it has reached the Bottom-Out Point for this key. The Zero Position Plane is shown for reference, along with the resulting distance BOD. The tip/apex of the Contact—when the Contact was in its Home Position—lay in the Zero Position Plane, which appears as a line in this side view. The values chosen for CTF and Bottom-Out Force were 200 grams-force and 250 grams-force, respectively. Note that the point where the Contact began to interact with the key is shown on the graph as point "CP". This point is defined in a subsequent section as the Mid-Run Key Collision Point. Notice how the force actually exceeded the CTF briefly, beginning at point "A". The algorithm quickly proved that point "A" was not due to compression of the Front Punching, allowing the Contact to continue past this "hump" until the true CTF point was found. The Bottom-Out Point (BOP in the figure) is then located, based on a given Bottom-Out Force. The displacement (BOD) corresponding to the Bottom-Out Point is 10.8 mm.

ii) Determining BOD while Employing Scanning Acquisition

Assume that for a given Bottom-Out Force, the Bottom-Out Point has been determined from measured forces of a downstroke Run. If Scanning Acquisition is employed, then Force Synchronization must be done on the raw force data, if it hasn't been already. Once the force graph has been synchronized, then the time (relative to "time zero"/TZ) to the Bottom-Out Point corresponds to TMBBO. As long as the Motion Profile is known, then as already explained, TMBBO corresponds to some unique displacement (the BOD), per the Motion Profile. Since Scanning Acquisition is being used, one must ensure beforehand that the Contact will descend far enough for "bottoming out" to occur. The calculations involved in verifying that compression of the Front Punching occurred could be done by the controlling program itself (upon completion of the Run), or could be done with a program/spreadsheet on a different computer entirely.

G. Kinetic, Collision-Based "at Rest" Key Leveling with a Well-Controlled, Force-Sensing Manipulator The present author, in U.S. Pat. No. 8,049,090, disclosed a method of finding the bottom of the keystroke with a kinetic, well-controlled, force-measuring manipulator. This allowed for positive determination of the actual "bottoming out" against the front punching. The author appeared to realize that reliance upon Passive Displacement gauges and height-measuring dial indicators limits the usefulness, repeatability, and throughput of a "key dip" measurement device. The methods described in U.S. Pat. No. 8,049,090 utilized both a well-controlled moving Contact, along with a means of continuously, simultaneously and accurately measuring forces acting upwardly on the moving Contact. In short, a "kinetic, well-controlled, force-sensing manipulator" for engaging each key over a large vertical range.

The present author has since discovered that such a well-controlled, force-sensing manipulator is actually capable of locating certain "collision" and/or "separation" events in a keystroke. Furthermore, it has been found that these events can be located and characterized very accurately and repeatably. One of these events is when the Contact actually impacts the "at rest" key from above. If the Contact begins a downward Run from a Key Clear State, with the vertical distance to the underlying "at rest" key unknown, then proper Contact movement, coupled with realtime or subsequent analysis of the synchronized force data, can yield the exact location of the "at rest" key, relative to the Contact's Home Position. The essentially vertical distance that the Contact travels, from its Home Position to the point where it begins to impact the "at rest" key, will be referred to herein as the Mid-Run Key Collision Displacement (MRKCD). It will be positive (+), as long as the Contact begins the Run in a Key Clear State. Furthermore, the point in time or space (or on the resulting force data) corresponding to the downwardly-moving Contact just starting to collide with the "at rest" key will be referred to herein as the Mid-Run Key Collision Point (MRKC Point). The downstroke can be very fast, and should move the Contact well below the lowest possible point where the "at rest" key may be encountered. The resulting force data can then be successfully analyzed for signs of the collision between the Contact and key. These contiguous force data points, which show a clear spike in force, fairly early in a downstroke that began with the Contact in a Key Clear State, will be referred to herein as a Mid-Run Key Collision String. The forces just before the Mid-Run Key Collision String will be fairly close to zero, as the Contact is not touching anything yet. Assuming the downstroke is not accelerating heavily, the string will end with the forces "falling back" to a value approximately equal to the expected Down Force. The MRKC Point is defined as the point (in time, space or on the force data) at or very near the beginning of the Mid-Run Key Collision String. This sort of force data string, which shows the "signature" of a collision and/or separation that occurs during—or shortly after—a downstroke or upstroke of the Contact, will be known herein as a Transitory Collision String.

This entire stroke, which might take only a fraction of a second, would be accompanied by continuous force measurement at the Contact. With proper placement of the machine relative to the piano action, the Contact's position—relative to the keyboard frame, key bed, or other datum associated with the action itself—would be fully known as a function of time. Whether or not "displacement-based acquisition" or "scanning acquisition" is employed, the measured/recorded forces would also be known as a function of the Contact displacement. So if the Contact begins a downstroke from a Home Position corresponding to a Key Clear State, the sudden presence of the "at rest" key can be detected and located precisely (via "collision signatures" received by the load cell) relative to the appropriate datum (or key bed, etc.). It should be noted that the subsequent upstroke for these movements can be extremely fast, taking the Contact quickly back to its Home Position. The Contact thus clears itself from the key automatically—and almost immediately—in preparation for moving the carriage on to the next key. No intervention on the part of the operator is needed to raise a probe, rod or piston, as is often the case with the more elaborate of the "passive displacement" gauge devices of the prior art. This—in addition to the other systemic and fundamental differences of the current invention's embodiments—makes for quicker and much less tedious work on the part of the technician. The time and tediousness required for measuring the "at rest" key locations is thus significantly reduced, as compared to prior art methods. If the sliding of the carriage between keys were automated (say, with the addition of a stationary lead screw, and a lead screw nut turned by a second motor on the carriage), all of the white keys could be measured in a matter of 15 minutes, while the technician is doing other work.

An inherent feature of this new method is actually "seeing" forces that occur when the downwardly-moving Contact begins to collide with and move the key. Aside from using these forces to determine the Mid-Run Key Collision Point, they can also shed light on potential "lost motion" or "play" in the mechanism. When a key action has such "lost motion", the main resistance of the action is not engaged until after the key moves by some significant amount. With the embodiments of the current invention, one will see in such cases the initial collision between Contact and key, and subsequently see a second, more drastic collision, corresponding to that lost motion having being taken up. Thus, the technician can learn not only that such "lost motion" exists on certain keys, but also get an idea of how much "lost motion" there is. In general, removing such "lost motion" should be done before key leveling is done. If it is not, however, the embodiments herein may still be able to give valid data with regards to key locations.

H. Zero Point, Zero Position Line, Zero Position Plane, and Desired Profiles Assume that a theoretical line is defined to pass through the bottom point/apex/tip of the Contact when it is at some specific Home Position. This point shall be called the "zero point" of the Contact/carriage. Then assume that this theoretical line is defined to also pass through the same "zero point" of the Contact (at the same Home Position) when it has translated to some significantly different location (key) along the keyboard. This translation, in the embodiments herein, is done by moving the carriage, which contains the Contact. If the machine is also oriented such that this line is parallel to the keybed or keyboard frame (or other action datum), and also in the Vertical AP Plane, then this theoretical line is said to be a Zero Position Line, which is fixed to the machine and to the keyboard frame, keybed, or action datum. So with the machine properly oriented, the Zero Position Line passes through the entire series of "zero points" that are created as the Contact moves laterally from key to same-colored key, while remaining parallel to the keybed, keyboard frame or relevant action datum. Thus, with the Contact above any particular key, the Zero Position Line passes through the "zero point" while also being parallel to the keybed/keyboard frame, and also remaining essentially in the Vertical AP Plane. The Zero Position Plane is then defined as the plane passing through the Zero Position Line, and also parallel to the key bed, key frame or important horizontal datum of the action itself. If Runs for determining the MRKC Point and MRKCD are then made on those same-colored keys, while maintaining the same Home Position for each Run, then one is determining—for each key—the distance from the Zero Position Plane to the top of the key. The machine is thus performing "at rest" key leveling measurements, but in an active, kinetic, and "hands free" manner. Similarly, if the Bottom-Out Point and BOD are also determined for each same-colored key (on the same or different Runs), one is determining—for each key—the distance from the Zero Position Plane to the Bottom-Out Point. The machine is thus performing "depressed" key leveling measurements, but in an active, kinetic, and "hands free" manner.

Depending on how the technician sets up the Zero Position Plane, he may want the "at rest" keys to be adjusted to positions other than those corresponding to the Zero Position Plane. This is where the Desired At-Rest Profile comes into play. The Desired At-Rest Profile specifies exactly—relative to the given Zero Position Plane—where the at-rest keys should preferably lie. For any given key, this desired point in space for the A.P. will be referred to herein as the MRKC_des point. The properly-signed vertical distance from the Zero Position Plane to the Desired At-Rest Profile (i.e. the "MRKC_des" point)—at any given key—will be referred to herein as "MRKCD_des". Another sign convention is established such that if the desired point "MRKC_des" for a given key is below the Zero Position Plane, then MRKCD_des is negative (−) in sign. If point "MRKC_des" for a given key is above the Zero Position Plane, then MRKCD_des is positive (+) in sign. Once determined, MRKCD_des is simply added to the MRKCD value, resulting in a "total differential" of "DY_AR" for that key. The equation for DY_AR is simply:

$$DY_AR = MRKCD + MRKCD_des \quad \text{Equ. 7a}$$

Thanks to the sign conventions for the measured and desired terms, a positive value for "DY_AR" means that the MRKC point (the A.P. of the "at rest" key) should be raised by that amount; a negative value means the MRKC point should be lowered by that amount. The goal for each key is to add/remove the exact amount of shimming to/from the balance rail to move the MRKC point by the amount "DY_AR", in the appropriate direction. If done properly, then the MRKC point will lie right on top of the "MRKC_des" point (as viewed horizontally, from the front of the keyboard). That is, it will lie right on the Desired At-Rest Profile.

The Desired Depressed Profile specifies exactly—relative to the given Zero Position Plane, and for a given "key color"—where the "depressed" keys (i.e., the Bottom-Out Points) should preferably lie. For any given key, this desired point in space for the depressed A.P. will be referred to herein as the "BO_des" point. The properly-signed vertical distance from the Zero Position Plane to the Desired Depressed Profile (i.e. the "BO_des" point)—at any given key—will be referred to herein as "BOD_des". Since the "BO_des" point for a given key will always be below the Zero Position Plane, the sign of BOD_des is always the same: negative (−). Once determined, BOD_des is simply added to the measured BOD value, resulting in a "differential" of "DY_Dep" for that key. The equation for DY_Dep is simply:

$$DY_Dep = BOD + BOD_des \quad \text{Equ. 7b}$$

A positive value for "DY_Dep" means that the measured Bottom-Out Point should be raised by that amount; a negative value means it should be lowered by that amount. The ultimate goal for each key is to add/remove the exact amount of shimming to/from the front rail to move the measured Bottom-Out Point by the amount "DY_Dep", in the appropriate direction. If done properly, then the new Bottom-Out Point will lie right on top of the "BO_des" point (as viewed from the front of the keyboard). That is, it will lie on the Desired Depressed Profile.

The Desired At-Rest Profile can simply be a horizontal line, with the equation "$y_{des}$=a", where "a" could be zero, or some positive or negative number. Sometimes it is chosen to be a "concave down" arc, due to some technicians preferring to level the keys with some "crown"—so that the middle region keys "start out" higher than the outer keys. In most cases, the Desired At-Rest Profile for the white keys is determined first. The Desired At-Rest Profile for the black keys is then obtained by translating the Desired At-Rest Profile for the white keys upwardly by some amount representing the desired height of the black keys above nearby white keys.

Figure 18:
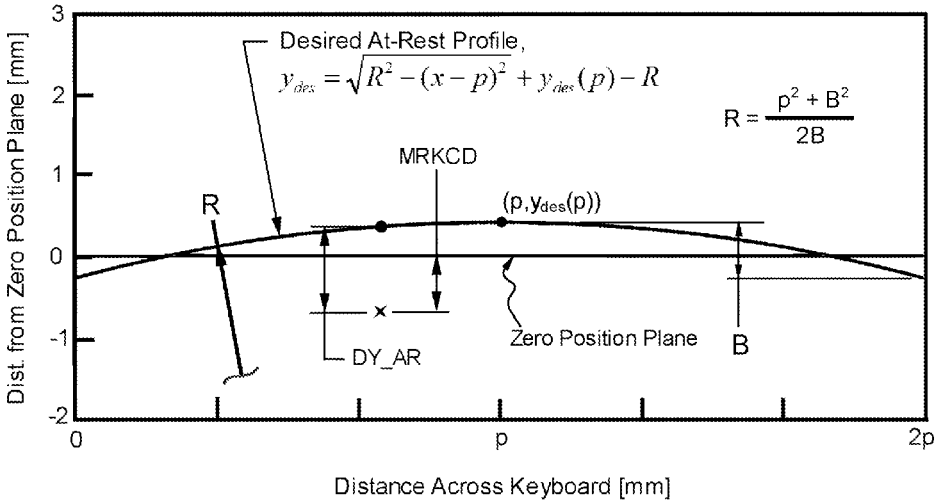
FIG. 18 shows a generic, inverted "arc-shaped" Desired At-Rest Profile plotted relative to a Zero Position Plane, along with the measured "at rest" AP of a typical key.

The case of the Desired At-Rest Profile being a "concave down" arc is now considered. The focus here will only be on the white keys. In general, the arc should be placed in the x-direction so that its apex/center is halfway between the AP of the leftmost white key (key 1) and the AP of the rightmost white key (key 88). Assume that the AP of the leftmost measured key is at x=0, and the AP of the rightmost white key is at x=2p. This puts the center/apex of the arc at x=p. Then, realizing that the y-value of the apex is simply equal to $y_{des}$(p), the equation for the Desired At-Rest Profile (i.e. $y_{des}$ as a function of x) is:

$$y_{des} = \sqrt{R^2 - (x-p)^2} + y_{des}(p) - R$$

where $y_{des}$(p) can be either (+) or (−) depending on where one places the theoretical arc relative to the Zero Position Plane (i.e. the x-axis). The general graph for this situation is shown in FIG. 18. All values should be in the same length units; normally either [mm] or inches. The value "R" is the radius of the theoretical arc, and it is easily found from two other geometric characteristics: 1) the overall height or "crown" of the arc, which will be referred to as "B", and 2) the horizontal distance between the two arc endpoints (e.g., between the AP's of the first and last white keys), which is simply "2p". The mathematical relationship is then simply:

$$R = \frac{(p^2 + B^2)}{2B}$$

Note that "p" is half the distance between the two endpoints of the arc. In this equation, if "p" and "B" are in inches, then R is in inches. If "p" and "B" are in [mm], then R is in [mm].

Figure 19:
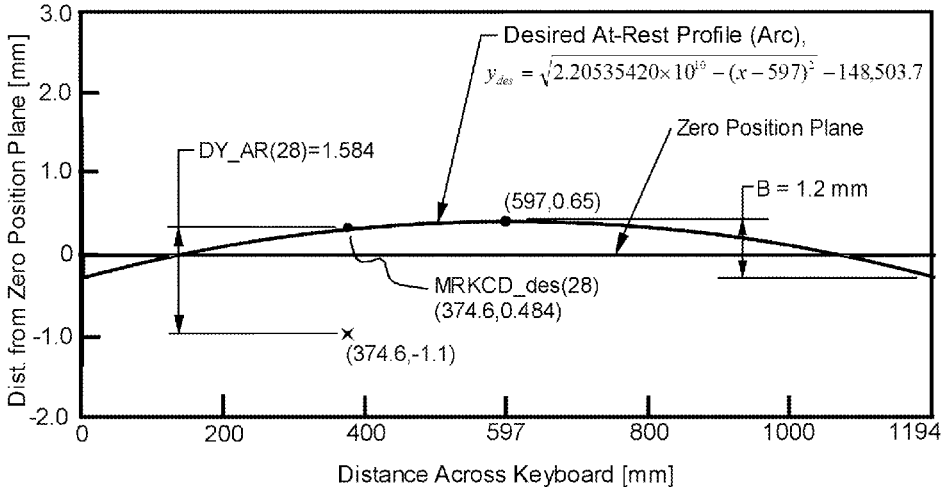
FIG. 19 shows a specific "arc-shaped" Desired At-Rest Profile, with specific values for "p", $y_{des}$(p), and "B", along with the Zero Position Plane and a typical measured "at rest" A.P. location for a "key 28".

Now a specific example utilizing a "concave downward" arc for the "white keys" Desired At-Rest Profile will be considered. Assume that "at rest" locational measurements were made on all white keys of some theoretical piano, with key 1 being the leftmost key and key 88 being the rightmost. If the horizontal distance between the AP's of keys 1 and 88 was measured to be 1194 mm, then "2p" is 1194 and "p" is thus 597 mm. Assume also that the crown "B" of the arc is desired to be 1.2 mm. The above equation for R would then yield 148,504.35 mm. If the arc is placed so that $y_{des}$(p) (i.e., $y_{des}$(597)) is 0.65 mm above the x-axis (Zero Position Plane), then the equation for the "desired profile" for the white keys becomes:

$$y_{des} = \sqrt{2.20535420 \times 10^{10} - (x-597)^2} - 148{,}503.7$$

where both x and $y_{des}$ are in millimeters. The graph of this situation is shown in FIG. 19, where neither the vertical placement nor the radius of the arc are shown to scale. Focusing on a particular key, say 28, notice that its MRKC point was found to be 1.1 mm below the Zero Position Plane. Thus, MRKCD for key 28 is 1.1 mm. A very helpful parameter in determining the proper value of "x" to plug into the "desired profile" equations (for white keys) is the distance between adjacent white keys. This will be called the "Key Pitch", $P_{key}$. In this example, the Key Pitch is 1194/51, or 23.41 mm. Assuming a normal "88 key" keyboard, $P_{key}$ can always be calculated by dividing the distance between the centerlines of keys 1 and 88 by 51. Since key 28 is 16 white keys to the right of key 1 (which is at x=0), the x-coordinate for key 28 is (16)(23.41), or 374.6 mm. When 374.6 is plugged into the "arc" equation above, $y_{des}$ becomes 0.484 mm. Recalling the sign convention for "desired" values, this means that MRKCD_des for key 28 is +0.484 mm. When the measured value (1.1) and the desired value (+0.484) are added, the resulting total differential "DY_AR" for key 28 is 1.584 mm. Because this is a positive value, the technician would want to raise key 28's "at rest" A.P. by 1.584 mm.

An important decision to make in analyzing the results of "key leveling" measurements is where to place the "desired" profiles, with respect to the Zero Position Plane. For the Desired At-Rest Profile, its location is usually determined by various regulation constraints and specifications (e.g., Key Height). With this determined, the Desired Depressed Profile is generally offset downwardly from the Desired At-Rest Profile, by an amount equal to the specified Key Dip value for the action. As with the larger "passive displacement" gauge devices in the prior art, the embodiments herein allow for all the keys to be removed together for adding/removing the spacers/shims. It may therefore sometimes be beneficial to manipulate the "desired" profiles so that they pass through (or near) as many of the measured points as possible. This could reduce the number of keys that required addition or removal of spacers.

Knowing some simple geometric parameters of the piano then allows one to calculate how much additional (or less) punching/shim thickness is required at the balance rail in order to move the "at rest" AP vertically by the desired amount DY_AR. The two most important parameters in this respect are: (1) the distance between the balance rail pin (at the point where it intersects the balance rail) and the back rail cloth (where the back end of the key depresses it), and (2) the distance between the back rail cloth (where the back end of the key depresses it) and a point near the front of the key top (preferably the traditional A.P. location). Both parameters will generally be different between white keys and black keys. Parameter (1) above will be referred to herein as "BackBal_W" or "BackBal_B" (the former for the white keys, latter for the black keys). Parameter (2) above will be referred to herein as "BackFrt_W" or "BackFrt_B". With most pianos, both "BackBal . . . " and "BackFrt . . . " will be constant amongst all white keys, and also constant amongst all black keys. With this geometric information known for a given key, the amount of expected vertical displacement "DY_AR_exp" at the "at rest" AP, due to changing the overall thickness of the balance rail shims by an amount "Delta_Shim_Bal", is equal to:

$$DY_AR_exp=(Delta_Shim_Bal)(BackFrt_X/BackBal_X)$$

where the "X" suffix is replaced with either a "W" or a "B", depending on whether one is preparing to shim white keys or black keys.

In "at rest" key leveling, the practice is to predict the amount of additional shimming (either adding or removing) required at the balance rail to produce the desired vertical movement "DY_AR" of the "MRKC" point. Replacing DY_AR_exp with DY_AR and solving the above equation for Delta_Shim_Bal gives:

$$Delta_Shim_Bal=(DY_AR)(BackBal_X)/(BackFrt_X) \quad \text{(Equ. 8)}$$

where, again, it is understood in this equation that the "X" suffices are replaced with either a "W" or a "B", depending on whether one is currently shimming a white key or a black key. With the sign convention already discussed, a positive (+) value of Delta_Shim_Bal means that shims are to be added (increase in thickness). A negative (−) value of Delta_Shim_Bal means that shims are to be removed (reduce in thickness).

The preferred practice would generally be to establish the equation of the Desired At-Rest Profile for the white keys first, with a curve that begins at key 1 and ends at key 88. To determine the corresponding Desired At-Rest Profile for the black keys, one simply adds a "positive constant" term to the right hand side (RHS) of the "white keys" equation. This positive constant corresponds to the amount of height difference one wants between an "at rest" black key and its neighboring "at rest" white keys. It will be referred to herein as the Black Key Profile Offset (BKPO). With this symbology, the Desired At-Rest Profile equation for the black keys in the example of FIG. 19 would be:

$$y_{des}=\sqrt{2.20535420\times10^{10}-(x-597)^2}-148{,}503.7+BKPO$$

The value of "x" for any given black key would then be determined, relative to the "x=0" value of key 1, and plugged into this equation to get the "desired" height for that black key. If this were done in FIG. 19, the resulting Desired At-Rest Profile for the black keys would show up as an arc identical to the first one, but offset in the positive "y" direction by BKPO.

Once each Desired At-Rest Profile (i.e., the one for white keys and the one for black keys) has been determined and located, the Desired Depressed Profile is generally located relative to its "at rest" counterpart. That is, the Desired Depressed Profile for the white keys is a simple downward offset (generally equal to the desired or specified Key Dip value) from the Desired At-Rest Profile for the white keys. The Desired Depressed Profile for the black keys is similarly a simple downward offset from the Desired At-Rest Profile for the black keys.

Both MRKCD and BOD parameters are relative to a "zero point" that is preferably chosen to pass through the lower apex/tip of the Contact at some Home Position. Once chosen, this "zero point" is fixed to a non-rotating coordinate system on the carriage, and is intersected by the Zero Position Plane, no matter which same-colored key is being addressed. At any point in a "key leveling" Run, the displacement of the Contact relative to its Home Position is identical to the distance from its apex/tip to the Zero Position Plane. In measuring/locating the keys of a given piano, the Contact is made to begin all runs at some consistent Home Position. With the embodiments of the current invention, the Zero Position Line/Plane should preferably be set up so that it is above even the highest A.P. of the same-colored keys to be measured. The offset between the Zero Position Plane and the Local Black Plane is herein referred to as the Black Plane Offset (BPO), and should be large enough to ensure that the Local Black Plane is also above the highest A.P. of the black keys.

If one wanted to measure only the black keys, one would follow an analogous procedure to that already described for setting up the machine to measure white keys. Of course, in this case the machine would be oriented in its "black key" configuration. In essence, a Local Black Plane would still exist, but it is not created by offsetting from the Zero Position Plane; it is instead set up independently as described above. The combination of all "zero points", as the carriage is slid over every black key, forms a line that should be parallel to the key bed (or action datum) and also within the Vertical AP Plane for black keys. This could be considered the "zero position black line", the counterpart to the normal Zero Position Line. The Local Black Plane would then pass through this line while also being approximately parallel to the key bed (or action datum).

I. More on the Mid-Run Key Collision Point

If a sufficiently aggressive downstroke begins from a Key Clear State, then when the Contact begins impacting and moving the key, the Contact force data will reflect this in the form of a string of forces that increase quickly (from a near-zero value), peak, and finally level off (at roughly the Down Force value) after a short distance. Such a contiguous group of force data points has been defined herein as a Mid-Run Key Collision String, and is an example of a Transitory Collision String. The Mid-Run Key Collision Point may be determined as the point corresponding to the first of these increasing forces (or a point just prior or just after the first point). Finding the Mid-Run Key Collision String (and MRKC Point) from the force data points could involve looking for "x" number of consecutive force increases in a row, with the first of the string being declared the MRKC Point. Or it might involve looking for the first point that is followed by a certain number of points where every second (or third, etc.) subsequent point exhibits some minimum amount of force increase. It may then involve looking for a sudden decrease in forces, following this string of increasing forces. It might also involve the use of some moving average. Or it might involve the calculation of a variance parameter of the forces, both before and after the potential Mid-Run Key Collision Point. When the variance parameter over some small region after the potential point is a certain amount larger than the variance parameter over some small region before the potential point, the point might be declared the Mid-Run Key Collision Point. It is probably most desirable for this downstroke to achieve a fairly constant speed as soon as possible. The more the key is accelerating, the more inertial forces can rear their head to mask some of the important data.

The vertical displacement between the Contact at a given Home Position (corresponding to a Key Clear State) and the Contact at the Mid-Run Key Collision Point is known herein as the MRKCD. The MRKCD thus corresponds to the vertical clearance between the Contact at Home Position and the top of the at-rest key below. With the embodiments herein, once the MRKC Point is found, then the MRKCD can be determined. Any mathematical, numerical or visual technique may be employed to locate a Mid-Run Key Collision String (and MRKC Point) from force data resulting from a downward Run from a Key Clear State.

a) Determining the MRKCD from the Mid-Run Key Collision Point, Employing Displacement-Based Acquisition Assume that a Run employing Displacement-Based Acquisition begins with the Contact at some Home Position, clear of the key by some unknown amount, and approximately in the Vertical AP Plane. Assume the Contact then follows a Motion Profile that causes it to move downwardly far enough to displace the key significantly. Because Displacement-Based Acquisition is being used, forces are read only at points in the movement where the displacement (relative to Home Position) at that instant is fully known. The resulting force data points are examined per the methods described herein, to determine the Mid-Run Key Collision String and MRKC Point. It represents the exact location of the A.P. of the "at rest" key. Once this point is determined in space, then the essentially vertical distance from the point to the Zero Position Plane is the Mid-Run Key Collision Displacement (MRKCD).

Figure 20:
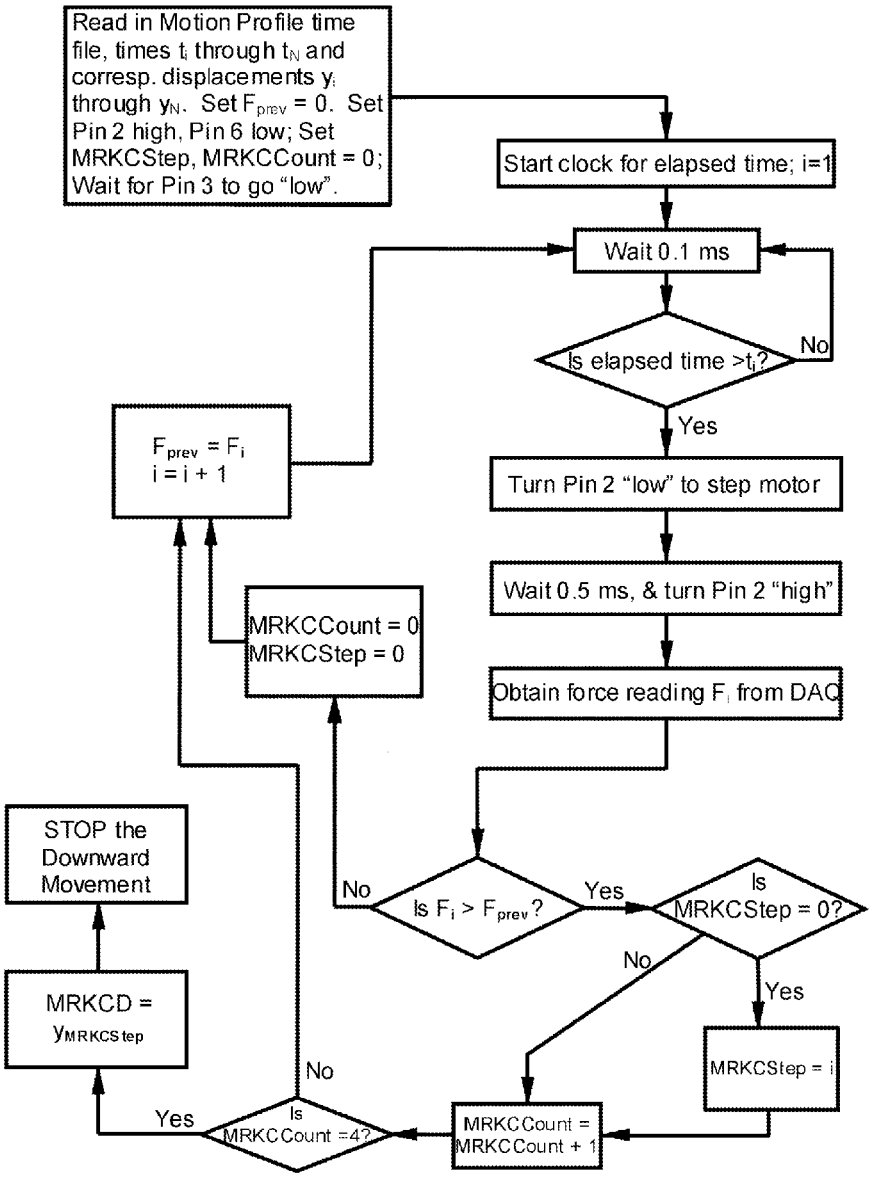
FIG. 20 is a flowchart detailing a Run that determines MRKCD on a downstroke, using Displacement-Based Acquisition.

This process is detailed in the flow chart of FIG. 20. The Run begins in a Key Clear State. A force reading is taken at each motor step, and each motor step corresponds to a given known displacement. The pairing of a known displacement with its corresponding force is considered a "point". This pairing may be done, for example, with a multi-row, two-column array in the controlling program. Each row would represent successive points in time where forces were read. For each reading/time/row, the first column would contain the displacement, which is known well beforehand. The force reading would be placed into the second column. The Mid-Run Key Collision Point is found simply by looking for "x" number of Consecutive "points" that all experience force increases. The displacement corresponding to the first of the "x" consecutive points is considered to be the MRKCD. In the flow chart of FIG. 20, "x" is 4.

b) Determining the MRKCD from the Mid-Run Key Collision Point, Employing Scanning Acquisition Assume that a Run employing Scanning Acquisition begins with the Contact at some Home Position, clear of a given key by some unknown amount, and approximately in the Vertical AP Plane. Assume the Trigger (to the DAQ) occurs, and that the Contact shortly afterwards begins to follow a predetermined Motion Profile that causes it to move downwardly far enough to displace the key significantly. A constant speed for this downstroke would preferably be reached quickly, and the resulting speed would be great enough to produce significant collision forces between the Contact and key. The raw data is examined per the methods described above, to determine the Mid-Run Key Collision String and MRKC Point. A Force Synchronization Step is then performed on the resulting raw force data, resulting in a "marker" (Point TZ) being placed along the time axis of the raw data. The time (on the raw force data axis; i.e. relative to the Trigger) corresponding to Point TZ (this should equal the PTD) is then subtracted from the time corresponding to the Mid-Run Key Collision Point. The result of this subtraction is the Time Moving Before Contact (TMBC). On the Motion Profile itself, the displacement that corresponds to the TMBC is located. As discussed previously, this is another example of Force Transposition. The corresponding displacement is the Mid-Run Key Collision Displacement (MRKCD). While the Mid-Run Key Collision Point was already found on the graph/force data, it is only after Force Synchronization and Force Transposition are performed that it is actually located in space, relative to the Zero Position Plane. It is thus found to be exactly MRKCD below the Zero Position Plane. Note that in the above process, the Force Synchronization Step could also be performed before the determination of the Mid-Run Key Collision Point.

Figure 21A:
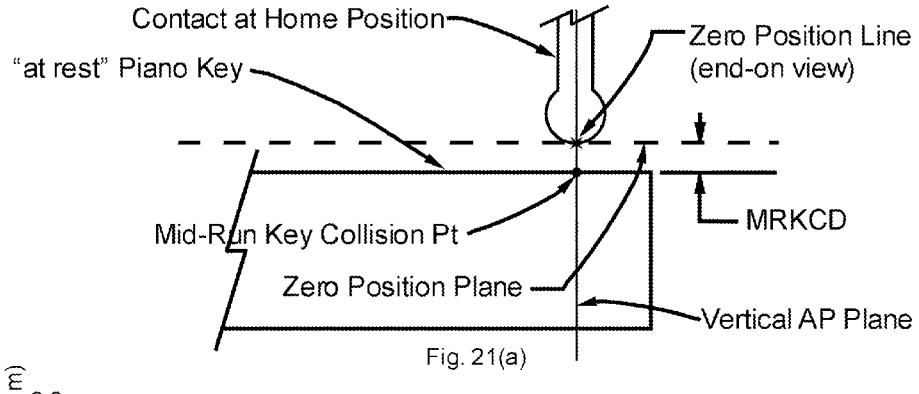
FIG. 21 (*a*) shows geometry at the piano key, during a run for determining the MRKC Point, TMBC, and MRKCD.
Figure 21:
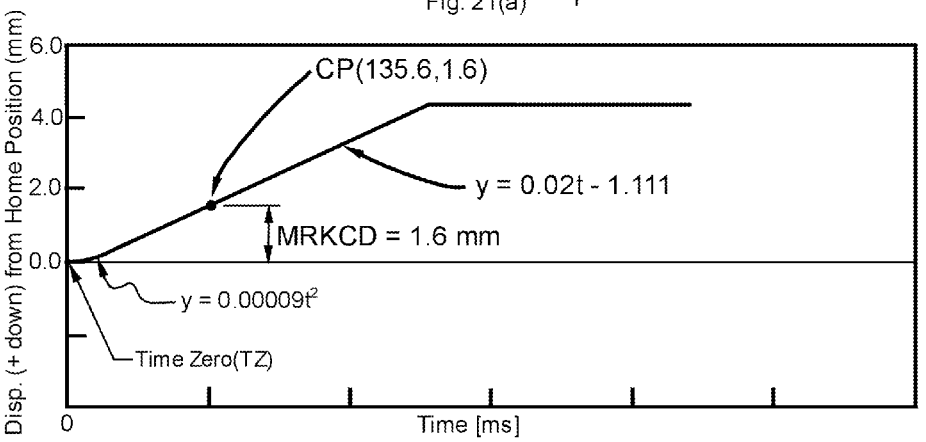
Figure 21C:
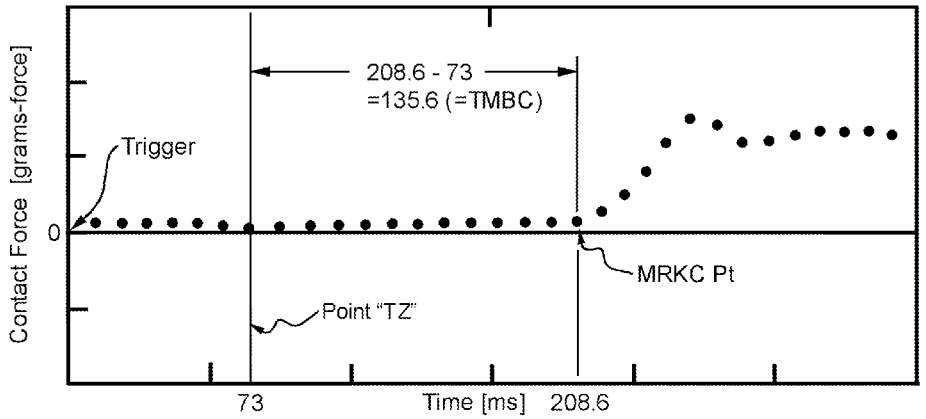

An actual piano key action was tested per these embodiments, with the Contact beginning a downstroke from a Home Position well clear of the "at rest" key, as shown in FIG. 21 (*a*). A flow chart of such a Scanning Acquisition process would look trivial, but would have the same sort of motor/Contact movement as did the Displacement-Based Acquisition case of FIG. 20. FIG. 21 (*b*) shows the Motion Profile used for the run, while FIG. 21 (*c*) shows the resulting "raw force data". In this example, the PTD was known ahead of time to be 73 ms. Thus, the raw force graph in (c) shows a "Point TZ" placed on the time-axis, 73 ms from the Trigger (origin). As already described, this turns the graph into a Synchronized Force vs. Time graph. An algorithm of the sort already described herein finds the Mid-Run Key Collision Point to be at the point labelled "MRKC Pt" (at t=208.6 ms) on the graph, as shown. The TMBC is thus equal to (208.6−73), or 135.6 ms. In the Motion Profile, one sees that 135.6 ms corresponds to 1.6 mm. This means that the MRKCD for this key is 1.6 mm.

Key Dip can be obtained for a given key (and at a given AP) by determining the BOD and the MRKCD relative to the same Zero Position Plane (and possibly in the same downstroke), then subtracting the latter from the former. The equation is:

$$\text{Key Dip}=\text{BOD}-\text{MRKCD}$$

In cases where the Contact begins the downstroke in a Key Adjacent State, the BOD is equal to the Key Dip, since MRKCD is zero.

J. Key Leveling Examples Using Embodiments of the Invention

Assume that both "at rest" and "depressed" measurements have been taken on the white keys of a piano keyboard, using the apparatus and methods of the current invention. It is helpful to set up a small spreadsheet for handling the "at rest" and "depressed" data. The locational data for each measured key are "read in", as are several important parameters relating to the geometry of the keyboard and relating to the ultimate desired shape/profile of the "at rest" and the "depressed" key positions across the keyboard. The spreadsheet contains a graph/chart that automatically plots out all the locational data relative to the Zero Position Plane. The spreadsheet also plots both a Desired At-Rest Profile and a Desired Depressed Profile, both of which can easily "float" up or down relative to the Zero Position Plane. The Desired At-Rest Profile may be a horizontal line, an arc-shaped curve, a roof-shaped composite curve, or some other shape. These "desired" profiles are governed by several parameters that are typed/read into the spreadsheet. The technician can thus see what is happening across the keyboard, and can quickly make important changes to the shape (e.g., the "crown") and/or the vertical locations of one or both desired profiles. The Desired Depressed Profile is usually created by simply translating the "at rest" desired profile downward by an amount equal to the desired Key Dip (KD). Of course, a similar spreadsheet could be made that only deals with the "at rest" measured values, and the Desired At-Rest Profile, for those who might prefer using more traditional techniques for measuring/adjusting the Key Dips.

The spreadsheet automatically calculates the "differentials" for each measured key—both "DY_AR" and "DY_Dep"—along with Delta_Shim_Bal. A representation of this spreadsheet is shown in FIG. 22, with the underlying equations of all "calculating" cells shown. The format of the equations shown is that of Microsoft Excel. The actual spreadsheet would have each white key represented by one row, each row spanning from column A to column M. For clarity in displaying the essential equations, only one "key row" (row 15) is shown in FIG. 22. Row 8 simply shows column descriptions. The cells expecting an input value—both in the "key row" and up near the top—have been given (for convenience) values that will be used in the subsequent example. The spreadsheet described creates and plots a "roof-shaped" Desired At-Rest Profile for the measured white keys. The beginning point of this profile corresponds to the centerline of key 1, and the endpoint to the centerline of key 88. The "roof-shaped" Desired At-Rest Profile is defined by the two equations:

$$\text{Line 1 (for } x<p\text{): } y_{des}=(B/p)x+y_{des}(p)-B$$

$$\text{Line 2 (for } x>p\text{): } y_{des}=(-B/p)x+y_{des}(p)+B$$

where "B" is the "crown" (i.e., total height of the profile), "2p" is the horizontal distance between the start point and endpoint of the profile (i.e. between keys 1 and 88), and $y_{des}(p)$ is the y-value of the Desired At-Rest Profile at the apex (at x=p). The "x" parameter starts at the centerline of Key 1, and increases to the right. The corresponding Desired Depressed Profile is created by simply translating the Desired At-Rest Profile downward by the desired Key Dip (KD), which is typed into cell B3 of the spreadsheet. In addition to KD, the other "input parameters" that are to be typed into individual cells of the spreadsheet include:

- the crown "B", in cell B1
- the distance between Keys 1 and 88, "2p", in cell B2
- BackBal_W, in cell E1
- BackFrt_W, in cell E2
- specified Key Height, in cell H1
- measured height of the Zero Pos. Plane above keybed, in cell H2

As has been described, if the DY_Dep term, for a given key, is positive, then that Bottom-Out Point needs to be raised by that amount to hit the "desired" profile. If it is negative, then the point (i.e., the depressed A.P.) needs to be lowered to hit the profile. As long as the Vertical AP Plane was located so that the measurements were made at the approximate traditional AP location, then the amount of shimming or de-shimming at the Front Rail will be identical to the magnitude of DY_Dep. The amount of shimming or de-shimming to be done in moving the "MRKC" points (i.e., the "at rest" points) was given by Eq. 8 for Delta_Shim_Bal. For most pianos, BackBal and BackFrt will be different for the black keys than for the white keys. This is the reason for having the "W" and "B" suffices. Of course, a positive value for DY_AR (which leads to a positive value for Delta_Shim_Bal) means that shimming must be increased, while a negative value means that shimming must be decreased. Since the spreadsheet currently being described is for white keys only, only two cells are needed for this data: one (E1) for entering in BackBal_W and one (E2) for entering in BackFrt_W Two other cells are used for calculating or entering certain important values, while not being tied to any particular key. These are the "p" value in cell H3 and the "key pitch" for the white keys, in cell H4. Columns A through L of the spreadsheet (for row 15) deal with values/properties/measurements that are tied to individual keys themselves. Column A is the "key number" (i.e., between 1 and 88), while column B is the corresponding "white key number" (between 1 and 52). The spreadsheet shown is for white keys only. Every "key number" has a unique "white key number" associated with it. The "white key number" of Key 11 is 7; of Key 88 is 52, etc. Columns C and E are where the measured values MRKCD and BOD are read in. Due to the nature of the apparatus and methods providing these numbers, they are "positive" in the downward direction, with zero being at the Zero Position Plane. These signs are reversed in columns D and F, so that the plot of all these points will appear with negative values downward (as if one is looking at the keyboard from the front, with positive "up"). Column G uses Column B, along with the "key pitch", to calculate the corresponding distance of the center of the given key from the center of Key 1. Columns H and J calculate the "desired" vertical locations of the "at rest" and "depressed" AP's, respectively, for each key. The equation used in column H is that of the "roof-shaped" profile given above. Column J values are obtained simply by subtracting the desired Key Dip (cell B3) from the values of column H. Columns I and K calculate the resulting differentials for the "at rest" and "depressed" positions, respectively, of each measured key. The DY_Dep value of column K gives the exact amount of shimming that needs to be added/reduced to/from the Front Rail to move the "depressed A.P." onto the Desired Depressed Profile. A (+) value means shimming must be increased, while a (−) value means shimming must be reduced. Column L multiplies the value in column I by the ratio of BackBal over BackFrt, this ratio being calculated in cell E3. The result is "Delta_Shim_Bal", the amount that the given key's Balance Rail shimming must be increased or decreased to place its "at rest" A.P. on the Desired At-Rest Profile. A (+) value means shimming must be increased, while a (−) value means shimming must be reduced. Columns D, F, H and J are all plotted (as y-values) versus Column G (the x-values).

One other thing that should be known while working with the spreadsheet is where the Zero Position Plane is with respect to the key bed or other relevant action datum. Once the machine is oriented over the keyboard for taking measurements, the vertical distance from the top of the key bed/datum to the Zero Position Plane (i.e. the bottom tip/apex of the Contact in Home Position) is measured. If the machine is oriented properly, then it shouldn't matter at what lateral position the carriage is in when taking this measurement; the Zero Position Plane is supposed to be parallel to the keybed/datum. Back in the spreadsheet, this measurement is typed into cell H2. The spreadsheet then knows exactly where the Zero Position Plane (and indeed every single measured value) lies with respect to something real and tangible: the key bed (or important horizontal datum of the action). The spreadsheet also reserves cell H1 for a "specified Key Height". This is the Key Height value that may come from the manufacturer's specifications. The difference in the values of H1 and H2 results in a value representing the location of this "specified key top", relative to the Zero Position Plane. Column M of the spreadsheet represents this value It is then plotted as a point or short line, near the center (i.e., x=p) of the graph. The spreadsheet is set up so that "$y_{des}(p)$" (cell B4) is assigned the value equal to this "specified key top" y-value plus half of the "crown". This "vertically disperses" the entire roof-shaped Desired At-Rest Profile about the "specified key top".

The usefulness of this spreadsheet will now be demonstrated with "locational" data from an actual piano keyboard. Locational measurements (both "at rest" and "depressed") were made on the white keys of the piano, using the embodiments described herein. The machine was situated relative to the keyboard so that the Contact at Home Position was well above (say, at least 0.4 mm) the highest white key's "at rest" AP. In other words, the resulting MRKCD for that highest key was at least 0.4 mm. This simply ensured that the Contact began its Run in a Key Clear State over each key that was measured. The crown for the roof-shaped "desired profiles" of this example is desired to be 1.2 mm. The distance between the centerlines of keys 1 and 88 of the measured keyboard was measured as 1194 mm. FIG. 23 is a representation of the spreadsheet with all the measured values copied into columns C and E. Only six "key rows" are shown here, in the interest of space. The keys shown are 11, 25, 37, 54, 68 and 81. In addition, all of the cells that contain equations have been replaced by the actual calculated values, based on both the "measured" values of columns C and E, and the various input parameters near the top. All of these input parameters are filled in, as shown.

Figure 24:
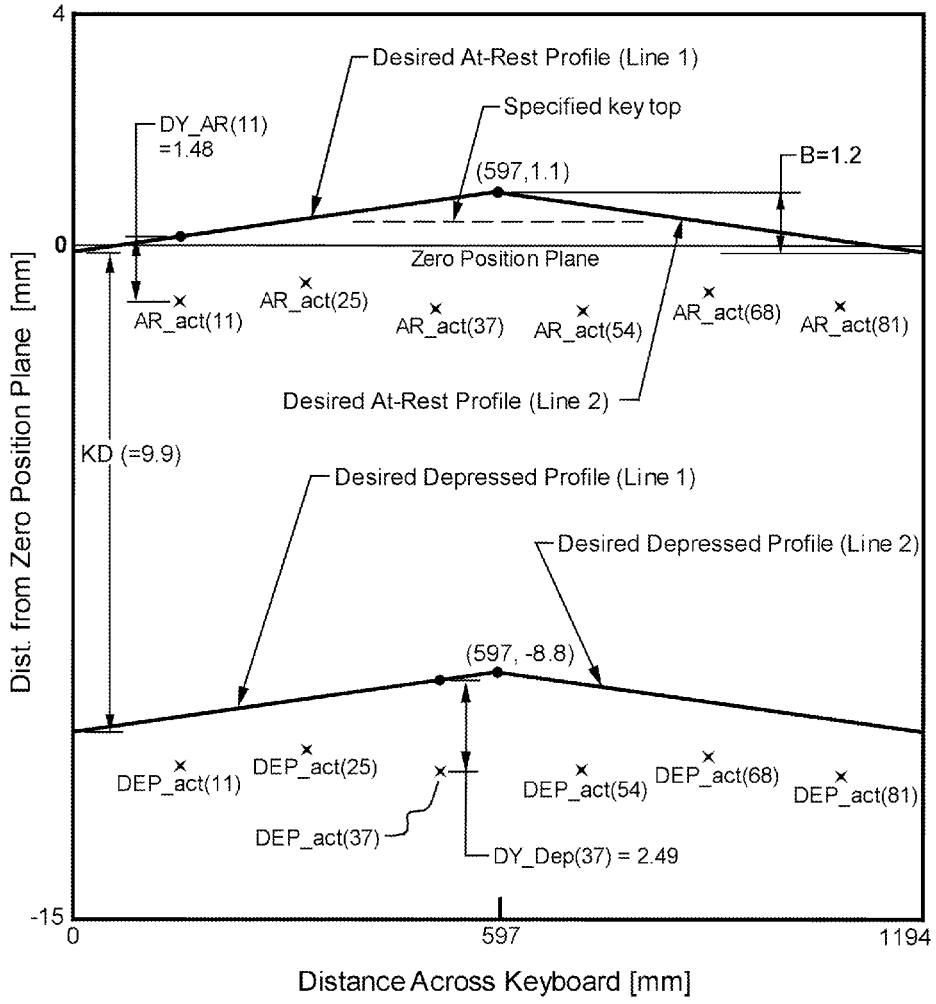
FIG. 24 shows the graph generated by the spreadsheet of FIG. 23, with the actual "locational" data ("at rest" and "depressed") for the six keys, and both "desired" profiles, all relative to the zero position plane.

Assume that the "specified Key Height" (cell H1) for this keyboard is 64 mm. The "zero point" of the Contact in Home Position (and thus the entire Zero Position Plane) was measured to be 63.5 mm above the key bed during the measurements. This is entered into cell H2. The spreadsheet plots a short horizontal line (using Column Q) at exactly 0.5 mm (i.e., 64-63.5) above the Zero Position Plane, representing the "specified key top". The resulting graph of the measured values of the six selected keys, along with both "desired" profiles—based on these initial inputs—is shown in FIG. 24. The value for $y_{des}(p)$ in cell B4 was calculated to be 1.1 mm, which forces the Desired At-Rest Profile to vertically "straddle" the "specified key top", as expected. For this particular keyboard, BackBal_W and BackFrt_W were measured as 190 mm and 400 mm, respectively (the AP being approximately 10 mm from the front edge of key). The Key Dip was chosen as 9.9 mm.

If the technician determines that the "specified" Key Height of 64 mm must be maintained, then the calculated values of Delta_Shim_Bal (column L) in FIG. 23 would be used for "shimming" work at the balance rail. As can be seen, all six selected keys shown would have their shimming thickness increased at the balance rail. If in addition, the technician determines that a 9.9 mm Key Dip must be held across the keyboard, then the six keys would also be shimmed at the Front Rail according to the DY_Dep values in column K. As both the spreadsheet of FIG. 23 and the corresponding graph of FIG. 24 indicate, the shim thickness for each of these six keys would have to be increased.

Those skilled in the art can easily modify the spreadsheet to include black key measurements (and their desired profiles and differentials), but things get quite "busy" when it comes to the graph. There would be four separate "desired profiles" on such a graph. It may be advisable to have a separate spreadsheet (and graph) for the black key measurements. Recall that the vertical location of the Local Black Plane is generally known exactly with respect to the Zero Position Plane. One could also have a version that deals only with "at rest" measurements, but contains both white and black key data.

K. New Parameters Characterizing the Let-Off Event

If the Contact of the embodiments herein is made to descend in a well-controlled manner through the entire keystroke, while forces at the Contact are simultaneously being measured or acquired, two very important points in the keystroke can also be located with the embodiments herein. These are the Let-Off Start Point and the Jack Trip Point, both having been mentioned previously herein.

With the Contact beginning a downstroke from some Home Position, as it passes through the "pre let-off" region of the stroke, it will experience forces generally similar in magnitude to the Average Down Force (ADF). This is particularly true if the Contact is made to follow a constant-speed profile in this region. If the Contact began in a Key Clear State, it will first encounter a Mid-Run Key Collision String. Once the Contact has displaced the key by at least 1 or 2 mm, the forces of the Mid-Run Key Collision String will have returned to a value approximately equal to the Average Down Force. Once the Let-Off Start Point is reached, however, the measured forces will begin to increase in magnitude, due to the impact of the jack hitting the let-off button (and/or the balancier hitting the drop screw). Depending on many physical attributes of the particular key action, along with various regulation settings, this force increase may be over in less than a millimeter of stroke. However, this region of increasing forces may also last for 2 or 3 millimeters of travel. Such an increasing string of forces, which begins after the key has moved downwardly by at least 5 or 6 millimeters from its "at rest" position, is an indication that the Let-Off Start Point has been reached. The final indication, especially when measuring a grand piano action, is a subsequent significant decrease in the measured forces, over some short time/distance. This sudden and significant decrease is due to the jack having "tripped out" from beneath the knuckle (or hammer butt in the case of a vertical piano). This leaves the hammer and shank flying through the air towards the string(s), unattached to the key or wippen.

These contiguous force data points, which on a downstroke show an initial clear and sustained increase in force beyond the known or expected Down Force value, followed by a sudden decrease in force, will be referred to herein as a Let-Off Collision String. For downstrokes beginning from a Key Clear State, the Let-Off Collision String will appear well after (at least 4 or 5 mm) the MRKC Point. For downstrokes beginning from a Key Adjacent State, the Let-Off Collision String will occur well after (at least 4 or 5 mm) the start of the downstroke. The Let-Off Start Point is defined as a point at or very near the beginning of the Let-Off Collision String. The Jack Trip Point is defined as a point at or very near the apex of the Let-Off Collision String. The Let-Off Collision String is an example of a Transitory Collision String.

Examples of algorithms that may be employed to locate the Let-Off Collision String, and thus the Let-Off Start Point and Jack Trip Point, from force data resulting from a downstroke, include:

once the increasing forces due to the initial acceleration of (or colliding with) the key by the Contact are passed through, calculating a "running average" of the measured forces up to each successive time or displacement, and determining if the latest force exceeds that running average by some minimum amount. Once this has occurred, the preceding location/time is labeled the "potential let-off start point". Each subsequent force measurement is compared to its predecessor (or "near predecessor"). Once some minimum number of data points have forces exceeding their predecessors (or near predecessors) by some minimum amount, a sudden reduction in forces is then searched for. If some minimum number of data points have forces some minimum amount less than their predecessors (or "near predecessors"), then the location/point/time immediately preceding the first of these decreases is deemed the Jack Trip Point. And the location/point/time represented by the "potential let-off start point" can be said to be the Let-Off Start Point. If at any point in this process, the required number of "increasing forces" is not obtained, or the required number of subsequent "decreasing forces" is not obtained, the location/time of the apparent Jack Trip Point and "potential let-off start point" is erased, and a new one searched for.

once the increasing forces due to the initial acceleration of (or colliding with) the key by the Contact are passed through, examining each subsequent force data point to determine if some minimum number of consecutive acquired points have forces that consistently exceed the force of their immediately preceding acquired point. Once this condition is met, the point just prior to (or very near to) the first of these increases is said to be the "potential let-off start point". The subsequent forces are then examined against their immediate predecessors, looking for a decrease in force of some minimum amount. If some minimum number of successive forces decrease by some minimum amount, then the point/location/time just prior to the first of these decreases is the Jack Trip Point. And the "potential let-off start point" is said to be the Let-Off Start Point. The group of contiguous points, from the Let-Off Start Point to that final checked force point, is the Let-Off Collision String.

In practice, any of these examples of "mathematical algorithms" can be used—as could a combination of them—to locate the Let-Off Collision String. Other mathematical algorithms may also be used, as long as they confirm an initial strong, increasing nature of the forces (signaling the start of let-off) above the preceding values, followed by a significant decrease in forces (signaling the jack trip point). Rather than looking for increases or decreases in force between "successive" data points, one could look for increases/decreases in force between every second, or every third data point, etc. The techniques could also involve measurements of variance parameters such as standard deviation, looking for sudden changes in these parameters.

The Distance to Let-Off Start is herein defined as the essentially vertical displacement between the Contact when at some Home Position (with the Contact's "zero point" approximately in some Vertical AP Plane) and the Contact when it has depressed the key to the Let-Off Start Point of its keystroke. The Distance to Jack Trip is herein defined as the essentially vertical displacement between the Contact when at some Home Position (with the Contact's "zero point" approximately within some Vertical AP Plane) and the Contact when it has depressed the key to the Jack Trip Point of its keystroke. As described above, Distance to Let-Off Start and Distance to Jack Trip will normally be measured/determined from the same downstroke.

The time required for the Contact to travel from Home Position to the Let-Off Start Point is herein referred to as the Time Moving Before Let-Off (TMBLO). As is the case with the TMBC, it is relative to the true "time zero" of the Motion Profile. For Runs employing Scanning Acquisition, either before or after the Let-Off Start Point is located, the forces are synchronized so that all resulting data points have their times known with respect to "time zero" of the Motion Profile. The time associated with the Let-Off Start Point (relative to "time zero") is TMBLO, by definition. From the Motion Profile that was used, one then picks off the displacement associated with TMBLO, which is the Distance to Let-Off Start. For Runs employing Displacement-Based Acquisition, the TMBLO is not necessary, since the displacement at every force data point is already inherently known.

Figure 26:
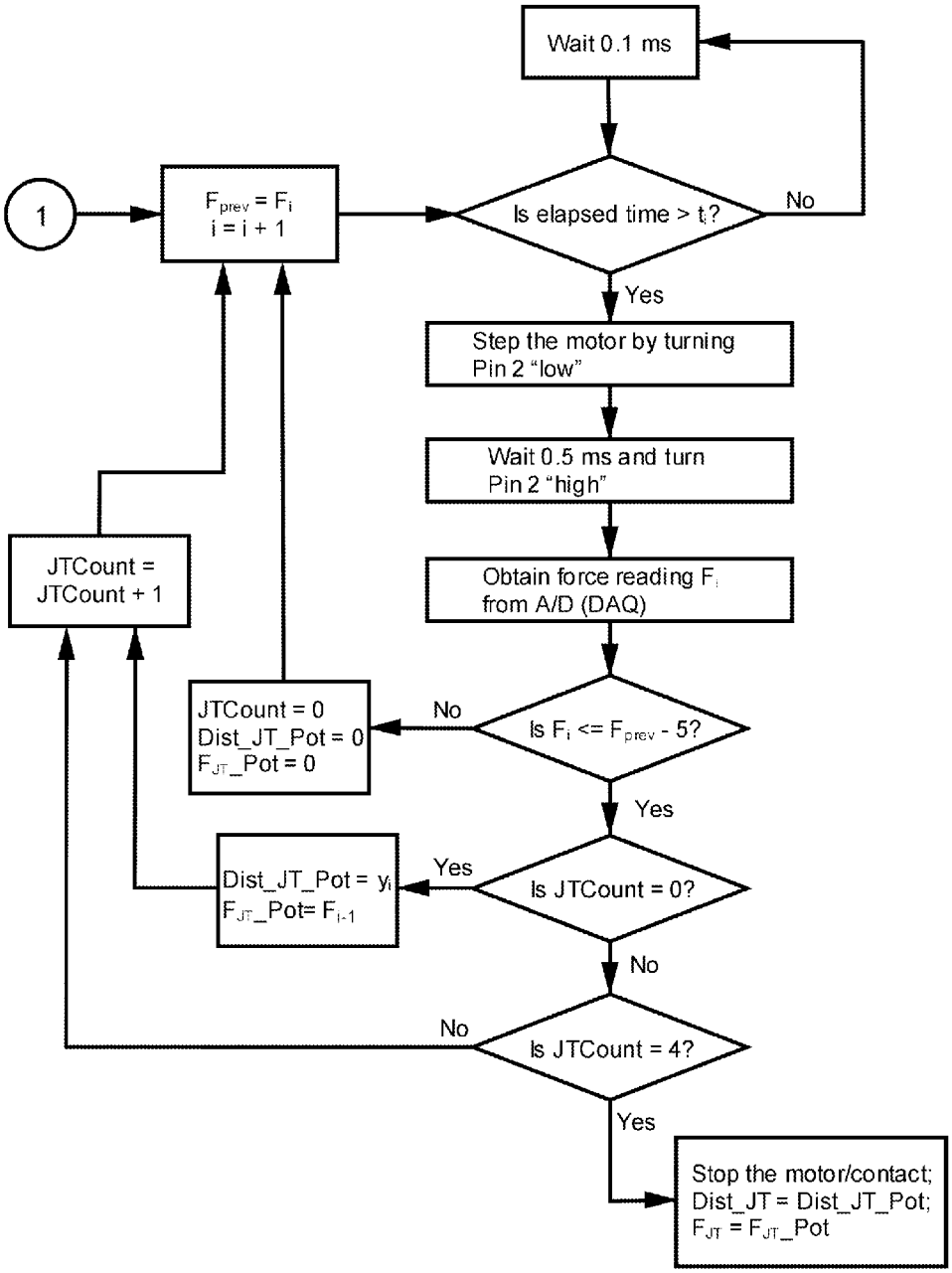

The time required for the Contact to travel from Home Position to the Jack Trip Point is herein referred to as the Time Moving Before Jack Trip (TMBJT). As is the case with the TMBLO, it is relative to the true "time zero" of the Motion Profile. For Runs employing Scanning Acquisition, either before or after the Jack Trip Point is located from the forces, the forces are synchronized so that all resulting data points have their times known with respect to "time zero" of the Motion Profile. The time associated with the Jack Trip Point (relative to "time zero") is TMBJT, by definition. From the Motion Profile that was used, one then picks off the displacement associated with TMBJT, which is the Distance to Jack Trip. For Runs employing Displacement-Based Acquisition, the TMBJT is not necessary, since the displacement at every force data point is already inherently known.

i) Determining Distance to Let-Off Start and Distance to Jack Trip while Employing Displacement-Based Acquisition For Runs employing Displacement-Based Acquisition, all of the acquired forces are already associated with displacements (as discussed elsewhere). So once the Let-Off Start Point and Jack Trip Point are found from the resulting force data, the Distance to Let-Off Start and Distance to Jack Trip are known. The flowchart of FIGS. 25 and 26 shows an embodiment for a downward Run to: (1) find the Let-Off Start Point and Distance to Let-Off Start, and (2) find the Jack Trip Point and Distance to Jack Trip. The Run is therefore locating the Let-Off Collision String. Displacement-Based Acquisition is employed. The Contact is initially located at a Home Position in some Vertical AP Plane, and in a Key Adjacent State. A Run to find the Mid-Run Key Collision point (and MRKCD) could have been made just prior to this, thus allowing the Home Address to move to the exact point where the Contact just barely touches the top of the key (i.e., a Key Adjacent State). Any upward force acting on the Contact is read at predetermined displacements in the ensuing downstroke, with the help of the load cell. In this embodiment, the testing for the "increasing force" signature of the Let-Off Start Point only begins after the key/contact has traveled 3 mm. This ensures that the forces have stabilized after an initial acceleration period, knowing that even a poorly-regulated "let off" will seldom begin prior to 5 mm into the stroke. It is assumed in the flowchart that the downward movement be linear (constant-speed) once that short acceleration period has ended. Once the descending key reaches the Let-Off Start Point, the measured force will begin to increase with each additional movement of the Contact. This occurs until the Jack Trip Point is encountered, at which point the measured forces begin to decrease for a time. The forces begin to increase again either when the hammer knuckle falls back onto the repetition lever or when the bottom of the key begins to significantly compress the Front Punching.

Figure 27:
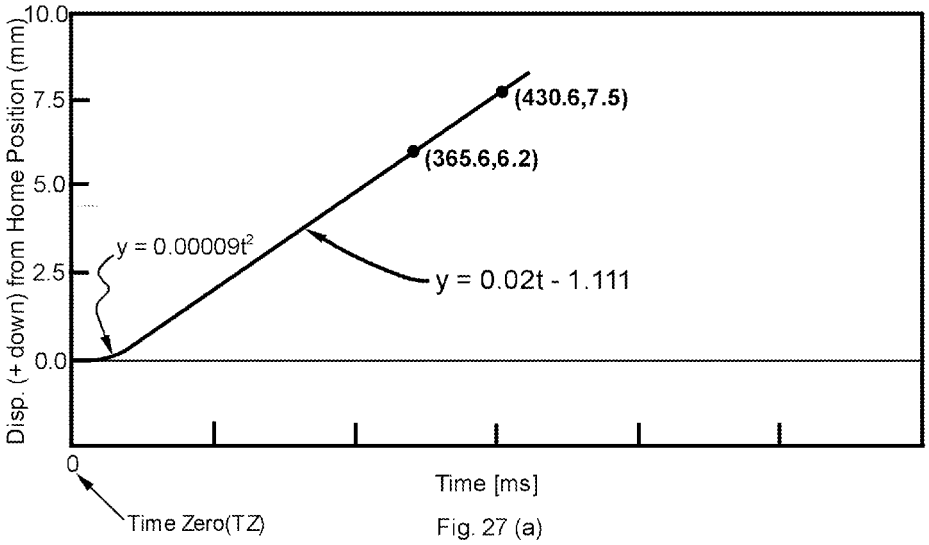
FIG. 27 (*a*) shows a constant-speed "downward" Motion Profile, for determining "let-off event" information. The resulting forces obtained when the Contact follows this profile during a displacement-acquisition Run are shown in FIG. 27 (*b*). Indicated on the force data are the letoff start and jack trip points, and the TMBLO and TMBJT values.
Figure 27:
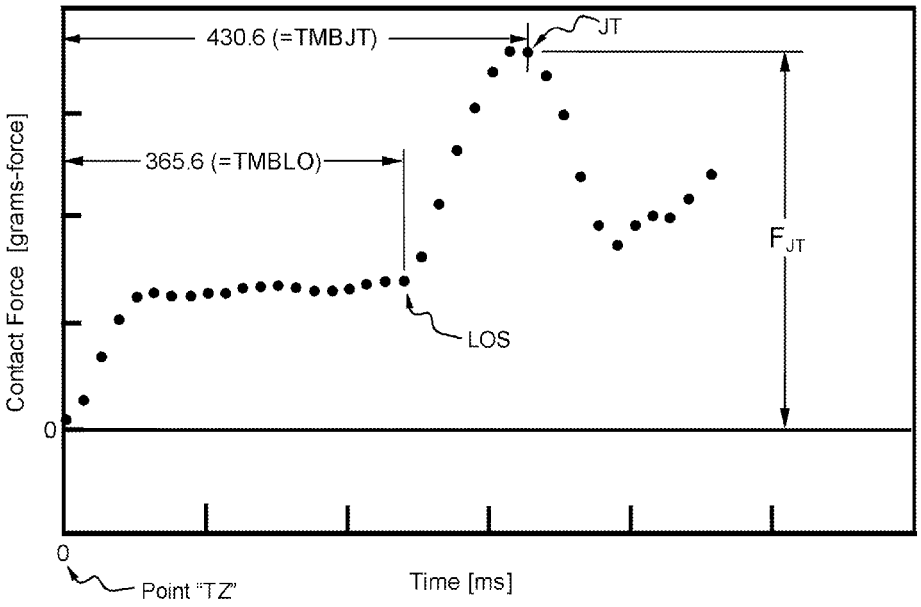

FIG. 27 (*a*) shows a Motion Profile that was used for a Run described by the flowchart of FIGS. 25 and 26. FIG. 27 (*b*) shows the resulting forces that this Run produced. Since displacement-based acquisition was used, the forces are already known (and thus graphed) versus Contact displacement. Point "LOS" represents the Let-Off Start Point, while point "JT" represents the Jack Trip Point.

Figure 28:
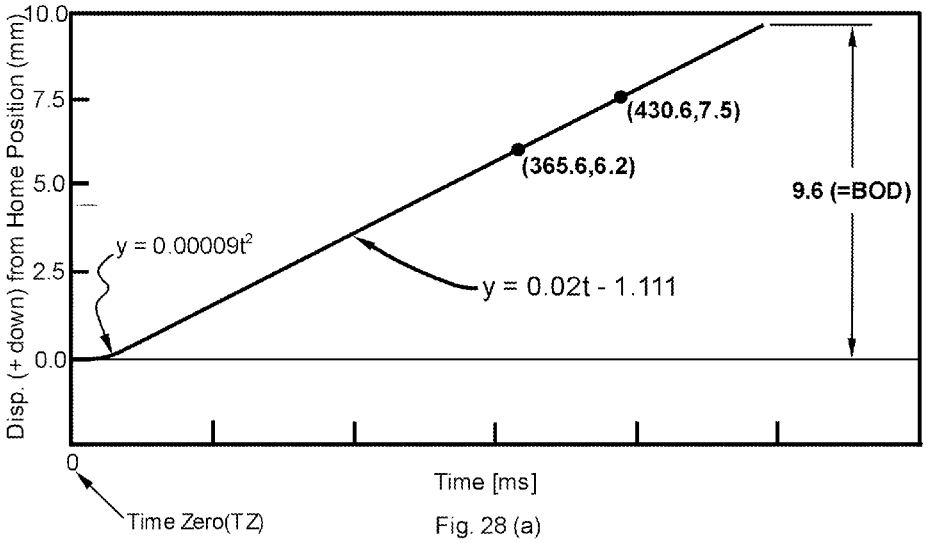
FIG. 28 (*a*) is essentially the same Motion Profile as that of FIG. 27 (*a*), but where Scanning Acquisition is employed.
Figure 28:
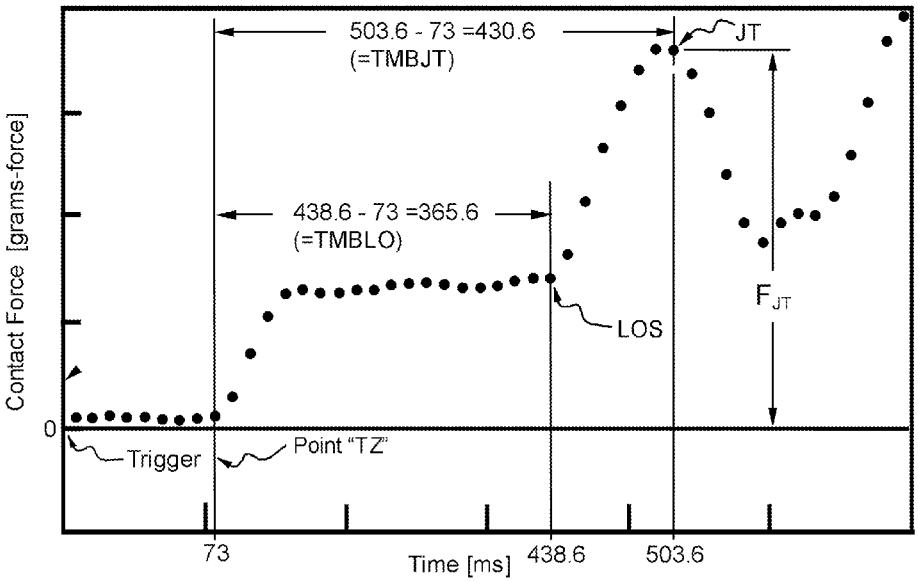

Similar embodiments to that described in the flowchart of FIGS. 25/26 could have the Contact begin the downward Run from a Key Clear State, or even a Key Embed State. In the former case, algorithms similar to those used to find the Mid-Run Key Collision point may then be used to determine when/where the Contact begins to touch the key. At a point approximately 3 or 4 mm below that, the search for the Let-Off Start Point would begin, followed by the search for the Jack Trip Point. Even if the downstroke begins from a Key Clear State or a Key Embed State, it could also be the case that the Contact location relative to the true "at rest" position of the key top is already known from a previous run. Note that since Displacement-Based Acquisition is being used, the same downstroke could also involve finding the Bottom-Out Point. This would allow the Contact to stop its downward movement before the forces reached a potentially damaging level to the load cell.

ii) Determining Distance to Let-Off Start and Distance to Jack Trip while Employing Scanning Acquisition It is often convenient to perform a Run for determining the Let-Off Start Point and the Jack Trip Point after the Bottom-Out Point has already been determined. In this situation, it makes sense to perform the Run using Scanning Acquisition, with the total downward movement (specified by the Motion Profile) equal to the distance necessary to reach the Bottom-Out Point. In this way, one knows before the Run that excessive forces will not be seen by the load cell. One also knows that the final act of the let-off event—the tripping of the jack—will definitely be captured in the resulting force data. Assume that the same Motion Profile as was used in the previous example is used for a run using Scanning Acquisition, and on the same key mechanism. Assume again that the Home Position corresponds to a Key Adjacent State. In this case, the displacement of the Contact would be equal to the Key Dip, which could have been found as the difference between the BOD and the MRKCD from a previous run. Assume that the Key Dip was found in such a manner to be 9.6 mm. So the Motion Profile is identical to the one in FIG. 27, except that it goes a little further down. The Motion Profile would thus be as shown in FIG. 28 (*a*). The reason the Motion Profile goes a bit further is because the previous example had the Contact stop shortly after the Jack Trip Point was found. Assume that the algorithms for determining both the Let-Off Start Point and the Jack Trip Point are identical to those shown in the flowchart of FIGS. 25 and 26. The resulting raw force data is shown in FIG. 28 (*b*), but the "time zero" of the Motion Profile is shown as well (point TZ), thus turning it into a synchronized force vs. time graph. The Let-Off Start Point and the Jack Trip Point, which result from the algorithms shown in the flowchart of FIG. 25/26, are shown here as points LOS and JT. From the data, it is seen that TMBLO and TMBJT are 365.6 ms and 430.6 ms, respectively. As expected, these are identical to those of the FIG. 27 example. From the Motion Profile, it is then seen that these correspond to displacements of 6.2 mm and 7.5 mm, respectively. Thus, the Distance to Let-Off Start is 6.2 mm, and the Distance to Jack Trip is 7.5 mm. Of course, these agree exactly with the values found in the displacement-based acquisition example of FIG. 27.

Note that the vertical distance between the A.P. when the key is at the Jack Trip Point and the A.P. when the key is at the Bottom-Out Point is the actual Aftertouch, as it is usually defined. The embodiments herein thus also provide a way of actually measuring the Aftertouch, quickly and consistently, for any piano key mechanism.

The vertical displacement between the Let-Off Start Point and the Jack Trip Point is an important new parameter, in and of itself. It will be referred to as the Let-Off Duration, and is found by subtracting the Distance to Let-Off Start from the Distance to Jack Trip. This Let-Off Duration can be an important indicator of let-off regulation settings, and has a significant impact on the "feel" of the downward keystroke as escapement occurs. The author has found that some key actions can have a Let-Off Duration of a mere 0.75 mm, while others can be as large as 2 mm or more.

Other important "let-off parameters" are disclosed and defined in the embodiments herein. One of these is a "representative force" that is encountered during a well-controlled downstroke, as the Contact moves completely through the let-off region, towards the Bottom-Out Point. It is often most desirable for this representative force to be the maximum force encountered in the let-off region. Since the maximum force of such a downward keystroke almost always occurs right at the Jack Trip Point, one can use the force acquired at this point as the "maximum force". No matter how it is obtained, this representative force of the let-off event will be referred to herein as the Jack Trip Force. While it is preferable for it to represent the force associated with the Jack Trip Point, it may also be the force associated with points near the Jack Trip Point. It may also be an average of some or all forces measured within the let-off collision string. The flowchart of FIGS. 25 and 26 shows how this force might be obtained, along with the other let-off parameters already discussed. In the flowchart, it is referred to as $F_{JT}$. The Let-Off Increase (LOI) is simply defined as the Jack Trip Force minus some representative "pre let-off region" force for that key. In most cases, this representative "pre let-off" force will be an Average Down Force that is also determined for that key action. Therefore, it is most preferable that:

$$\text{Let-Off Increase (LOI)} = \text{Jack Trip Force} - \text{Average Down Force}$$

The LOI has proved to be a good, scientific and repeatable measure of how much resistance the let-off/escapement itself offers to the downstroke. In measuring LOI, it is usually best if the Contact quickly achieves a constant speed through the downstroke. In this way, one always knows what the Contact/key speed is when let-off occurs. Experiments by the author have shown that different speeds produce somewhat different Jack Trip Force values. Of course, as long as one uses one speed for all keys, this is not an issue. It may also be preferable to perform two or three of these downward Runs for measuring Jack Trip Force and LOI, with each Run at a different speed. One can then take the average of the Jack Trip Force values obtained, and plug that into the equation for LOI. One may also have the Contact move at a constant acceleration through the let-off region, realizing that higher accelerations generally lead to higher Jack Trip Force values.

It should be noted that the "force profile" for the let-off region, shown in FIGS. 27 and 28, may look quite different for different keys and pianos. Apart from the LOI being larger or smaller (i.e. the curve being taller or shorter), the author has found through thousands of experiments that the entire shape of the let-off region curve varies significantly. It is also true that if a given piano is very well-regulated, the let-off region curves look quite similar between keys, with the LOI varying quite continuously across the keyboard (highest in the bass region of course). If the repetition lever hits the drop screw well before the jack hits the let-off button, the initial (rising) portion of the "let-off bump" will be disrupted, with a "secondary" hump showing up there. Since the repetition lever can no longer help support the knuckle after it is stopped by the drop screw, the force between the top of jack and the knuckle increases, with commensurate increase in friction. Thus, when the repetition lever hits "early", the Jack Trip Force (and thus LOI) tends to be larger. Of course, if the repetition lever's spring is weak, then the effect on Jack Trip Force/LOI is not so pronounced by this timing problem. There are many other factors that determine the magnitude of the Let-Off Increase. These include the material properties and condition of the knuckle, the presence of lubricant there, and the initial position of the jack relative to the spine of the knuckle.

A pianist is uncomfortable with "static" forces (e.g., Down Weight or Down Force) varying randomly between successive notes of a piano. For improved "playability", the pianist prefers these forces to vary continuously across the keyboard. The pianist also prefers there to be no significant random variations in "at rest" or "depressed" key heights across the keyboard. These heights/locations should rather be constant, or at least vary smoothly across the keyboard. In a similar manner, the pianist should find random changes in "let-off resistance", "let-off location" and "let-off duration" to be detrimental to good piano playing. That is, these new parameters of Distance to Let-Off Start, Distance to Jack Trip, Let-Off Increase, and Let-Off Duration should vary smoothly from note to note across the keyboard. Variations in Let-Off Increase, in particular, can wreak havoc on a pianist's playing, especially when "soft passages" are involved. A key that has unexpectedly large "let-off force" may not even produce a sound during such soft playing. All of these "let-off" parameters can be easily plotted for all notes across the keyboard, so that the technician can readily determine notes having severe inconsistencies, relative to their neighbors or a "best fit" line or curve. With regards to Distance to Let-Off Start and Distance to Jack Trip, it is extremely instructive to plot them with respect to the Zero Position Plane set up for "key leveling" measurements. If each "let-off" run begins from the same Key Clear State as the corresponding "key leveling" run began from, then all distances are relative to the same Zero Position Plane. It is straightforward to plot MRKCD, BOD, Distance to Let-Off Start, and Distance to Jack Trip for each note across the keyboard. If the "let-off" run began from a Key Adjacent State, then one simply adds MRKCD to Distance to Let-Off Start, and also to Distance to Jack Trip, with those resulting values plotted along with MRKCD and BOD. In either case, one would have graphs similar to the "key leveling" graphs of FIGS. 18, 19 and 24, but with the valuable new "let-off" information incorporated within. Graphing the "let-off" distances relative to the carefully created Zero Position Plane allows one to quickly see how they vary relative to a meaningful horizontal datum, or to the key bed itself.

L. The Inertial Parameter Terminology a. Local Inertial Force and Local Inertia

Some of the embodiments of the invention are methods of measuring inertial parameters of an isolated individual component of the key mechanism, about some convenient axis. The chosen axis would normally be parallel to (if not coincident with) the standard/usual axis of rotation for that component during normal operation. The standard/usual axis about which an individual action component rotates during normal operation in the key action will be referred to herein as the Operating Axis of the component. These parameters will be known herein as "local inertial parameters". In the typical piano, the three individual key action components possible to measure in such a manner are the hammer assembly, the wippen assembly and the key itself (with or without embedded key leads). The Local Inertial Parameters are: (1) Local Inertial Force, and (2) Local Inertia. As will be seen, the Local Inertial Force will normally be measured simply as a necessary step in determining the component's Local Inertia about the chosen axis. The Local Inertia is the actual "mass moment of inertia" of the component about the designated axis. It has units of mass times "length squared". It states exactly how much resistance—due solely to inertia of the distributed mass of the component—there would be to any possible angular acceleration of the component about the designated axis. It is an intrinsic property of the component (for the given axis), in that it is independent of the magnitude of the angular acceleration. The Local Inertial Force is the force at some point of application, generated solely by inertia as the component is accelerated at some constant angular acceleration about that axis. It is directly dependent upon the magnitude of angular acceleration. It also depends upon the point of application of the Contact. That is, it depends upon the moment arm about the designated axis. Once the Local Inertial Force is known/measured for some angular acceleration, about any chosen pivot, the Local Inertia (i.e. mass moment of inertia) about that same pivot is obtained from Newtonian physics. If the chosen pivot does not coincide with (but is parallel to) the Operating Axis, the Local Inertia about the Operating Axis can then be obtained by applying the Parallel Axis Theorem. In some cases, it is desirable for a Local Inertia value (about the Operating Axis) to be further manipulated to determine that particular component's "reflected", "equivalent" or "component" inertia "at the key". This concept is discussed in the next section, and elsewhere herein.

b. Reflected (Component) Inertia "at the Key"

In this context, "component inertia" and "reflected inertia" are the same thing. The latter term is preferable since "component inertia" might be mistakenly confused with Local Inertia. When one knows the "reflected" inertia "at the key" due to any particular component "X" in the key action, this value will be referred to herein as the X Inertia at the Key. For example, if one knows the "reflected" inertia at the key of the hammer assembly (say, after measuring the "local inertia" of the hammer assembly about its Operating Axis), it is referred to as the Hammer Assembly Inertia at the Key. Knowing this value means that—from an inertial perspective—the Hammer Assembly could be replaced by adding mass that rotates with the key, about the key's pivot axis, with the inertia of the mass—about that axis—equal to the Hammer Assembly Inertia at the Key. This concept even applies to the key itself, if its inertia is known about some axis other than its Operating Axis (i.e., at the balance rail pin opening). If this is the case, then the key's "reflected" inertia "at the key" is found using the parallel axis theorem. It would be somewhat awkwardly called the Key Inertia at the Key. Thus it is seen that the phrase "at the key" always implies not only the key, but also rotation about the Operating Axis of the key, at the balance pin hole. Unless specifically noted otherwise, the phrase "reflected inertia" by itself implies reflected inertia "at the key".

c. The Total Inertia Parameters

Probably the most important inertial parameters described herein are those that express the combined (or global) inertia "at the key", of the entire "in place" key mechanism. On an actual piano key mechanism, these parameters may be obtained in two ways: (i) via direct force measurement "at the key", followed by appropriate calculations, or (ii) by summing the "reflected inertia" values of the major components' local inertias. The first will be called the "direct" method; the second the "indirect" method. There are three "global inertia parameters": (1) Inertial Force (IF), (2) Inertia at the Key (IK), and (3) Effective Mass (EM). These are parameters directly related to how much torque or force is produced at the key itself, due solely to all of the mass in the complete piano key mechanism being resistant to a downward acceleration at some A.P. on the key. Each of these parameters provides a much-needed quantification of the "dynamic feel" of an entire key action under accelerated downstrokes. As will be demonstrated shortly, both the IK and the EM are "intrinsic" properties of the key mechanism, in that they are independent of the acceleration at the A.P. They both depend greatly upon the balance rail pivot point "P", and the EM depends also upon the exact location of the A.P. On the other hand, the Inertial Force (IF)—as will be subsequently shown—is directly proportional to the acceleration at the A.P.

When determining Global Inertia Parameters by adding the reflected inertias of the individual components (i.e., the "indirect method"), the result of this addition is the IK. Either the EM or the Inertial Force can then be determined from the proper equation. Since the IF is not an "intrinsic" property of the mechanism, it would have to be associated with some chosen acceleration at the A.P. For this reason, the IF is generally only a means to an end, used only when directly measuring the entire mechanism. As will be shown, once the IF is measured at the key, the two intrinsic inertial properties (IK and EM) are obtained from it. There is generally no need to proceed in the opposite direction (from IK to IF).

For very simple geometries, all three "classes" of inertial parameters (local, reflected and global) can be calculated theoretically using Newtonian physics. When these parameters are determined using pure theory and/or physics, the determination is referred to as "theoretical or conceptual". "Theoretical determination" can only be done on a "simplified" or idealized piano key action or component, as opposed to the "complicated" actual piano key action and components. For these more complicated geometries, it is only practical to determine these parameters via careful kinetic measurement, with appropriate methods, equipment and some complementary application of physics. What makes a piano action (or component of an action) "complicated" in this respect is the lack of pure "point masses", along with the lack of uniform (and known) lever/member densities and cross-sections. Changing leverages throughout the key action's stroke can also make things more difficult, and requires that certain assumptions be made. When inertial parameters are determined with the help of any sort of kinetic force or acceleration measurement—on component parts or on the "in place" total mechanism itself—the determination is referred to as "experimental" or "test-based".

M. Defining and Measuring Local Inertia

Figure 29:
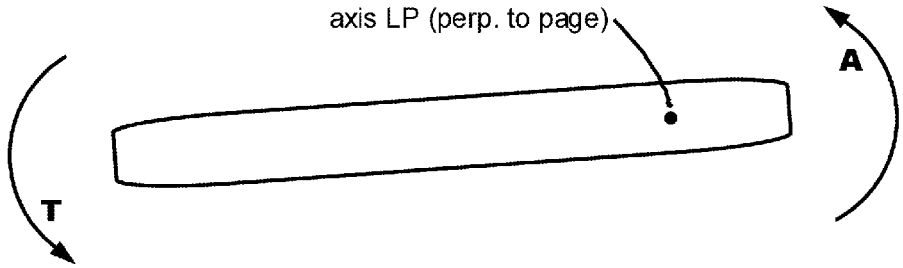
FIGS. 29 (*a*), 29 (*b*) and 29 (*c*) are representations of a generic component, in support of descriptions of various local inertial parameters.
Figure 29:
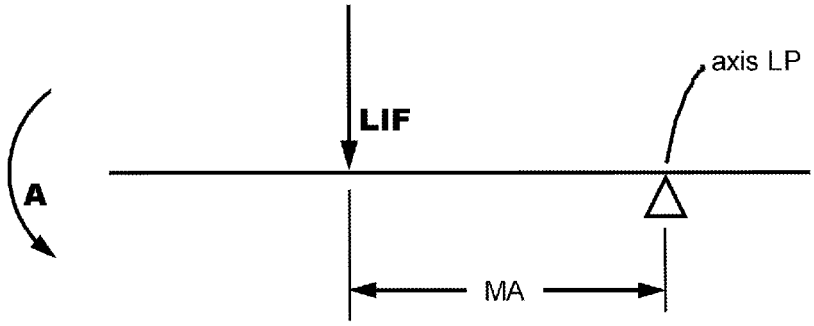
Figure 29:
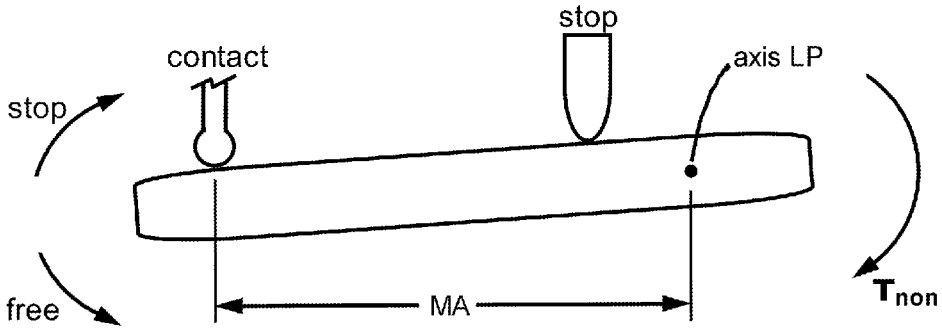

Imagine a generic component that rotates in a plane, about an axis "LP" that is normal to that plane, as shown in FIG. 29(*a*). The axis is perpendicular to the page in the figure. Let the Local Inertia of this component, about axis LP, be called $I_{loc,LP}$. Imagine it is rotating in a "zero gravity" environment, and that the friction at the pivot/axis LP is zero. There are no spring or magnetic forces acting. If the application of a constant CCW torque T (about axis LP) to the component causes an angular acceleration of α, then $I_{loc,LP}$ is defined by the equation:

$$T=(I_{loc,LP})(\alpha)$$

In the figure, α is shown as "A". One can also look at this equation as saying: Rotating the component at some constant angular acceleration "α" requires the application of a constant torque "T" (about axis LP) equal to $(I_{loc,LP})(\alpha)$. Since the torque is due solely to acceleration of distributed mass about the axis, it is wise to call it an "inertial torque". In many cases, this "inertial torque" will be created by a contact force, applied by a Contact at some distance (moment arm) from the axis LP. Such an applied force, necessary to accelerate the component in this zero-gravity and zero-friction situation, is therefore an "inertial force". It is caused exclusively by the inherent resistance of the component's mass to being accelerated about the axis. This situation is shown in FIG. 29(*b*), in the form of a simple free body force diagram. Calling this "local inertial force" LIF, the above equation becomes:

$$LIF = \frac{I_{loc,LP} \cdot \alpha}{MA} \quad \text{(Equ. 9)}$$

where MA is the moment arm of the applied force (LIF) about LP. One sees from this equation that the Local Inertial Force generated by any given angular acceleration (about LP) is directly proportional to the Local Inertia $I_{loc,LP}$. It is assumed here that there is negligible friction between the Contact and the component.

Figure 30:
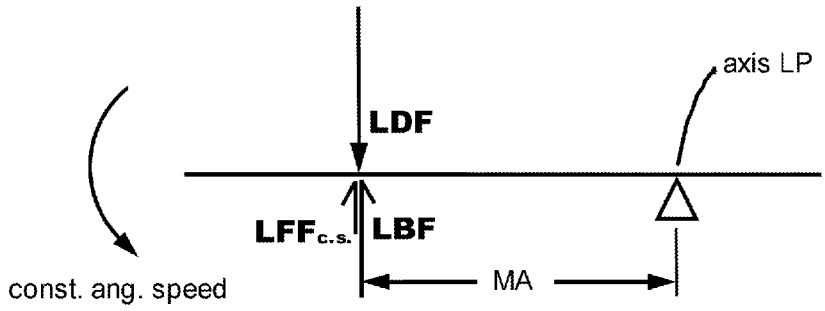
FIGS. 30 (*a*) and 30 (*b*) are free body diagrams for certain static and dynamic movements, respectively, of a generic component.
Figure 30:
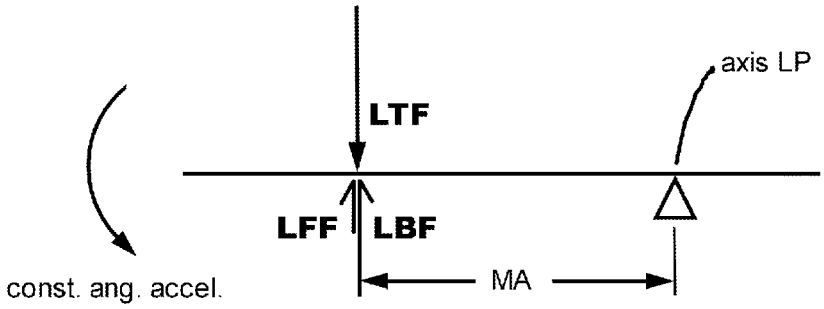

Of course, it is impractical to perform such "zero gravity" and "zero friction" measurements, which would measure the Local Inertial Force directly. In the real world, there will be friction to some degree. And in the real world, one must perform the acceleration and measurement in the normal Earth gravity, where gravity forces are also acting on the component. This necessitates performing other "constant speed" tests, to determine the friction and non-inertial forces. The same basic principles that were discussed herein when defining Down Force, Up Force and Balance Force will be employed for this. Assume that the component of FIG. 29(*a*) now has gravity and spring/magnetic forces acting on it. FIG. 29(*c*) shows such a component in a static, "rest" position. If the component is rotated slightly in the CCW direction and "let go", a non-inertial, restoring force or forces (gravity, springs, etc.) will bring it back to its rest position. The rest position may be created with a "stop" of some sort, preventing the rotation of the component (due to springs, gravity, or magnets) in one particular direction. The torque vector $T_{non}$ is shown in FIG. 29(*c*), to represent the combined torque (moment) of all non-inertial forces other than friction. It is this moment that produces the "local Balance Force" at the Contact. The direction corresponding to moving the component from its rest/stop position will be referred to as the "free" direction. The direction corresponding to moving the component back towards the rest position is the "stop" direction. In FIG. 29(*c*), the free and stop directions are CCW and CW, respectively. Assume some sort of Inducer/Sensor (i.e. the Contact) can rotate the component in some desired manner, while simultaneously measuring the reactive force generated. If the Contact moves so that the component rotates at or near a constant angular speed—in the "free" direction—the reactive force at any instant will be called the Local Down Force (LDF). This terminology is used to be consistent with the "static forces" terminology described elsewhere herein. The "local" modifier is added to stress the fact that this is for an isolated component, as opposed to the entire key action. At any point during this "downstroke", the movement is resisted by (1) a Local Balance Force (LBF), and (2) a local "constant speed" frictional force ($LFF_{c.s.}$). The LBF is due solely to gravitational forces (and "springlike" forces and magnetic forces, if applicable). FIG. 30(*a*) is the free body diagram for this constant-speed situation.

At the end of the angular displacement, the Contact allows the component to rotate back in the "stop" direction, but also at some nearly-constant angular speed, while measuring the reactive force. This force, at any instant, is called the Local Up Force (LUF), and is equal to the LBF minus the $LFF_{c.s.}$. The free body diagram for this "upstroke" movement would look the same as FIG. 30(*a*), except that the frictional force ($LFF_{c.s.}$) would point downward (opposing the upward motion), the angular velocity would be clockwise, and LDF would be replaced with LUF. The LBF is a continuous function across the same range where Local Down Force and Local Up Force are measured. At any point in the stroke, it is exactly halfway between the value of the Local Down Force and Local Up Force. When the LBF is averaged over some range/stroke, one has the Average Local Balance Force (ALBF). When the LDF is averaged over some range, the result is the Average Local Down Force (ALDF). The average of the Local Up Force, preferably over the same angular region as was used for obtaining the ALDF, is called the Average Local Up Force (ALUF). If there is friction involved, ALUF will be less than ALDF. At any point along the range, the constant-speed "local frictional force" ($LFF_{c.s.}$) is equal to half the difference between the Local Down Force and the Local Up Force. The average of the constant-speed "local frictional force" ($ALFF_{c.s.}$) over that same angular range can be determined from the equation:

$$ALFF_{c.s.} = \frac{(ALDF - ALUF)}{2}$$

And also one can see that:

$$ALDF = ALBF + ALFF_{c.s.} \quad \text{(Equ. 10)}$$

Focus is now shifted back to the necessary "acceleration" tests in this "normal gravity" environment. Assume the component of FIG. 29(*c*) is in the same rest/stop position as was described in the "constant speed" tests above. Assume that the Contact accelerates the component—at a constant angular acceleration—away from this equilibrium position, in the "free" direction (CCW in figure). The Free Body Force Diagram for such a movement is shown in FIG. 30(*b*). The reacting force due to all "non-inertial and nonfrictional" forces is still the same LBF. The reaction force due to friction is the "local frictional force (LFF). In the figure, notice how LFF and LBF oppose the applied force, just as in the constant speed situation of FIG. 30(*a*). The total applied force necessary to create the desired angular acceleration against gravity, springs (and magnets), friction and inertia is called the "local total force", or LTF. Summing moments about LP at any point within the movement, and using Newton's $2^{nd}$ Law gives:

$$(LTF)(MA) - (LBF)(MA) - (LFF)(MA) = (I_{loc,LP})(\alpha)$$

Dividing out the "MA" terms and using eq. 9 yields:

$$LTF = LBF + LIF + LFF$$

Since acceleration is now involved, the frictional force (LFF) is now made up of two components: 1) the traditional "constant speed" force, and 2) an "accelerated frictional force" value. The concept of "accelerated friction" will be discussed shortly. In equation form, this is:

$$LFF = LFF_{c.s.} + LFF_{acc}$$

where LFF is the total frictional force, $LFF_{c.s.}$ is the "constant speed" frictional force, and $LFF_{acc}$ is the "accelerated" frictional force. Plugging this into the above equation for Local Total Force yields:

$$LTF = LBF + LIF + LFF_{c.s.} + LFF_{acc}$$

Using average values over some region of the movement, this equation becomes:

$$ALTF = ALBF + ALIF + ALFF_{c.s.} + ALFF_{acc}$$

But using the definition of Average Local Down Force (ALDF) from eq. 10 gives:

$$ALTF = ALIF + ALDF + ALFF_{acc} \quad \text{(Equ. 11a)}$$

Using equation 9 again (in average form) gives the alternative form:

$$ALTF = \frac{(I_{loc,LP})(\alpha)}{MA} + ALDF + ALFF_{acc} \quad \text{(Equ. 11b)}$$

So the total applied force at the given application point (moment arm), necessary to produce an angular acceleration α, is the sum of the Local Inertial Force, the Local Down Force and an "accelerated friction" force. For any given angular acceleration value, equation 11 must hold.

The "constant speed" frictional force is included in the Local Down Force measurement. However, when the component is accelerated, the reactive force increases from its Local Down Force value (due to the inertia of the component). This in turn tends to cause an increase in the reaction force at the joint (axis LP). If all of the "constant speed" friction at the joint were due to Coulomb friction, then the higher reaction force experienced during the accelerated run will necessarily cause increased frictional torque. The larger the acceleration, the more the friction increases. This added frictional force, brought on by acceleration, is known herein as the "accelerated local frictional force" $LFF_{acc}$. Its average value is $ALFF_{acc}$. However, some or all of the component's constant-speed frictional force may be due to "non Coulomb" friction as well. That type of friction does not depend on the joint force. If the joint is made up exclusively of this type of friction, or has no friction at all, then the frictional force will remain at the "constant speed" value, even during accelerated runs. A Local Friction Sensitivity Factor "$c_{loc}$" will be employed to account for the possibility of increased frictional force during acceleration runs of a component. The factor will vary depending on the mechanism and loading situation, and could potentially even be negative. When the factor is zero, the acceleration of the component has no effect on friction.

An expression for this average "accelerated local frictional force" will now be developed, incorporating and defining the Local Friction Sensitivity Factor "$c_{loc}$". The expression is:

$$ALFF_{acc} = c_{loc} \cdot ALFF_{c.s.}\left(\frac{ALIF}{ALDF}\right) \quad \text{(Equ. 12a)}$$

Using an "average" form of eq. 9, one gets the alternative form:

$$ALFF_{acc} = c_{loc} \cdot ALFF_{c.s.}\left(\frac{I_{loc,LP} \cdot \alpha}{ALDF \cdot MA}\right) \quad \text{(Equ. 12b)}$$

If $c_{loc}=1$, then doubling the applied force (from ALDF to 2ALDF), due to acceleration, would double the frictional force. That is, if ALIF=ALDF, then $ALFF_{acc}=(1)(ALFF_{c.s.})$ (1), or $ALFF_{c.s.}$, meaning that the total frictional force $ALFF=ALFF_{c.s.}+ALFF_{c.s.}$, or (2)($ALFF_{c.s.}$). Although the form shown here (in equ. 12a) has $ALFF_{acc}$ varying linearly with the ratio of "inertia to static" forces, it might also vary in some nonlinear way. For instance, one might find that in certain situations, eq. 12a would work better if the term (ALIF/ALDF) was raised to some power. That exponent could be "2", or possibly "½". However, I will assume herein that eq. 12a/b is sufficient in its stated "linear" form.

For any given angular acceleration used in an "acceleration run", equations 11 and 12 must hold. For a given value of "$c_{loc}$", one has—for any given acceleration "α"—two equations (11a/b and 12a/b) and two unknowns ($I_{loc,LP}$ and $ALFF_{acc}$). Of course, ALTF is determined from the acceleration run force data, while ALDF and $ALFF_{c.s.}$ are known from one or more separate "constant speed" runs. Equations 11b and 12b are solved simultaneously, resulting in:

$$I_{loc,LP} = \frac{(ALTF - ALDF)(MA)}{\left(1 + \frac{c_{loc} \cdot ALFF_{c.s.}}{ALDF}\right)(\alpha)} \quad \text{(Eq. 13a)}$$

$$ALFF_{acc} = \frac{c_{loc} \cdot ALFF_{c.s.}(ALTF - ALDF)}{(ALDF)\left(1 + \frac{c_{loc} \cdot ALFF_{c.s.}}{ALDF}\right)} \quad \text{(Eq. 13b)}$$

Of course, per equ. 9, the Local Inertial Force (LIF or ALIF) is obtained by multiplying $I_{loc,LP}$ by the term "α/MA". Thus, an alternative to Eq. 13a becomes:

$$ALIF = \frac{(ALTF - ALDF)}{\left(1 + \frac{c_{loc} \cdot ALFF_{c.s.}}{ALDF}\right)} \quad \text{(Eq. 13c)}$$

Since the angular acceleration "α" can be approximated as the linear acceleration "a", divided by the moment arm "MA", eq. 13a can also be expressed as:

$$I_{loc,LP} = \frac{(ALTF - ALDF)(MA)^2}{\left(1 + \frac{c_{loc} \cdot ALFF_{c.s.}}{ALDF}\right)(a)} \quad \text{(Eq. 13d)}$$

The "1+ . . . " term in the denominator of equations 13a, 13b, 13c and 13d will be referred to herein as the Local Friction Sensitivity Sum. That is:

$$LocalFrictionSensitivitySum = \left(1 + \frac{c_{loc} \cdot ALFF_{c.s.}}{ALDF}\right) \quad \text{(Eq. 14)}$$

Notice that if the ratio of $ALFF_{c.s.}$ to ALDF is small, then the value of "$c_{loc}$" doesn't matter very much. The larger the "constant speed friction" to "static force" ratio is, the more importance the exact value of "$c_{loc}$" has. If the ratio is zero (i.e., no friction), then the Local Friction Sensitivity Sum becomes "1", with "$c_{loc}$" having no consequence or meaning whatsoever. Making use of this equation for the Local Friction Sensitivity Sum, equation 13d becomes:

$$I_{loc,LP} = \frac{(ALTF - ALDF)(MA)^2}{(\text{Loc. Friction Sensit. Sum})(a)} \quad \text{(Eq. 15)}$$

If "accelerated friction" effects are assumed to be negligible, then "$c_{loc}$" is zero, the Friction Sensitivity Sum is 1.0, and the equation becomes:

$$I_{loc,LP} = \frac{(ALTF - ALDF)(MA)^2}{(a)} \quad \text{(Eq. 16)}$$

The process of calculating the Local Friction Sensitivity Sum as given in Eq. 14 is herein referred to as a Step for Calculating Local Friction Sensitivity Sum. This step might include adding terms to either side of Eq. 14, as long as they are subsequently subtracted. This step might include multiplying some or all of the terms in Eq. 14 by one or more terms, as long as each of those terms is also multiplied by its own inverse. This step might also include any sort of function acting on one or more terms of Eq. 14, as long as each of those functions is subsequently cancelled by its inverse function. In short, if any sort of unnecessarily complicated equation is created, whose end result looks essentially as that of Eq. 14, that entire mathematical process is still considered as a Step for Calculating Local Friction Sensitivity Sum.

The process of calculating the Local Inertia per Eq. 15 is herein referred to as a Step for Calculating Local Inertia. This step might include adding terms to either side of Eq. 15, as long as they are subsequently subtracted. This step might include multiplying some or all of the terms in Eq. 15 by one or more terms, as long as each of those terms is also multiplied by its own inverse. This step might also include any sort of function acting on one or more terms of Eq. 15, as long as each of those functions is subsequently cancelled by its inverse function. In short, if any sort of unnecessarily complicated equation is created, whose end result looks essentially as that of Eq. 15, that entire mathematical process is still considered as a Step for Calculating Local Inertia. The step might also include the substitution of "MA divided by the angular acceleration" for the quotient "$MA^2$ divided by a", since the two terms are essentially equal, as described above.

The process of calculating the Local Inertia per Eq. 16 is herein referred to as a Step for Calculating Local Inertia with Accelerated Friction Neglected. This step might include adding terms to either side of Eq. 16, as long as they are subsequently subtracted. This step might include multiplying some or all of the terms of Eq. 16 by one or more terms, as long as each of those terms is also multiplied by its own inverse. This step might also include any sort of function acting on one or more terms of Eq. 16, as long as each of those functions is subsequently cancelled by its inverse function. In short, if any sort of unnecessarily complicated equation is created, whose end result looks essentially as that of Eq. 16, that entire mathematical process is still considered as a Step for Calculating Local Inertia with Accelerated Friction Neglected. The step might also include the substitution of "MA divided by the angular acceleration" for the quotient "$MA^2$ divided by a", since the two terms are essentially equal, due to basic trigonometry.

One should be a bit careful in choosing the value for "$c_{loc}$". If it is chosen too high, then too much of the added force of the acceleration run will be attributed to "accelerated frictional force", and too little to inertia itself. If it is chosen too low, then the opposite is the case. The remedy here could be to perform additional runs at other acceleration values, solving again for $I_{loc,LP}$ and $ALFF_{acc}$ in each case. If "$c_{loc}$" was chosen wrong, then the resulting value for $I_{loc,LP}$ will be significantly different for each separate run/acceleration. Of course, in reality $I_{loc,LP}$ is an intrinsic property of the component (like mass would be for a one-dimensional situation), having one unique value independent of the acceleration. If this disagreement in $I_{loc,LP}$ occurs, the value of "$c_{loc}$" is then changed (say, from 0.0 to 0.1) and one again solves for $I_{loc,LP}$ and $ALFF_{acc}$ for each run/acceleration. Because $ALFF_{acc}$ and the Local Inertial Force (ALIF) have different relationships with respect to acceleration, this iterative process with "$c_{loc}$" should allow the proper value for ALIF (and thus $I_{loc,LP}$) to be nailed down. One keeps changing "$c_{loc}$"—between zero and, say, 1.0—until each acceleration run yields a sufficiently identical value for $I_{loc,LP}$. However, in many instances, it is sufficient to simply choose a reasonable value for "$c_{loc}$", with no iterating involved.

Since the component is not infinitely stiff, there will be oscillations present in the "total force" curve/data. The physical nature of these oscillations makes it extremely important how the average of the LTF (or Total Force, for "global" tests) is obtained. The exact region over which the ALTF is obtained from the LTF is critical to obtaining good results from such tests. More specifically, one would look for certain "averaging points" in the LTF curve/data, two of these points indicating where the "total force" averaging is to begin and end. Once determined from the "total force" curve/data, these same two "averaging points" could also be used as the limits/boundaries for averaging the Local Down Force as well. The process of determining these points, between which the total applied force (either LTF or Total Force) is to be averaged, will be referred to herein as Determination of Total Force Integration Limits. The process is essentially identical, whether one is averaging Local Total Force or Total Force (i.e., for "global" inertia tests). In the description that immediately follows, "total force" refers to either Local Total Force or Total Force (described fully in section O on global inertial properties).

The process consists of choosing an appropriate startpoint and endpoint for the integration/averaging of the total force. Energy is being periodically absorbed and released by the component(s) (most importantly, the hammer shank) during the acceleration stroke. This causes the resulting total force data/curve to have local peaks and troughs (maxima and minima) along the downstroke. The philosophy behind the Determination of Total Force Integration Limits appears to be that the elastic potential energy state of the shank (due to vibrational bending) should be at—or consistently offset from—a "maximum state", both at the end of the averaging period and at the beginning. The shank bends due to the inertia of the heavy hammer head perched out near its end. Employing too low of a cut-off frequency on the low-pass filter prevents the shank's potential energy state from being deciphered whatsoever, leading to inaccurate "average total force" values. Information about the exact timing of the oscillations is therefore lost. The cut-off frequency value used for the acceleration runs herein is about 56 Hz, while employing an active $8^{th}$ order low-pass Bessel Filter. Synchronizing the forces is not essential when trying to determine the average "total force" from the data. Remaining in the time domain (i.e. no force transposition), one simply needs to average forces between the selected "averaging points", and only "delta times" are important. In general, one should use as the fastest acceleration a value that allows at least two peaks to be located on the total force data. For such a run, one could then choose the first peak and the second peak as the "averaging points".

The portion between two successive peaks, or two successive "troughs", of the curve/data represents one period of the oscillation. This period will normally vary as the downstroke progresses, due to damping and other factors. In terms of radians, one period is $27\pi$ (approximately 6.28) radians. Once a "start point" is chosen, one should choose as the "end point" a point that is a multiple of $\pi$ radians (i.e. half a period) further along the curve, and preferably at least $27\pi$ radians (i.e. a full period). The "distance" between the start point and the end point, in terms of radians, will be referred to herein as the Radian Distance. Regarding the "start point" itself, it is usually desirable for it to represent a peak on the force curve, although a trough may sometimes be chosen. This makes it much easier (and indeed, possible) to find the endpoint, since it will then also lie on a peak or trough. Of course, there will only be a very limited number of peaks and troughs on any force curve, since the travel of the Contact is limited. The start point should generally correspond to the first peak. It could, however, be offset from a peak or trough by some fraction of the period. For example, it may be $\pi/4$ radians to the left of the first peak. The endpoint for that case should therefore be also $\pi/4$ radians to the left of a subsequent peak or trough, thus giving a multiple of $\pi$ as the Radian Distance. Because of the varying period along the stroke, it is not very practical or accurate to use anything other than a peak or a trough for either the startpoint or endpoint.

In general, if there is enough data to discern a peak or trough an additional $\pi$ radians further to the right, one should choose it. That is, if one can choose the endpoint so that Radian Distance equals either $2\pi$ or $3\pi$, one should generally choose $3\pi$. Doing so provides more Contact travel between the startpoint and the endpoint. It is also often a sound strategy to match a peak with a peak. That is, if one chooses a peak for the start point, it is often advisable to also choose a peak for the end point (i.e., Radian Distance will be $2\pi$, $4\pi$, $6\pi$, etc.). These two guidelines therefore must be balanced against one another, based on experience with certain types of hammers or actions, etc. Note that these procedures apply equally well if the forces are graphed versus distance (i.e. transposed forces). Whether time or distance, one finds a good "start point" and "endpoint" for force-averaging, based on the rules and guidelines given here. Following these rules represents the process of Determination of Total Force Integration Limits.

When performing the "static force" runs and acceleration runs (for Total Inertia determination) on a complete piano key action, the pivot arm tends to be quite large (200 mm or more). That is, the distance from the balance rail pin to the traditional A.P. is usually 200 mm or more. In addition, the angle of rotation of the key is quite small (3 degrees maximum). With Local Inertia measurements, the Contact will usually be much closer to the pivot point of the component being moved/measured. Thus, the angle of rotation for the same linear displacement of the Contact is quite large (as much as 20 degrees with a moment arm of 30 mm). Because of this trigonometry, a constant vertical acceleration of the Contact does not exactly correspond to a constant angular acceleration of the component. Similarly, a constant vertical speed of the Contact does not exactly correspond to a constant rotational speed (angular velocity) of the component. It takes more math to get the necessary equations for the Contact movement associated with either a constant angular acceleration or a constant angular speed of the component about LP. Solving for the motion equations of the vertically-moving Contact that is required to ensure either constant angular speed or constant angular acceleration of the component leads to fairly complicated equations involving tangents of angles. When the time "t" is extracted, the result is arctangent functions. Tests performed by the author showed that adding this level of "exactness" to the motion does very little to improve the calculated inertia values. For this reason, it is sufficient to treat these movements of the hammer assembly in essentially the same way as is done herein on the full key mechanism. That is, it is assumed that moving the Contact at constant speed (or acceleration), in a direction essentially normal to the hammer shank, achieves sufficiently constant angular speed (or angular acceleration) of the hammer assembly.

With respect to finding an "average force" from a series of force data, this average is generally best determined through some sort of numerical integration. To those skilled in the art, this is a fairly common way of determining the area beneath a graph of, say, an ordinate representing force, relative to a time or displacement variable representing the abscissa. The process of determining an average force from any of the various force data described herein (be it "local" static, inertial, or "total" forces, or "global" static, inertial, or "total" forces) is herein referred to as "force averaging" or "averaging force". It applies to measured forces obtained during a stroke or portion thereof, and may be done with numerical integration or any other means, whether using a computer or not.

Actual Tests Local Inertia of a Hammer Assembly

Figure 31:
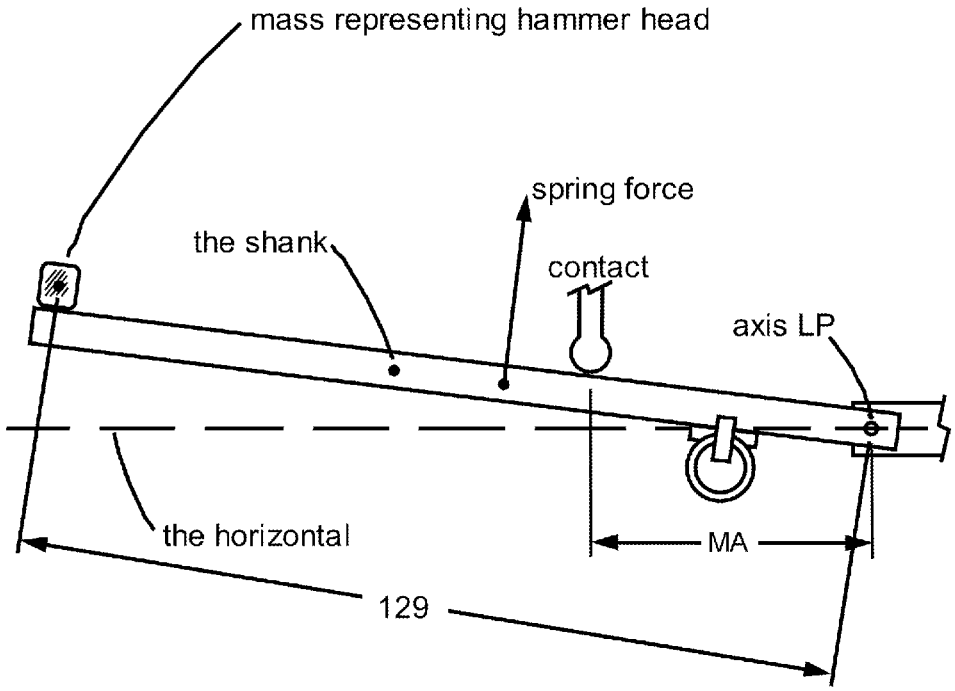
FIG. 31 shows a slightly-simplified hammer assembly, including a means for "preloading" it, and a means for exciting it with a Contact.

An actual piano hammer assembly was tested in this manner. Four separate accelerations were used. The sensitivity factor "c" was chosen as 0.5, and the Local Inertia and ALF-$F_{acc}$ were determined at each acceleration (using eq. 13). A simple extension spring exerts an upward force on the component (the non-inertial torque/moment). The spring constant is fairly small, so that the spring force does not vary tremendously throughout the stroke. A physical "stop" is present, so that the hammer shank is preloaded into an initial "rest" position by the spring force. The moment arm "MA" is approximately 28 mm. FIG. 31 shows the hammer at some "mid stroke" position. For purposes of theoretical verification of results, the hammer head was actually removed and replaced with a simple 9.8 gram "point mass", sitting at the end of the shank as shown. The distance from the pivot axis to the mass is 129 mm, while the distance from the axis to the end/tip of the shank is 133 mm. The mass of the shank itself is 4.5 grams (approximated to have constant linear density along its length). The mass of the knuckle is neglected, being so close to the pivot. The actual Local Inertia, about axis LP is thus:

$$I_{loc,LP}=(1/3)(4.5)(133)^2+(9.8)(129)^2=189{,}615\ \text{g}\cdot\text{mm}^2$$

Figure 32A:
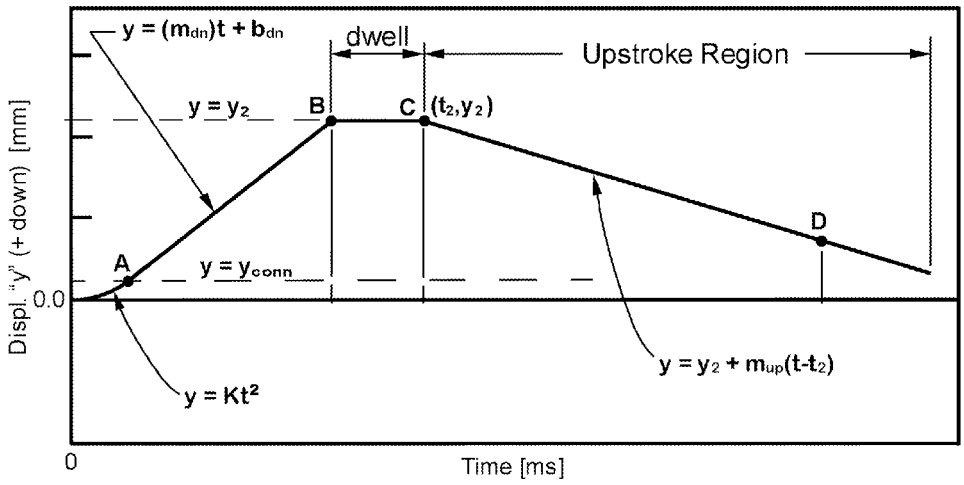
FIG. 32 (*a*) shows a Motion Profile for a Contact moving the same hammer assembly, where a constant-speed downstroke and a constant-speed upstroke are created.
Figure 32B:
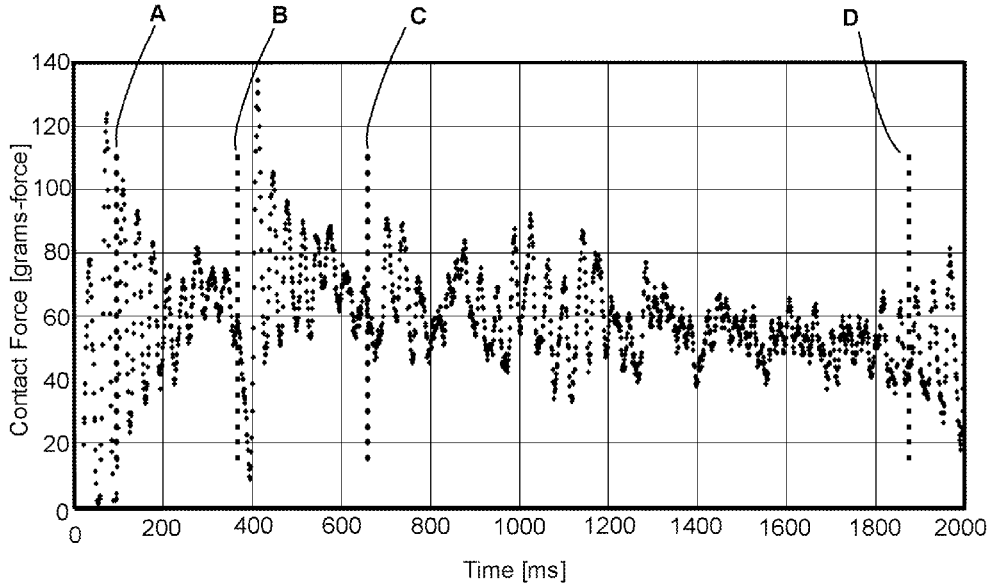

FIG. 32(*a*) shows the Motion Profile used for the constant-speed "down and up" run, used to determine the Local Down Force (LDF) and Local Up Force (LUF). Note that, as with the "full key mechanism" Down Force and Up Force runs discussed extensively herein, the goal here is for the Contact to move at constant speed during the "static" downstroke and upstroke. One sees in FIG. 32(*a*) that the downstroke begins with a brief acceleration region, until the Contact reaches the desired linear speed for the downstroke (the "$m_{dn}$" value). The stroke then continues until the maximum displacement "$y_2$" is achieved, where the Contact abruptly stops. After a "dwell" period, the motion resumes, but in the "up" direction, and at a constant speed of "$m_{up}$". This continues until the Contact is back within a millimeter or less of its Home Position. In this run, $y_2$ was 8.9 mm, and $y_{conn}$ was 0.8 mm. This latter term ($y_{conn}$) is the displacement where the motion, changes from the parabolic region to the pure linear region. If one knows $y_{eonn}$ and $m_{dn}$, then one gets: $K=m_{dn}^2/4\cdot y_{conn}$, where K is the coefficient of the short acceleration region. One then gets: $b_{dn}=-m_{dn}^2/4K$, which also equals $-y_{conn}$. Of course, $b_{dn}$ is the "y-intercept" of the linear equation line. Thus, once a value for $y_{conn}$ and $m_{dn}$ are chosen, one obtains K, and then $b_{dn}$. The value of $m_{dn}$ used was 0.0263 mm/ms. Point A is the point where force averaging on the downstroke begins. In this example, it is approximately equal to $y_{conn}$. The elapsed time to reach $y_2$ (point B in FIG. 32(*a*)) was thus 370 ms. With a dwell time of about 205 ms, the time to point C (i.e., $t_2$) was 575 ms. At that point the upstroke began, with a speed of 0.00588 mm/ms. The resulting force data from the "constant speed" downstroke, followed by the "constant speed" upstroke, is shown in FIG. 32(*b*). These forces are synchronized, with "time zero" of the Motion Profile corresponding to the origin. Averaging the LDF between points A and B gives an Average Local Down Force (ALDF) of 61.5 grams-force. Averaging the LUF between points C and D (where D corresponds to y=1 mm) gives an Average Local Up Force (ALUF) of 57.3 grams-force. The $ALFF_{c.s.}$ is thus half of this difference (approximately 2 grams-force).

As with the "full key mechanism" acceleration runs discussed elsewhere herein, the goal when measuring LTF values is for the Contact to move at constant acceleration during the downstroke. The four linear accelerations used to determine Local Total Force (LTF) were: 0.00108, 0.00183, 0.00237 and 0.00401 mm/ms$^2$. The moment arm "MA" was approximately 28 mm. Using this MA value, the four linear accelerations correspond to approximate angular accelerations (of the shank) of: 0.0000386, 0.0000654, 0.0000846, and 0.000143 rad/ms$^2$, respectively.

Figure 33A:
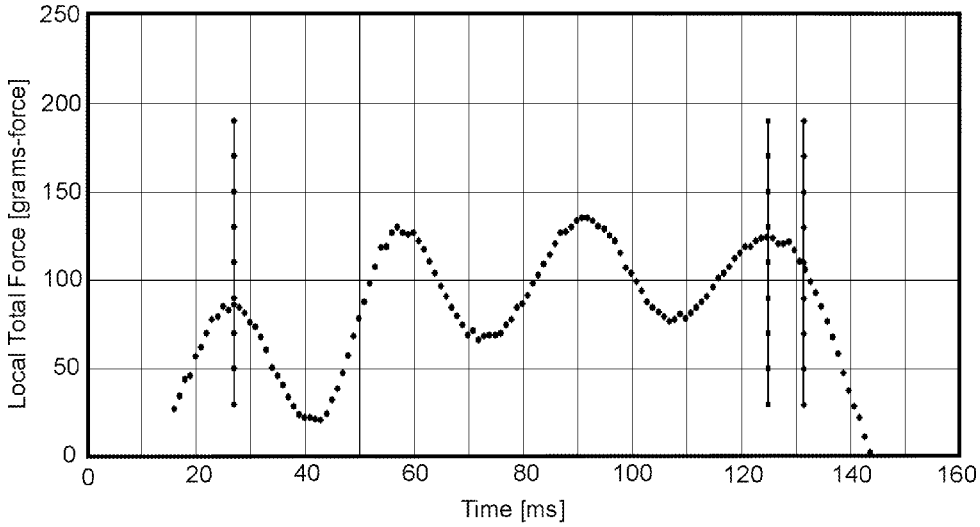
FIGS. 33 (*a*), 33 (*b*), 34 (*a*), and 34 (*b*) show four resulting "total local force" curves, from four increasingly larger downward acceleration runs on the hammer assembly of FIG. 31. The linear acceleration of the Contact was constant during each run.
Figure 33B:
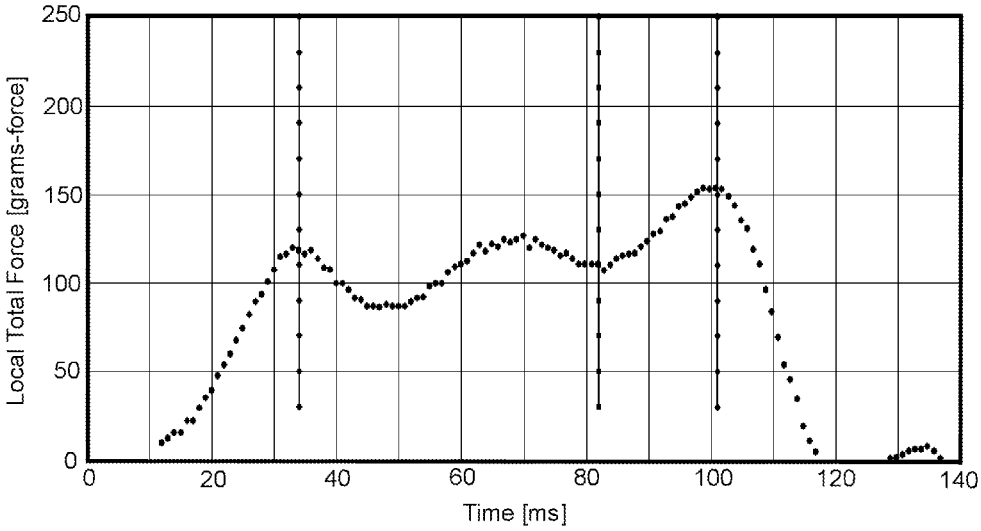
Figure 34A:
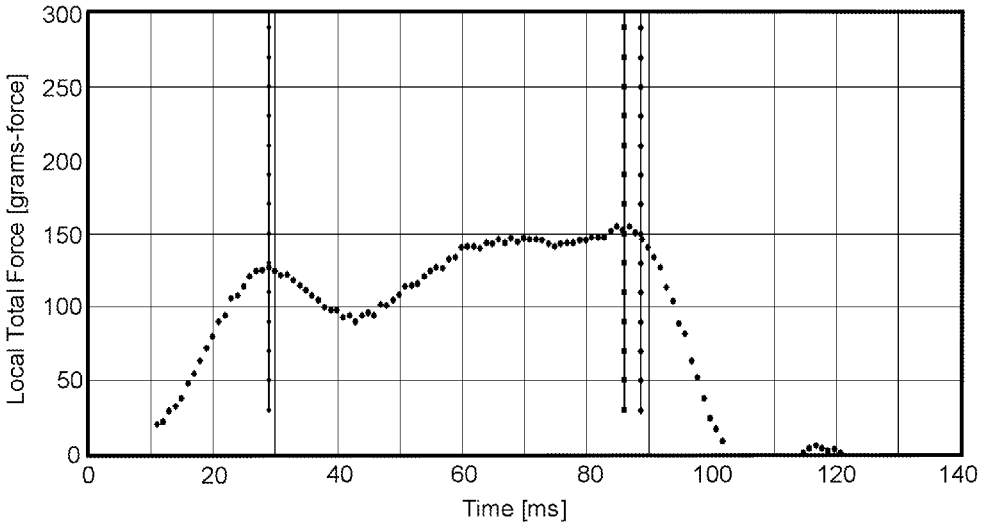
Figure 34B:
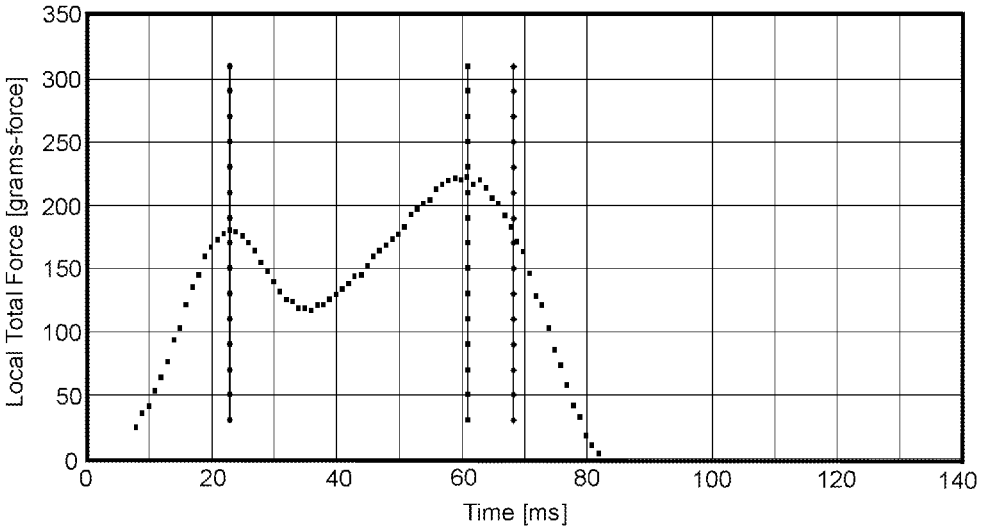

The resulting Local Total Force (LTF) curves for these four accelerations are plotted in FIGS. 33(*a*), 33(*b*), 34(*a*) and 34(*b*), respectively. In FIG. 33(*a*), one sees peaks occurring at approximately t=27, 58, 91, and 125 ms. One also sees "troughs" (i.e., local minima) in the data/curve at approximately 42, 74 and 108 ms. In keeping with the rules mentioned above, the first peak (at t=27 ms) was chosen as the integration startpoint. Similarly, the fourth peak (at t=125 ms) was chosen as the integration endpoint, representing a Radian Distance of 6π. Vertical lines on the graph indicate each of these points. Force Averaging of the LTF between these two points resulted in an ALTF of 89.0 grams-frc. The corresponding displacements for the startpoint and endpoint were then determined, using the mathematical relationship between Contact displacement and time. The Average Local Down Force (ALDF) was then calculated (after implementing separate "static" runs) between those same corresponding displacements. In this run, the ALDF was determined to be 59.63 grams-frc. The Average Local Up Force was also determined from "static runs", and the "constant speed" friction was found to be 1.75 grams-frc. For all four accelerations, the ALTF and ALDF were found to be:

| | | |
|---|---|---|
| Run 1 (.00108 mm/ms$^2$): | ALTF = 89.0 | ALDF = 59.63 |
| Run 2 (.00183 mm/ms$^2$): | ALTF = 102.5 | ALDF = 55.41 |
| Run 3 (.00237 mm/ms$^2$): | ALTF = 124.9 | ALDF = 59.59 |
| Run 4 (.00401 mm/ms$^2$): | ALTF = 160.2 | ALDF = 58.35 |

For each run, these values—along with MA, friction, the chosen sensitivity factor, and the linear acceleration values—are used in equations 13d and 13b to solve for the Local Inertia ($I_{loc,LP}$) and accelerated friction, respectively. The results for each run are as follows:

| | | |
|---|---|---|
| Run 1: | $I_{loc,LP} = 205{,}900$ | $ALFF_{acc} = 0.0042$ |
| Run 2: | $I_{loc,LP} = 195{,}540$ | $ALFF_{acc} = 0.0072$ |
| Run 3: | $I_{loc,LP} = 208{,}591$ | $ALFF_{acc} = 0.0093$ |
| Run 4: | $I_{loc,LP} = 192{,}592$ | $ALFF_{acc} = 0.0148$ |

where the units of Local Inertia and accelerated friction are $g \cdot mm^2$ and grams-force, respectively. It is obvious that the "accelerated friction" is negligible in this situation. Taking the average of the four local inertia values gives a Local Inertia value of 200,655. The Percent Error between the measured value of Local Inertia and the theoretical value obtained above (189,615) is thus only 5.8%.

Of course, for runs 2, 3 and 4, the proper startpoints and endpoints (for Force Averaging) also had to be determined. As the vertical lines indicate in FIGS. 33(*b*), 34(*a*) and 34(*b*), the first peak was used as the startpoint in each case, with a subsequent peak used as the endpoint. In run 3, the third peak was used as the endpoint for averaging; in run 4, the second peak was used. In run 4, with such a high acceleration occurring, things are over quicker, and there were only two total peaks before the stroke ended. In all four figures, the rightmost vertical line represents the very end of the downstroke (approximately 9.3 mm down). In Run 2, the third peak was too close to the abrupt "stop point" of the stroke, so its location could not be determined with confidence. Rather, the second trough was chosen (at t=82 ms) as the integration endpoint. The second peak also could have been chosen, but in general, the more displacement (between startpoint and endpoint), the better. The second peak only corresponded to a displacement of y=4.47 mm, whereas the second trough corresponds to y=6.14 mm (thus, 1.65 mm more travel).

The actual method of locating the appropriate peaks and troughs for averaging "total force" values may involve simply looking at the plot of the forces (like the plots of FIGS. 33 and 34, or 58, 59, 60, etc.). If the graphs are part of a spreadsheet, then one would type in the desired value (time or displacement) for both the startpoint and the endpoint, and the graph would be immediately updated with vertical lines indicating those inputs (for visual verification). The calculations corresponding to Equ. 13 (Equ. 21 for "global" inertia tests) would then be immediately performed in the spreadsheet, with the results displayed in certain cells.

Alternatively, one can have the controlling program perform some of the calculations beforehand. For instance, the controlling program can go ahead and integrate the total force vs. time data from time zero (point TZ), or from the trigger point, to many predetermined points in time (time 15 ms, 20 ms, 25 ms . . . 150 ms, 155 ms, etc.). These integrations (areas) can then be written as part of the output file which is brought into the spreadsheet. Inside the spreadsheet, once the startpoint is selected, the spreadsheet will simply interpolate between the bounding (and known) integration values to calculate the proper integral of the total force curve to that point. Thus if the user chooses 23 ms for the start point, the spreadsheet (knowing the integral to both 20 and 25 ms), performs an interpolation between the 20 and 25 ms values to yield the correct integral from time zero to time 23 ms. The same would be done for a chosen endpoint, and the startpoint integral would then be subtracted from the endpoint integral. This resulting value is then divided by the "delta time" between the startpoint and endpoint to get the proper average "total force". Of course, one could also get more complicated and have the program—or the spreadsheet—use logic to try and locate the peaks and troughs automatically, and go ahead and solve for the average total force.

Figure 35:
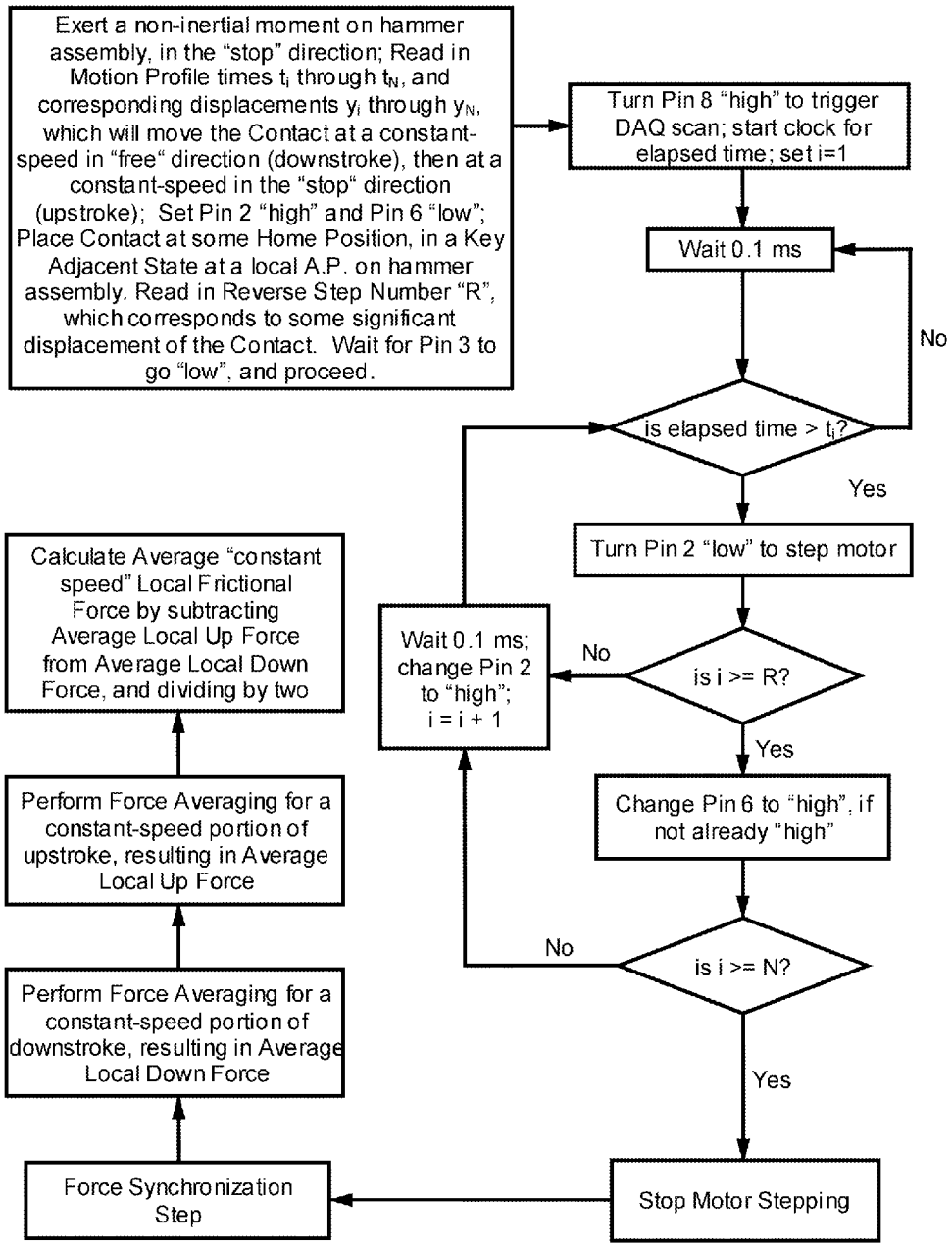
FIG. 35 is a flowchart detailing a run and subsequent operations, on a hammer assembly, where average local down force, average local up force and average local friction are determined.
Figure 36:
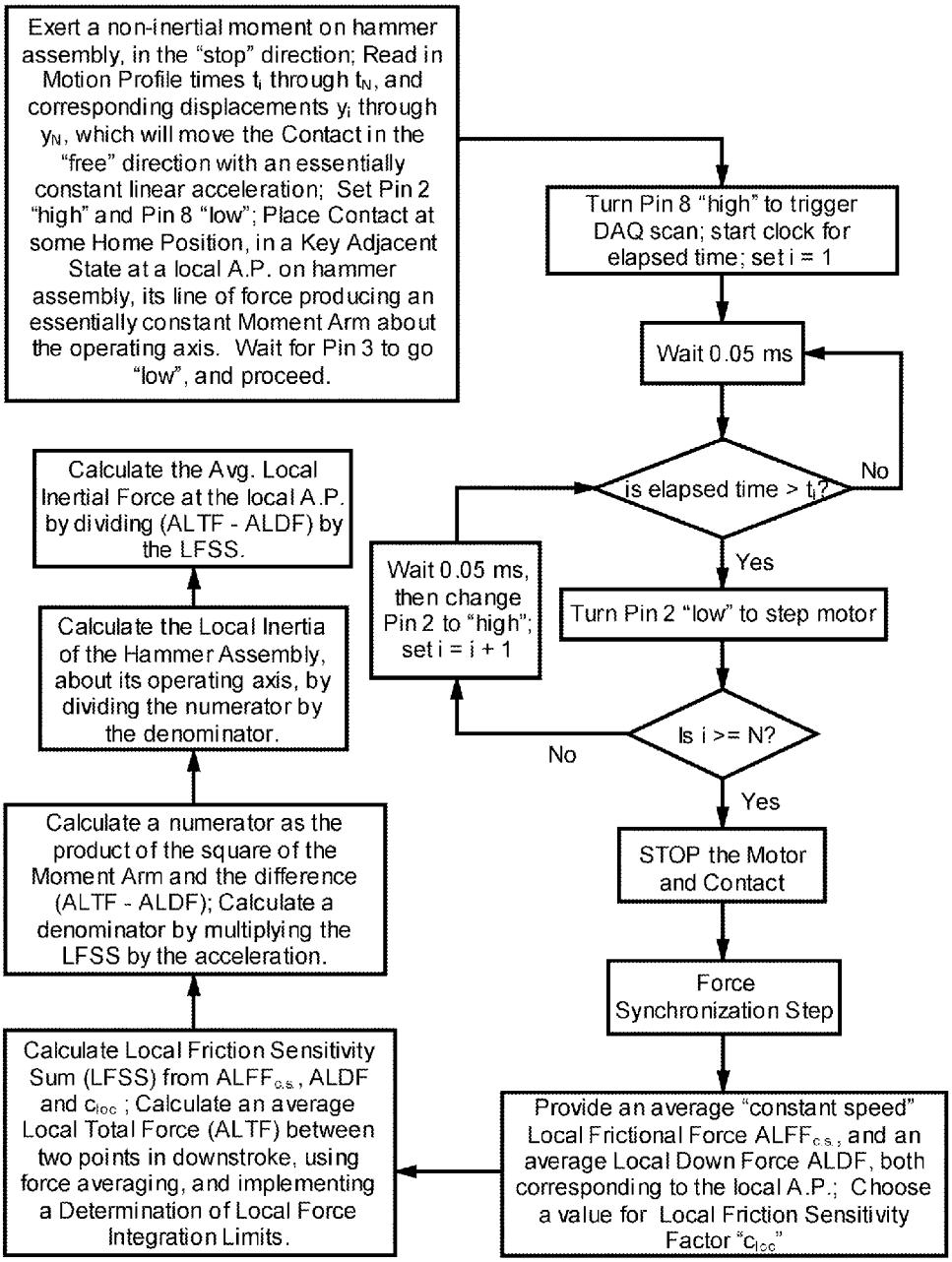
FIG. 36 is a flowchart detailing a run and subsequent operations, on a hammer assembly, for determining Local Inertia and Average Local Inertial Force. Potential effects of accelerated friction are included.
Figure 37:
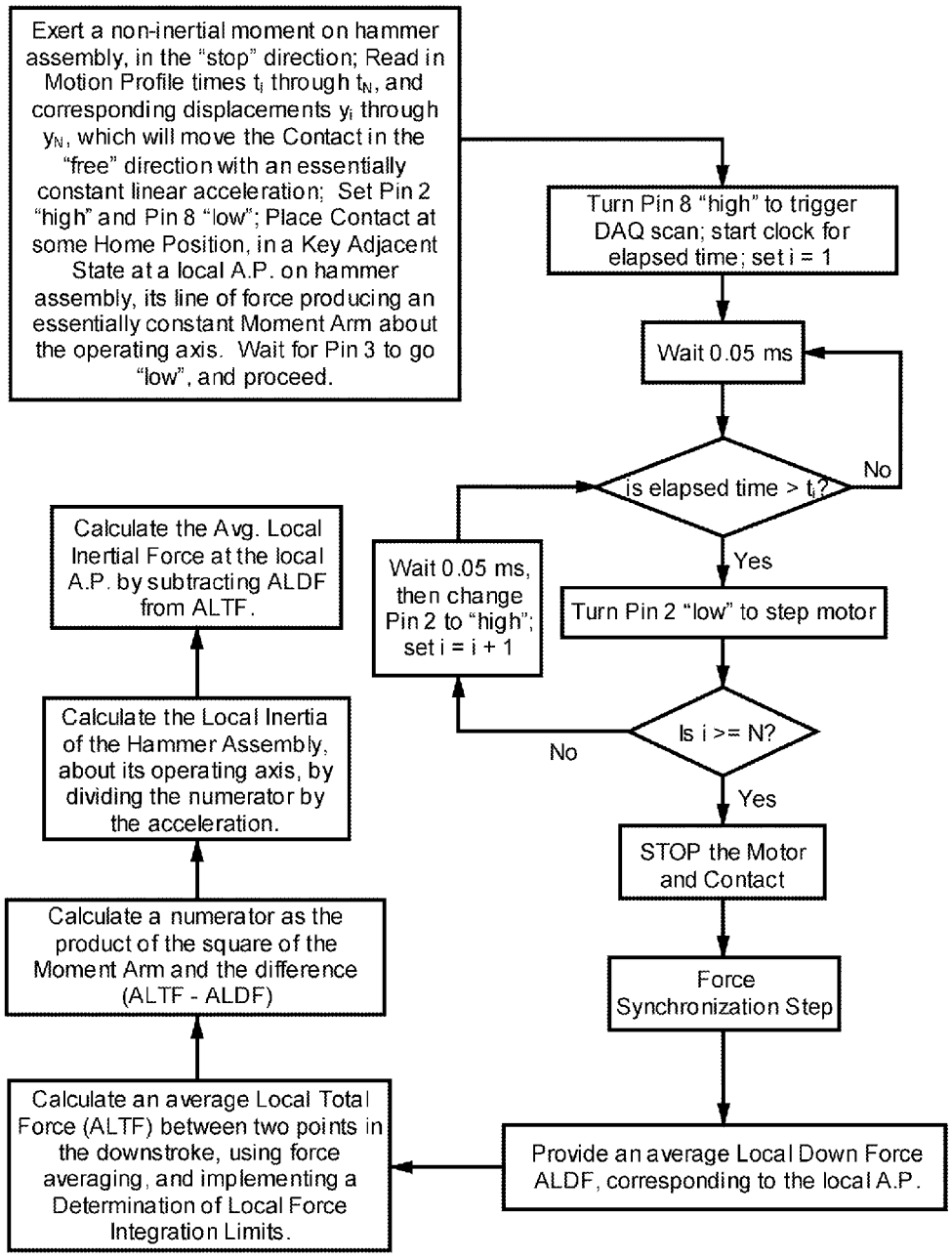
FIG. 37 is a flowchart detailing a run and subsequent operations, on a hammer assembly, for determining Local Inertia and Average Local Inertial Force. Potential effects of accelerated friction are neglected.

FIG. 35 is a flow chart detailing a "constant speed" run and other steps, necessary for determining the continuous and average Local Down Force and Local Up Force for a hammer assembly. FIG. 36 is a flow chart detailing an acceleration run and other steps, which together yield various local inertia parameters for a hammer assembly. The calculations involved include the effects of accelerated friction. FIG. 37 is a flow chart detailing very similar methods and calculations as FIG. 36, but with any potential "accelerated friction" effects neglected.

Performing the constant-speed runs necessary for measuring Local Down Force and Local Up Force on a hammer assembly is obviously essential for determining Local Inertia parameters for that component. Assuming the Operating Axis is used as the pivot for these runs, and the hammer flange joint is kept intact (as was done in the previous two examples), it has the added benefit of allowing friction to be measured for the hammer flange itself. The torque produced by the Local Friction about the hammer flange pin is simply multiplied by the Moment Ratio to get the equivalent torque at the key (about the balance rail pin). This can then be converted into an equivalent force at the A.P. In the previous example, the constant-speed Local Friction ($ALFF_{c.s.}$) was found to be 2 grams. Since MA was 28 mm, this corresponds to a torque/moment on the shank (about the hammer flange pin) of 56 grams-frc·mm. Assuming a Moment Ratio of 9.5, this equates to a torque/moment at the key (about the balance rail pin) of 532 grams-frc·mm. With a typical distance from the balance rail pin to the A.P. of 211 mm, this corresponds to a friction at the A.P. of 2.5 grams-force.

It is possible to perform Local Inertia (or simply Local Down Force and Local Up Force) tests on the hammer assembly without actually removing parts from the action. One still produces the setup similar to what was already described in FIG. 31, where each hammer is preloaded by "nonfrictional and non-inertial" forces against a stop. As was described in the previous examples, this preloading may be done with a long spring with a very small spring constant, pulling upwardly on the shank. One would then backweight the keysticks (or chock them up front), so that the rear of each of the keys remains down. One could then build a simple device that has a horizontal member running laterally, situated perhaps one or two feet above the shanks. The upper end of the spring could terminate at a ring, which can slide along this horizontal member as needed. When one is ready to move to the next hammer, one simply slides the ring over slightly, unhooks the bottom end of the spring from the former shank, and onto the current shank. One may even have many such springs (and rings) attached to the horizontal member, where one can attach the lower end of each spring to the shank below the corresponding ring. To obtain the preloading of each hammer assembly, the same support structure could have a separate horizontal member (adjustable vertically and longitudinally) that would serve as the "stop" discussed in describing FIG. 31. In lieu of a spring, the upward "preloading" force on the hammer shank could also be produced by, say, some sort of foam or other flexible material placed beneath the shank or hammer tail (perhaps resting on the wippen or rear of key). The properties of the foam should preferably produce as uniform a resistance across the downstroke/upstroke as possible. Certain open-cell foam products may be acceptable for this application. If one raised the hammers and placed long strips of foam beneath the shanks, then put the "preloading stop" member in place, one could then measure—using embodiments described herein—the hammer assemblies one after the other, without removing them from the action.

N. Reflected Inertias of a Simplified Key Action

The "simplified" hammer assembly of the previous example will now be combined with a simplified wippen assembly, a simple keystick assembly, and a 20-gram key lead, to create a piano action model whose "component" and "total" inertias can be theoretically calculated. The Local Inertia of the wippen assembly, the keystick assembly, and the key lead will be calculated (the value for the hammer assembly (189,615 g·mm$^2$) was already done for the previous example). Since the Local Inertia of the keystick and the key lead will be calculated about the operating axis of the key (i.e., the balance pin hole), those two will already represent "reflected" values of inertia at the key. The Local Inertia of both the hammer assembly and the wippen assembly will each then be used to determine their corresponding reflected inertia "at the key". These will then be added to the keystick and key lead Local Inertia values, to yield the actual Inertia At the Key (IK) for the key action. For each of the four components, those skilled in the prior art can determine corresponding prior art values, obtained with stationary weighing techniques, whose relative proportions differ greatly from those obtained herein with actual inertia calculations.

Figure 38A:
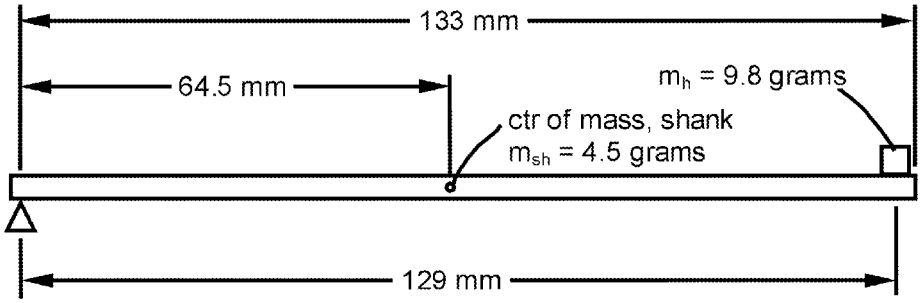
FIGS. 38 (*a*), 38 (*b*), and 38 (*c*) show a slightly-idealized hammer, wippen, and keystick, respectively, whose actual "equivalent" inertia values "at the key" will be calculated.
Figure 38B:
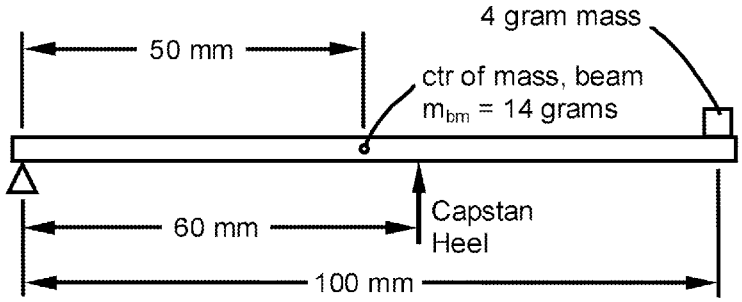
Figure 38C:
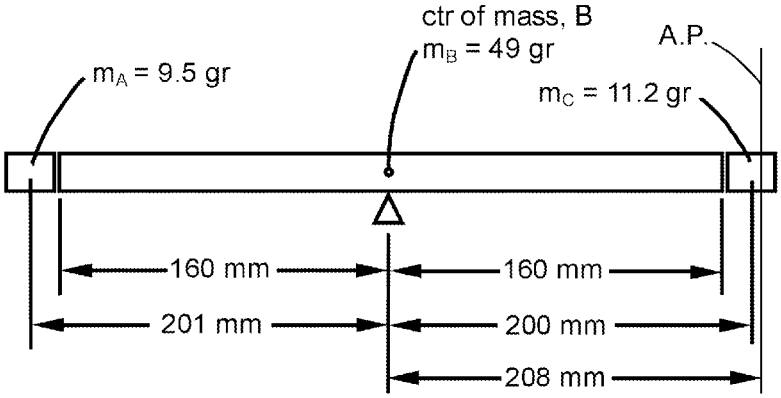

A simple schematic of the theoretical hammer assembly is shown in FIG. 38(*a*). The action geometry will be such that the point mass (representing the hammer head) moves 5.6 times faster (vertically) than the "application point" (AP), which is 10 mm from the front edge of the key. This is the Action Ratio, as it is generally defined. This is a fairly typical value for a grand piano key action. With this Action Ratio, if a 1-gram mass were added to the 9.8-gram mass, the Balance Weight (or Balance Force) would increase by 5.6 grams-force. But more importantly, when it comes to inertial calculations, the shank rotates 9.4 times as fast as the keystick. This latter parameter is referred to herein as the Moment Ratio (MR) of the action, and is very important for inertial calculations. A given amount of torque (moment) applied to the shank is magnified by this amount at the keystick. The hammer shank and the keystick can be viewed as a gearset, with an idler gear (the pivoting wippen) between them. Applying a moment/torque to the small gear (the shank) results in a much larger torque acting on the larger gear (the key). And of course, the rotational speeds vary in the inverse direction. One may determine the Moment Ratio of a key action by first measuring the Balance Force of the normal key action. One then adds a known mass to the hammer (say, at the hammer head) and then measures the Balance Force again. The gravitational force of the added mass, multiplied by the added mass's average horizontal distance from the hammer pivot (flange) during the stroke, is the "differential hammer torque". The difference between the original and "new" Balance Forces, multiplied by the distance from the balance rail pin to the AP, is the "differential torque at the key". The Moment Ratio is then simply the ratio of the "differential torque at the key" to the "differential hammer torque". The value of 9.4 has been found by the present author to be fairly typical for a key action of a grand piano. Since the gravitational constant would divide out from both sides, one can simply use "grams force" multiplied by the distance, for both these "differential torque" calculations. Thus, the units would simply be "grams force" times millimeters, rather than N-mm.

The simplified wippen model is sketched in FIG. 38(*b*), and consists of a 14-gram horizontal beam, with a 4-gram point mass (representing the jack) sitting at its non-pivoting end. The beam is 100 mm long, from the pivot to this point mass. The center of mass of the beam is halfway (i.e. 50 mm) along the beam to this point mass, while the capstan heel is 60 mm from the pivot. The keystick ratio is 0.5, meaning that the AP moves twice as far (and fast) as the capstan does. The simplified keystick is shown in FIG. 38(*c*), made up of three separate parts. This was deemed necessary to account for the extra mass at the back end (due to the backcheck) and at the front end (due to the much wider key there). The rear piece (piece A) has a mass of 9.5 grams, and is located 201 mm behind the balance rail pivot. The front piece (piece C) has a mass of 11.2 grams, and is located 200 mm in front of the pivot. The main portion of the key (piece B) weighs 49 grams (includes weight of the capstan), and is 320 mm long, divided evenly front-to-back with respect to the pivot. The A.P. is located 208 mm in front of the pivot. Finally, a 20-gram key lead (point mass) is placed directly beneath the A.P. The resulting Balance Weight/Balance Force can be shown from physics to be 40 grams-force for this model.

The actual inertia components will now be calculated for this theoretical key mechanism.

Hammer/Shank Assy, Actual Mom. of Inertia at the Key

Looking at FIG. 38(*a*) again, the moment of inertia of the hammer and shank about point P is:

$$I_{hmr,P}=(1/3)(m_{sh})(133)^2+(M_{hmr})(129)^2$$

where $m_{sh}$ and $M_{hmr}$ are the mass of the shank and the hammerhead, respectively. With those values set to 4.5 grams and 9.8 grams, respectively, the result is:

$$I_{hmr,P}=189{,}615\ \text{g}\cdot\text{mm}^2$$

But since the shank is rotating 9.4 (i.e., the Moment Ratio) times faster than the key, one equates the rotational kinetic energy of the hammer/shank about P with the rotational energy of some "equivalent member" rotating at the same angular velocity as the key, about the key's pivot axis. That is, if one rotates this "equivalent member" at the same angular speed as the key—and about the same pivot axis (the balance rail pin)—it must have the same rotational energy as the hammer assembly does. This equivalent moment of inertia will be called $I_{hmr,equiv}$, and is found by setting the two rotational kinetic energies equal as follows:

$$(1/2)(I_{hmr,P})(\omega_{sh})^2=(1/2)(I_{hmr,equiv})(\omega_k)^2$$

where $\omega_{sh}$ and $\omega_k$ are the angular velocities of the shank and key, respectively. Solving for $I_{hmr,equiv}$, this becomes:

$$I_{hmr,equiv} = I_{hmr,P}\left(\frac{\omega_{sh}}{\omega_k}\right)^2 = (189,615)(9.4)^2$$

This becomes: $I_{hmr,equiv}=1.68\times10^7$ g mm$^2$. Of course, the quotient term is the Moment Ratio.

Wippen Assy, Actual Mom. of Inertia at the Key

Looking at FIG. 38(*b*), the moment of inertia of the idealized wippen assembly about point P is:

$$I_{wipp,P}=(1/3)(m_{bm})(100\ \text{mm})^2+(m_{jk})(100\ \text{mm})^2$$

With $m_{bm}$ and $m_{jk}$ set to 14 and 4 grams, respectively, becomes 86,667 g mm$^2$. One must equate the rotational kinetic energy of the wippen about its pivot with the rotational energy of some "equivalent member" rotating at the same angular velocity—and about the same pivot axis—as the key. That is, if one rotates this "equivalent member" at the same angular speed as the key (and also about the balance rail pin) it must have the same rotational energy as the wippen assembly has. And note that the wippen assembly rotates 1.56 times as fast as the key. The 1.56 value will be referred to herein as the Wippen Moment Ratio, and is a fairly typical value for a grand piano action. Stated another way, it is the amount of torque created at the key per unit torque applied at the wippen assembly. It can be obtained purely from the geometry and relative geometry of the assembled key and wippen components. It can also be obtained experimentally in a similar manner as the regular Moment Ratio test was described. Just as the Moment Ratio is conceptually much different than the Action Ratio, so the Wippen Moment Ratio is also different (in value and concept/definition) than the keystick ratio. Back to the calculation, this equivalent moment of inertia will be called $I_{wip,equiv}$, and is found by setting the two rotational kinetic energies equal as follows:

$$(1/2)(I_{wipp,P})(\omega_{wip})^2=(1/2)(I_{wip,equiv})(\omega_k)^2$$

where $\omega_{wip}$ and $\omega_k$ are the angular velocities of the wippen and key, respectively. Solving for $I_{wip,equiv}$ this becomes:

$$I_{wip,equiv} = I_{wipp,P}\left(\frac{\omega_{wip}}{\omega_k}\right)^2 = (86, 667)(1.56)^2$$

This becomes: $I_{wip,equiv}$=210,913 g mm$^2$. Of course, the quotient term is the Wippen Moment Ratio.

Actual Moment of Inertia of the Keystick

Looking at FIG. 38(*c*) again, the moment of inertia of the key about its pivot P is obtained by adding that due to the two "point masses" A and C to that due to the beam B rotating about its center, P. The calculation is:

$$I_{Key,P}=(1/12)(m_B)(320\text{ mm})^2+(m_A)(201\text{ mm})^2+(m_C)(200\text{ mm})^2$$

Substituting 49, 9.5 and 11.2 grams in for $m_B$, $m_A$, and $m_C$ respectively results in:

$$I_{key,P}=1.25\times10^6\text{ g mm}^2.$$

Actual Mom. of Inertia of the Keylead

For the 20 gram mass (keylead) at the "application point" near the front of the key, note from FIG. 38(*c*) that the A.P. is 208 mm in front of the pivot point. And of course, this is where the key lead was placed. The moment of inertia of this "point mass" about the balance rail is simply:

$$L_{lead,P}=(20\text{ grams})(208\text{ mm})^2=865{,}280\text{ g mm}^2.$$

The sum of these four "equivalent" inertia values is the theoretical "total inertia" at the key, for this idealized piano key mechanism, and equals $1.913\times10^7$ g·mm$^2$. The percentage of this total due to the four components is thus: hammer and shank—87.8%, wippen—1.1%, keystick—6.5%, and key lead—4.5%. Those skilled in the art will quickly see how these proportions differ significantly from numbers determined by "stationary weighing" methods of the prior art.

In motor and gearbox design, this "equivalent inertia" is commonly referred to as "reflected inertia". It is used to determine the actual inertia that is "seen" at the driving motor of a geartrain, due to masses that are rotating with (or part of) various gears downstream. To help with this concept, one should imagine a simple spur gear pair, with the output gear having a much smaller pitch diameter ($D_{out}$) than the pitch diameter of the driving gear ($D_{in}$). In other words, the output gear rotates and accelerates much faster than the driving gear. To determine the moment of inertia at the driving gear of any mass added to the output gear, one first determines the moment of inertia, $I_{out}$, of the added mass about the output gear's own axis. Then one must multiply this by the square of the gear ratio. For a gearset, it is always the case that ($D_{in}/D_{out}$) equals ($\omega_{out}/\omega_{in}$), where $\omega_{in}$ and $\omega_{out}$ are the angular speeds at the driving gear and output gear, respectively. Either of these ratios is referred to as the gear ratio. Imagine replacing the added mass at the output gear with some other mass rotating directly about the driving (input) axis. What moment of inertia, must this "effective" mass have, about the driving axis, to create the same kinetic energy as the mass that was added to the output gear (which is rotating much faster)? Using the equation for rotational kinetic energy, one has:

$$1/2*I_{in}*\omega_{in}^2=1/2*I_{out}*\chi_{out}^2.$$

where. Solving this for $I_{in}$ gives:

$$I_{in} = I_{out}\cdot\left(\frac{\omega_{out}}{\omega_{in}}\right)^2$$

This is the "effective" moment of inertia (of the added mass at the output gear) at the driving gear. When considering the piano action, this "gear ratio" will usually correspond to the Moment Ratio, with the output gear being the hammer/shank assembly, and the input gear being the key itself. In those occasions (as was done above) where one is dealing with the effective inertia of the wippen, this gear ratio will correspond to the Wippen Moment Ratio.

O. Defining and Measuring Global Inertial Parameters (IF, IK, and EM)

The focus here will be on methods involving direct measurement and determination of the entire mechanism's inertia "at the key", without resorting to measuring "local inertias" of individual components and adding their "reflected inertia" values together. As will be seen, this will involve direct measurement of contact forces at the key during one or more accelerated downstrokes. It will also involve knowledge of one or more "static" force values, such as Down Force, Down Weight, Balance Force, etc. These "static" values would most preferably be measured with "constant speed" runs, as described in U.S. Pat. No. 8,049,090 and also herein. Such "acceleration" measurements, coupled with the proper "static" forces, allow non-invasive determination of the three global inertial parameters of Inertial Force (IF), Inertia at the Key (IK), and Effective Mass (EM). These three parameters are all closely related to each other, with IK and EM being true intrinsic properties of the mechanism, independent of acceleration. They will be mathematically defined for a generic mechanism below, followed by disclosure of methods necessary for measuring each of them.

For the purposes of determining inertial parameters, additional terminology will be defined for the "static" forces. Each of the following four parameters is considered a "representative static force indicator". A Representative Up Force Indicator (RUFI) is defined as either of:

- an Up Force value (average or otherwise) obtained from a "constant speed" upward Run, or
- an Up Weight value, determined using traditional "gram weight" techniques.

A Representative Down Force Indicator (RDFI) is defined as any of:

(a) a Down Force value (average or otherwise) obtained from a "constant speed" downward run, or (b) a Down Weight value, determined using traditional "gram weight" techniques, (c) the value obtained by adding a Representative Frictional Force Indicator to a Representative Balance Force Indicator, and (d) the value obtained by adding twice the Representative Frictional Force Indicator to a Representative Up Force Indicator.

Whether obtained from (a), (b), (c) or (d), if the RDFI is added to any numerical value, only to be followed by a subtraction of the numerical value, the result is still considered an RDFI. If the RDFI is multiplied by any numerical value, then divided by the numerical value, the result is still considered an RDFI. If the RDFI is acted upon by any function, followed by an action by the inverse function, the result is still considered an RDFI. If a tiny numerical value is added to the RDFI, the result is still considered an RDFI. If a numerical value close to 1.0 is multiplied by the RDFI, the result is still considered an RDFI. In short, if any sort of mathematical manipulation is done to an RDFI obtained via options (a) through (d) above, so that the end result is essentially the same value, the end result is still considered the RDFI.

A Representative Balance Force Indicator (RBFI) is defined as the value obtained by averaging an RDFI and an RUFI. A Representative Frictional Force Indicator (RFFI) is defined as the value obtained by subtracting an RUFI from an RDFI, then dividing by two. In the same way as described for manipulations of the RDFI, if any sort of additional mathematical manipulation is done to an RFFI, so that the end result is essentially the same numerical value, the end result is still considered the RFFI. The RFFI is the normal, "constant speed" friction at the A.P. It is not "accelerated friction", which will be discussed shortly.

Consider a mechanism that includes at least one rotating lever that pivots at some point "P", with this lever acted upon at an Application Point (A.P.) by a Contact. This lever will be called the "key", and may also be coupled to other levers, with those coupled to still other levers. Some levers may rotate, some may translate, with no two rotational or translational speeds necessarily equal. All of these factors depend on the geometry of the mechanism. The levers may have significant mass, and any lever may also have additional masses attached to it (i.e., moving with it). There may be springs acting on some of the levers, or even magnetic forces. The key is also assumed to be fairly close to horizontal, at least when the mechanism is said to be under Earth's gravity. Each rotating lever in such a mechanism has a "gear ratio" relative to the "key". As previously discussed, each rotating lever has its own "local inertia", which is reflected back to the "key", based on the square of its own "gear ratio". Whatever is accelerating the key "feels" the sum of all the reflected inertias as one cumulative "effective" inertia at the key. Since this sort of generic mechanism is difficult to depict (either in actual or "free body diagram" form), a theoretical "leveraged" see-saw will be created. It will have two or more straight members, each of constant linear density, all stacked and fastened to each other, with partial or total overlap between members. The linear densities will in general be different between the members. These straight members (levers) will be oriented in an essentially horizontal manner, with one of the members (the "key") resting on (or including) a pivot axis "P". This "key" will also be acted upon by a Contact at the A.P. In addition to gravity forces, spring and/or magnetic forces may also act on one or more of these members. In addition, one or more point masses may be secured to one or more of the levers, at various locations relative to the pivot "P". There will also be a physical "stop" that allows some combination of gravity, spring and magnetic forces to "pre-load" the mechanism against the stop. From an inertial perspective, this "leveraged see-saw" has essentially the same traits as the generic mechanism just described. Similar to how each rotating lever of the generic mechanism has a reflected inertia about P based on its own gear ratio, each point mass in the "leveraged see-saw" has an inertia about "P" based on the square of the distance from the mass to "P". If one can somehow directly and non-invasively measure the inertia of the leveraged see-saw, then one should also be able to directly measure the inertia of the generic mechanism (and a piano key action).

Figure 39:
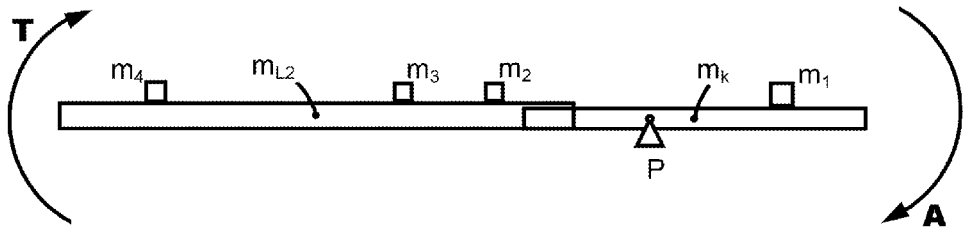
FIG. 39 (*a*) and FIG. 39 (*b*) are a schematic and free-body diagram of a "leveraged see-saw" that is accelerated in a purely zero-gravity environment.
Figure 39:
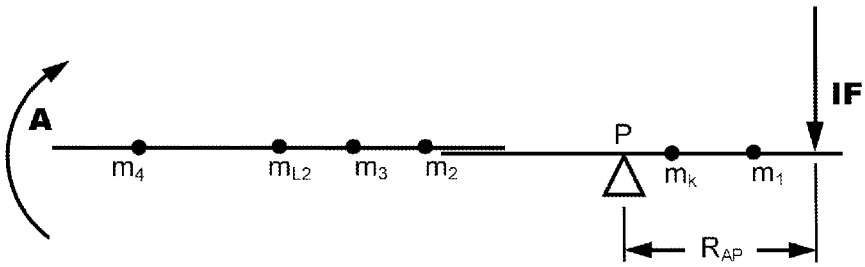
Figure 39:
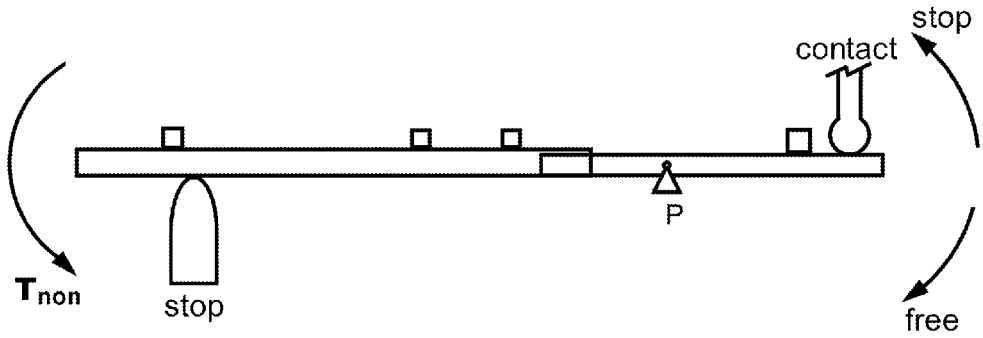

Now assume that such a leveraged see-saw, with four point masses, is somehow placed in a zero gravity environment, and that there is no friction anywhere. Neither are there any spring or magnetic forces acting on any part of the mechanism. The Inertia at the Key (IK) is directly proportional to how much "reaction torque" would be generated at the key in this zero gravity environment (and with no friction) when one accelerates the key at some angular acceleration, about its pivot "P". FIG. 39(*a*) shows the "springless and magnetless" leveraged see-saw (with two levers, including the "key") in this "zero gravity/zero friction" environment, and being accelerated in the CW direction by an amount "A" rad/ms. The torque (moment) imparted due to this acceleration is shown as "T". Since the torque is due solely to acceleration of distributed mass about "P", it is wise to call it an "inertial torque". For ease of viewing, the point masses are depicted here as small blocks secured to the top edge of their corresponding lever. They have masses $m_1$, $m_2$, $m_3$ and $m_4$ as shown. The mass of the "key" is $m_k$, while the mass of the other (second) lever is $m_{L2}$. The center of mass of the "key" is at a distance $R_k$ from the pivot "P", while the center of mass of the second lever is at a distance $R_{L2}$ from "P". If the acceleration is created by moving the A.P. downwardly with some linear acceleration "a"—in this "zero gravity" and frictionless environment—the Free Body Diagram is as shown in FIG. 39(*b*). The applied force at the A.P. is the Inertial Force (IF). The torque "T" is thus produced by IF acting at moment arm R. If one sums moments (positive clockwise in the figure) about the pivot, and invokes a rotational application of Newton's $2^{nd}$ Law, one obtains:

$$(\mathrm{IF})(R_{AP})=(\mathrm{IK})(A)$$

Knowing that $A=a/R_{AP}$ and solving for IF, one has:

$$IF = \frac{(IK)(a)}{(R_{AP})^2} \qquad \text{(Eq. 17)}$$

So if one took the mechanism to the space station, ensured that the friction at the joints/contact points was essentially zero, and excited the A.P. with an acceleration "a" while measuring the reactive force, the result will be very close to the theoretical Inertial Force in eq. 17. If the levers are not infinitely stiff, there will be oscillations in the resulting measured/experienced forces. As has been discussed, it is therefore wise to "force average" the resulting IF over some appropriate portion of the stroke. The resulting "average" Inertial Force will be referred to herein as AIF.

Figure 40:
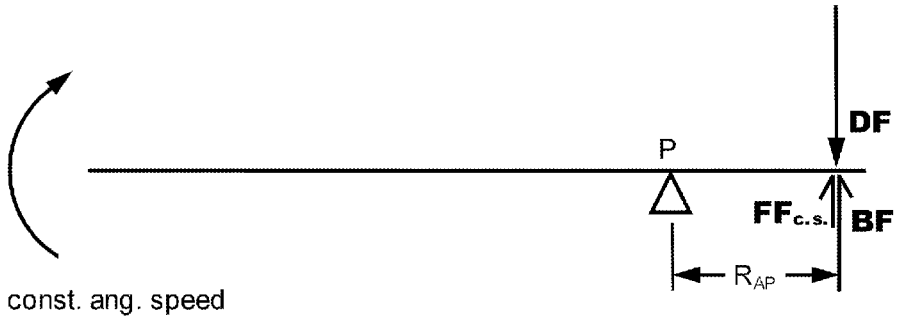
FIGS. 40 (*a*) and 40 (*b*) are free-body diagrams of the leveraged see-saw during a constant-speed and constant-acceleration downstroke, respectively.
Figure 40:
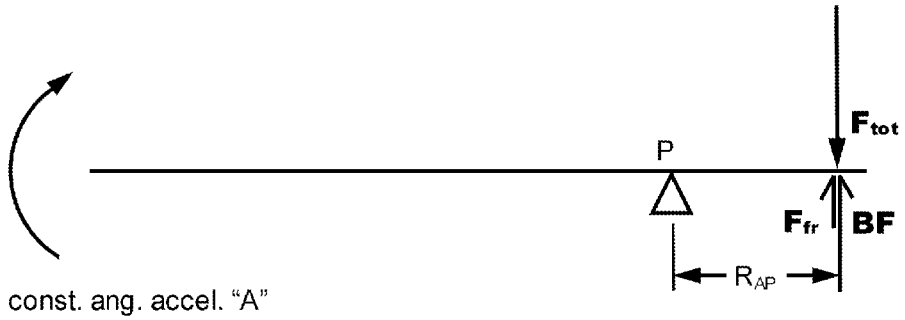

Of course, it is impractical to perform such "zero gravity" and "zero friction" measurements, which would measure the Inertial Force directly. In the real world, there will be friction to some degree. And in the real world, one must perform the acceleration and measurement in the normal Earth gravity, where gravity forces are also acting on the entire mechanism. Spring or magnetic forces may also be acting. This necessitates knowledge of one or more of the "representative" static force indicators defined above (RDFI, RUFI, RBFI, and RFFI). Assume that the mechanism of FIG. 39(*a*) now has gravity and (optionally) spring/magnetic forces acting on it. FIG. 39(*c*) shows this mechanism in a static, "rest" position. If the component is rotated slightly in the CW direction and "let go", a non-inertial, restoring force or forces (gravity, springs, etc.) will bring it back to its rest position. The rest position may be created with a "stop" of some sort, preventing the rotation of the key/mechanism (due to springs, gravity, or magnets) in one particular direction. The torque vector $T_{non}$ is shown in FIG. 39(*c*), to represent the combined torque (moment) of all non-inertial forces other than friction. It is this moment, in fact, that produces the Balance Force at the Contact. The direction corresponding to moving the key from its rest/stop position will be referred to as the "free" direction. The direction corresponding to moving the key back towards the rest position is the "stop" direction. In FIG. 39(*c*), the free and stop directions are CW and CCW, respectively. If the Contact now moves so that the key rotates at or near a constant angular speed—in the "free" direction—the reactive force at any instant is the Down Force (DF). At any point during this downstroke, the movement is resisted by (1) the Balance Force (BF), and (2) a "constant speed" frictional force ($FF_{c.s.}$). As described elsewhere herein, the BF is due solely to gravitational forces (and "springlike" forces and magnetic forces, if applicable). FIG. 40(*a*) is the free body diagram for this constant-speed situation.

At the end of the angular displacement, the Contact allows the key to rotate back in the "stop" direction, but also at some nearly-constant angular speed, while measuring the reactive force. This force, at any instant, is the Up Force (UF), and is equal to the BF minus the $FF_{c.s.}$. The free body diagram for this "upstroke" movement would look the same as FIG. 40(*a*), except that the frictional force ($FF_{c.s.}$) would point downward (opposing the upward motion), the angular velocity would be CCW, and DF would be replaced with UF. The average of the constant-speed frictional force ($AFF_{c.s.}$) over the same region where an Average Down Force (ADF) and an Average Up Force (AUF) are measured is found from the equation:

$$AFF_{c.s.} = \frac{(ADF - AUF)}{2}$$

And of course:

$$ADF = ABF + AFF_{c.s.} \quad \text{(Eq. 18)}$$

Where ABF is the Average Balance Force.

Focus is now shifted back to the necessary "acceleration" tests in this "normal gravity" environment. Assume the mechanism of FIG. 39(*c*) is in its rest position. Assume that the Contact accelerates the key—at a constant angular acceleration—away from this equilibrium position, in the "free" direction (CW in figure). The Free Body Force Diagram for such a movement is shown in FIG. 40(*b*). The reacting force due to all "non-inertial and nonfrictional" forces is still the same Balance Force (BF). The reaction force due to friction is the frictional force "FF". In the figure, notice how FF and BF oppose the applied force, just as in the constant speed situation of FIG. 40(*a*). The total applied force necessary to create the desired angular acceleration against gravity, springs (and magnets), friction and inertia is called the "total force", or $F_{tot}$. Using the fact that $A = a/R_{AP}$, then summing moments about P and using Newton's $2^{nd}$ Law gives:

$$(F_{tot})(R_{AP}) = (IK)(a/R_{AP}) + (BF)(R_{AP}) + (FF)(R_{AP})$$

Note that the frictional force "FF" is now made up of two components: 1) its traditional "constant speed" value, and 2) an "accelerated friction" value. That is:

$$FF = FF_{c.s.} + FF_{acc}$$

Solving the above "moment" equation for $F_{tot}$, and employing eq. 17, thus gives:

$$F_{tot} = IF + BF + FF_{c.s.} + FF_{acc}$$

Signifying "average" values of all parameters in the above equation by adding an "A" in front, the "average" version of the equation is:

$$AF_{tot} = AIF + ABF + AFF_{c.s.} + AFF_{acc}$$

Using eq. 18 for Average Down Force (ADF), this becomes:

$$AF_{tot} = AIF + ADF + AFF_{acc} \quad \text{(Eq. 19a)}$$

One sees that the Total Force at the A.P. is the sum of the Inertial Force, the Down Force and an "accelerated friction" force. For any given acceleration value, this equation must hold. Now employing the average form of eq. 17, this is identical to:

$$AF_{tot} = \left(\frac{IK}{R_{AP}^2}\right)(a) + ADF + AFF_{acc} \quad \text{(Eq. 19b)}$$

Based on "constant speed" embodiments described herein and in U.S. Pat. No. 8,049,090, the Contact may move the A.P. downwardly and return upwardly, resulting in values for Down Force, Up Force, Balance Force and Frictional Force for the mechanism. If the Contact then moves downwardly—at some finite acceleration—against the A.P., it experiences a reactive force at any instant equal to the Down Force plus an Inertial Force plus an "accelerated friction" force. This reactive force is referred to herein as the Total Force ($F_{tot}$), or $AF_{tot}$ in its average form. The Down Force, as discussed elsewhere within, is due solely to non-inertial effects, such as friction, gravity and leverage, and spring and/or magnetic forces (if those exist). The Inertial Force (IF) is due solely to the "distributed" mass in the entire mechanism being accelerated, and would be experienced identically no matter if the mechanism were in a "zero gravity" or "reduced gravity" environment. The "accelerated friction" needs some further explaining, which is done in the following paragraph.

The "traditional" frictional force is already included in any Down Force measurement. However, that friction could actually be referred to as "constant speed" frictional force, since the Down Force is obtained during constant-speed downstrokes, where there is no acceleration of the key. However, when the key is accelerated downwardly, the reactive force at the key increases from its Down Force value (due to the inertia of all the mass in the mechanism). But in addition to this, there is also an increase in force at the various joints and contact points of the generic mechanism. In an actual piano key action, the joints would be at the hammer flange, wippen flange, and balance rail. The contact points would be at the capstan heel and the knuckle/jack interface. For a generic mechanism, the measured friction at the A.P. is largely comprised of the effective, cumulative friction at all these joints and contact points. Therefore, anything that increases the reaction forces at these "joints"—such as downward acceleration of the key—will usually increase total friction. Only if all of the friction were due to, say, some rubbing/shearing action would acceleration have essentially no impact on the friction. As will be seen below, a Friction Sensitivity Factor "c" will be employed to account for the possibility of increased friction during acceleration runs. The factor can theoretically vary from 0 to 1.0 (or even greater), with 0 being the situation where acceleration has no effect on friction, and 1.0 (or higher) where acceleration has its "full effect" on friction.

An expression for the average "accelerated friction" $AFF_{acc}$ will now be developed, incorporating and defining the Friction Sensitivity Factor "c" mentioned above. The expression is:

$$AFF_{acc} = c \cdot AFF_{c.s.}\left(\frac{AIF}{ADF}\right) \quad \text{(Eq. 20a)}$$

And again using eq. 17, this becomes:

$$AFF_{acc} = c \cdot AFF_{c.s.}\left(\frac{IK \cdot a}{ADF \cdot R_{AP}^2}\right) \quad \text{(Eq. 20b)}$$

If c=1, then doubling the key force at the A.P. (from ADF to 2·ADF), due to acceleration, would also double the friction. That is, if AIF=ADF, then $AFF_{acc}=(1)(AFF_{c.s.})(1)=AFF_{c.s.}$, meaning that the total friction $AF_{fr}=AFF_{c.s.}+AFF_{c.s.}$, or (2)($AFF_{c.s.}$). So again, this factor states how sensitive the total friction is to the additional joint forces brought on by acceleration.

For any given acceleration value used in a downward "acceleration run", equations 19 and 20 must hold. If one chooses/guesses a value for "c", then one has—for any given acceleration "a"—two equations (19a/b and 20a/b) and two unknowns (IK and $AFF_{acc}$). Of course, $AF_{tot}$ is determined from the acceleration run data, while ADF and $AFF_{c.s.}$ are known from a separate "constant speed" run. The Application Point Lever Arm "$R_{AP}$" is also known, being the essentially longitudinal distance from the key's operating axis (pivot) to the A.P. Equations 19b and 20b are solved simultaneously, resulting in:

$$IK = \frac{(AF_{tot} - ADF)(R_{AP}^2)}{\left(1 + \frac{c \cdot AFF_{c.s.}}{ADF}\right)(a)} \quad \text{(Eq. 21a)}$$

$$AFF_{acc} = \frac{c \cdot AFF_{c.s.}(AF_{tot} - ADF)}{(ADF)\left(1 + \frac{c \cdot AFF_{c.s.}}{ADF}\right)} \quad \text{(Eq. 22)}$$

Of course, per equ. 17, the Average Inertial Force (AIF) is obtained by multiplying IK by the term "$a/R_{AP}^2$". Thus, an alternative to Eq. 21(a) becomes:

$$AIF = \frac{(AF_{tot} - ADF}{\left(1 + \frac{c \cdot AFF_{c.s.}}{ADF}\right)} \quad \text{(Eq. 21b)}$$

The "1+ . . . " term in the denominator of equations 21a, 21b and 22 will be referred to herein as the Friction Sensitivity Sum. That is:

$$FrictionSensitivitySum = \left(1 + \frac{c \cdot AFF_{c.s.}}{ADF}\right)$$

Stated more generally, in terms of "representative static forces", the equation is:

$$FrictionSensitivitySum = \left(1 + \frac{c \cdot RFFI}{RDFI}\right) \quad \text{(Eq. 23)}$$

If it were not for these "accelerated friction" effects, then the "$AFF_{acc}$" term in Eq. 19b would be zero, and that equation could be solved directly for IK. Of course, the result of that is the same as if the friction sensitivity factor "c" is set to zero in Eq. 21a. So the Friction Sensitivity Sum (and Friction Sensitivity Factor) essentially "correct" the Inertial Force and Inertia at the Key equations, for the effects of "accelerated friction". If, for example, "c" is 1.0, and the ratio of "constant speed" frictional force to Down Force is, say, 0.5, then the Friction Sensitivity Sum equals 1.5. Thus, AIF in Eq. 21b equals only two thirds of ($AF_{tot}$−ADF). If, on the other hand, "c" equaled zero, then AIF would equal ($AF_{tot}$−ADF). Of course, the Friction Sensitivity Sum has the same "correcting" effect in equation 21a, for Inertia at the Key. If one determines that these "accelerated friction" effects are negligible, then "c" is zero, and the Friction Sensitivity Sum becomes (or is replaced by) 1.0.

The process of calculating the Friction Sensitivity Sum as given in Eq. 23 is herein referred to as a Step for Calculating Friction Sensitivity Sum. This step might include adding terms to either side of Eq. 23, as long as they are subsequently subtracted. This step might include multiplying some or all of the terms of Eq. 23 by one or more terms, as long as each of those terms is also multiplied by its own inverse. This step might also include any sort of function acting on one or more terms of Eq. 23, as long as each of those functions is subsequently cancelled by its inverse function. In short, if any sort of unnecessarily complicated equation is created, whose end result looks essentially as that of Eq. 23, that entire mathematical process is still considered as a Step for Calculating Friction Sensitivity Sum.

If equations 21a and 21b are generalized with the more general Friction Sensitivity Sum, and for a more general version of the Average Down Force, one would have:

$$IK = \frac{(AF_{tot} - RDFI)(R_{AP}^2)}{(\text{Friction Sens. Sum})(a)} \quad \text{(Eq. 24)}$$

$$AIF = \frac{(AF_{tot} - RDFI)}{(\text{Friction Sens. Sum})} \quad \text{(Eq. 25)}$$

And as already stated, if "accelerated friction" effects are assumed to be negligible, then the Friction Sensitivity Sum is 1.0, and these equations become:

$$IK = \frac{(AF_{tot} - RDFI)(R_{AP}^2)}{(a)} \quad \text{(Eq. 26)}$$

$$AIF = AF_{tot} - RDFI \quad \text{(Eq. 27)}$$

In either of these equations for Inertia at the Key (IK), the "$R_{AP}^2$ divided by a" quotient may be replaced by "$R_{AP}$ divided by angular acceleration", where the latter is the approximate angular acceleration of the keystick during the accelerated movement.

The process of calculating Inertia at the Key as given in Eq. 24 is herein referred to as a Step for Calculating Inertia at the Key. This step might include adding terms to either side of Eq. 24, as long as they are subsequently subtracted. This step might include multiplying some or all of the terms of Eq. 24 by one or more terms, as long as each of those terms is also multiplied by its own inverse. This step might also include any sort of function acting on one or more terms of Eq. 24, as long as each of those functions is subsequently cancelled by its inverse function. In short, if any sort of unnecessarily complicated equation is created, whose end result looks essentially as that of Eq. 24, that entire mathematical process is still considered as a Step for Calculating Inertia at the Key. The step might also include—as mentioned above—the substitution of "$R_{AP}$ divided by the angular acceleration" for the quotient "$R_{AP}^2$ divided by a", since the two terms have been shown to be equal.

The process of calculating Average Inertial Force as given in Eq. 25 is herein referred to as a Step for Calculating Average Inertial Force. This step might include adding terms to either side of Eq. 25, as long as they are subsequently subtracted. This step might include multiplying some or all of the terms of Eq. 25 by one or more terms, as long as each of those terms is also multiplied by its own inverse. This step might also include any sort of function acting on one or more terms of Eq. 25, as long as each of those functions is subsequently cancelled by its inverse function. In short, if any sort of unnecessarily complicated equation is created, whose end result looks essentially as that of Eq. 25, that entire mathematical process is still considered as a Step for Calculating Average Inertial Force.

The process of calculating Inertia at the Key as given in Eq. 26 is herein referred to as a Step for Calculating Inertia at the Key with Accelerated Friction Neglected. This step might include adding terms to either side of Eq. 26, as long as they are subsequently subtracted. This step might include multiplying some or all of the terms of Eq. 26 by one or more terms, as long as each of those terms is also multiplied by its own inverse. This step might also include any sort of function acting on one or more terms of Eq. 26, as long as each of those functions is subsequently cancelled by its inverse function. In short, if any sort of unnecessarily complicated equation is created, whose end result looks essentially as that of Eq. 26, that entire mathematical process is still considered as a Step for Calculating Inertia at the Key with Accelerated Friction Neglected. The step might also include—as mentioned above—the substitution of "$R_{AP}$ divided by the angular acceleration" for the quotient "$R_{AP}^2$ divided by a", since the two terms have been shown to be equal.

The process of calculating Average Inertial Force as given in Eq. 27 is herein referred to as a Step for Calculating Average Inertial Force with Accelerated Friction Neglected. This step might include adding terms to either side of Eq. 27, as long as they are subsequently subtracted. This step might include multiplying some or all of the terms of Eq. 27 by one or more terms, as long as each of those latter terms is also multiplied by its own inverse. This step might also include any sort of function acting on one or more terms of Eq. 27, as long as each of those functions is subsequently cancelled by its inverse function. In short, if any sort of unnecessarily complicated equation is created, whose end result looks essentially as that of Eq. 27, that entire mathematical process is still considered as a Step for Calculating Average Inertial Force with Accelerated Friction Neglected.

If only one acceleration run is done, then one is somewhat at the mercy of the chosen value for "c". If it is chosen too high, then too much of the added force of the lone acceleration run may be attributed to "accelerated friction", and too little to inertia itself. If it is chosen too low, then the opposite is the case. A remedy may be to perform additional runs at other accelerations, solving again for IK and $AFF_{acc}$ in each case. If "c" was chosen wrong, then the resulting value for IK will be significantly different for each separate run/acceleration. Of course, in reality IK is an intrinsic property of the mechanism (like mass would be for a one-dimensional situation), having one unique value independent of the acceleration. If this disagreement in IK occurs, the value of "c" is then changed (say, from 0.0 to 0.1) and one again solves for IK and $AFF_{acc}$ for each run/acceleration. Because $AFF_{acc}$ and AIF have different relationships with respect to acceleration, this iterative process with "c" should allow the proper value for AIF (and thus IK) to be nailed down. One keeps changing "c"—between reasonable extremes like 0 and 1.0—until each acceleration yields a sufficiently identical value for IK. Notice in the above equations for IK and IF that if $AFF_{c.s.}$ is very small, then the value chosen for "c" makes little difference anyway (i.e., the Friction Sensitivity Sum approaches 1 regardless of "c"). Oftentimes, the "c" factor has little effect on the forces, and one can simply choose a value (possibly zero) for "c". It is still preferable to have runs at different accelerations though. The resulting IK values for each acceleration/run may then be averaged to obtain a final "average" value of IK.

The Effective Mass (EM) represents the equivalent point mass which, if placed directly beneath the AP, would produce the same resisting force during an acceleration as the actual distributed masses offer, assuming the non-inertial forces are also identical. Stated another way, the EM represents the point mass which, if placed directly beneath the AP, would produce the same Inertial Force (i.e. that which is not due to friction, gravity, springs or magnets) as the actual "distributed mass" mechanism, for a given acceleration. This Inertial Force—for any given acceleration value—would be felt at the A.P. no matter where the action was located (e.g., in a zero gravity region). For a simple mechanism like the leveraged see-saw, there are a couple ways of theoretically calculating the EM. One way is to calculate the kinetic energy of all the individual point masses and members, for any given speed of the A.P. These are then summed and set equal to the kinetic energy of a theoretical point mass (having mass EM) located at the A.P., and moving at the same speed as the A.P. EM is then solved for from that equation. Another way is to first theoretically calculate the IK, using standard equations for determining mass moments of inertia about a point. Then, one would plug IK into equation 17, and set that equal to the product of EM and "a". Solving for EM, one has:

$$EM = \frac{IK}{R_{AP}^2}$$

Basically, one has assigned all of the IK to the point mass sitting at the A.P. By manipulating the above equation with help from eq. 17, one also finds that:

$$EM = \frac{AIF}{a}$$

where the average form of Inertial Force is used. The problem has therefore simplified to that of a purely one-dimensional acceleration of a point mass. This is nothing more than the traditional linear form of Newton's $2^{nd}$ Law; that is, F=(m)(a).

By substituting eq. 24 for IK into the above equation for EM, one can easily obtain EM in terms of the various measured forces. That is:

$$EM = \frac{(AF_{tot} - RDFI)}{(\text{Friction Sens. Sum})(a)} \quad \text{(Eq. 28)}$$

If "accelerated friction" effects are considered negligible, then the Friction Sensitivity Sum is 1, and this becomes:

$$EM = \frac{(AF_{tot} - RDFI)}{(a)} \quad \text{(Eq. 29)}$$

The process of calculating Effective Mass as given in Eq. 28 is herein referred to as a Step for Calculating Effective Mass. This step might include adding terms to either side of Eq. 28, as long as they are subsequently subtracted. This step might include multiplying some or all of the terms of Eq. 28 by one or more terms, as long as each of those terms is also multiplied by its own inverse. This step might also include any sort of function acting on one or more terms of Eq. 28, as long as each of those functions is subsequently cancelled by its inverse function. In short, if any sort of unnecessarily complicated equation is created, whose end result looks essentially as that of Eq. 28, that entire mathematical process is still considered as a Step for Calculating Effective Mass. The step might also include the substitution of "$R_{AP}$ multiplied by the keystick angular acceleration" for the acceleration term, since the two terms are equal.

The process of calculating Effective Mass as given in Eq. 29 is herein referred to as a Step for Calculating Effective Mass with Accelerated Friction Neglected. This step might include adding terms to either side of Eq. 29, as long as they are subsequently subtracted. This step might include multiplying some or all of the terms of Eq. 29 by one or more terms, as long as each of those terms is also multiplied by its own inverse. This step might also include any sort of function acting on one or more terms of Eq. 29, as long as each of those functions is subsequently cancelled by its inverse function. In short, if any sort of unnecessarily complicated equation is created, whose end result looks essentially as that of Eq. 29, that entire mathematical process is still considered as a Step for Calculating Effective Mass with Accelerated Friction Neglected. The step might also include the substitution of "$R_{AP}$ multiplied by the keystick angular acceleration" for the acceleration term, since the two terms have been shown to be equal.

When the lever(s) of the mechanism are not infinitely stiff, there will be oscillations present in the $F_{tot}$ force curve. In addition, the Down Force itself may vary across the stroke, as described elsewhere within. Therefore, it is generally preferable to determine average values for both $F_{tot}$ and DF, over some desired and strategic portion of the downstroke. Average values have already been incorporated into eq. 21. The friction values, in both eq. 21 and eq. 22, also represent average friction values, preferably over that same portion of the stroke. More specifically, one would look for certain "averaging points" in the $F_{tot}$ curve/data, two of these points indicating where the "total force" averaging is to begin and end. The process of determining these points, between which the Total Force is to be averaged, has already been referred to herein as Determination of Total Force Integration Limits. How to intelligently choose these "averaging points" will be further demonstrated in subsequent examples.

Figure 41:
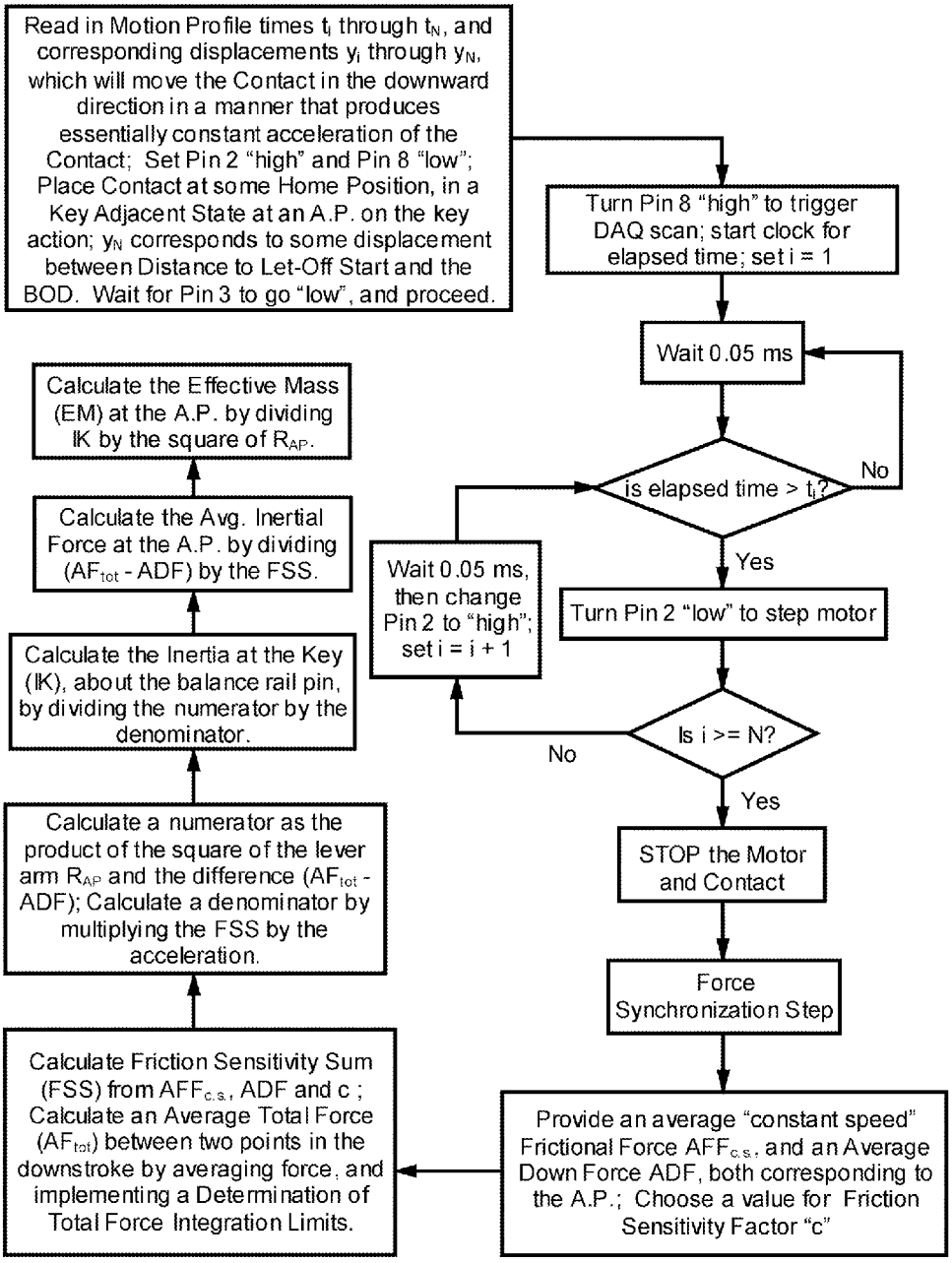
FIG. 41 is a flowchart detailing a Run, and subsequent steps, for determining various global inertial parameters of a piano key mechanism, when "accelerated friction" effects are considered.
Figure 42:
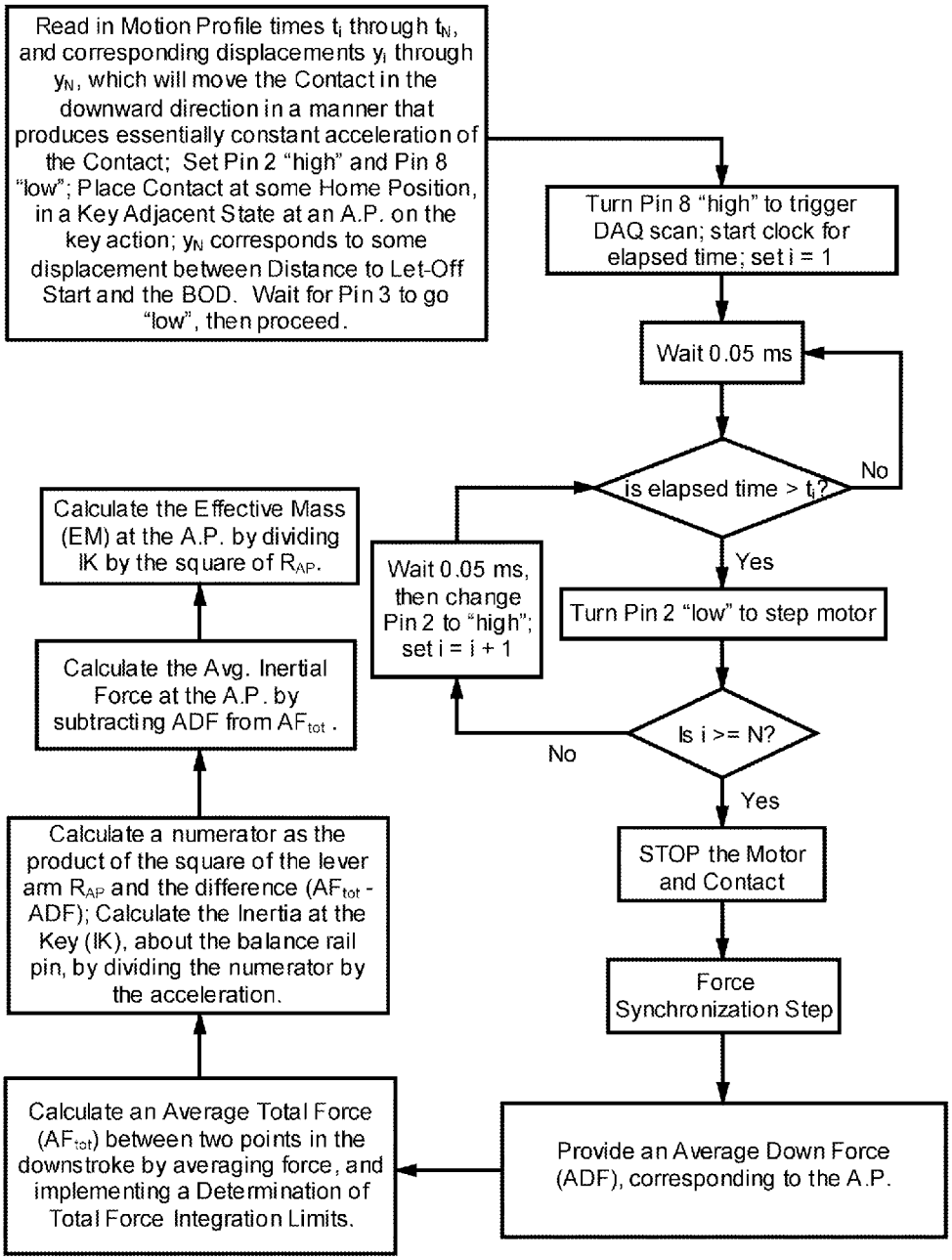
FIG. 42 is a flowchart detailing a Run, and subsequent steps, for determining various global inertial parameters of a piano key mechanism, when "accelerated friction" effects are neglected.

It will often be advantageous to temporarily adjust the let-off button (and possibly the drop screw) upwardly before the acceleration run. That is, to maximize the "pre let-off region". An accelerated downstroke, at some predetermined acceleration, can be performed as follows. The Contact is first brought into a Key Adjacent State, at the A.P. The Contact is then accelerated downwardly using a predetermined "constant acceleration" Motion Profile. Meanwhile, reaction forces between the Contact and the key are continually read and/or recorded during the downstroke, at time intervals small enough to yield dozens or hundreds of data points for the stroke. The Contact may stop somewhere near the Let-Off Start Point of the stroke, or may continue to some point between the Let-Off Start Point and the Bottom-Out Point. Regardless, the force data beyond the Let-Off Start Point will generally not be considered for the subsequent "force averaging" calculations. The flowchart of FIG. 41 describes the procedure as well, including steps representing subsequent calculations required to get Inertia at the Key (IK), Inertial Force (IF), and Effective Mass (EM). FIG. 42 shows the same basic procedures, but where any potential "accelerated friction" effects are neglected.

P. Examples of Measuring Total Inertial Parameters i) On a "Leveraged See-Saw"

The "leveraged see-saw" of FIG. 39 will now be used again, to better illustrate the concepts behind the parameters and their determination. A physical model of the "leveraged see-saw" was also created, and was subsequently tested by embodiments herein. Use of the "leveraged see-saw" lends itself to having the true (theoretical) inertial values easily calculated, for comparison with results from the tests. The methods are equally valid for use on an actual piano key action.

Figure 43:
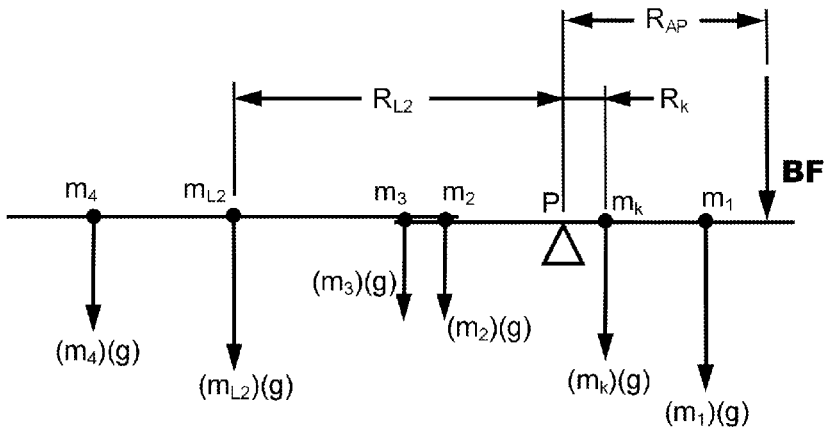
FIG. 43(*a*) is a free body diagram for "constant speed" runs on the leveraged see-saw.
Figure 43:
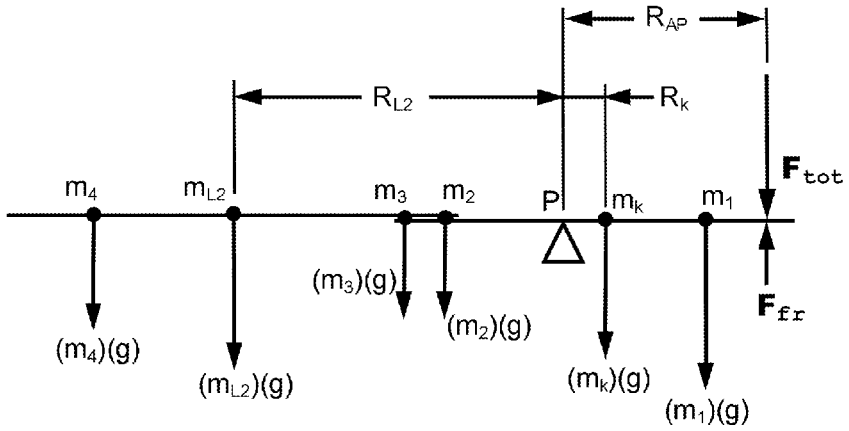

The physical model required two fasteners to secure the "key" lever to the second lever (in the overlap region). The two masses "$m_2$" and "$m_3$" (see FIG. 39) are set aside to represent these two fasteners (both being 2.5 grams). For the leveraged see-saw, the distance from "P" to any mass "$m_i$" is $R_i$. Three different configurations (cases) of the see-saw will be tested, with the values of $m_1$, $m_4$, and $R_4$ varied. In each case, $R_1$ is held constant at 184 mm, $R_{AP}$ is 166 mm, $R_2$ is 135 mm and $R_3$ is 210.5 mm. For each configuration, the IK is determined: (a) from the pure textbook definition of mass moment of inertia (i.e., the "theoretical" method), and (b) by measuring $AF_{tot}$, ADF and $AFF_{c.s.}$ and plugging into equation 21 (the "empirical" method). The Friction Sensitivity Factor is assumed to be 1.0. Regarding the "empirical" method, four different acceleration runs are performed for each case/configuration. Each acceleration run uses a significantly different acceleration than the other three. For each acceleration, the resulting "average total force" is determined, and plugged into eq. 21 to get the IK. The final value of IK for that case/configuration is obtained by averaging the IK values obtained at each acceleration. The EM is then obtained from the IK value, per equation 28. For clarity, the free body diagram for "constant speed" runs on the see-saw is shown in FIG. 43(*a*). The free body diagram for the "acceleration" runs is shown in FIG. 43(*b*). Separate runs are done to determine ADF and $AFF_{c.s.}$, per embodiments described elsewhere herein. From standard textbook definitions of mass moment of inertia, the overall inertia of the leveraged see-saw should be:

$$IK_{th} = \sum_{i=1}^{i=4} m_i \cdot R_i^2 + I_{L2} + m_{L2}R_{L2}^2 + I_k + m_k R_k^2$$

where $I_{L2}$ and $I_k$ are the mass moments of inertia of the "second lever" and the "key", respectively, about their own centers of mass. For all three configurations, $I_k$ is 468,000 g·mm$^2$, $I_{L2}$ is 775,207 g·mm$^2$, $R_k$ is 22 mm, $R_{L2}$ is 462 mm, $m_k$ is 35.1 grams, and $m_{L2}$ is 20 grams. The results and pertinent information for all three configurations are given in the table of FIG. 44.

a) Leveraged See-Saw Test No. 1, and Comparison with Theory

This configuration has $m_1$ and $m_4$ at 80 and 18.4 grams, respectively. $R_4$ is 698 mm. The four acceleration values used, and the resulting "average total force" values are given in the table of FIG. 44. Also in the table are the IK values for each acceleration, obtained from the empirical data, using eq. 21. Note that the resulting average value of IK is $1.73\times10^7$ g·mm$^2$. The theoretical value of IK is $1.74\times10^7$ g·mm$^2$, resulting in a Percent Error of only 0.57%. Using eq. 28 with $R_{AP}$ equal to 166 mm, the theoretical EM is 631 grams. Since EM and IK are directly proportional to each other, the Percent Error applies equally to both IK and EM.

As mentioned, these "total" force curves will exhibit periodic oscillations in the forces. The portion between two successive peaks, or two successive "troughs", of the curve/data represents one period of the oscillation. This period will normally vary as the downstroke progresses, due to damping and other factors. In terms of radians, one period is 2π radians. As with the very similar situation when averaging Local total forces, one cannot simply choose any two points as the boundary points for averaging "global" total forces (i.e., for a piano key action or leveraged see-saw). Rather, once a "start point" is chosen, one should choose as the "end point" a point that is a multiple of π radians (i.e. half a period) further along the force curve, and preferably at least 2π radians (i.e. a full period). The "distance" between the start point and the end point, in terms of radians, will be referred to herein as the Radian Distance. Regarding the "start point", it is usually best for it to represent a peak on the force curve, although a trough may sometimes be chosen. Choosing either a peak or trough makes it much easier (and indeed, possible) to find the endpoint, since it will then also lie on a peak or trough. Of course, there will only be a very limited number of peaks and troughs on any force curve, since the travel of the Contact is limited. The start point should generally correspond to the first peak. It could, however, be offset from a peak or trough by some fraction of the period. For example, it may be π/4 radians to the left of the first peak. The endpoint for that case should therefore be also π/4 radians to the left of a subsequent peak or trough, thus giving a multiple of π as the Radian Distance. Because of the varying period along the stroke, it is not very practical or accurate to use anything other than a peak or a trough for either the startpoint or endpoint.

In general, if there is enough data to discern a peak or trough an additional π radians further to the right, it should be chosen as the endpoint. This tends to maximize the Contact travel between the startpoint and the endpoint. It is also often a sound strategy to match a peak with a peak. That is, if one chooses a peak for the start point, one may want to also choose a peak for the end point (i.e., Radian Distance will be 2π, 4π, 6π, etc.). These two guidelines therefore must be balanced against one another, based on experience with certain types of actions, etc. Note that these procedures apply equally well to forces that are graphed versus distance (i.e. transposed forces). Whether time or distance, one finds a good "start point" for force-averaging based on these rules, then wisely chooses the endpoint based also on the guidelines given here. Following these rules represents the process of Determination of Total Force Integration Limits.

Figure 45A:
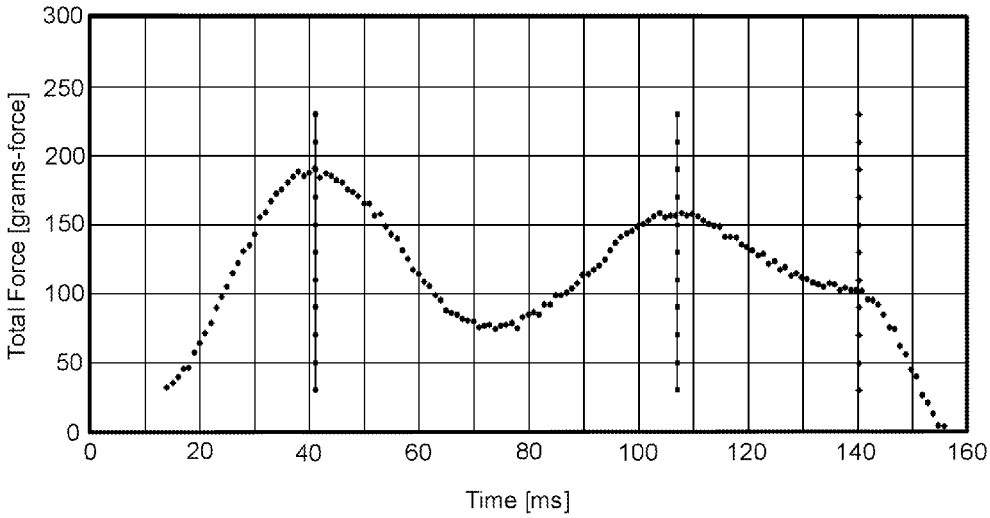
FIGS. 45 (*a*) and 45 (*b*) show the total force curve for the first two accelerations ($a_1$ and $a_2$), respectively, done on Configuration 1 of the see-saw.
Figure 45B:
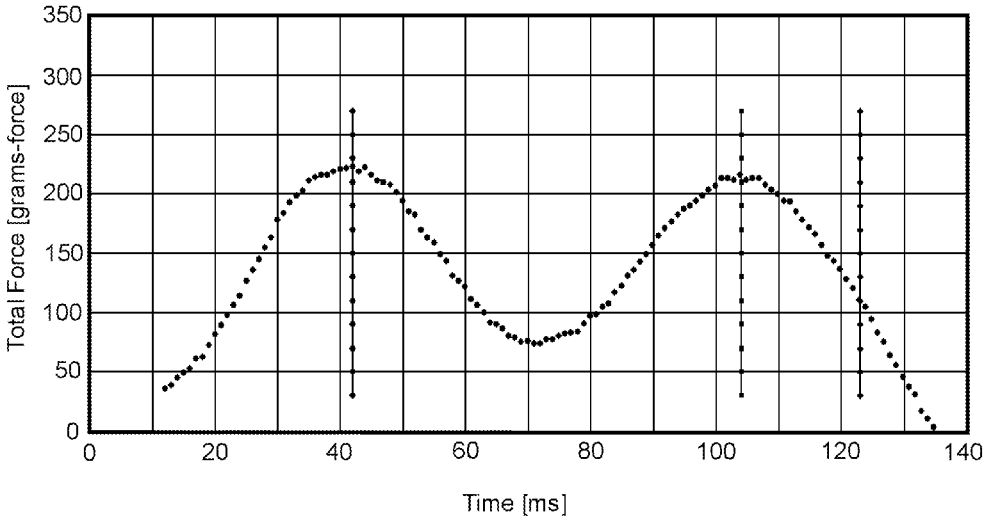

The synchronized Total Force curves for accelerations $a_1$ and $a_2$ ($9.88\times10^{-4}$ and $1.28\times10^{-3}$) are shown in FIGS. 45(*a*) and 45(*b*) respectively. The first vertical line represents the startpoint for force-averaging. Its time value is 41 ms in 45(*a*). The startpoint for averaging the Total Force should generally correspond to the first peak, as is the case here. The endpoint for averaging was chosen at time 107 ms, corresponding to the second peak. This gives a radian distance of 27π. The potential second trough could not be chosen because it was too close to the braking point of the stroke (the vertical line at time 140 ms). The forces appear to be approaching a local minimum near time 140 ms, but before this can be confirmed, the downstroke ends. If a second trough could have been found, it would have been preferable to choose it as the endpoint, thus maximizing Contact displacement between startpoint and endpoint. The resulting Average Total Force between times 41 and 107 was found from numerical integration to be 122.6 grams-force. In FIG. 45(*b*), the first peak was again chosen as the startpoint for force-averaging, as should generally be the case. It is located at time 42 ms. No peaks or troughs beyond the second peak are present in the data, so the endpoint was chosen at the second peak (time 104 ms). This again represents a radian distance of 27π. The resulting Average Total Force between times 42 and 104 was found to be 143.9 grams-force.

Figure 46A:
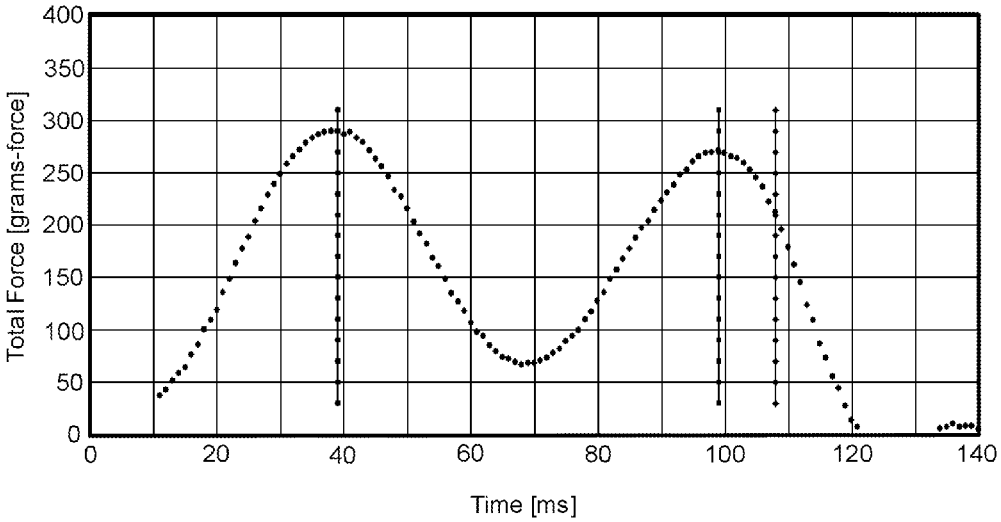
FIGS. 46 (*a*) and 46 (*b*) show the total force curve for the third and fourth accelerations ($a_3$ and $a_4$), respectively, done on Configuration 1 of the see-saw.
Figure 46B:
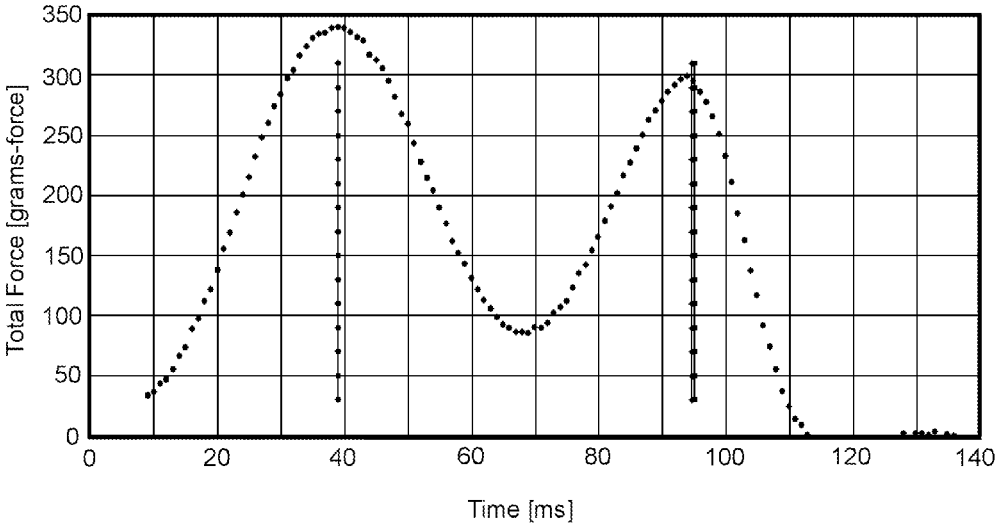

The synchronized Total Force curves for accelerations $a_3$ and $a_4$ ($1.67\times10^{-3}$ and $2.17\times10^{-3}$) are shown in FIG. 46(*a*) and FIG. 46(*b*), respectively. In FIG. 46(*a*), the first and second peak were chosen as the startpoint and endpoint, respectively, as there were no other peaks or troughs present in the data. The two are at times 39 ms and 99 ms, respectively, as shown. The resulting Average Total Force was calculated to be 171.2 grams-force. In FIG. 46(*b*), even the second peak barely occurred before the end of the acceleration stroke. The startpoint was chosen (at the first peak) to be time 39 ms, with the endpoint chosen as the second peak (at time 95 ms). The resulting Average Total Force was calculated to be 201.1 grams-force.

b) Leveraged See-Saw Test No. 2, and Comparison with Theory

This configuration has $m_1$ and $m_4$ at 100 and 26.8 grams, respectively. $R_4$ is 618 mm. The four acceleration values used, and the resulting "average total force" values are given in the table of FIG. 44. Also in the table are the IK values for each acceleration, obtained from the empirical data, using eq. 21. Note that the resulting average value of IK is $2.04\times10^7$ g·mm$^2$. The theoretical value of IK is $1.93\times10^7$ g·mm$^2$, resulting in a Percent Error of 5.7%. Using eq. 28 with $R_{AP}$ equal to 166 mm (and IK=$1.93\times10^7$), the theoretical EM is 700 grams.

Figure 47A:
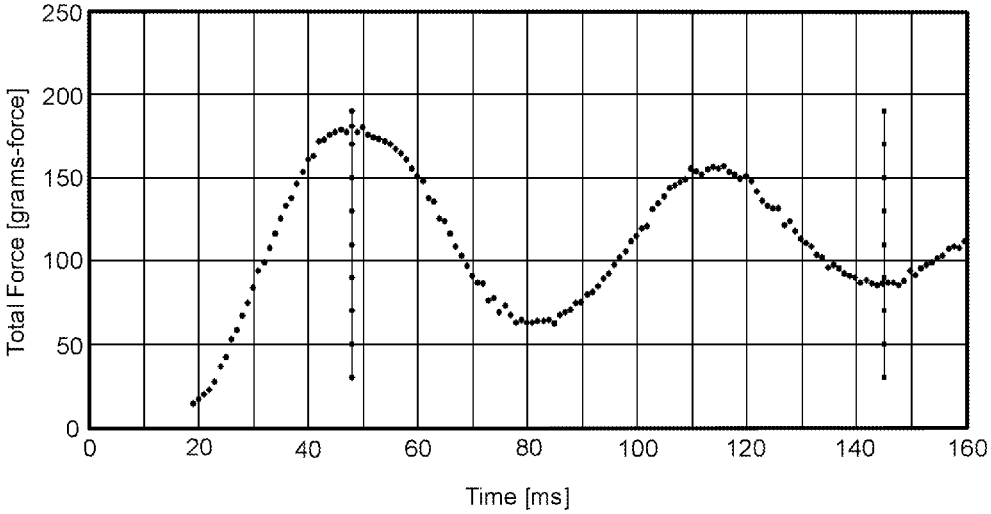
FIGS. 47 (*a*) and 47 (*b*) show the total force curve for the first two accelerations ($a_1$ and $a_2$), respectively, done on Configuration 2 of the see-saw.
Figure 47B:
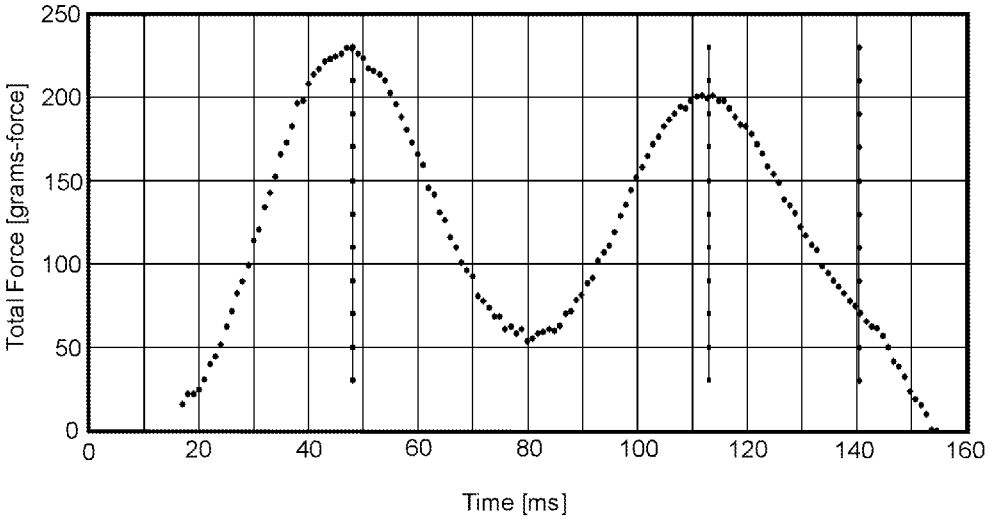

The synchronized Total Force curves for accelerations $a_1$ and $a_2$ ($7.6\times10^{-4}$ and $9.88\times10^{-4}$) are shown in FIGS. 47(*a*) and 47(*b*) respectively. As shown before, the first vertical line represents the startpoint for force-averaging. Its time value is 48 ms, and corresponds to the first peak. The endpoint for averaging was chosen at time 145 ms, corresponding to the second trough. This gives a radian distance of 3π. The second peak could have been chosen, but as mentioned above, it is often preferable to have the endpoint represent as large a displacement as possible. The resulting Average Total Force between times 48 and 145 was found from numerical integration to be 116.3 grams-force. In FIG. 47(*b*), the first peak was again chosen as the startpoint for force-averaging, as should generally be the case. It is located at time 48 ms. No peaks or troughs beyond the second peak are present in the data, so the endpoint was chosen at the second peak (time 113 ms). This represents a radian distance of 2π. The resulting Average Total Force between times 48 and 113 was found to be 131.7 grams-force.

Figure 48A:
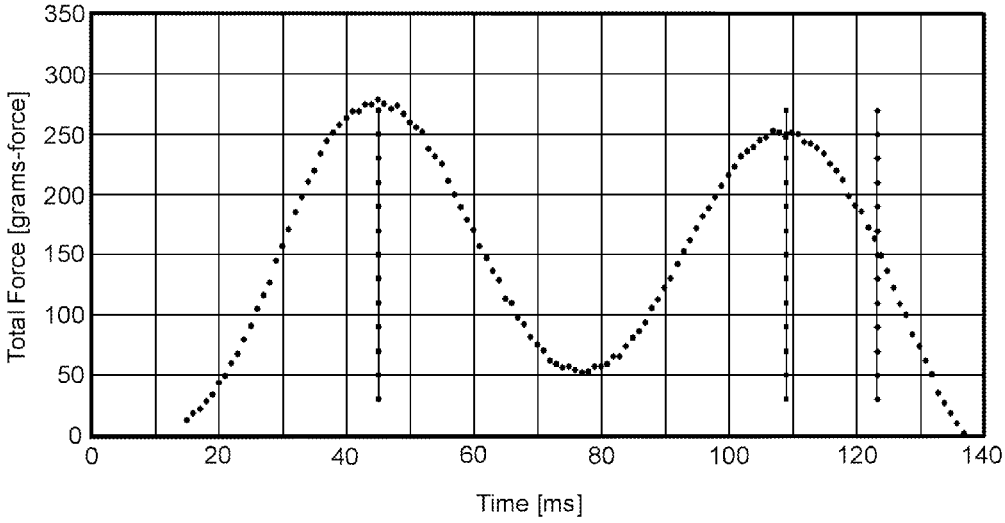
FIGS. 48 (*a*) and 48 (*b*) show the total force curve for the third and fourth accelerations ($a_3$ and $a_4$), respectively, done on Configuration 2 of the see-saw.
Figure 48B:
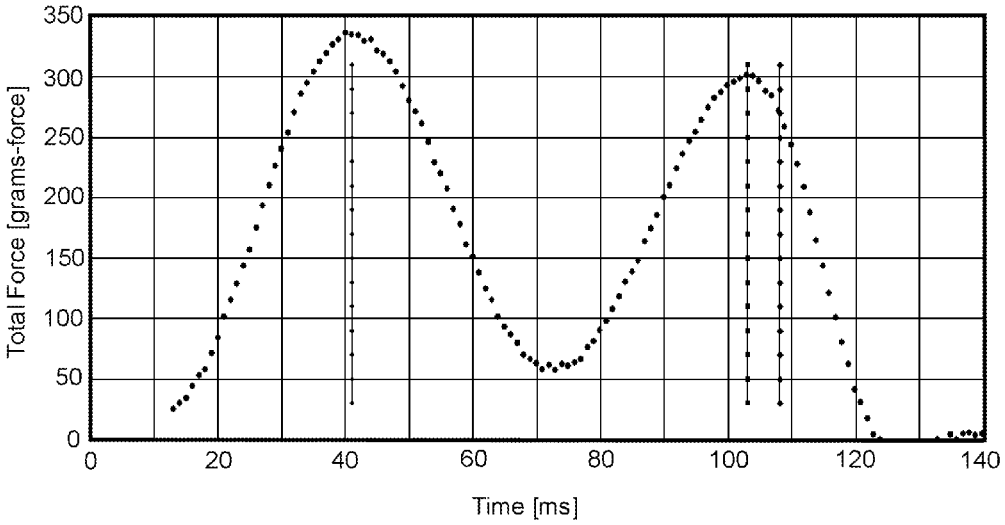

The synchronized Total Force curves for accelerations $a_3$ and $a_4$ ($1.28\times10^{-3}$ and $1.67\times10^{-3}$) are shown in FIGS. 48(*a*) and 48(*b*), respectively. In 48(*a*), the first and second peak were chosen as the startpoint and endpoint, respectively, as there were no other peaks or troughs present in the data. The two are at times 45 ms and 109 ms, respectively, as shown. The resulting Average Total Force was calculated to be 156.6 grams-force. In 48(*b*), the second peak occurred just a few milliseconds before the end of the acceleration stroke. It is quite obvious from all these examples that the faster the acceleration, the fewer peaks and troughs will occur. That is another good reason to do the dynamic run at several different accelerations, as some accelerations may be too aggressive to produce even a second peak. The startpoint was chosen (at the first peak) to be time 41 ms, with the endpoint chosen as the second peak (at time 103 ms). The resulting Average Total Force was calculated to be 186.9 grams-force.

c) Leveraged See-Saw Test No. 3, and Comparison with Theory

This configuration has $m_1$ and $m_4$ at 100 and 35.2 grams, respectively. $R_4$ is 458 mm. The four acceleration values used, and the resulting "average total force" values are given in the table of FIG. 44. Also in the table are the IK values for each acceleration, obtained from the empirical data, using eq. 21. Note that the resulting averaged value of IK is $1.76\times10^7$ g·mm$^2$. The theoretical value of IK is $1.65\times10^7$ g·mm$^2$, resulting in a Percent Error of 6.7%. Using eq. 28 with $R_{AP}$ equal to 166 mm (and IK=$1.65\times10^7$), the theoretical EM is 599 grams.

Figure 49A:
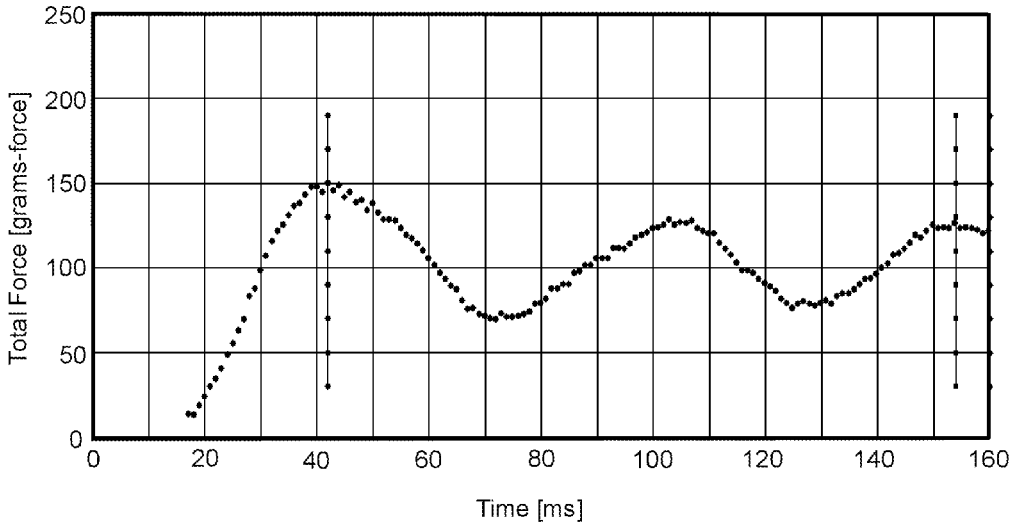
FIGS. 49 (*a*) and 49 (*b*) show the total force curve for the first two accelerations ($a_1$ and $a_2$), respectively, done on Configuration 3 of the see-saw.
Figure 49B:
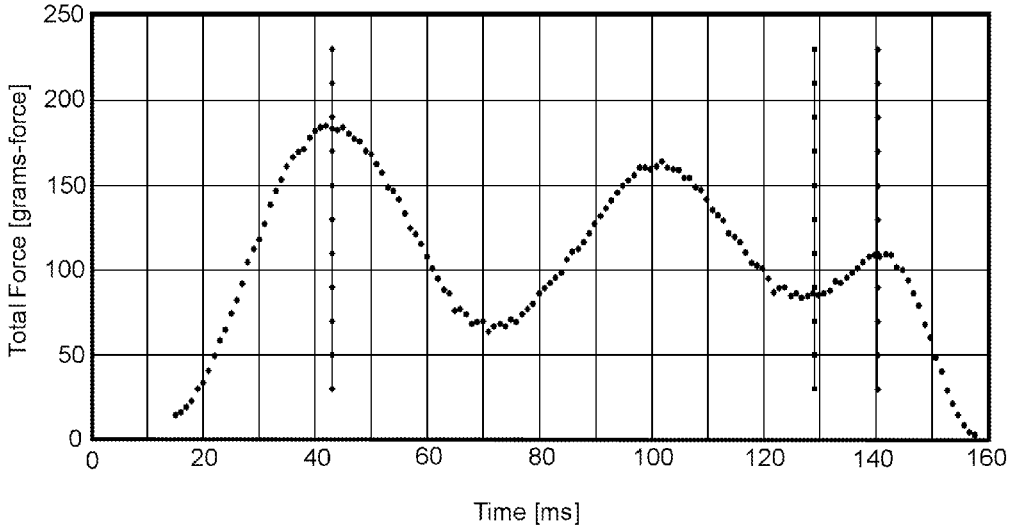

The synchronized Total Force curves for accelerations $a_1$ and $a_2$ ($7.6\times10^{-4}$ and $9.88\times10^{-4}$) are shown in FIGS. 49(*a*) and 49(*b*) respectively. As shown before, the first vertical line represents the startpoint for force-averaging. Its time value is 42 ms, and corresponds to the first peak. The endpoint for averaging was chosen at time 154 ms, corresponding to the third peak. This gives a Radian Distance of 4π. The second peak or second trough could have been chosen, but as mentioned above, it is often preferable to have the endpoint represent as large a displacement as possible. The resulting Average Total Force between times 42 and 154 was found from numerical integration to be 103.6 grams-force. In FIG. 49(*b*), the first peak was again chosen as the startpoint for force-averaging, as should generally be the case. It is located at time 43 ms. A second trough is clearly visible in the force data, so that was chosen (at time 129) as the endpoint. This represents a Radian Distance of 3π. The resulting Average Total Force between times 43 and 129 was found to be 119.6 grams-force.

Figure 50A:
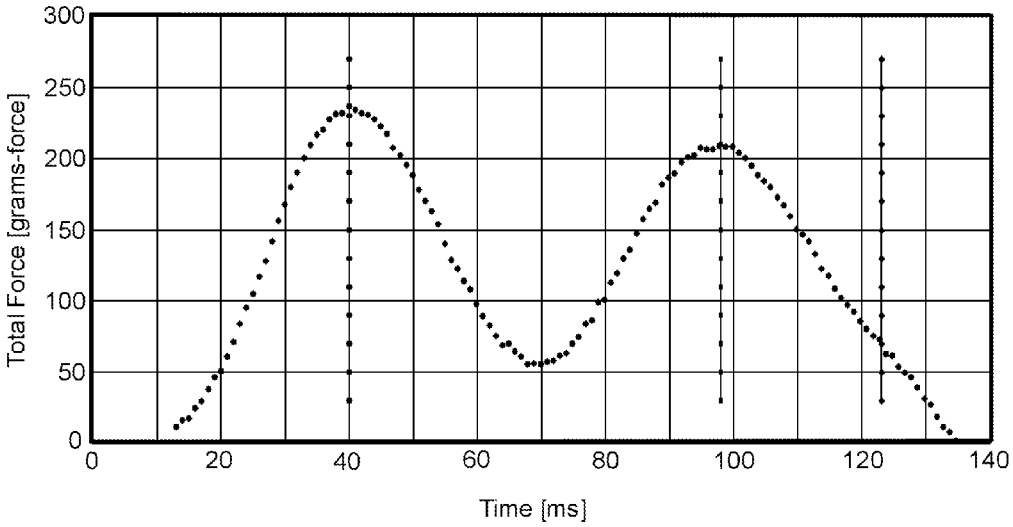
FIGS. 50 (*a*) and 50 (*b*) show the total force curve for the third and fourth accelerations ($a_3$ and $a_4$), respectively, done on Configuration 3 of the see-saw.
Figure 50B:
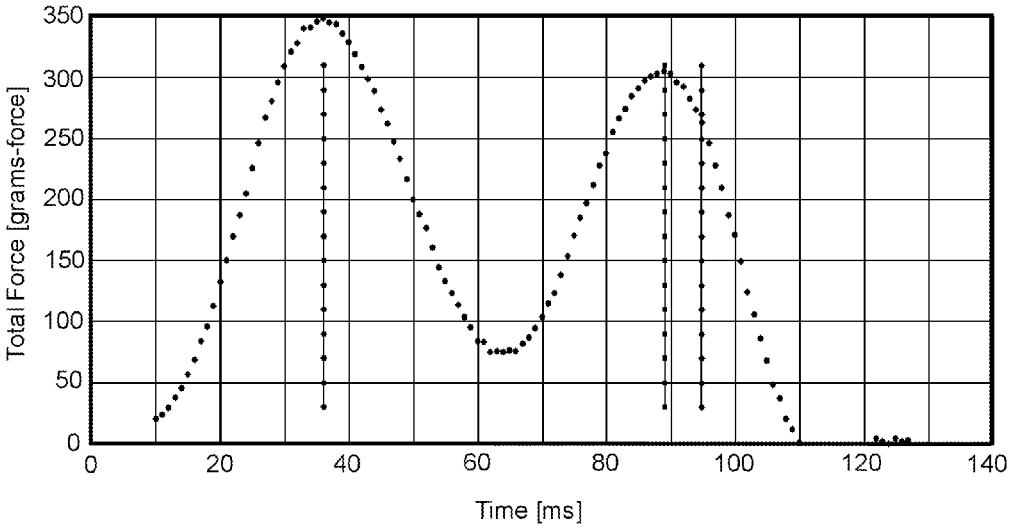

The synchronized Total Force curves for accelerations $a_3$ and $a_4$ ($1.28\times10^{-3}$ and $2.17\times10^{-3}$) are shown in FIGS. 50(*a*) and 50(*b*), respectively. In 50(*a*), the first and second peak were chosen as the startpoint and endpoint, respectively, as there were no other peaks or troughs present in the data. The two are at times 40 ms and 98 ms, respectively, as shown. The resulting Average Total Force was calculated to be 139.8 grams-force. In FIG. 50(*b*), the second peak was again clearly visible in the data, occurring about six milliseconds before the end of the acceleration stroke. The startpoint was chosen (at the first peak) to be time 36 ms, with the endpoint chosen as the second peak (at time 89 ms). The resulting Average Total Force was calculated to be 199.3 grams-force.

ii) On an Actual Piano Key Mechanism

Tests were also done on an actual piano key action, to determine the "global" inertial parameters. The hammer head was replaced by a 9 gram "point mass", firmly affixed to the end of the shank, at a true distance of 129 mm from the hammer flange (pivot). Thus, the hammer assembly for the "baseline" test looked like the one in FIG. 38(*a*), except that the mass was only 9 grams. In addition, the mass of the shank was a little heavier, at 5.1 grams. Two point masses were also added to the front half of the keystick: a 19 gram mass 145 mm in front of the balance rail pin, and a 26 gram mass at the A.P. (211 mm in front of the balance rail pin). This "baseline" configuration is referred to as G1. A second configuration consisted of adding an additional 4.8 grams to the existing 9 gram mass on the shank, resulting in a total "point mass" of 13.8 grams, still 129 mm from the pivot. In addition, a 19 gram mass is added at the A.P. (making 45 grams total at the A.P.). This test/configuration is referred to as G2.

Before these configurations were tested and evaluated for global inertia properties, the technique previously disclosed for determining the Moment Ratio was performed. Purely static (constant speed) tests done on the "baseline" configuration (G1) resulted in an Average Balance Force (ABF) of 37.8 grams-force. A second test was done after adding a significant mass (9.4 grams) out near the existing 9 gram mass. The average gravitational moment arm (horizontal component) for this added mass—about the operating axis of the hammer assembly—was 122 mm, meaning that the gravitational moment/torque added about the hammer axis was:

$$T_{add,hmr}=(9.4)(0.00981)(122)=11.25\ \text{N·mm}$$

The resulting ABF for this case where 9.4 grams was added near the "hammer head" location was 87.4 grams-force. With the A.P. being 211 mm in front of the pivot (balance rail pin), this gives a differential torque/moment at the key of:

$$T_{add,key}=(87.4-37.8)(0.00981)(211)=102.7\ \text{N·mm}$$

The Moment Ratio is then obtained by dividing $T_{add,key}$ by $T_{add,hmr}$, resulting in a value of 9.1. This will be used shortly to calculate the theoretical inertia values "at the key" for G1 and G2.

For both G1 and G2, the IK is determined: (a) from the pure textbook definition of mass moment of inertia (i.e., the "theoretical" method), and (b) by measuring $AF_{tot}$, ADF and $AFF_{c.s.}$ and plugging into equation 21 (the "empirical" method). The Friction Sensitivity Factor is assumed to be 1.0. Regarding the "empirical" method, two different acceleration runs are performed for each configuration. For each acceleration, the resulting "average total force" is determined, and plugged into eq. 21 to get the IK. The final value of IK for that configuration is obtained by averaging the IK values obtained at each acceleration. The EM is then obtained from the IK value, per equation 28. Separate runs are done to determine ADF and $AFF_{c.s.}$, per embodiments described elsewhere herein. The local inertia of the wippen and keystick are assumed to be the same as those described in Section N. Assuming the same Wippen Moment Ratio of 1.56, the reflected inertia of the wippen assembly is 210,913 g·mm$^2$. The inertia due to the keystick is $1.25\times10^6$ g·mm$^2$. The 19 gram key lead at 145 mm, which is common to both configurations, has an inertia value "at the key" of 19 multiplied by the square of 145 mm, or 399,475 g·mm$^2$. For configuration G1, the local inertia of the shank and 9-gram point mass is:

$$I_{hmr,loc}=(1/3)(5.1)(133)^2+(9)(129)^2=1.8\times10^5\ \text{g·mm}^2$$

Using the Moment Ratio of 9.1, the reflected inertia of the hammer for G1 is:

$$I_{hmr,refl}=(1.8\times10^5)(9.1)^2=1.49\times10^7\ g\cdot mm^2$$

The inertia due to the 26-gram mass at the A.P. is simply 26 times the square of 211, which becomes $1.16\times10^6$ g·mm$^2$. The theoretical Inertia at the Key (IK) for configuration G1, obtained by summing all these components, is $1.79\times10^7$ g·mm$^2$.

For configuration G2, the local inertia of the shank and 13.8-gram mass is:

$$I_{hmr,loc}=(1/3)(5.1)(133)^2+(13.8)(129)^2=2.6\times10^5\ g\cdot mm^2$$

Using the Moment Ratio of 9.1, the reflected inertia of the hammer for G2 is:

$$I_{hmr,refl}=(2.6\times10^5)(9.1)^2=2.15\times10^7\ g\cdot mm^2$$

The inertia due to the 45-gram mass at the A.P. is simply 45 times the square of 211, which becomes $2.0\times10^6$ g·mm$^2$. The theoretical Inertia at the Key (IK) for configuration G2, obtained by summing all these components, is thus $2.54\times10^7$ g·mm$^2$.

The results and pertinent information for both configurations are given in the table of FIG. 51. FIG. 52 (*a*) shows the resulting force data for the slower acceleration run of the G1 configuration. As the table shows, this acceleration is 0.00065 mm/ms$^2$. As expected, the first peak (at time 69 ms) was chosen as the startpoint for force averaging. One then sees that, beyond time 140 ms, the force flattens out almost entirely. In such cases, one can choose essentially any point in the flattened (horizontal) region as the endpoint. As shown, t=150 ms was chosen, as part of the Determination of Total Force Integration Limits. The resulting Average Total Force was 82.1 grams-force. The second run of G1 was made at a higher acceleration of 0.00081 mm/ms$^2$. The resulting forces are shown in FIG. 52 (*b*). The startpoint for force averaging was chosen as the first peak (at t=60 ms). One then sees that just enough of a second peak is visible before the force drops due to the Contact reaching the end of its stroke. The second peak (at t=144) is thus chosen as the endpoint for force averaging. The resulting Average Total Force was 89.4 grams-force. The values for IK at each run (obtained from eq. 21) are $1.94\times10^7$ and $1.90\times10^7$ [g·mm$^2$]. The average is thus $1.92\times10^7$ g·mm$^2$. This result has a Per Cent Error of 7.3%, using the theoretical value of $1.79\times10^7$ g·mm$^2$. Using eq. 28, the Effective Mass (EM) is found by dividing the average IK by the square of 211 mm. This results in an EM for configuration G1 of 431 grams.

Figure 53A:
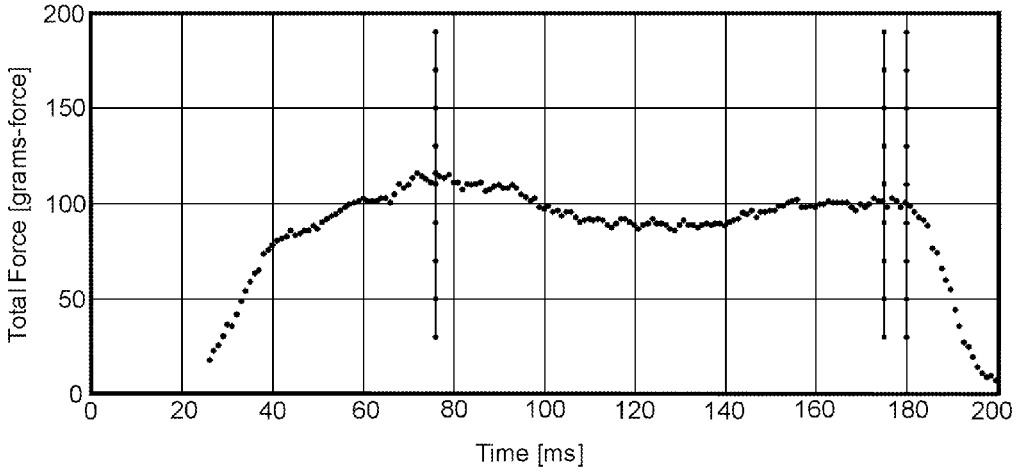
FIGS. 53 (*a*) and 53 (*b*) show the resulting total force curves for two different accelerations, with configuration G2.
Figure 53B:
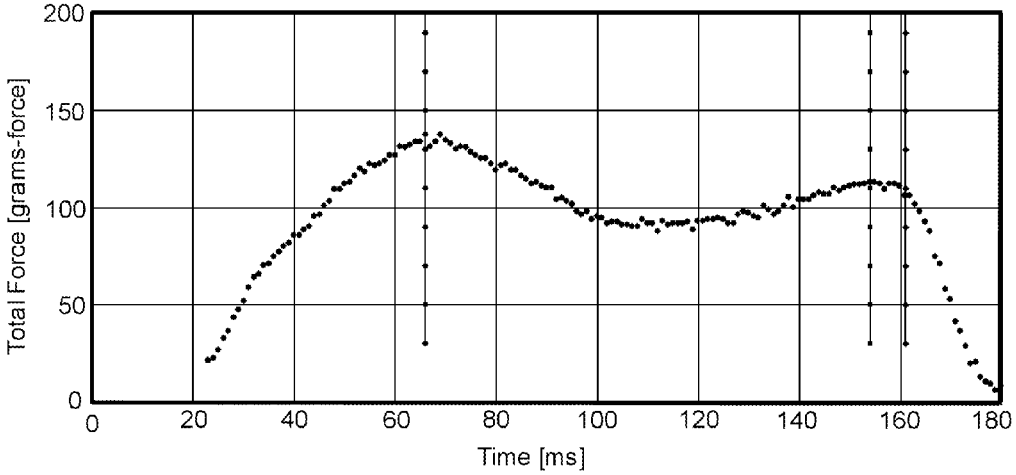

FIG. 53(*a*) shows the resulting forces for the slower acceleration run (0.00052 mm/ms$^2$) of the G2 configuration. The first peak (at t=76 ms) was chosen as the startpoint for force averaging. As was the case in the "slow" run of the G1 configuration, the forces flatten out near the end of the stroke. Any time may be chosen in this flattened region, for the endpoint. The time 175 ms was chosen, and the resulting Average Total Force was 97.3 grams-force. From eq. 21, Inertia at the Key (IK) for this "slow" run is found to be $2.8\times10^7$ g·mm$^2$. The second run in configuration G2 was made using an acceleration of 0.00065 mm/ms$^2$. The resulting forces are shown in FIG. 53(*b*). The first peak (at t=66 ms) was chosen as the startpoint for force averaging. A second peak (at time 154 ms) is just discernible before the stroke ends, and is chosen as the endpoint for the total force averaging. The resulting Average Total Force for acceleration 0.00065 was found to be 105.7 grams-force. From eq. 21, IK for this "faster" run is found to be $2.67\times10^7$ g·mm$^2$. The average of the two is thus $2.74\times10^7$ g·mm$^2$, giving a Per Cent Error of 7.9%, using the theoretical value of $2.54\times10^7$ g·mm$^2$. Using eq. 28, the Effective Mass (EM) is found by dividing the average IK by the square of 211 mm. This results in an EM for configuration G2 of 615 grams.

With regards to these "global" inertia parameters (like Inertia at the Key, Effective Mass, or Inertial Force), the goal would generally be to have the values vary continuously (i.e., smoothly) across the keyboard, from note to note. In order to ensure this, one must first and foremost be able to measure what the actual inertia values are. One must then know or determine what the "desired" value is for each note. That is, one would determine a "desired" curve of inertia values across the keyboard. Such a curve could be simply a "best fit" curve through some or all of the inertia values for the notes. One might create other desired curves as well, possibly offset from the "best fit" curve, when "heavier" or "lighter" dynamic feel is desired. The difference between the actual and the desired value, for any given note, might be called the "inertial deviation". For the keys with significant inertial deviations, Newtonian physics would be used to determine how/where mass needs to be added/removed to "cancel out" the deviation. Tradeoffs would be made on some notes, because the Balance Force should also vary continuously across the keyboard. In some cases, the two are not fully compatible without employing somewhat unorthodox means of adding mass (e.g. clips on the shank itself).

Q. Key Return and its Determination

A method is now disclosed, which directly measures the ability/readiness of the key to return towards its "rest" position, from some depressed position within the "pre let-off" region. The resulting parameter is called Key Return, and is a function not only of inertia in the key mechanism, but also of gravitational (and frictional) effects. The units of Key Return are "time", the most appropriate units for measuring this ability. Downward gravitational force on the hammer head aids the return movement of the keystick, while the hammer head's mass (inertia) impedes it. However, downward gravitational force on any key leads near the front of the key hinders this return movement, as does their inertia. A big reason why Up Weight is not a very good indicator of true "key sluggishness" is because these inertial effects cannot be considered in its determination. It will be shown that mass addition/subtraction near the front of the keystick has a significantly greater impact on "key returnability" than does adding/subtracting mass at the hammer head. Key Return as defined herein will be independent of any "aiding" forces from the repetition lever spring. It is defined so that it only takes into account any traditional "Up Weight" factors, along with inertia (i.e., distribution of mass in the mechanism) effects. Of course, the Up Weight factors would be friction, gravity forces, and any springs or magnets that are in play during the "pre let-off region" of the stroke. Key Return is defined herein as the amount of time it takes the key (or A.P. of the key) of a key mechanism to rise unimpeded from some initial "depressed" position to some higher position. It is preferable that the initial position be in the "pre let-off region" of the keystroke. To make this parameter more valuable, the vertical distance between the two points would generally be the same for all measurements (keys). And similarly, the vertical location of each point will generally be consistent relative to some known reference point, such as the "rest" position of the key. Of course, the larger the measured value of Key Return, the worse "key returnability" that key action exhibits. Phrased another way, the more "sluggish" that particular key mechanism is.

A method for determining Key Return involves temporarily placing the Contact in a Key Embed State, but at a known point, relative to "rest" position or Key Adjacent State. This point should, in one embodiment, be in the "pre let-off region" of the key's stroke. This Key Embed State will correspond to the Home Position for such a Key Return Run. The cut-off frequency for the active low-pass filter would be similar to that used for the acceleration/inertia runs. With an $8^{th}$-order active low-pass Bessel filter, a value of 56 Hz seems to work well. The DAQ would begin reading the forces at the Contact, and the Contact would ascend very quickly until it reached a known point at or somewhat below the "rest" position (i.e., at or somewhat below the Key Adjacent State), where it would quickly come to a stop. The startpoint of this quick upstroke might be 5 or 6 mm below the Key Adjacent State, with the endpoint at, say, 0.5 mm below the Key Adjacent State. With the Contact rising so fast, it will separate from the key and reach its endpoint before the key does. When the key finally catches up, it will collide with the stopped Contact, with the acquired forces revealing this collision event. The point where the force data shows the rising key beginning to collide with the Contact will be known herein as the Key Return Collision Point. The contiguous forces revealing this collision event will be referred to as a Key Return Collision String. The forces in this string will show an initial overwhelmingly upward trend in their magnitude, versus elapsed time. This is immediately followed by an overwhelming decrease in force values. In other words, a "force spike" occurs from the collision. The Key Return Collision String corresponds to this entire "spike" in measured forces, and is another example of a Transitory Collision String. The point where the Contact first begins its quick upstroke is also seen on the force data, showing up as a sudden decrease in force. This point will be referred to herein as the Key Return Start Point.

When the Contact begins quickly ascending at the start of the Key Return procedure, the Contact force data will reflect this in the form of a string of forces that decrease quickly (from a stable value approximately equal to the BF). The forces may even go negative briefly, since the Contact is accelerating upwardly. The Key Return Start Point can be determined as the point corresponding to the first (or thereabouts) of these decreasing forces. Finding this sudden decrease in force from the force data points could involve looking for "x" number of consecutive force decreases in a row, with the first (or point very near the first) of the string being declared the Key Return Start Point. Or it might involve looking for the first point that is followed by a certain number of points where every second (or third, etc.) subsequent point exhibits some minimum amount of force decrease. It might also involve the use of some moving average. Or it might involve the calculation of a variance parameter of the forces, both before and after the potential Key Return Start Point. When the variance parameter over some small region after the potential point is a certain amount larger than the variance parameter over some small region before the potential point, the point might be declared the Key Return Start Point. Any mathematical, numerical or visual technique for extracting the Key Return Start Point from force data that corresponds to the quick upstroke of a Key Return run is referred to herein as a Step for Determining Key Return Start Point. However, as long as the forces are synchronized, the Key Return Start Point will also correspond to "time zero" of the Motion Profile being followed. In that case, the Step for Determining Key Return Start Point is as simple as locating "time zero (TZ)" on the synchronized force versus time graph.

The ascending Contact separates from the key during the Key Return procedure, with the resulting forces temporarily going to zero or below. When the Key finally catches up to the suddenly-stopped Contact during the Key Return procedure, the Contact force data reflects this in the form of a significant and temporary "spike" in force. This is the Key Return Collision String. The Key Return Collision Point can be determined as the point corresponding to the first (or thereabouts) of these increasing forces. For instance, this point may be defined to correspond to the force data point just before the first of the increasing forces of the Key Return Collision String. Finding the Key Return Collision String from the force data points could involve looking for "x" number of consecutive force increases in a row, followed by "y" number of consecutive force decreases in a row. Or it might involve looking for the region beginning at a point followed by a certain number of points where every second (or third, etc.) subsequent point exhibits some minimum amount of force increase; and then every second (or third, etc.) subsequent point exhibits some minimum force decrease. Similarly, it may involve looking for the first point that is followed by some minimum number of ever-increasing forces, with the final increasing force at least "y" grams greater than the first (or thereabouts) force of the increasing string. It might also involve the use of some moving average. Or it might involve the calculation of a variance parameter of the forces, both before and after the potential Key Return Collision Point. When the variance parameter over some small region after the potential point is a certain amount larger than the variance parameter over some small region before the potential point, the point might be declared the Key Return Collision Point. The deceleration of the Contact and arm/follower—at the top of the Key Return movement—inevitably leads to an "inertia hump". This "inertia hump" is always nearly the same (for a given Key Return Motion Profile), as far as where it starts and where it ends. In addition, its total "height" is somewhat constant as well. This hump has nothing to do with the key recontacting the Contact, and must therefore be ignored. Normally the forces in this hump are significantly lower than those seen when the key collides with the Contact. This, coupled with the fact that the hump always has the same place and shape (although varies in height sometimes), makes it fairly easy to "filter out" the "inertia hump", and find the true Key Return Collision String/Point. For example, the logic in the Controlling Program (or subsequent spreadsheet) can be adjusted to ensure that the required "force rise" (for finding the Key Return Collision String) is higher than that produced by the "inertia hump". If the inertia hump occurs early enough, it can also be filtered out (ignored) by simply not looking for the Key Return Collision String until the elapsed time corresponding to, say, the apex of the hump has occurred. Any mathematical, numerical or visual technique for locating the Key Return Collision String from force data resulting from the quick upstroke—and subsequent Contact braking and key/contact collision—of a Key Return run is referred to herein as a Step for Determining Key Return Collision String. Once the string is found, the Key Return Collision Point is extracted as described above. The flowchart of FIG. 1 represents some of the steps involved in finding the Key Return. The following examples show the results of Key Return procedures performed on two actual key actions, per the embodiments herein.

Figure 2A:
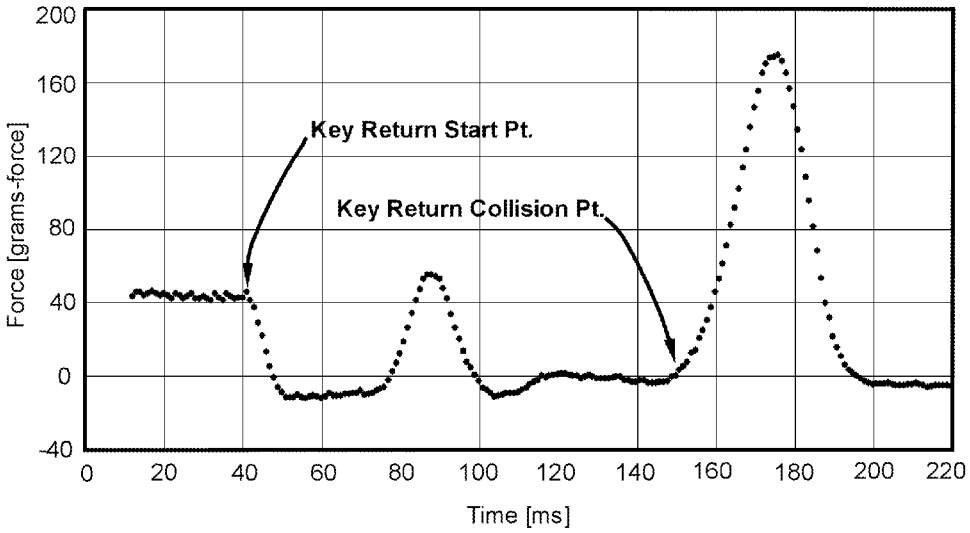
FIG. 2 (*a*) and FIG. 2 (*b*) show resulting force curves taken during Key Return runs on a piano action, where mass was added to the front of the key for the second run.
Figure 2B:
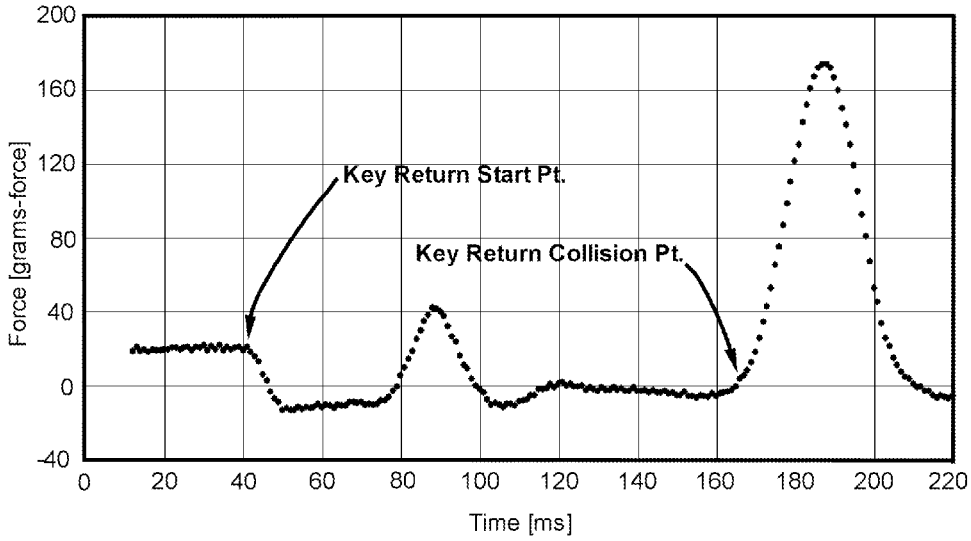

A Key Return procedure was performed on an actual key action (Key Action 1), with the Key Return Start Point located 6 mm below the Key Adjacent State, and the Key Return Collision Point occurring at 0.5 mm below the Key Adjacent State. In other words, the Contact begins its quick Key Return ascent at Key Adjacent State plus 6 mm, and ends it at Key Adjacent State plus 0.5 mm. A Motion Profile was followed that moved the Contact from start to end (a distance of 5.5 mm) in only 45 ms. The resulting force data is shown in FIG. 2(*a*). The force data shown is unsynchronized, although the extraction of the "start time" and "end/collision time" of the Key Return procedure may be done on either synchronized or unsynchronized force data. As one sees, a long string of decreasing forces begins at a time of 41 ms. Per the methods described above, the point corresponding to this time is therefore the Key Return Start Point. One also sees that—subsequent to this—the forces begin to increase drastically at a time of 150 ms. Again according to the methods described above, the point corresponding to this time is therefore determined to be the Key Return Collision Point. The Key Return is simply the elapsed time between these two points. That is, the Key Return is 150−41, or 109 ms. It should be noted that examination of previous runs had shown clearly that the "hump" beginning at time 76 (i.e., 35 ms after the Key Return Start Point), and ending at approximately 103 ms (i.e., 62 ms after the Key Return Start Point), was consistent timewise for all keys/runs, and was therefore the "inertia hump". The logic for finding the Key Return Collision Point was therefore adjusted by requiring the total force increase to be greater than, say, 65 grams. Of course, other means for adjusting the search logic could have been used to "filter out" the inertia hump.

A Key Return procedure was then performed on another key action (Key Action 2) of the same piano, using the same Motion Profile and displacement for the movement. The resulting force data is shown in FIG. 2(*b*). As one sees, a long string of decreasing forces begins at a time of 41 ms (same as the other key action). Per the logic described herein, the point corresponding to this time is therefore the Key Return Start Point. The "inertia hump", as expected, is in the exact spot as before, only not as tall. The Balance Force for this key is seen to be significantly less than the first key's, as well. One now sees that—out beyond the "inertia hump"—the forces begin to increase drastically at a time of 165 ms, and reach a maximum value of 175 grams. According to the logic described herein, the point corresponding to this time is therefore determined to be the Key Return Collision Point for Key Action 2. The Key Return is therefore 165−41, or 124 ms. It thus takes this key 15 additional milliseconds (compared to Key Action 1) to rise from a 6 mm depressed position to the position 0.5 mm shy of "rest position". This difference certainly makes sense, since Key Action 2 had a little more lead out near the front of the key (which also explains the smaller BF).

Figure 3A:
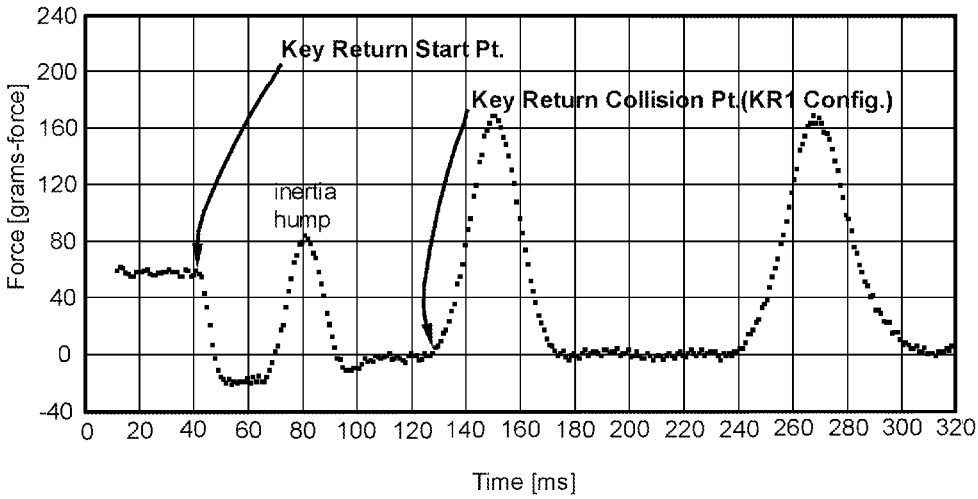
FIG. 3 (*a*) and FIG. 3 (*b*) show resulting force curves from two Key Return runs on a piano action, where mass was added to the hammer head before the second run.
Figure 3B:
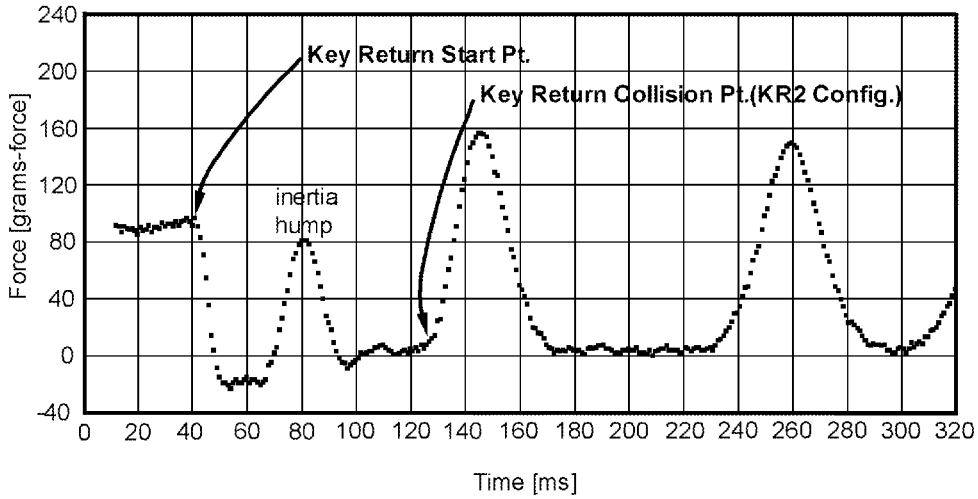

Key Return tests were done on yet another piano key action pair. The keystick, wippen and hammer were nearly identical to those shown in FIG. 38. The baseline test (Test KR1) had a "point mass" of 9 grams (rather than 9.8 grams) affixed to the end of the shank, so that its distance from the hammer shank pivot was 129 mm. The mass of the shank was 4.5 grams. A second test (Test KR2) had a configuration the same as the baseline, but with an additional 4.8 gram point mass added to the 9 gram mass (i.e., 129 mm from the pivot). The third and final test (Test KR3) had the same configuration as KR2, but also included a 26 gram "point mass" out at the A.P. of the keystick. FIG. 3(*a*) shows the force data resulting from a Key Return test on the baseline (KR1) configuration, while FIG. 3(*b*) shows the force data for the KR2 configuration. By comparing the two, one sees that the addition of 4.8 grams at the "hammer head" location had very little effect on the Key Return value. Without the 4.8 gram mass, it took the key 86 ms to ascend the 5.5 mm (i.e., 127−41=86). With the 4.8 gram mass, the ascent time (Key Return) was reduced by about 3%, to 84 ms (i.e., 125−41=84). While the heavier "hammer" produced more gravitational moment, it also created more inertia. The two effects essentially cancelled each other, in this case.

Figure 4A:
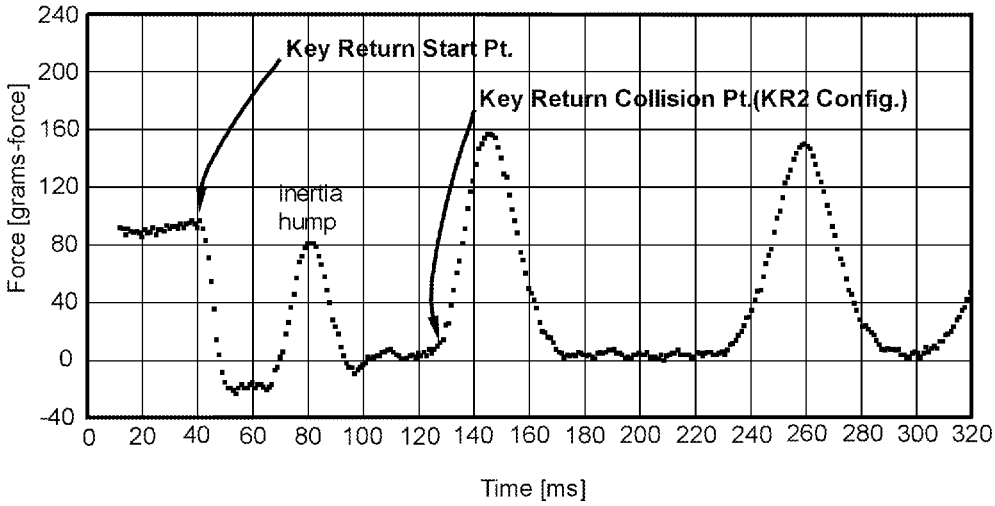
FIG. 4 (*a*) and FIG. 4 (*b*) show resulting force curves from two Key Return runs on a piano action, where 26 grams was added to the A.P. before the second run.
Figure 4B:
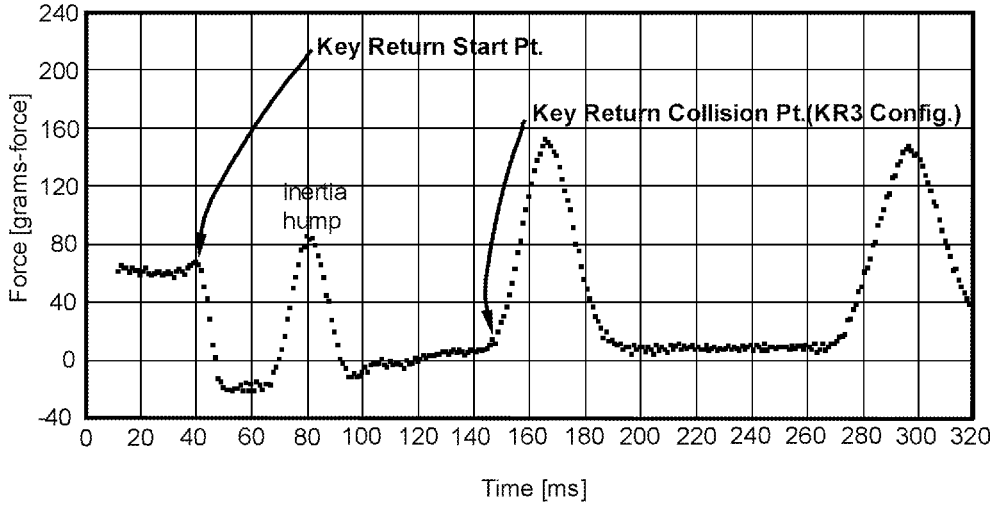

FIG. 4(*b*) shows the force data from the third test (KR3). The data from KR2 is shown again as FIG. 4(*a*) to aid the direct comparison. Note that adding the 26 gram mass out at the A.P. (211 mm from the balance rail pin) increased the Key Return from 84 ms to 107 ms. This is an increase of 27%. The Key Return Start Point stayed at 41 ms, while the Key Return Collision Point moved to 148 ms (148−41=107). The added 26 gram mass (simulating a key lead) resists the key's ascent in two ways: (1) the moment/torque due to gravitational forces on the mass, and (2) the inertia, about the balance rail pivot, of the mass.

Just as with inertia, static forces, and let-off parameters, one could determine a "desired" curve of Key Return values across the keyboard. This may be obtained from some sort of "best fit" analysis of the measured values, possibly after removing certain outliers. One then knows exactly where any given key's Key Return value is relative to its "desired" value. Even if used for only qualitative purposes, this information is extremely valuable. For instance, imagine a note whose Balance Force is well above the "desired" Balance Force curve. One may be inclined to add a key lead near the front to reduce the BF. However, if that note's Key Return value is already well above its neighbors (i.e., well above the "desired" Key Return curve), one may decide to leave the Balance Force where it is so that "key sluggishness" is not made even worse. Or possibly, one might add a smaller key lead to "split the difference".

All electrical and electronic circuitry and processes contemplated herein may be implemented using convenient functional and operational modules. All methods involving calculations described herein may be carried out via electronic or digital processes using a conventional computer in a conventional manner with all of its conventional components, or a similar CPU-based computing device, via computer-executable instructions, and conventional data manipulation, storage and operations, implemented in the applicable software and programming modules.

DEFINITIONS

For understanding and interpretation of the description of the invention and the claims, except as otherwise noted, certain terms used herein are defined as follows:

Application Point (AP)—the approximate point on the top surface of the key where the key is acted upon (or simply contacted) by either gram-weights, or by the well-controlled Contact. Its traditional location (10 to 13 mm from the front of the key), where gram-weights have been historically applied, is herein known as the traditional Application Point. The AP as defined herein actually moves with the key. A vertically-moving Contact may therefore not stay exactly on the AP as the keystroke progresses, but will remain fairly close to it.

Local Application Point ($AP_{loc}$)—the approximate point on the surface of the action component being measured that is contacted by the Contact during runs required for determining "local" static forces or "local inertia parameters" for that component.

Balance Force—the theoretical key force a Contact would experience if moving at a constant speed up or down through the "pre let-off" region, with all frictional forces removed from the key action. As with Down Force and Up Force, it is a continuous function of key displacement.

Black Key Profile Offset (BKPO)—a constant that specifies exactly how far above the white keys' Desired At-Rest Profile the black keys' Desired At-Rest Profile should be. It is based on specifications and/or the preference of the technician.

Black Plane Offset (BPO)—the exact amount of vertical displacement that the Contact (in some given Home Position) undergoes in switching from white key measurements to black key measurements. In other words, it is the distance between the Zero Position Plane and the Local Black Plane.

Bottom-Out Force—a given value of force that directly determines which point during a downstroke corresponds to the Bottom-Out Point, and thus the BOD.

Bottom-Out Displacement (BOD)—the amount of distance traveled by the Contact between some Home Position of a downward Run and the Bottom-Out Point.

Bottom-Out Point—the point (in time and/or space and/or the force data) in the downstroke of a Contact where some minimum and predetermined amount of compression resistance (due to the Front Punching or its equivalent) is encountered by the Contact.

Compression Threshold Force (CTF)—during a Run for determining the BOD, the force threshold above which the reaction forces and displacement at the Contact are recorded for subsequent or realtime use in (a) verifying that Front Punching compression has occurred, and/or (b) calculating stiffness values and/or the BOD, assuming verification is achieved.

Contact—the portion of the machine that moves in a well-controlled manner near and against the piano key, often touching and moving the piano key, while transmitting the reaction forces to the force transducer. It can move the piano key downwardly, and allow the key to move upwardly, in a controlled manner, while also transmitting the reaction forces to the force transducer.

Desired At-Rest Profile—the curve formed by the combination of all the desired "at rest" AP's of a given key color, as viewed from the front of the keyboard.

Desired Depressed Profile—the curve formed by the combination of all the desired "depressed" AP's of a given key color, as viewed from the front of the keyboard.

Down Force—the continuous reactive force felt by a Contact moving a key downwardly at an essentially constant speed, prior to let-off being reached.

Local Down Force—the continuous reactive force felt by a Contact moving essentially transversely against an action component—in the "free" direction (normally downward)—so that either the Contact is moving at an essentially constant speed, or the component is rotating at an essentially constant angular speed. This is needed for the full determination of local inertia parameters for the component. It can also be used with Local Up Force to determine the friction in the operating axis of that component.

Downstroke—any controlled downward movement of the Contact, while near or actually moving the key or action component.

Force Transposition—the act of "converting" one or more force data points from its "synchronized" time domain to its displacement domain. That is to say, taking a force data point on a force versus "synchronized" time graph, and placing it in its proper location on the corresponding Force vs. Displacement graph.

Front Punching Stiffness (FPS)—the apparent stiffness of the key mechanism at the AP, with the Front Punching already being deformed by the bottom of the key.

Grams—In addition to its traditional definition as a unit of mass, it is used here also as a unit of force; the amount of force that gravity exerts at sea-level on a body of a given mass "x" [grams] will also be considered herein as "x" grams of force, or "x" grams-force.

Home Address—The process of bringing the motor and contact to a Home Position.

Home Position—any one point in the motor's movement that corresponds to some convenient or desired vertical position of the Contact. It is normally the "starting point" of the current Run. In referring to "home position" herein, the reference is usually to the Contact's vertical position at said condition, but can also be to the motor position/orientation at said condition. The "zero point" is then considered as the point in space—relative to some non-rotating coordinate system attached to the Carriage—corresponding to some specific point on the Contact (normally the lower tip/apex) when at the designated Home Position. Once determined, the "zero point" is fixed relative to a non-rotating coordinate system on the Carriage, and does not move vertically with the Contact.

Inertial Force—during an accelerated downstroke, the reaction force at the A.P. of a piano key action, due solely to inertia of the mechanism.

Jack Trip Force—a representative force of the let-off event, often corresponding to the largest force. It is best considered to be the force associated with the Jack Trip Point. However, it may also be the force associated with points near, or just prior to, the Jack Trip Point. It may also be an average of some or all forces measured within the let-off region of the keystroke.

Jack Trip Point—the point in space, time, and/or on resulting force data, during the downward keystroke of a key action, where the jack ends direct contact with the hammer knuckle (in the case of a grand piano), or with the hammer butt (in the case of most vertical pianos). It is located at the apex of the Let-Off Collision String.

Key—the long lever of a piano key action, which is depressed by the player to ultimately create the sound. In certain instances herein, the term "key" may also imply any of the major action components (most notably, hammer assembly or wippen assembly) which are excited by the Contact during various tests to determine Local Inertia or Local Force values. The term as used herein also includes the potential presence of any stiff member(s) that might be placed on top of the key or component, which would allow coupling of a Contact to the actual key or component.

Key Action (also known as Key Mechanism)—all the levers and other components, including the key and the hammer assembly, which convert key movement into hammer head movement; this includes the let-off components, which serve to free the hammer from the other components before the hammer strikes the strings.

Key Adjacent State—A geometric configuration where the Contact is either within some minimal distance of the "at rest" key top, or displacing the key some minimal amount. The force between the Contact and the key in such a state is nearly zero. When performing measurements of an individual action component (for determining local inertia parameters or local forces), "key top" and "key" can be replaced by "component".

Key Bed—a thick, horizontally-situated slab, which is considered part of the structure of a piano, and upon which the keyboard rests. In the descriptions of various embodiments herein, usage of "key bed" may also be used to imply "some important part of the keyboard frame", for situations when the action is removed from the piano.

Key Clear State—A geometric configuration where the piano key is below the Contact by some finite amount.

Key Embed State—A geometric configuration where the Contact is displacing the key downwardly—from its uppermost, "at rest" position—by some finite amount.

Key Height—the vertical distance from the top of the key bed to the AP of a key mechanism in its "at rest" position.

Key Leveling—the process of locating and then repositioning the "at rest" playing surfaces of the key mechanisms to their desired vertical locations, relative to the key bed. It can also mean measuring and adjusting the "depressed" positions of the key mechanisms as well. Sometimes, the former process is referred to as "at rest" key leveling, and the latter as "depressed" key leveling.

Key Return Collision Point—the point where the measured force data shows the rising key beginning to collide with the Contact, during a Key Return run. It represents the beginning of a Key Return Collision String.

Key Return Collision String—the contiguous forces revealing the collision event (between key and Contact) that occurs after the upwardly-moving Contact suddenly stops during a Key Return run. The forces show an initial overwhelmingly upward trend in their magnitude, versus elapsed time. This is immediately followed by an overwhelming decrease in force values. In other words, a "force spike" occurs from the collision. It is an example of a Transitory Collision String.

Let-Off Collision String—a series of contiguous and increasing force data points—followed by a contiguous string of decreasing force data points—resulting from the downward Run of a Contact against a piano key mechanism, when the let-off event is encountered at some appreciable speed. The Let-Off Start Point is at or very near the beginning of the Let-Off Collision String, which is another example of a Transitory Collision String.

Let-Off Start Point—the point in space and/or time where either (a) the jack first contacts the let-off button during a downward keystroke, or (b) the repetition lever first contacts the drop screw during a downward keystroke. On the resulting force diagram, it is at or near the beginning of the Let-Off Collision String.

Local Black Plane—the "reference/zero plane" used when performing "key leveling" measurements (either at-rest or depressed) on black keys. Normally, it is simply located at some known distance from the Zero Position Plane, this distance being "built into" the machine. If only black keys are to be measured, it can be established independently with respect to the key bed, in the same way the Zero Position Plane is established for white key measurements.

Longitudinal—an orientation meaning "in the direction of the main axis" of a key. That is, in a direction essentially parallel to the top surface of the key, but also essentially perpendicular to the front edge of the key and keyboard.

Mid-Run Key Collision Displacement (MRKCD)—The distance (relative to some Home Position) that the Contact must travel downwardly during a Run, before contacting the top of the key. It is typically determined from the force data, and more specifically after the Mid-Run Key Collision Point is determined.

Mid-Run Key Collision Point—the point (in time or space) in a downstroke where the Contact first begins contacting and moving the key (assuming that the Contact began the downstroke in a Key Clear State). It corresponds to the point at or very near the beginning of a Mid-Run Key Collision String.

Mid-Run Key Collision String—during a downward Run beginning in a Key Clear State, a series of contiguous and increasing force data points, measured and/or recorded as the Contact begins to collide with and move the key. The forces represent the contact force between the Contact and the top of the key. It is another example of a Transitory Collision String.

Motion Profile—the theoretical displacement vs. time curve that the Contact follows for a given Run. The zero reference for the displacement is usually the Contact's Home Position for that Run.

Passive Displacement (PD) Gauge—A traditional gauge having a "main body" and some sort of "sliding rod", which moves relative to the main body. This type of gauge generally relies on gravity or a light spring to maintain one end (the mating end) of the sliding rod against an object. The gauge cannot initiate movement, and simply finds/follows the object of interest (e.g., a piano key), which is already in a static state. After the object has moved to another position (or been "replaced" by another object), the relative displacement of the sliding rod (relative to the main body) along its axis is read or recorded, often with the help of an attached Dial Indicator device.

Post-Trigger Delay (PTD)—the time elapsed between the Trigger and the theoretical "time zero" point of the Motion Profile for a Scanning Acquisition Run.

Pre Let-Off Region—the region of a piano key mechanism's stroke between the key's "at rest" position and the point in a downward keystroke where either the jack first contacts the let-off button, or the repetition lever first contacts the drop screw. It is a purely geometric definition, and therefore applies no matter which direction the key is moving, or even if the key is not moving.

Run—The controlled movement and positioning of a Contact near or against the key, not including preparatory movements such as Home Address, while simultaneously measuring and/or recording any forces acting upwardly on the Contact. When performing measurements of an individual action component (for determining local inertia parameters or local forces), the word "key" in the previous sentence is replaced by "component".

Synchronized Force-Time Graph—a graph of acquired forces (acting against the Contact) versus time, whereby "time zero" of the Motion Profile is "mapped" onto its proper corresponding location (herein called point TZ) along the time axis of the raw Force-Time graph. All points to the left of point TZ, on the raw force graph, could subsequently be removed, so that point TZ actually corresponds to the origin of the Synchronized Force-Time Graph.

Time File—a file read in (or created) by the controlling program, each line representing the time associated with the corresponding motor step (or position, if non-stepping motors are used), in order to generate some predetermined Contact Displacement vs. Time curve.

Time Moving Before Bottom-Out (TMBBO)—the time elapsed between "time zero" of the Motion Profile and the point where the Contact is determined to reach the Bottom-Out Point during a downstroke. It is particularly important for Scanning Acquisition runs. In such runs, it can be used to determine Bottom-Out Displacement (BOD) via the Motion Profile.

Time Moving Before Contact (TMBC)—the time elapsed between "time zero" of the Motion Profile and the instant when the Contact first collides with the key during a downstroke that began from a Key Clear State, and ends in a Key Embed State. This is particularly important for Scanning Acquisition runs. The main purpose for TMBC is in determining MRKCD from it (via the Motion Profile).

Time Moving Before Jack Trip (TMBJT)—the time elapsed between "time zero" of the Motion Profile and the instant when the Contact has pushed the key downwardly far enough for the jack to "trip out" from beneath the knuckle (for a grand piano action) or the hammer butt (for a vertical piano).

Time Moving Before Let-Off (TMBLO)—the time elapsed between "time zero" of the Motion Profile and the instant when the Contact has pushed the key downwardly far enough for either (a) the jack toe to begin contacting the let-off button, or (b) the repetition lever to begin contacting the drop screw.

Total Force—the total key force felt at the A.P. at any instant during an accelerated downstroke (in the "pre let-off region"). It includes the Inertial Force, along with various frictional and non-inertial forces such as those due to gravity and springs.

Transitory Collision String—a group of contiguous, measured force data points that show an overwhelming trend of increasing force (with time or displacement), often followed closely by a series of decreasing forces (with time or displacement), due to a "collision" event (and sometimes a "separation" event) during or shortly after a downward or upward Run of the Contact. These events include the downwardly-moving Contact colliding with the "at rest" key, the key passing through its "let-off" region, and the rising key "catching up" to the recently-stopped Contact during a Key Return procedure.

Trigger—the point in time when the DAQ first begins taking data in some sort of scanning mode. Also can refer to the actual signal that is sent to the DAQ to initiate the scanning Up Force—the continuous key force acting against a Contact as it moves upwardly at an essentially constant speed while in contact with a depressed key, and always avoiding the let-off region of the key action.

Local Up Force—the continuous component force acting against a Contact as it moves in the "stop" direction (normally upward) so that either the Contact is moving at an essentially constant speed. Local friction is half the difference between Local Up Force and Local Down Force.

Upstroke—any controlled upward movement of the Contact, while near or actually touching the key or action component.

Vertical—a direction that is approximately perpendicular to the key bed of the piano, and/or approximately perpendicular to the main rails of the key frame. For "local" measurements on the hammer assembly itself, vertical may imply a direction essentially perpendicular to the longitudinal axis of the hammer shank.

Vertical AP Plane—the plane which is perpendicular to the key bed/key frame, parallel to the front edge of the keyboard, and passing through the designated Application Points of all keys of a given color. So once the longitudinal AP location (e.g. 10 mm from the front edge, etc.) for each key color is determined, the Vertical AP Plane for that key color is also established.

Zero Position Line—a theoretical line, lying approximately in the Vertical AP Plane for the white keys, which is essentially parallel to the keybed and/or keyboard frame, while also passing through the "zero point" of the Carriage/Contact when it is over any white key. When the machine is properly oriented for performing "key leveling" measurements on white keys, the Zero Position Line will pass through all "zero points", no matter which white key is being addressed. A similar line called the Zero Position Black Line exists for performing "key leveling" measurements on black keys.

Zero Position Plane—a plane that passes through the Zero Position Line, while being approximately parallel to the keybed/keyboard frame. The Local Black Plane, to which the black key measurements are relative, is usually simply parallel to the Zero Position Plane, and above it by some known amount (normally dictated by the design of the machine/device doing the key leveling). If the text of the specification could clearly be referring to a "zero plane" for either white keys or black keys, the term Zero Position Plane may imply either Zero Position Plane (i.e., its usual "white key" definition) or Local Black Plane.

The invention claimed is:

1. A method of measuring the mechanical characteristics of a piano key mechanism, comprising the steps of:

a) moving a contact, originally at a home position, in a substantially vertical direction by having said contact follow a predetermined motion profile, b) simultaneously measuring resulting forces acting upwardly on said contact, for a time period that includes said contact's movement, and c) locating a transitory collision string from said resulting forces, and wherein:

(i) said contact touches the key for some portion of said time period, at or near an application point, and (ii) said contact at said home position corresponds to one of the group of:

(aa) a key clear state, (bb) a key adjacent state, or (cc) a key embed state, whereby a series of measured forces acting on said contact during said time period is obtained, with the force signature of a significant collision event being located within said series of measured forces.

2. The method of claim 1 wherein:

(a) said contact begins said run in a key clear state, (b) said contact moves downwardly during the run, (c) said transitory collision string is a mid-run key collision string, and one of the group of:

(d) said forces are obtained with displacement-based acquisition, and further comprising:

(i) determining the mid-run key collision point from said mid-run key collision string, and (ii) determining the mid-run key collision displacement from said mid-run key collision point and said motion profile, or (e) said forces are obtained with scanning acquisition, and further comprising:

(i) determining the mid-run key collision point from said mid-run key collision string, and (ii) a force synchronization step, and (iii) determining the time moving before contact from said mid-run key collision point, and (iv) determining the mid-run key collision displacement from said time moving before contact and said motion profile, whereby said mid-run key collision displacement represents the clearance between the at-rest key and said contact in said key clear state.

3. The method of claim 1 wherein:

(a) said contact moves downwardly during the run, (b) said transitory collision string is a let-off collision string, and one of the group of:

(c) said forces were obtained with displacement-based acquisition, and further comprising:

(i) determining the let-off start point from said let-off collision string, and (ii) determining the distance to let-off start from said let-off start point and said motion profile, or (d) said forces were obtained with scanning acquisition, and further comprising:
(i) determining the let-off start point from said let-off collision string,
(ii) a force synchronization step,
(iii) determining the time moving before let-off from said let-off start point, and
(iv) determining the distance to let-off start from said time moving before let-off and said motion profile, whereby said distance to let-off start is the essentially vertical distance said contact must travel downwardly, from said home position, before reaching said let-off start point.

4. The method of claim 1 wherein:
(a) said contact moves downwardly during the run,
(b) said transitory collision string is a let-off collision string, and one of the group of:
(c) said forces were obtained with displacement-based acquisition, and further comprising:
(i) determining the jack trip point from said let-off collision string, and
(ii) determining the distance to jack trip from said jack trip point and said motion profile, or
(d) said forces were obtained with scanning acquisition, and further comprising:
(i) determining the jack trip point from said let-off collision string,
(ii) a force synchronization step,
(iii) determining the time moving before jack trip from said jack trip point, and
(iv) determining the distance to jack trip from said time moving before jack trip and said motion profile, whereby said distance to jack trip is the essentially vertical distance said contact must travel downwardly, from said home position, before reaching said jack trip point.

5. The method of claim 4, further comprising one of the group of:
(a) determining a jack trip force as the force corresponding to said jack trip point,
(b) determining a jack trip force as the force corresponding to a point near to said jack trip point, or
(c) determining a jack trip force from an average of measured forces within said let-off collision string, whereby said jack trip force indicates the maximum force one feels when pushing said piano key mechanism fully through its let-off region.

6. The method of claim 1 wherein:
(a) said contact moves quickly upwards during said movement,
(b) said measuring of forces continues for some time after said movement ends,
(c) said contact at said home position corresponds to a key embed state,
(d) said transitory collision string is a key return collision string, and
(e) said locating of said key return collision string is done with a step for determining key return collision string, and further comprising:
(i) a step for determining key return start point,
(ii) determining the key return collision point from said key return collision string, and
(iii) subtracting the time associated with said key return start point from the time associated with said key return collision point, whereby the result is the key return of said piano key mechanism, associated with the initial and final position of the key and contact during the run.

7. The method of claim 6 wherein said home position of said contact, in said key embed state, corresponds to said piano key mechanism being within its pre let-off region.

8. A method of measuring the mechanical characteristics of a piano key mechanism, comprising the steps of:
a) moving a contact in a substantially vertical direction, and at essentially constant speed, and
b) simultaneously measuring resulting forces acting between said contact and the key during the movement, and
c) calculating a best fit line, having a slope m, through forces and their corresponding displacements, between two points of said movement, and wherein:
(i) said contact is in direct contact with said key during said movement,
(ii) said piano key mechanism is in its pre let-off region, and one of the group of:
(iii) said forces were obtained with displacement-based acquisition, or
(iv) said forces were obtained with scanning acquisition, and were acted upon by a force synchronization step and a force transposition step.

9. The method of claim 8 wherein said contact moves downwardly,
whereby said best fit line corresponds to a linear equation of down force versus displacement, and said slope m corresponds to the down force slope, for the region between said two points of said movement.

10. The method of claim 8 wherein said contact moves upwardly,
whereby said best fit line corresponds to a linear equation of up force versus displacement, and said slope m corresponds to the up force slope, for the region between said two points of said movement.

11. A method of measuring inertial characteristics of a piano key action, comprising the steps of:
a) moving a contact downwardly, at an essentially constant acceleration, against said piano key action at an application point corresponding to some application point lever arm,
b) simultaneously measuring the resulting forces acting between said contact and said piano key action during the movement, and
c) calculating an average total force between two points of said movement, whereby an average of the total force required to accelerate the key between said two points of the keystroke is obtained.

12. The method of claim 11 wherein said calculating of said average total force includes a determination of total force integration limits,
whereby said average total force is achieved in a more accurate manner.

13. The method of claim 11, further comprising:
(i) providing a representative down force indicator and a representative frictional force indicator, both corresponding to said application point of said piano key action,
(ii) choosing a friction sensitivity factor for said piano key action,
(iii) a step for calculating friction sensitivity sum, and
(iv) a step for calculating inertia at the key, whereby the inertia at the key, about said key's operating axis, is obtained for said piano key action.

14. The method of claim 11, further comprising:

(i) providing a representative down force indicator, corresponding to said application point of said piano key action, and (ii) a step for calculating inertia at the key with accelerated friction neglected, whereby the inertia at the key, about said key's operating axis, is obtained for said piano key action, with accelerated friction effects neglected.

15. The method of claim 12, further comprising:

(i) providing a representative down force indicator and a representative frictional force indicator, both corresponding to said application point of said piano key action, (ii) choosing a friction sensitivity factor for said piano key action, (iii) a step for calculating friction sensitivity sum, and (iv) a step for calculating inertia at the key, whereby the inertia at the key, about said key's operating axis, is obtained for said piano key action.

16. The method of claim 12, further comprising:

(i) providing a representative down force indicator, corresponding to said application point of said piano key action, and (ii) a step for calculating inertia at the key with accelerated friction neglected, whereby the inertia at the key, about said key's operating axis, is obtained for said piano key action, with accelerated friction effects neglected.

17. The method of claim 11, further comprising:

(i) providing a representative down force indicator, corresponding to said application point of said piano key action, and (ii) a step for calculating average inertial force with accelerated friction neglected, whereby the average inertial force, corresponding to said acceleration and said application point, is obtained for said piano key action, with accelerated friction effects neglected.

18. The method of claim 12, further comprising:

(i) providing a representative down force indicator and a representative frictional force indicator, both corresponding to said application point of said piano key action, (ii) choosing a friction sensitivity factor for said piano key action, (iii) a step for calculating friction sensitivity sum, and (iv) a step for calculating average inertial force, whereby the average inertial force, corresponding to said acceleration and said application point, is obtained for said piano key action.

19. The method of claim 12, further comprising:

(i) providing a representative down force indicator, corresponding to said application point of said piano key action, and (ii) a step for calculating average inertial force with accelerated friction neglected, whereby the average inertial force, corresponding to said acceleration and said application point, is obtained for said piano key action, with accelerated friction effects neglected.

20. The method of claim 11, further comprising:

(i) providing a representative down force indicator, corresponding to said application point of said piano key action, and (ii) a step for calculating effective mass with accelerated friction neglected, whereby the effective mass, corresponding to said application point, is obtained for said piano key action, with accelerated friction effects neglected.

21. The method of claim 12, further comprising:

(i) providing a representative down force indicator and a representative frictional force indicator, both corresponding to said application point of said piano key action, (ii) choosing a friction sensitivity factor for said piano key action, (iii) a step for calculating friction sensitivity sum, and (iv) a step for calculating effective mass, whereby the effective mass, corresponding to said application point, is obtained for said piano key action.

22. The method of claim 12, further comprising:

(i) providing a representative down force indicator, corresponding to said application point of said piano key action, and (ii) a step for calculating effective mass with accelerated friction neglected, whereby the effective mass, corresponding to said application point, is obtained for said piano key action, with accelerated friction effects neglected.

23. A method of measuring the mechanical characteristics of a hammer assembly of a piano key action, comprising the steps of:

a) exerting a non-inertial torque on said hammer assembly so it tends toward some equilibrium rest position and physical stop, and is free to rotate about a pivot axis, in the direction opposing said non-inertial torque, upon sufficient urging in said direction, b) moving a contact against said hammer assembly, at a local application point, in a direction substantially perpendicular to the longitudinal axis of the hammer shank, with said contact following a predetermined motion profile, c) simultaneously measuring resulting forces acting on said contact during the movement, and d) averaging the measured forces over a portion of said movement, whereby an average force required to move said hammer assembly across said portion of said movement is obtained.

24. The method of claim 23 wherein:

(a) said contact moves in the free direction, opposing said non-inertial torque, and (b) said contact moves with essentially constant linear speed during said portion of said movement, whereby said average force is an average local down force for said hammer assembly, at said local application point, corresponding to said pivot axis, and for said portion of said movement.

25. The method of claim 23 wherein:

(a) said contact moves in the free direction, opposing said non-inertial torque, and (b) said contact moves with essentially constant linear acceleration during said portion of said movement, whereby said average force is an average local total force for said hammer assembly, at said local application point, corresponding to said pivot axis and said acceleration, and for said portion of said movement.

26. The method of claim 25 wherein said averaging of said measured forces includes a determination of total force integration limits, whereby said average local total force is achieved in a more accurate manner.

27. The method of claim 25 wherein said local application point has an essentially constant moment arm about said pivot axis, and further comprising:

(i) providing an average local down force and an average constant-speed local friction, both corresponding to said pivot axis and said local application point, (ii) providing a chosen value for local friction sensitivity factor, (iii) a step for calculating local friction sensitivity sum, and (iv) a step for calculating local inertia, whereby the result is the local inertia of said hammer assembly about said pivot axis.

28. The method of claim 25 wherein said local application point has an essentially constant moment arm about said pivot axis, and further comprising:

(i) providing an average local down force, corresponding to said pivot axis and said local application point, and (ii) a step for calculating local inertia with accelerated friction neglected, whereby the result is the local inertia of said hammer assembly about said pivot axis, with any accelerated friction effects neglected.

29. A machine for measuring the inertial characteristics of a piano key mechanism, comprising:

a) a well-controlled contact that moves downwardly against the key of a piano key mechanism, at some application point, at an essentially constant acceleration, b) a force transducer coupled to said contact, which simultaneously measures the forces acting upwardly on said contact during the movement and provides an output signal proportional thereto, c) a motor with an output shaft, coupled to said contact, for moving said contact in the desired manner, and d) a means of calculating an average total force between two points of said movement, said means including a determination of total force integration limits, whereby an average of the total force required to accelerate the key between said two points of the keystroke is obtained.

* * * * *